US007942602B2

(12) United States Patent
Bunk et al.

(10) Patent No.: US 7,942,602 B2
(45) Date of Patent: May 17, 2011

(54) BARRIER SYSTEM

(75) Inventors: Kenneth J. Bunk, Millersville, MD (US); Wendell B. Leimbach, Baltimore, MD (US); Michael Lester O'Banion, Westminster, MD (US); Daniel Stafford O'Banion, Westminster, MD (US); William Alan George, Parkton, MD (US); Robert Somers, Reisterstown, MD (US); James W. Marshall, Shrewsbery, PA (US)

(73) Assignee: Protectus, LLC, Waldorf, MD (US)

( * ) Notice: Subject to any disclaimer, the term of this patent is extended or adjusted under 35 U.S.C. 154(b) by 814 days.

(21) Appl. No.: 11/761,072

(22) Filed: Jun. 11, 2007

(65) Prior Publication Data

US 2007/0284562 A1 Dec. 13, 2007

Related U.S. Application Data

(60) Provisional application No. 60/812,801, filed on Jun. 12, 2006.

(51) Int. Cl.
*E01F 13/00* (2006.01)
*E01F 15/00* (2006.01)

(52) U.S. Cl. ..... 404/6; 256/13.1

(58) Field of Classification Search ..... 404/6, 9, 404/10; 256/13.1, 1
See application file for complete search history.

(56) References Cited

U.S. PATENT DOCUMENTS

| | | | | |
|---|---|---|---|---|
| 1,549,139 A | | 8/1925 | Maudlin | |
| 1,680,548 A | | 8/1928 | Keiser | |
| 1,848,246 A | | 3/1932 | Dowel | |
| 2,265,698 A | * | 12/1941 | Opgenorth | 256/13.1 |
| 2,907,552 A | | 10/1959 | Crone | |
| 3,126,671 A | | 3/1964 | Nagel | |
| 3,210,051 A | | 10/1965 | Case | |
| 3,448,963 A | | 6/1969 | Gravisse | |
| 3,698,749 A | | 10/1972 | Yonkers | |
| 3,732,653 A | | 5/1973 | Pickett | |
| 3,807,699 A | | 4/1974 | France | |
| 3,820,832 A | | 6/1974 | Brandestini et al. | |
| 3,952,377 A | | 4/1976 | Morell | |
| 4,062,521 A | * | 12/1977 | Moreau | 256/1 |
| 4,075,473 A | | 2/1978 | Winston | |
| 4,111,401 A | | 9/1978 | Pickett | |
| 4,113,400 A | | 9/1978 | Smith | |
| 4,183,505 A | * | 1/1980 | Maestri | 256/13.1 |
| 4,190,380 A | | 2/1980 | Almer et al. | |
| 4,433,831 A | | 2/1984 | Bunger | |

(Continued)

FOREIGN PATENT DOCUMENTS

EP 1 122 383 A1 8/2001

(Continued)

OTHER PUBLICATIONS

International Search Report and Written Opinion dated Aug. 25, 2008 in PCT/US07/71001.

*Primary Examiner* — Raymond W Addie
(74) *Attorney, Agent, or Firm* — Duane Morris LLP

(57) ABSTRACT

A barrier system and method for providing a barrier system are disclosed. The barrier system and method relate to a vehicle and pedestrian barrier system which can be positioned in vehicle and pedestrian passageways adjacent a protected structure or area to preclude the vehicle or the pedestrian from reaching and engaging the protected structure or area.

9 Claims, 108 Drawing Sheets

U.S. PATENT DOCUMENTS 4,503,423 A 3/1985 Mainiero et al.
4,553,875 A 11/1985 Casey
4,576,507 A 3/1986 Terio
4,576,509 A 3/1986 Beaty, Sr.
4,600,335 A 7/1986 Truglio
4,661,010 A 4/1987 Almer et al.
4,780,020 A 10/1988 Terio
4,828,424 A 5/1989 Crisp, Sr.
4,828,425 A 5/1989 Duckett
4,838,523 A 6/1989 Humble et al.
4,844,652 A 7/1989 Schroughan
4,576,507 A 12/1989 Mainiero et al.
4,979,817 A * 12/1990 Crisp, Sr. ..... 256/13.1
4,986,042 A 1/1991 Richardt
5,011,325 A 4/1991 Antonioli
5,011,326 A 4/1991 Carney, III
5,022,782 A 6/1991 Gertz et al.
5,074,704 A 12/1991 McKay
5,123,773 A 6/1992 Yodock
5,134,817 A 8/1992 Richardt
5,149,224 A 9/1992 Smith
5,156,485 A 10/1992 Ivey et al.
5,286,136 A 2/1994 Mandish et al.
5,292,467 A 3/1994 Mandish et al.
5,389,049 A 2/1995 Mabee
5,403,112 A 4/1995 Carney, III
5,425,594 A * 6/1995 Krage et al. ..... 404/6
5,443,324 A 8/1995 Sullivan
5,464,306 A 11/1995 Cristiano
5,509,249 A * 4/1996 House et al. ..... 52/745.1
5,531,540 A 7/1996 Wasserstrom et al.
5,547,310 A 8/1996 Muller
5,605,413 A 2/1997 Brown
5,628,582 A 5/1997 Nagle
5,676,350 A 10/1997 Galli et al.
5,685,665 A * 11/1997 Lembo ..... 404/6
5,752,691 A 5/1998 Bashon et al.
5,762,443 A 6/1998 Gelfand et al.
5,860,762 A 1/1999 Nelson
5,947,452 A 9/1999 Albritton
5,975,793 A 11/1999 Simmons, Jr. et al.
5,988,934 A 11/1999 Wasserstrom
6,022,003 A 2/2000 Sicking et al.
6,062,765 A 5/2000 Dotson
6,065,738 A 5/2000 Pearce et al.
6,102,611 A 8/2000 Roller
6,129,342 A 10/2000 Bronstad
6,164,865 A 12/2000 McCallum
6,203,242 B1 3/2001 Englund
6,244,781 B1 6/2001 Roller
6,382,869 B1 5/2002 Dickenson
6,409,417 B1 6/2002 Muller et al.
6,413,009 B1 7/2002 Duckett
6,439,801 B1 8/2002 Galiana et al.
6,474,904 B1 11/2002 Duckett et al.
6,485,224 B1 11/2002 Dyke et al.
6,487,757 B1 12/2002 Stubler et al.
6,505,820 B2 1/2003 Sicking et al.
6,533,250 B2 3/2003 Arthur
6,551,011 B1 4/2003 Valentine
6,561,492 B1 5/2003 Hubbell
6,669,402 B1 12/2003 Davis et al.
6,702,513 B1 3/2004 Raupach
6,712,545 B2 3/2004 Muller et al.
6,719,483 B1 4/2004 Welandsson
6,767,158 B1 7/2004 Consolazio et al.
6,773,201 B2 8/2004 Witcher
6,782,624 B2 8/2004 Marsh et al.
6,843,613 B2 1/2005 Gelfand et al.
6,857,227 B2 2/2005 Russell
6,863,264 B2 * 3/2005 Johansson et al. ..... 256/13.1
6,863,468 B2 3/2005 Davis et al.
6,866,252 B2 3/2005 Pulliam
6,874,767 B1 * 4/2005 Gibbs ..... 256/65.08
6,902,149 B2 6/2005 Piron
6,913,415 B1 7/2005 Tagg
6,962,245 B2 11/2005 Ray et al.
6,962,328 B2 11/2005 Bergendahl
7,037,029 B2 * 5/2006 Buehler et al. ..... 404/6
7,083,357 B2 * 8/2006 Lamore ..... 404/6
7,111,827 B2 9/2006 Sicking et al.
7,140,802 B2 11/2006 Lamore
7,144,186 B1 12/2006 Nolte
7,144,187 B1 12/2006 Nolte et al.
7,147,088 B2 12/2006 Reid et al.
7,182,320 B2 2/2007 Heimbecker et al.
7,214,000 B2 5/2007 Marsh et al.
7,258,205 B2 8/2007 Berti et al.
7,441,751 B1 * 10/2008 Gibbs ..... 256/23
7,530,548 B2 5/2009 Ochoa
7,563,051 B2 7/2009 Buckley et al.
2003/0016996 A1 1/2003 Gelfand
2003/0022254 A1 1/2003 Kaser et al.
2003/0025112 A1 2/2003 Sicking et al.
2003/0068199 A1 4/2003 Ulislam et al.
2003/0070894 A1 4/2003 Reid et al.
2003/0086761 A1 5/2003 Anderson
2003/0093869 A1 5/2003 Petersen
2003/0127636 A1 7/2003 Piron
2003/0159356 A1 8/2003 Russell
2004/0041140 A1 * 3/2004 Johansson et al. ..... 256/13.1
2004/0067104 A1 4/2004 Venegas
2004/0146347 A1 7/2004 Davis et al.
2004/0156677 A1 8/2004 Gelfand et al.
2004/0197140 A1 10/2004 Maleska
2004/0228683 A9 11/2004 Gelfand et al.
2005/0023095 A1 2/2005 Reid et al.
2005/0220536 A1 10/2005 Blair et al.
2005/0252742 A1 11/2005 Reid et al.
2006/0002760 A1 1/2006 Vellozzi et al.
2006/0011900 A1 1/2006 Ochoa
2006/0027797 A1 2/2006 Sicking et al.
2006/0038164 A1 2/2006 Sicking et al.
2006/0078380 A1 4/2006 Dehart
2006/0093431 A1 5/2006 Marsh et al.
2006/0140718 A1 6/2006 Lamore
2006/0233607 A1 10/2006 Buckley et al.
2007/0068079 A1 3/2007 Morgan et al.
2007/0086857 A1 4/2007 Rogers et al.
2007/0284562 A1 12/2007 Bunk et al.
2008/0083919 A1 4/2008 Takahashi et al.
2008/0205982 A1 8/2008 Hubbell
2009/0193627 A1 8/2009 Campbell et al.
2009/0194752 A1 8/2009 Ochoa
2009/0250675 A1 10/2009 Cashin et al.

FOREIGN PATENT DOCUMENTS

FR 2719063 * 4/1994

* cited by examiner

BARRIER SYSTEM

CROSS-REFERENCE TO RELATED APPLICATIONS

This Application claims the benefit of U.S. Provisional Application No. 60/812,801, filed Jun. 12, 2006.

BACKGROUND OF THE INVENTION

The invention relates to a barrier system. More particularly, the invention relates to a vehicle and pedestrian barrier system which can be positioned in vehicle and pedestrian passageways adjacent a protected structure or area to preclude the vehicle or the pedestrian from reaching and engaging the protected structure or area.

For some time, terrorists and insurgents have used various types of vehicles to transport explosives, and other destructive substances, into a position adjacent, or literally into, a normally-secured or unsecured structure, whereby the explosives are detonated in some fashion to destroy or damage the structures, and injure or kill occupants therein. Recently, pedestrians, such as the so-called "suicide bombers," have literally strapped explosives to their body, walked into a target area, and detonated the body-carried explosives, thereby killing themselves as well as destroying or damaging structures, and injuring or killing people, in the target area.

In recent years, barriers have been strategically placed to prevent such explosive-laden vehicles and pedestrians from being placed sufficiently close to, or driven directly into, such structures for the purpose of explosive destruction of the structure, and potential injury or death of the occupants.

While worth-while vehicle barrier systems have been devised in recent years, some of these systems are not readily portable, use elaborate and complex barrier structure, and/or require major alteration in the ground-surface topography to facilitate support thereof.

One such system involving elaborate and complex barrier structure is disclosed in U.S. Pat. No. 4,780,020, which includes a single high-strength cable extending between spaced I-beams, with the cable woven in an elaborate pattern through openings in the I-beams and around pipes adjacent webs of the I-beams. A crushable aluminum honeycomb structure can be used with the woven cable, pipes and I-beams to serve as a shock-absorbing element if the barrier system is struck by a vehicle. Also, panels can be placed between the spaced I-beams for aesthetic purposes, and to conceal the complex cabling structure.

In a security gate structure disclosed in U.S. Pat. No. 4,576,507, multiple high-strength cables are attached to, and extend between, a pair of I-beams to form a barrier system. In a non-operated position, the barrier system is mounted below ground level for movement within spaced tracks in an underground structure, and the system is thereby not normally visible. When a vehicle approaches the gate location, a vehicle sensor is activated to raise the barrier system, and position the cables in the path of the oncoming vehicle. Opposite ends of each cable are looped about shock absorbers to sustain the shock of the vehicle moving into contact with the cables.

DETAILED DESCRIPTION OF THE INVENTION

Figure 1:
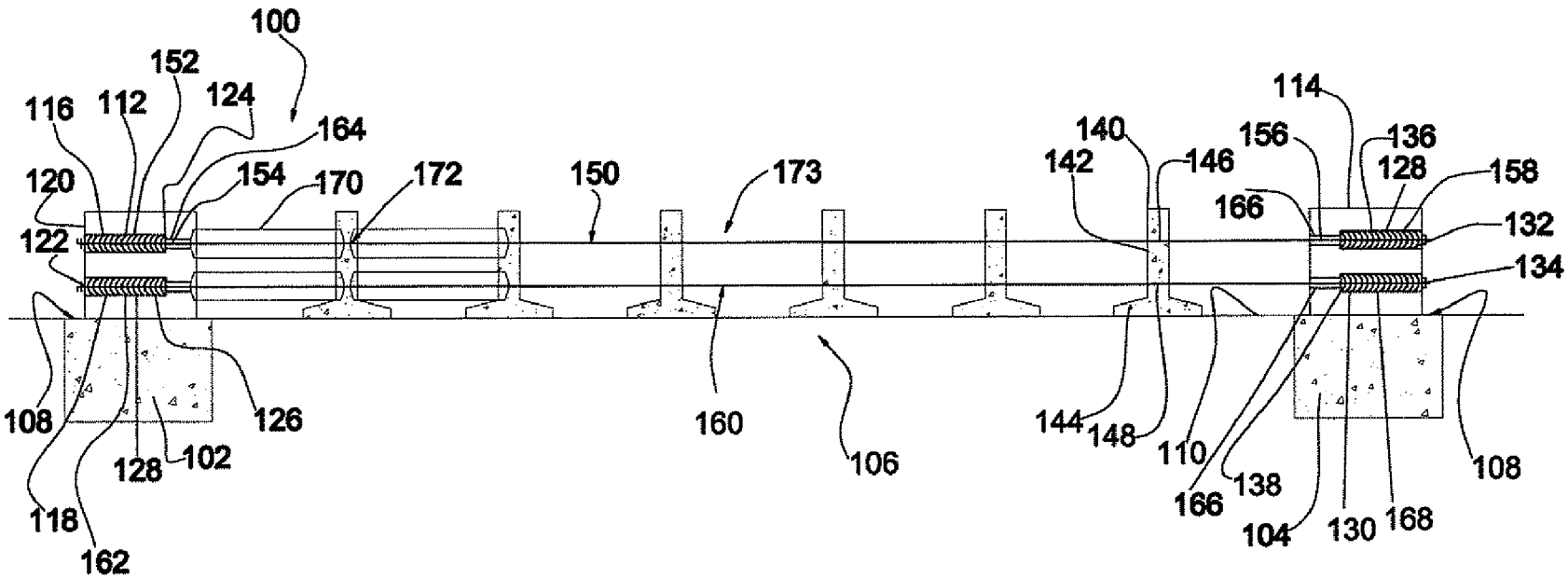
FIG. 1 is a front view showing a barrier system in accordance with certain principles of the invention.

This description of preferred embodiments is intended to be read in connection with the accompanying drawings, which are to be considered part of the entire written description of the invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. References to axial dimensions and directions (e.g., in an "X" direction, over a "Y" dimension, etc.) should also be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "joined," "connected," and "interconnected," refer to a relationship wherein structures are secured or attached to one another either directly or indirectly through intervening structures, as well as both movable or rigid attachments or relationships, unless expressly described otherwise.

Historically, terrorists, and others with destructive intentions, have employed rapidly moving objects, such as vehicles, to transport explosives for direct impact with, or into a location adjacent, critically important structures. Such structures usually include civilian government, military, and non-government buildings. The explosives are detonated to damage or destroy the structures and to injure or kill anyone in or adjacent such structures.

In similar fashion, destructive-intending pedestrians, commonly referred to as "suicide bombers," having explosives attached to their bodies, have entered such important structures as well as gatherings of other people, and thereafter detonated the explosives to destroy and damage the buildings and kill or injure the other people.

In order to preclude the entry of such explosive-containing vehicles and pedestrians into critical areas, barrier systems have been designed, which are intended to preclude entry of any unauthorized vehicles and pedestrians into such structures. Some of the barrier systems have been formed by bollards, water-filled obstructions, jersey walls, berms, chain link fences and tensioned cable beams. Products of this type can be standard or generic designs for use at any location, or they can be custom designed for the particular environment of the structures and gatherings of people in the area to be protected. In any event, the barrier systems should be designed with force-reactive parameters necessary to insure barring the entry of the explosive-laden vehicles into the protected areas, and security systems necessary to bar entry of unauthorized personnel into the protected areas.

In areas of critical importance, where vehicle traffic flow is frequent, barrier systems may be located underground, for aesthetic purposes. Such underground barrier systems are readily movable, automatically or by human control, to an above-ground position to present an obstacle to entry of an explosive-laden and/or unidentified vehicle into the areas of critical importance.

In the past, architects have designed custom made barrier systems where high levels of protection are warranted. In addition, architects have designed barrier systems which are unobtrusive and pleasing in appearance.

In view of a significant increase in destructive actions by terrorists in recent years, the United States Department of State has issued several levels of requirements for barrier systems, with each level being dependent on the anticipated size of the vehicle (e.g., 15,000 pounds) and the speed of such vehicle (e.g., 30, 40 or 50 miles per hour). In the most stringent level, the barrier system must limit the travel or penetration of the vehicle to three meters after impacting the barrier system.

In order to meet such stringent and high level standards for barrier systems, careful design is necessary. At the same time, it is desirable that such barrier systems present a pleasant appearance, particularly in areas where government office buildings and living quarters, as well as similarly situated non-government buildings and residences, are located.

Some of the attributes for such barrier systems and components thereof include (a) providing for relatively easy assembly of the components, (b) permitting repair or replacement of components without disassembly of the entire barrier system, (c) providing a means for self diagnostics to determine if disablement of the barrier system has occurred, (d) providing for the electrical wiring of the barrier system to power lights, motion sensors, proximity and impact detectors, and other intelligence functions, (e) providing facility for preventing entry, as well as allowing selective entry, of vehicles and pedestrians, and (f) providing aesthetic enhancements.

The inventive concepts disclosed herein provide a pre-engineered barrier system having optionally-selectable components which an architect, builder or security personnel can assemble without the need to design and build a barrier system on a custom basis, while meeting the above-noted requirements and standards, and attaining the above-noted security attributes.

It is to be understood that terms such as "energy absorbing means," "load absorbing means," "shock absorbing means," "energy absorber," "load absorber," "shock absorber," and like terms are used substantially interchangeably throughout the specification. Use of any of these or like terms references any suitable means for absorbing energy.

Referring now to FIG. 1, a barrier system 100 includes a pair of spaced foundations 102 and 104, which are located, at least partially, within ground soil 106. An upper surface 108 of each of the foundations 102 and 104 is selectively located at, above, or below ground level 110 of the soil 106. The spaced foundations 102 and 104 may be formed integrally with a pair of respective end posts 112 and 114, or, if formed separately, bottom surfaces of the pair of end posts may be situated on the upper surfaces 108 of the pair of respective foundations 102 and 104.

The end post 112 is formed with a pair of spaced chambers 116 and 118, which are formed with respective open ends 120 and 122 and respective closed ends 124 and 126. In similar fashion, the end post 114 is formed with a pair of spaced chambers 128 and 130, which are formed with respective open ends 132 and 134 and respective closed ends 136 and 138.

A plurality of spaced intermediate posts 140 are each formed with an upstanding beam 142, and a foundation, pedestal, or foot 144 which is resting on the soil 106 at ground level 110. The plurality of posts 140 are spaced from, and are located between, the pair of end posts 112 and 114. Each beam 142 of the posts 140 is formed with a first or upper through opening 146, and a second or lower through opening 148 spaced below the first opening.

Opposite ends of a first high-strength wire rope or tension cable 150 are located within respective ones of the chambers 116 and 128 formed in the respective end posts 112 and 114. The tension cable 150 is threaded through aligned openings of a first plurality of energy absorbers, load absorbers, or shock absorbers 152 within the chamber 116, an opening 154 formed through the end post 112 between the closed end 124 and the adjacent side of the end post, the first openings 146 of the intermediate posts 140, an opening 156 formed through the end post 112 between the closed end 136 and the adjacent side of the end post, and through aligned openings of a second plurality of energy absorbers, load absorbers, or shock absorbers 158 within the chamber 128. In at least one embodiment, energy absorbers 152 and 158 are stacked, crushable cups.

In similar fashion, a second tension cable 160 is strung between the end posts 112 and 114, with the ends of the cable being located in the respective chambers 128 and 130. The tension cable 160 is threaded through aligned openings of a plurality of energy absorbers, load absorbers, or shock absorbers 162 located in the chamber 128, a through hole 164 formed in the end post 112, the second openings 148 of the intermediate posts 140, a through hole 166 formed in the end post 114, and aligned holes of a plurality of energy absorbers, load absorbers, or shock absorbers 168 located in the chamber 130. Each of the opposite ends of the first and second tension cables 150 and 160 are secured with a large fastener (not shown) to facilitate the retention of the cables in the assembled arrangement of the barrier system 100. In at least one embodiment, energy absorbers 162 and 168 are stacked, crushable cups.

One or more decorative panels 170 can be placed between the end posts 112 and 114 and the respective adjacent intermediate posts 140, and between any of the remaining pairs of adjacent intermediate posts. The ends of the panels 170 can be formed to mount into accommodating grooves (not shown) formed in the end posts 112 and 114, and the intermediate posts 140. Each of the panels 170 can be formed with concealed passageways 172, which extend from one end to the opposite end thereof, to facilitate threading of the tension cables 150 and 160 therethrough at the time of threading of the cables as described above.

The foundations 102 and 104 with the respective end posts 112 and 114, the intermediate posts 140, and the tension cables 150 and 160, when assembled as the barrier system 100, form a barrier fence 173, with the inclusion of the panels 170 providing enhanced opposition to unauthorized vehicle and pedestrian traffic, and pleasing decorativeness.

The tension cables 150 and 160 are stretched to place the cables under tension to meet the requirements and standards noted above, and the ends of the cables are attached to the fasteners to retain the cables in the tensioned state. If a vehicle impacts the barrier system 100, the opposite ends of the tension cables 150 and 160 are drawn inward by the impacting force, whereby the energy absorbers 152, 158, 162 and 168 are crushed to allow a minimal level of slack to develop in the cables. The crushed energy absorbers 152, 158, 162 and 168, any damaged posts 112, 114 and 140, any damaged panels 170, and any damaged tension cables 150 and 160 can be readily replaced.

The energy absorbers 152, 158, 162 and 168 are preferably made of a ductile material. Carbon steel and stainless steel are such materials. Such a material can absorb large amounts of energy as it is stretching between yield and ultimate strength. This is shown in Table 1 below as elongation % in 2 inches under the "Mechanical properties—annealed" heading. Upon the impact of a vehicle striking a portion of the fence, the tension cables 150 and 160 will transfer the tension to end posts 112 and 114. In certain circumstances, the forces may become greater than the strength of the tension cable due to rapid vehicle deceleration. By providing an energy absorbing means, the vehicle will stop in a longer period of time, thus resulting in a lower force on the tension cables and a substantial portion of the kinetic energy from the vehicle will be absorbed by the energy absorbing means.

TABLE 1

Properties of Stainless Steel.

| | Group CHROMIUM-NICKEL AUSTENITIC GROUP Type Number | | | | | |
|---|---|---|---|---|---|---|
| | 201 | 202 | 301 | 302 | 304 | 304L |
| Analyses - percent: | | | | | | |
| Chromium | 16.0–18.0 | 17.0–19.0 | 16.00–18.00 | 17.00–19.00 | 18.00–20.00 | 18.00–20.00 |
| Nickel | 3.5–5.5 | 4.0–6.0 | 6.00–8.00 | 8.00–10.00 | 8.00–12.00 | 8.00–12.00 |
| Other elements (Note 6) | $N_2$ .25 max | $N_2$ .25 max | | | | |
| Carbon | .15 max | .15 max | .15 max | .15 max | .08 max | .03 max |
| Manganese | 5.5/7.5 | 7.5/10.0 | 2.00 max | 2.00 max | 2.00 max | 2.00 max |
| Silicon | 1.00 max | 1.00 max | 1.00 max | 1.00 max | 1.00 max | 1.00 max |
| Physical data: | | | | | | |
| Melting range - ° F. | | | 2550–2590 | 2550–2590 | 2550–2650 | 2550–2650 |
| Density - lb/in.$^3$ | .28 | .28 | 0.29 | 0.29 | 0.29 | 0.29 |
| Specific heat - Btu/° F./lb (32–212 F.) | 0.12 | 0.12 | 0.12 | 0.12 | 0.12 | 0.12 |
| Thermal conductivity - Btu/ft$^2$/hr/° F./ft: | | | | | | |
| 212 F. | | | 9.4 | 9.4 | 9.4 | 9.4 |
| 932 F. | | | 12.4 | 12.4 | 12.4 | 12.4 |
| Mean coefficient of thermal expansion - in/in/° F. × $10^{-6}$: | | | | | | |
| 68–212 F. | 9.2 | 9.4 | 9.2 | 9.2 | 9.2 | 9.2 |
| 68 to indicated temperature - ° F. | 11.3 (1600) | 10.9 (1600) | 11.0 (1600) | 11.0 (1600) | 11.0 (1600) | 11.0 (1600) |
| Electrical properties: | | | | | | |
| Magnetic permeability at 200 H annealed | 1.02 max | 1.02 max | 1.02 | 1.02 | 1.02 | 1.02 |
| Electrical resistivity - microhm-cm: | | | | | | |
| 68 F. | 69.0 | 69.0 | 72.0 | 72.0 | 72.0 | 72.0 |
| 1200 F. | | | 116.0 | 116.0 | 116.0 | 116.0 |
| Heat resistance: | | | | | | |
| Maximum operating temperature - ° F.: | | | | | | |
| Intermittent service (Note 1) | 1500 | 1500 | 1600 | 1600 | 1600 | 1600 |
| Continuous service | 1550 | 1550 | 1700 | 1700 | 1700 | 1700 |
| Temperatures-working and treating - ° F.: | | | | | | |
| Forging - start | 2300 | 2300 | 2200 | 2200 | 2200 | 2200 |
| Forging - finish | 1700 | 1700 | 1700 | 1700 | 1700 | 1700 |
| Annealing - ranges (Note 2) | 1850–2000 | 1850–2000 | 1950–2050 | 1850–2050 | 1800–1950 | 1800–1950 |
| Annealing - cooling (Note 3) | WQ (AC) | WQ (AC) | WQ (AC) | WQ (AC) | WQ (AC) | A.C. |
| Hardening - ranges | (Note 7) | (Note 7) | (Note 7) | (Note 7) | (Note 7) | (Note 7) |
| Quenching | | | | | | |
| Tempering - for intermediate hardness | | | | | | |
| Drawing - for relieving stresses | | | | | | |
| Mechanical properties - annealed: | | | | | | |
| Structure annealed | A | A | A | A | A | A |
| Yield strength - lb/in.$^2$ - min | 40 000 | 40 000 | 35 000 | 30 000 | 30 000 | 25 000 |
| Ultimate strength - lb/in.$^2$ - min | 115 000 | 100 000 | 100 000 | 80 000 | 80 000 | 70 000 |
| Elongation - % in 2 inches - min | 40.0 | 40.0 | 50.0 | 50.0 | 50.0 | 40.0 |
| Reduction in area - % - min | | | 60.0 | 60.0 | 60.0 | 60.0 |
| Modulus of elasticity in tension - lb/in.$^2$ × $10^6$ | 29.0 | 29.0 | 29.0 | 29.0 | 29.0 | 29.0 |
| Hardness - Brinell | 210 max | 210 max | 180 max | 180 max | 180 max | 180 max |
| Hardness - Rockwell | B95 max | B95 max | B90 max | B90 max | B90 max | B90 max |
| Impact values - Izod - ft-lb | 85 min | 85 min | 85 min | 85 min | 85 min | 80 min |
| Mechanical properties - heat treated: | | | | | | |
| Yield strength - lb/in.$^2$ | | | | | | |
| Ultimate strength - lb/in.$^2$ | (Note 8) | (Note 8) | (Note 8) | (Note 8) | (Note 8) | (Note 8) |
| Elongation - % in 2 inches | | | | | | |
| Hardness - Brinell | | | | | | |
| Hardness - Rockwell | | | | | | |
| Creep strength - lb/in.$^2$ at 1000° F.: | | | | | | |

TABLE 1-continued

| Properties of Stainless Steel. | | | | | | |
|---|---|---|---|---|---|---|
| | Group CHROMIUM-NICKEL AUSTENITIC GROUP Type Number | | | | | |
| | 201 | 202 | 301 | 302 | 304 | 304L |
| 1% Flow in 10,000 hr | | | 19 000 | 19 000 | 19 000 | 19 000 |
| 1% Flow in 100,000 hr | | | 13 000 | 13 000 | 13 000 | 13 000 |

Figure 2:
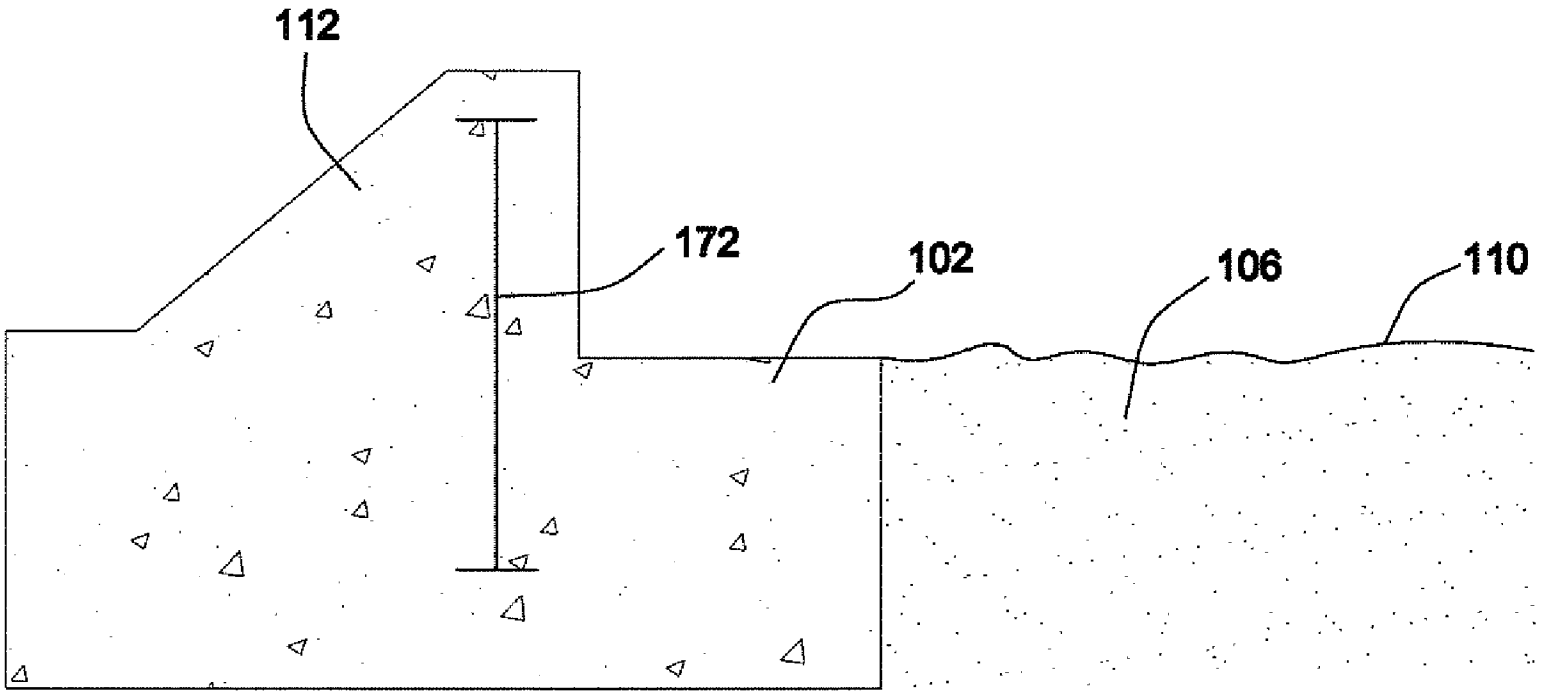
FIG. 2 is a side view showing an end, or terminal, post and foundation structure therefor in accordance with certain principles of the invention.

As shown in FIG. 2, the foundation 102 is formed integrally with the end post 112, with a tension rod 172 embedded in the cured material of the foundation and rod. This arrangement enhances the strength of the integral structure of the foundation 102 and the end post 112 to provide relatively greater opposition to any destructive reaction encountered by the foundation and the end post. A portion of foundation 102 is subterranean, being adjacent soil 106 and below ground level 110.

Figure 3:
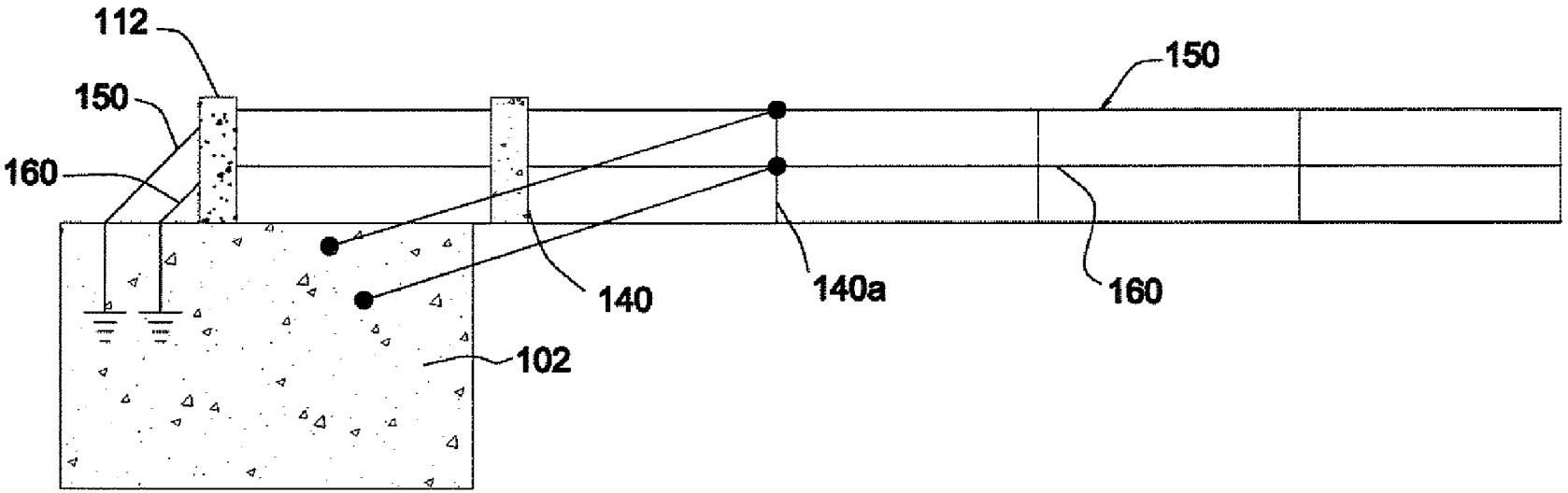
FIG. 3 is a front view showing alternate embodiments of securing tension cables directly to a foundation and alternately to an end post integral with the foundation, or to an intermediate post, in accordance with certain principles of the invention.

In the illustration of FIG. 3, in a first embodiment, the end post 112 is supported on the foundation 102, with tension cables 150 and 160 extending through the intermediate posts 140. The ends of the cables 150 and 160 extend from the end post 112 and are anchored to the foundation 102 to provide tensioning of the cables. In an alternate or second embodiment, an intermediate post 140*a* functions as an end post, and the ends of the cables 150 and 160 extend from the post 140*a* and are anchored to the foundation.

Figure 4:
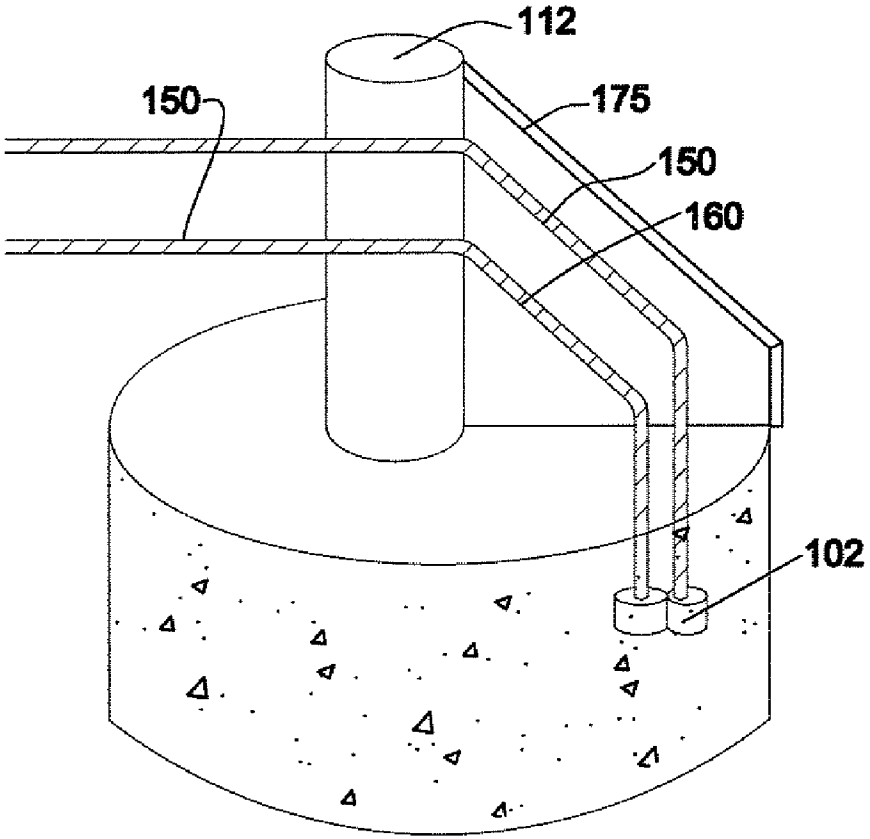
FIG. 4 is a front view showing an end post integrally formed with a foundation with tension cables mounted on the foundation and extending through the end post in accordance with certain principles of the invention.

As shown in FIG. 4, the post 112 extends upward from the foundation 102, with a gusset 175 being located in engagement with a vertical side of the post and an adjacent portion of the top of the foundation. The post 112 and the gusset 175 are each formed with communicating through holes for receipt of the tension cables 150 and 160 therethrough. The ends of the cables 150 and 160 are anchored to the foundation 102.

Figure 5:
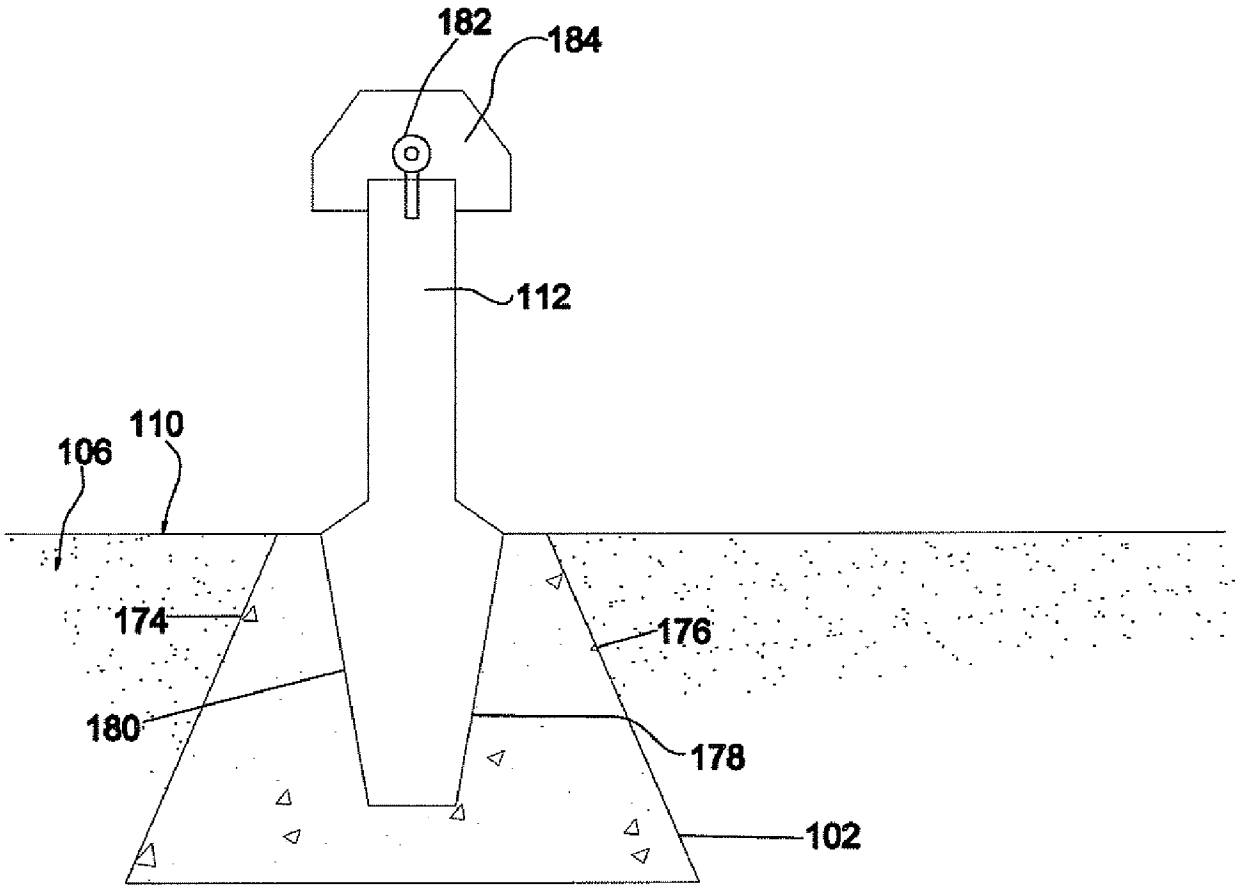
FIG. 5 is a side view showing an in-ground foundation with two adjacent cones joined integrally by a common base and forming a recess therebetween for complementary receipt of an inverted conical or trapezoidal base of a replaceable post in accordance with certain principles of the invention.

Referring to FIG. 5, the foundation 102 is formed with integrally connected double cones 174 and 176 with a trapezoidal recess 178 between the cones. The end post 112, which is replaceable, is formed with a trapezoidal base 180 which nests in the recess 178 for a secure support of the base by the foundation 102. An eyebolt 182 is attached to an upper end of the post 112 to facilitate placement, and replacement, of the base 180 with respect to the recess 178. A decorative cap 184 can be positioned at the upper end of the post 112.

Figure 6:
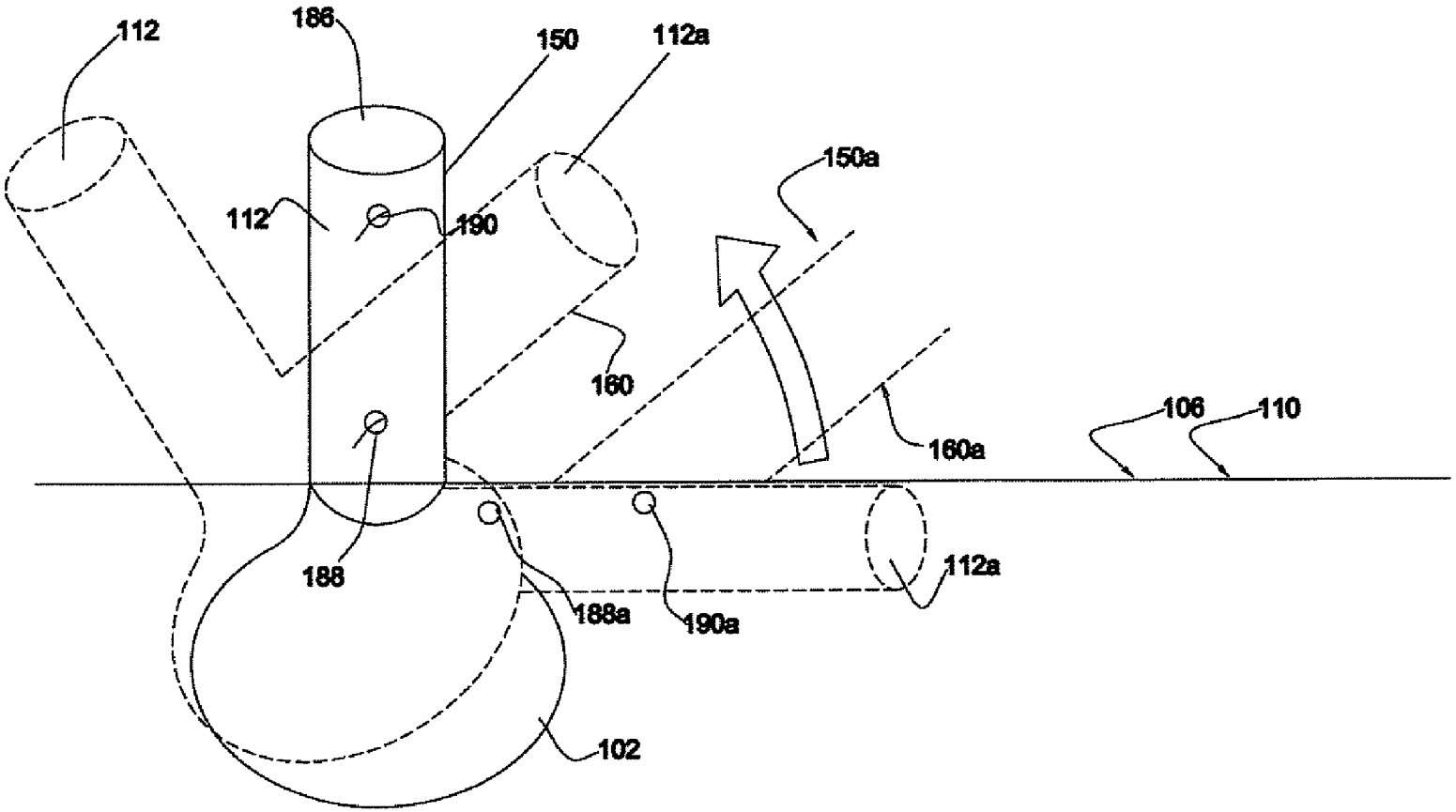
FIG. 6 is a perspective view showing a first cable-mount post and a second lever post which are angularly separated and which are formed integrally with a common foundation in accordance with certain principles of the invention.

As shown in FIG. 6, a first post/foundation assembly 186 includes the post 112 integrally formed, or separately secured, with the foundation 102. The post 112 is formed with openings 188 and 190 for receipt of the tension cables 150 and 160, respectively. A pivot post 112*a* is also integrally formed, or separately secured, with the foundation 102, and is located generally at an angle of ninety degrees with the post 112. The pivot post 112*a* is formed with openings 188*a* and 190*a* for receipt of a second pair of tension cables 150*a* and 160*a*. When the first post/foundation assembly 186 is assembled as a component of a barrier system, the post 112 extends upward from the foundation 102, and the pivot post 112*a* located in the soil 106 slightly below ground level 110.

A second post/foundation assembly (not shown) is identical to, and spaced from, the first post/foundation assembly 186, with the tension cables 150, 160, 150*a* and 160*a* being attached to, and extending between, the first and second post/foundation assemblies.

When a vehicle impacts, and attempts to pass beyond, the tension cables 150 and 160, the cables are moved in the direction of travel of the vehicle whereby the posts 112 of the two spaced post/foundation assemblies 186 are moved to position as shown in phantom in FIG. 6. At the same time, the foundations 102 of the two spaced post/assemblies 186 revolves partially to pivot the pivot posts 112*a* out of the soil 106 to the position shown in phantom. As the pivot posts 12*a* pivot out of the soil 106, the tension cables 150*a* and 160*a* are also raised from the soil to engage the under carriage of the vehicle, elevating and lifting the vehicle upward from ground level 110.

Figure 7:
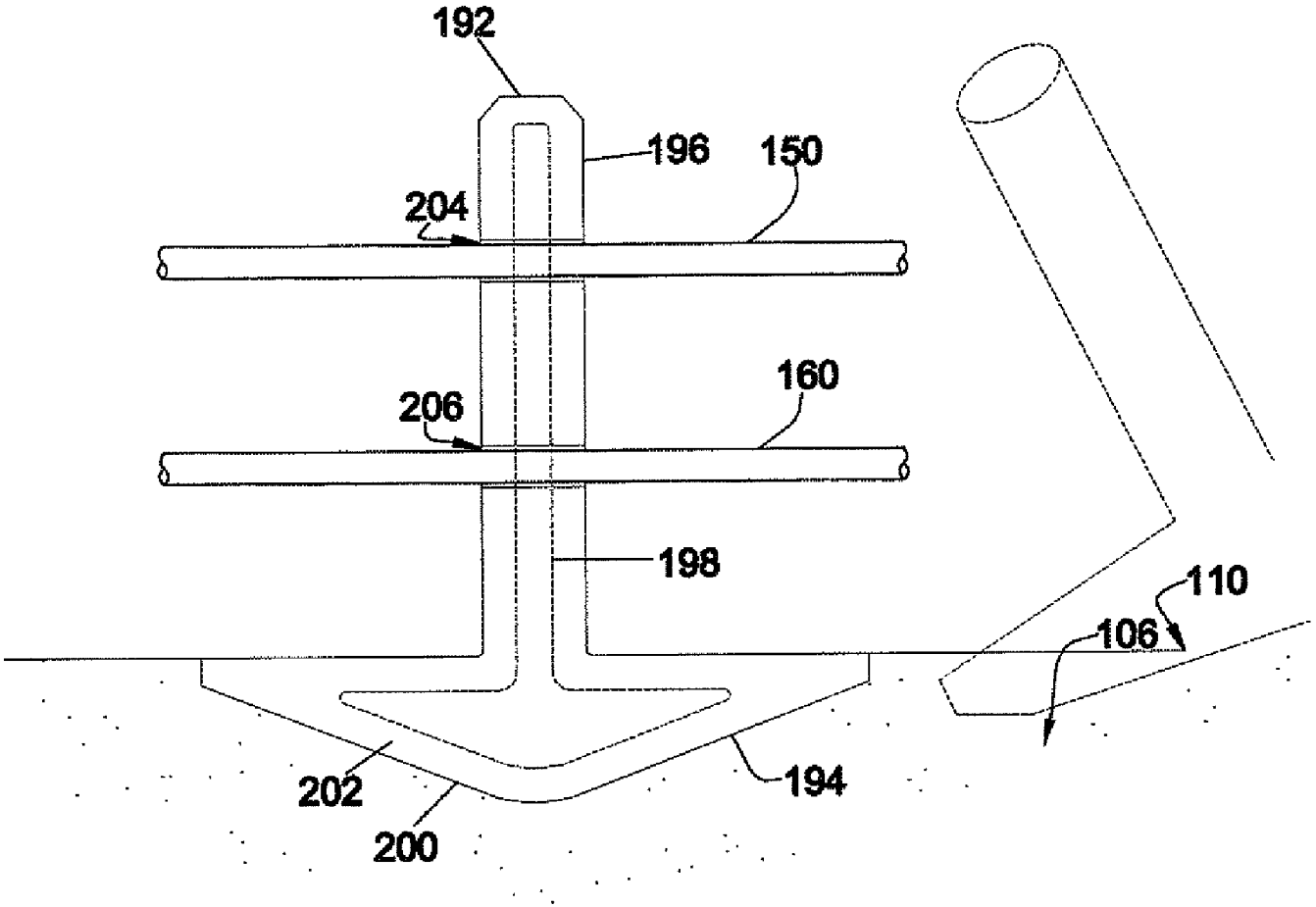
FIG. 7 is a front view showing a wide below-ground foundation formed integrally with an above-ground post having tension cables extending through the post in accordance with certain principles of the invention.

Referring to FIG. 7, a post 192 includes an integrally formed base 194 and a beam 196 extending upward from the base, with a steel reinforcing bar 198 embedded within the integral post. Steel reinforcing bar is commonly, and hereinafter, referred to as "rebar." The base 194 is formed with a convex undersurface 200, which is located within a complimentary concave recess 202 formed in the soil 106 below the ground level 110. The beam 196 is formed with a pair of spaced through holes 204 and 206 for receipt of the tension cables 150 and 160.

As the beam 196, or the cables 150 and 160, are impacted by a vehicle, the post 192 is pivoted out of the concave recess 202, whereby the portion of the base 194, which is closest to the vehicle, is raised to lift and stop the vehicle from further forward movement. Also, as the base 194 is pivoted from the recess 202, the base will rotate and move laterally to plow the soil to form a berm-like deterrent to further movement of the vehicle.

Figure 8:
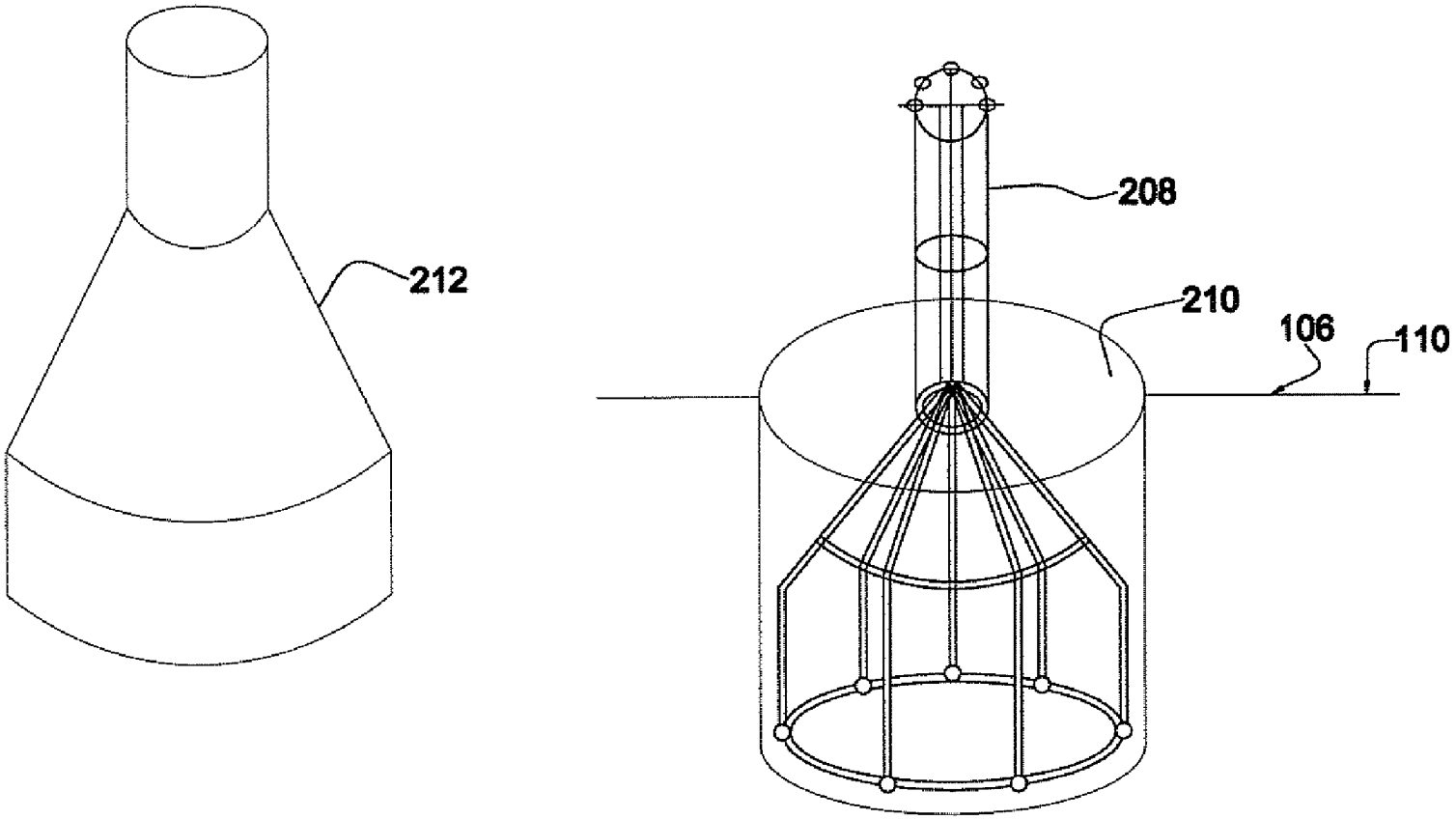
FIG. 8 is a perspective view showing a preformed steel reinforced bar concrete structure for mounting within a ground hole in preparation for forming an integral foundation and post in accordance with certain principles of the invention.

Referring to FIG. 8, a process for forming a foundation, with or without an integral post, in situ, initially includes the forming, off site, of a rebar skeleton 208 in the general configuration of the foundation, with or without the post. A cylindrical hole 210 is dug into the soil 106 with a diameter slightly larger than the ultimate diameter of the foundation, and at a depth generally equal to, or less than, the height of the foundation. Thereafter, the rebar skeleton 208 is deposited into the hole 210. If a post is to be formed integrally with the foundation, the upper portion of the rebar skeleton 208, about which the post is to be formed, will extend outward from the hole 210 and above ground level 110.

A mold 212 is also produced off site, and is formed generally in the exterior shape of the rebar skeleton 208, but is laterally larger than the rebar skeleton. The mold 212, which is generally in the shape of an inverted funnel, is placed over the rebar skeleton 208, with the foundation portion of the mold being located within the hole 210 and the post portion of the mold being located above ground level 110. A standoff, which could be ribs formed integrally with, and extending radially inward from the interior walls of, the mold 212, locates the interior wall of the mold by a prescribed distance from adjacent portions of the rebar skeleton 208. The standoff insures that the rebar skeleton is fully embedded within the ultimately formed foundation and post.

A foundation-and-post material such as, for example, concrete is deposited through an open top of the mold 212 and into the cavity formed by the mold. The deposited concrete surrounds the rebar skeleton 208 and fills the cavity of the mold 212 where, upon curing of the concrete, the foundation and the post are formed with the rebar skeleton being embedded within the concrete. The mold 212 can be removed from, or can be retained with, the formed concrete foundation and post. Soil 106 is then used to back fill, to the ground level 110, the portions of the hole 210 not occupied by the formed foundation, whereby the post, and selectively an upper position of the foundation, extends above the ground level.

A plurality of the rebar skeletons 208 can be manufactured off-site and stored in a stacked arrangement. Similarly, a plurality of the molds 212 can be manufactured off-site and stored in a stacked arrangement. The stacked rebar skeletons 208 and the stacked molds 212 can then be readily shipped in the stacked arrangement to the location of the in situ formation of a prescribed number of foundations and posts in the construction of the barrier system 100.

Figure 9:
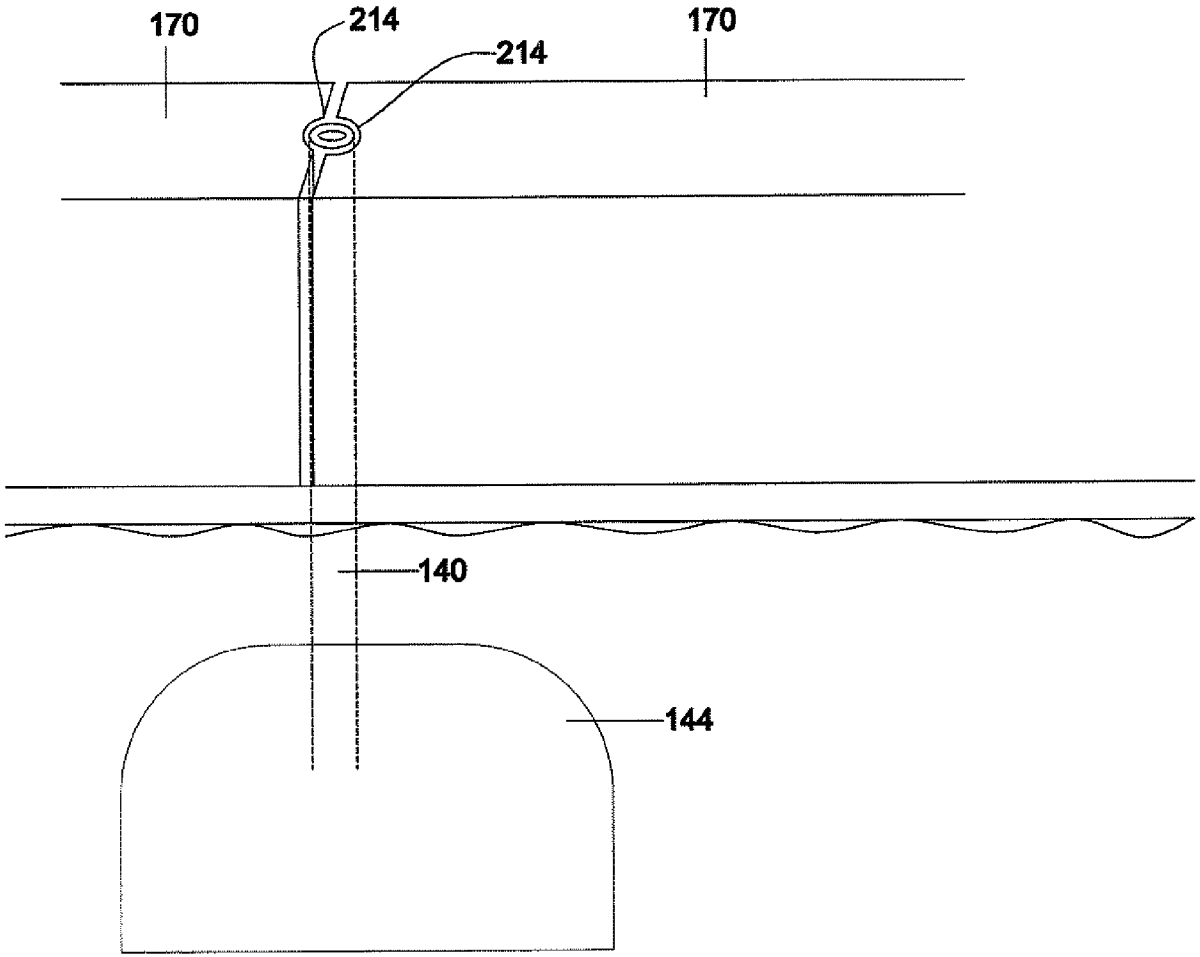
FIG. 9 is a perspective view showing a rod-like post mounted in, and extending from, a foundation with mating end portions of adjacent panels in complementary wrap-around assembly with the post in accordance with certain principles of the invention.

As shown in FIG. 9, the post 140 extends upward from the foundation 144. It is noted that the illustrated post-and-pedestal assembly could also represent either of the foundations 102 and 104 and the respective end post 112 and 114. Each end of each of the panels 170 is formed with a concave groove, which extends from the top to the bottom of the panel. The concavity of each groove 214 is complementary to approximately one-half of the longitudinal configuration of the post 140. In the assembly of the panels 170 with the posts 140, the grooves 214, at opposite ends of each of the panels, is positioned about the adjacent one of the posts 140, and are thereby retained in the assembled position with the posts.

Figure 10:
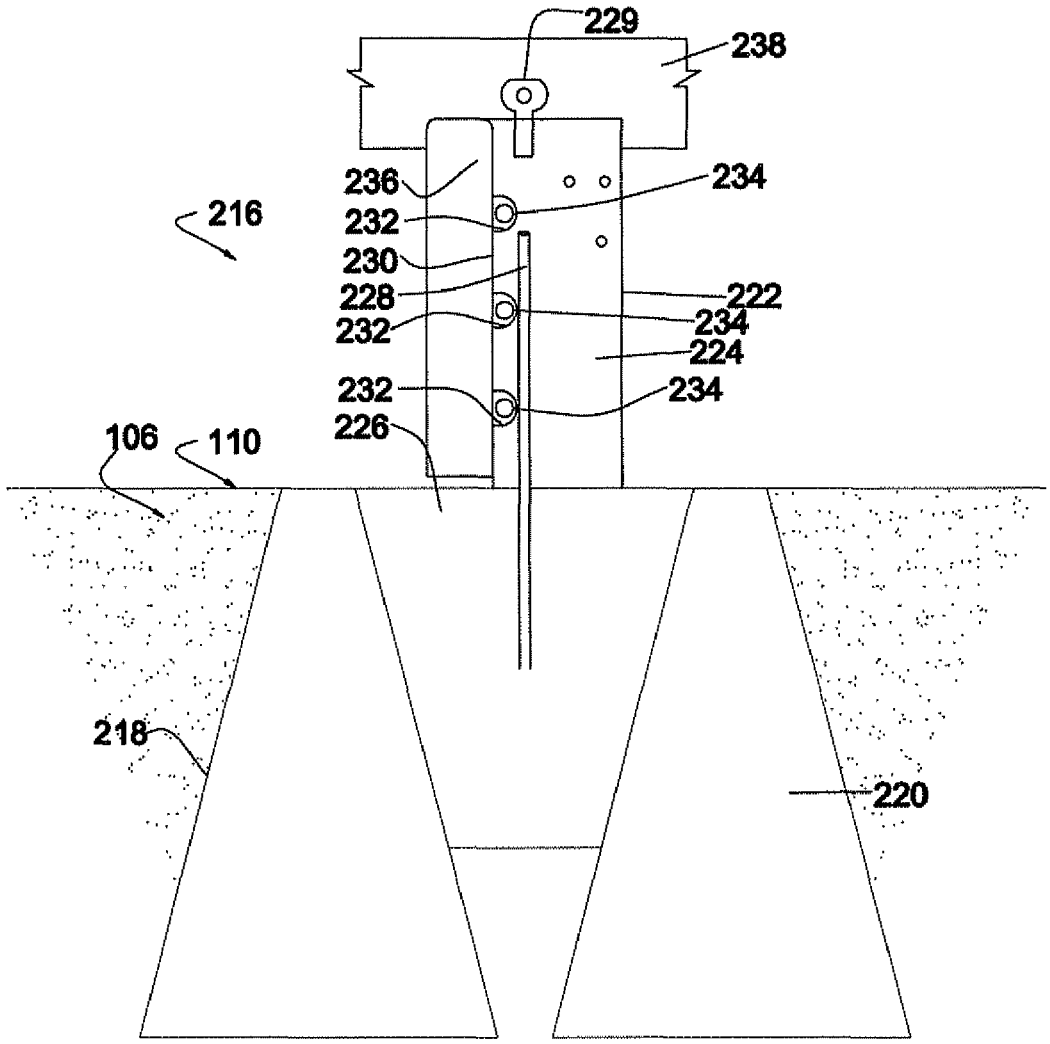
FIG. 10 is a side view showing a post formed with an inverted conical or trapezoidal base mounted within an accommodating recess formed between two below-ground foundation supports in a manner similar to that shown in FIG. 5, with the post with a cover and a cap attachable thereto to facilitate retention of tension cables with the post in accordance with certain principles of the invention.

Referring to FIG. 10, a foundation-and-post assembly 216, generally similar to the assembly of FIG. 5, includes a pair of spaced conical foundation members 218 and 220, which are located within the soil 106, with an upper end of each of the members being located at ground level 110. A post 222 is formed with a beam 224 and a trapezoidal base 226, with a common rebar 228 being embedded within the beam and base. The base 226 is wedged within the space between the two foundation members 218 and 220. An eyebolt 229 is secured to an upper end of the beam 224 to facilitate lowering, and raising, of the base 226 relative to the space between the foundation members 218 and 220.

One side 230 of the beam 224 is formed with three vertically spaced grooves 232, which receive three respective tension cables 234. A side cover 236 is placed in engagement with the one side 228 of the beam 224 to cover the grooves 232 to facilitate retention of the tension cables 234 within the respective grooves. A cap 238 is placed over an upper end of the assembled beam 224 and cover 236 to retain the beam and cover in the assembled arrangement.

Figure 11:
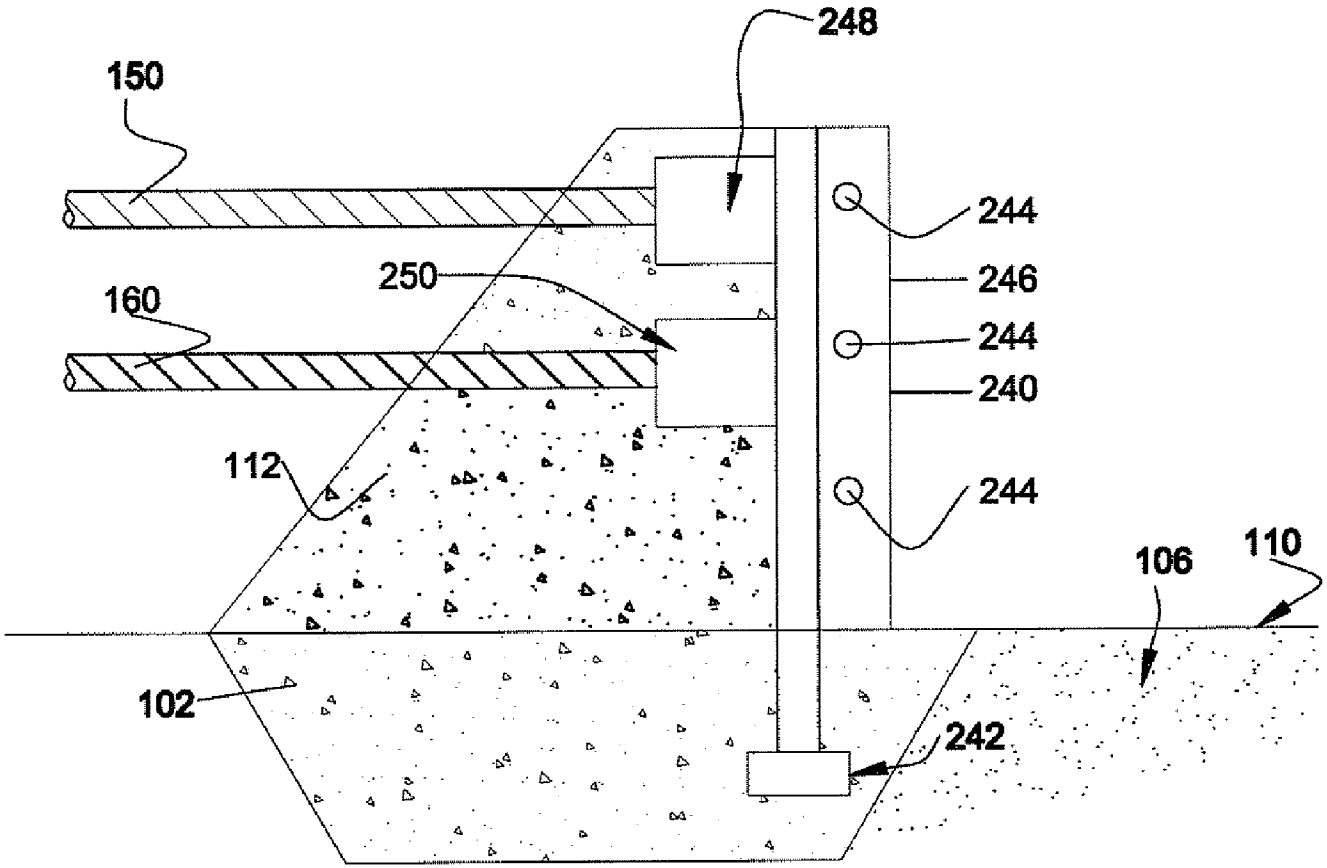
FIG. 11 is a side view showing a below-ground foundation formed integrally with an above-ground post with a tension rod mounted in the foundation and extending through the post in accordance with certain principles of the invention.

Referring to FIG. 11, the foundation 102 is formed integrally with the end post 112, with a tension rod 240 and an enlarged base 242 thereof embedded within the foundation. The tension rod 240, which could be a pipe or an I-beam, also extends upward from the foundation 102, through the end post 112 and is exposed at an upper end of the end post.

A plurality of vertically spaced rebars 244 are located within the end post 112, and extend perpendicularly of the tension rod 240 between the rod and one side 246 of the end post. The end post 112 is formed internally with two vertically spaced chambers 248 and 250, which provide enclosures for energy absorbing means, and with the tension cables 150 and 160, respectively, terminating in the chambers and attached to the energy absorbing means.

Figure 12:
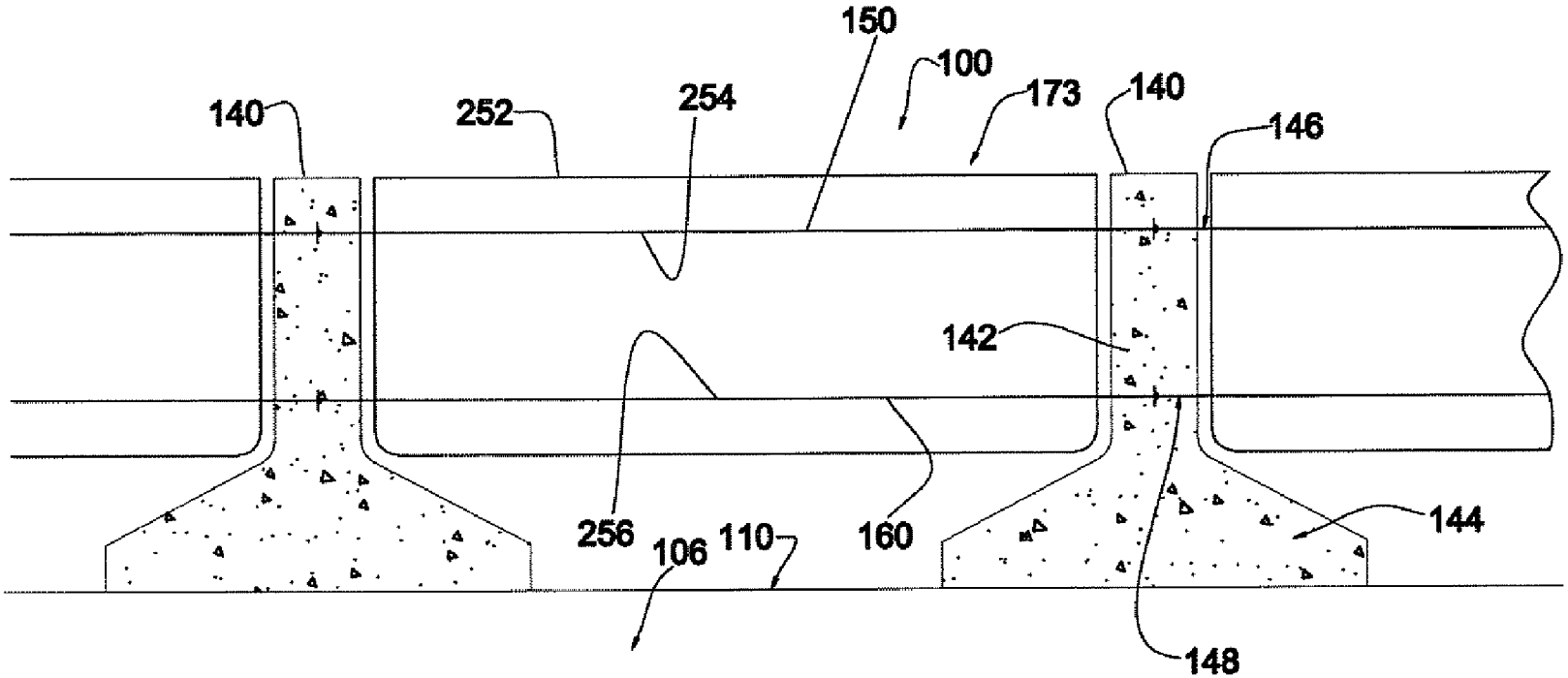
FIG. 12 is a front view of a pair of spaced intermediate posts each of which is formed with a foot extending radially from an axis of the post in accordance with certain principles of the invention.

As shown in FIG. 12, an intermediate portion of the fence 173 of FIG. 1 includes a plurality panels 252, each of which extend between adjacent intermediate posts 140. Each panel 252 is formed with passages 254 and 256 through which the tension cables 150 and 160, respectively, are threaded. The plurality of panels 252 can assist in the barrier function to stop oncoming vehicles, and also can provide a decorative appearance for the barrier system by concealing the tension cables 150 and 160. The use of the plurality of panels 252 facilitates various arrangements of the barrier system 100 such as, for example, where the components of the fence 173 must be arranged in a serpentine fashion, as viewed from the top, or on a topographical slope, as viewed from the front.

It is noted that, while not shown, the bottom of each of the panels 252 could extend to the ground level 110 for support of the panel thereby. The bottom of each of the panels 252 would be shaped to accommodate any obstruction presented by other objects above the ground level 110, such as, for example, the foundation 144 of the post 140, so that the unobstructed portion of the bottom of the panel would rest on the ground level.

Figure 13:
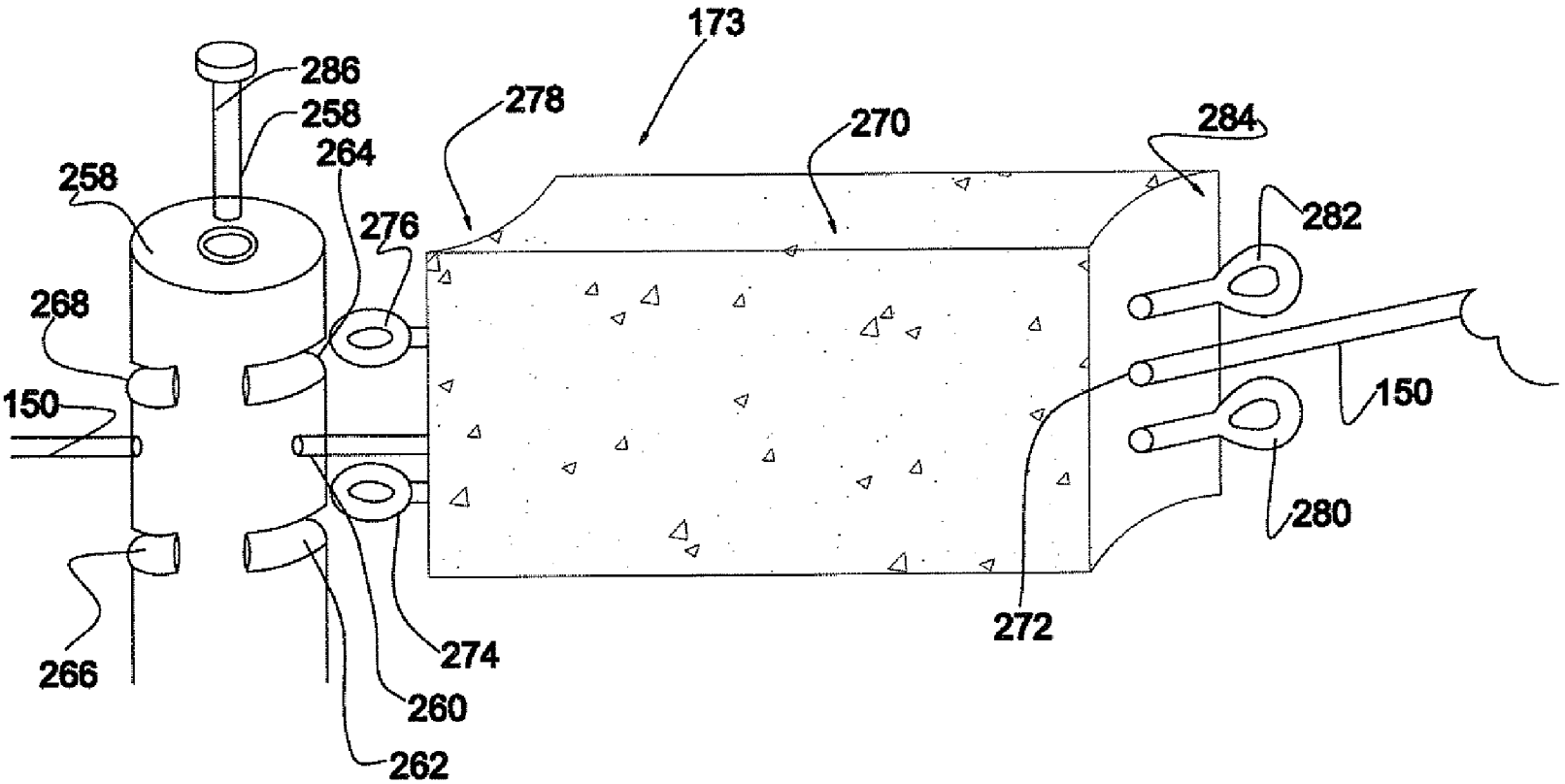
FIG. 13 is a perspective view showing an energy-absorbing elastic strand extending through, and from opposite ends of, a tension-member-containing panel, and through support posts, with facility for attaching the panel to the post, all in accordance with certain principles of the invention.

As shown in FIG. 13, a post 258 is formed with a passage 260 for the threading of the tension cable 150 therethrough, with a first set of vertically spaced recesses 262 and 264 formed are on one side of the post, and are spaced apart by a prescribed distance. A second set of vertically spaced recesses 266 and 268 are formed on an opposite side of the post 258, are spaced apart by the prescribed distance, and are aligned with the recesses 262 and 264, respectively. It is noted that the tension cable 150 could be, for example, an energy-absorbing elastic strand.

A heavy-duty cast concrete or plastic panel 270 is also formed with a passage 272 to facilitate the threading of the tension cable 150 therethrough. A first set of vertically spaced eyebolts 274 and 276 are firmly secured at one end thereof to a first end 278 of the panel 270, and are spaced apart by the prescribed distance, with the eye portion of the eyebolts being exposed. A second set of vertically spaced eyebolts 280 and 282 are firmly secured at one end thereof to a second end 284 of the panel 270, are aligned with the eyebolts 274 and 276, respectively, and are spaced apart by the prescribed distance, with the eye portion of the eyebolts being exposed.

When assembling the fence 173, the tension cable 150 is threaded through the passage 260 of the illustrated post 258, through the passage 272 of the panel 270, and through the passage 260 of a post (not shown), which is adjacent the end 284 of the panel. The panel 270 is manipulated to insert the eye portion of the eyebolts 274 and 276 into respective recesses 262 and 264 of post 258, and to insert the eye portion of the eyebolts 280 and 282 into respective recesses 266 and 268 of the post (not shown), which is adjacent the end 284 of the panel 270. As an alternative, the eye portions of the eyebolts 274, 276, 280 and 282 could initially be assembled within the respective recesses 262, 264, 266 and 268, and the tension cable 150 then threaded through the aligned passageways 260 and 272.

After the assembly as described above, the eye portions of the eyebolts 274, 276, 280 and 282 could be supported on the lower ledge of each of the respective recesses 262, 264, 266 and 268, and retained in that position by the tension cable 150 passing through the panel 270. Alternatively, a locking mechanism (not shown) which is contained within the post 258 can be actuated by an external actuator 286 to move locking pins through each of the eye portions of the eyebolts 274, 276, 280 and 282 to further facilitate retention of the panel 270 in position between each set of adjacent posts 258.

Figure 14:
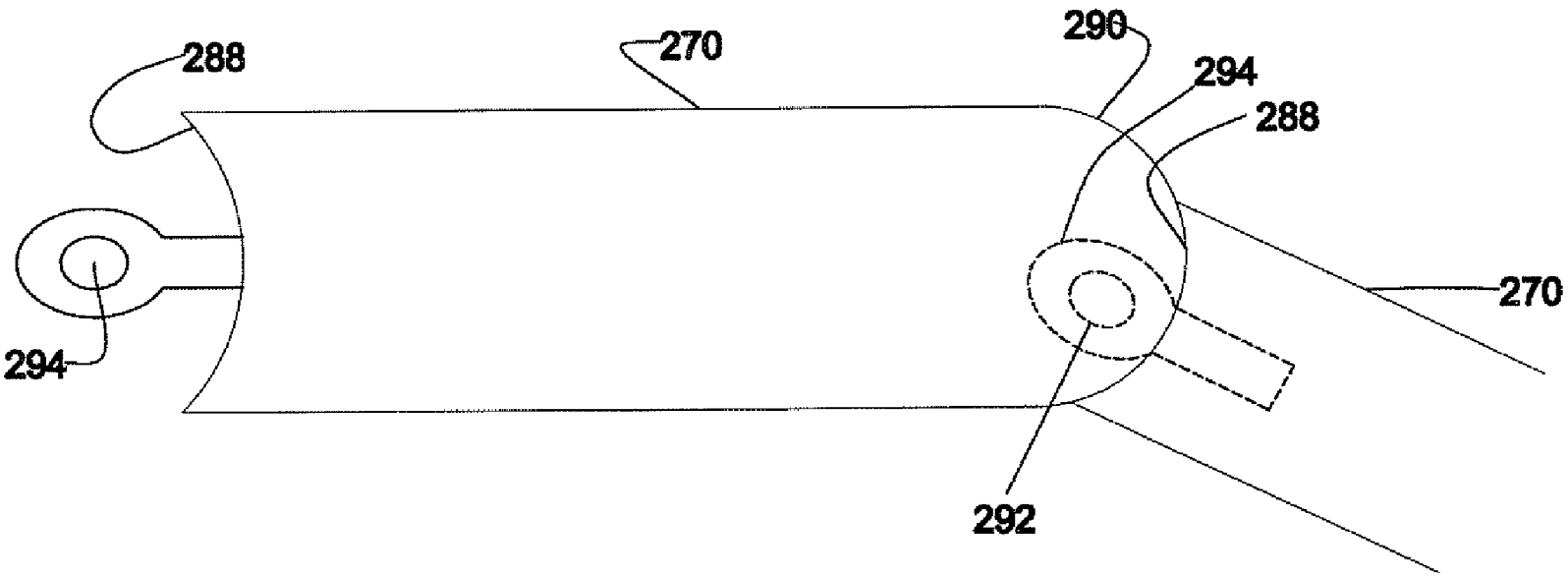
FIG. 14 is a top view showing a panel of the type shown in FIG. 13 with one end of the panel being convex and the opposite end of the panel being concave to accommodate linking adjacent panels for serpentine arrangement in accordance with certain principles of the invention.

Referring to FIG. 14, adjacent cast concrete or plastic panels 270 of FIG. 13, with the tension cable 150 threaded therethrough, can be formed with a concave end 288 at one end thereof, and a convex end 290 at the other end thereof, with a recess 292 formed in the convex end. An eyebolt 294 is firmly secured within the concave end 288, with the eye portion of the eyebolt being exposed. Adjacent panels 270 can then be assembled in a serpentine fashion, as viewed from the top of the fence 173, by positioning the concave end 288 of one panel about the convex end 290 of the adjacent panel, and by inserting the eye portion of the eyebolt 294 into the recess 292.

A locking pin (not shown) can be positioned through an opening in the panel 270, adjacent the convex end thereof, and the eye portion of the eyebolt 294, which is aligned with the panel opening. In this manner, one panel 270 can be positioned angularly with respect to the adjacent panel.

Figure 15:
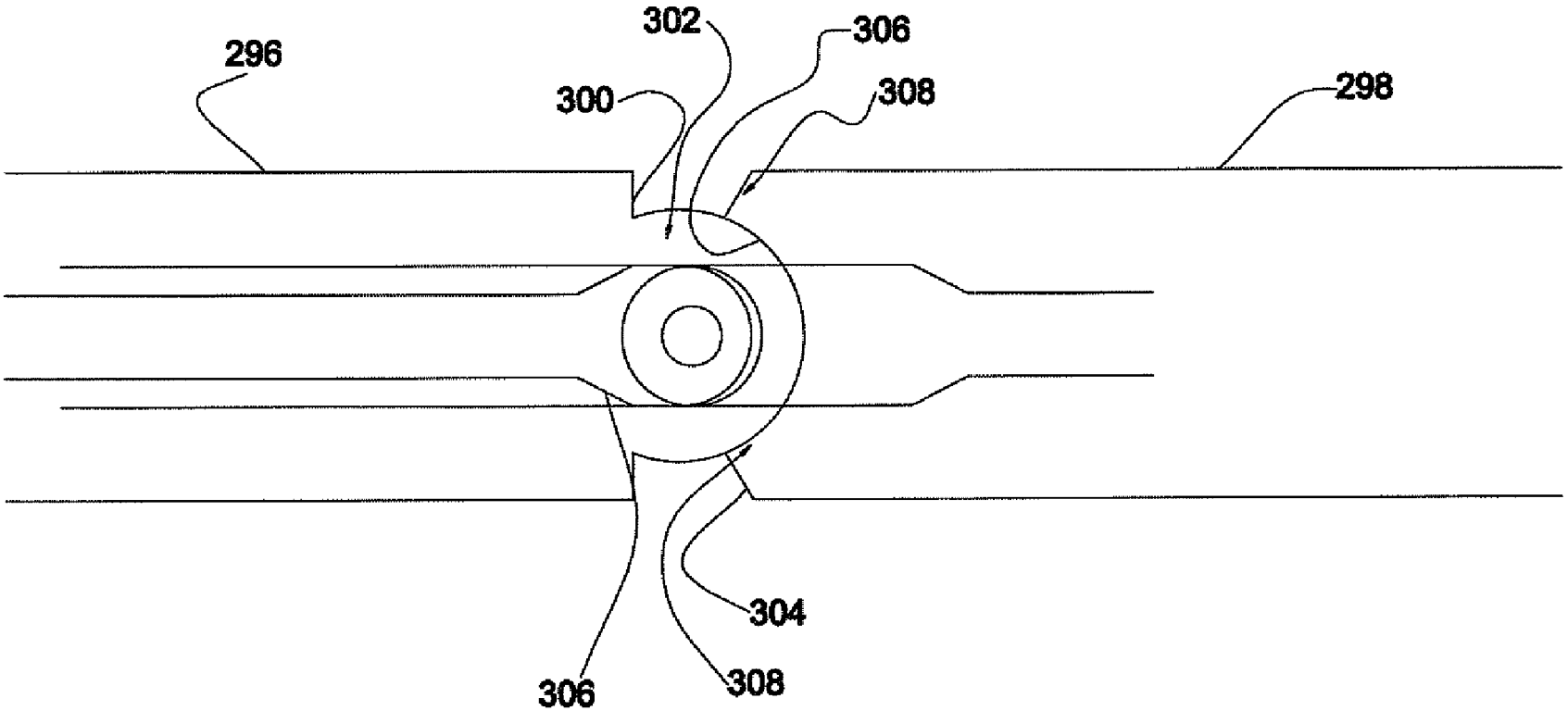
FIG. 15 is a top view showing mating ends of two adjacent panels of the type shown in FIG. 13 with interweaving linking elements, each of which are in the form of a clevis, to retain the panels in linked assembly in accordance with certain principles of the invention.

As shown in FIG. 15, a first panel 296, as viewed from the top thereof, is in assembly with a second panel 298, with the panels being composed of cast concrete or plastic. The first panel 296 is formed at one end 300 with a central extension 302 of a prescribed shape and is formed with a hole therethrough. A rod 304 is embedded within the first panel 296, and is formed with an enlarged head 306, which is embedded within the central extension 302. A common hole is formed through the extension 302 and the embedded head 306.

The second panel 298 is formed at one end 308 with a recess 310, which is complementary to the prescribed shape. The recess 310 of the second panel 298 is positioned for receipt of the extension 302 of the first panel 296. Portions 312 of the end 308 of the second panel 298 are flared from the recess 310 to opposite sides thereof, with the flare being in a direction away from the first panel 296.

A clevis 314 is secured in the second panel 298 and extends centrally from the recess 310 thereof, and into overlapping position with the extension 302, with a hole of the clevis being aligned with the common hole of the extension and the embedded head 306. A pin is inserted through the common hole of the extension 302 and the embedded head 306, and the hole of the clevis 314 to retain panels 296 and 298 together and to allow pivotal positioning between the panels. A rebar 316 is embedded within the first panel 296 and is looped around the common hole of the extension 302 and the embedded head 306.

Figure 16:
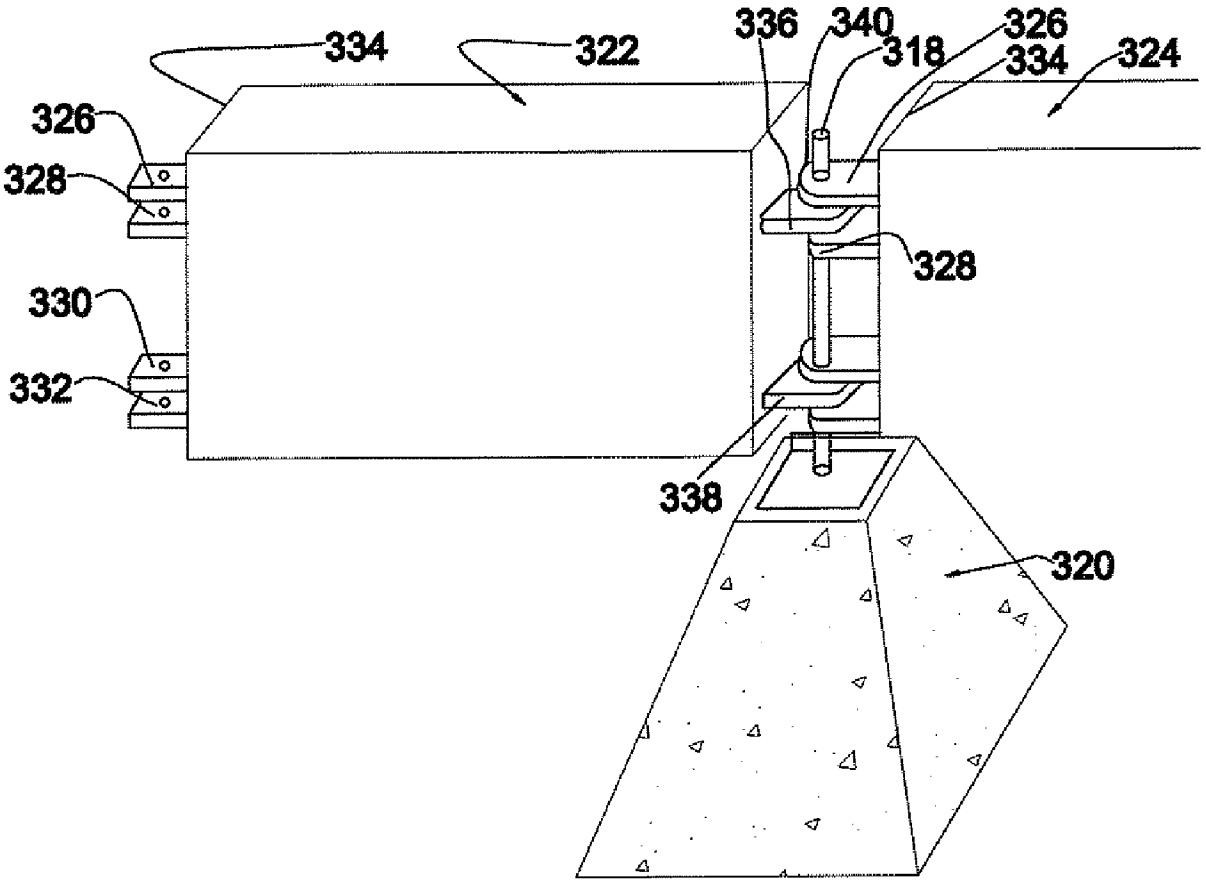
FIG. 16 is a perspective view showing a linking rod extending from a foundation and through aligned holes of panel-supported linking elements of the type shown in FIG. 15 in accordance with certain principles of the invention.

As shown in FIG. 16, a steel post 318 is formed in place, and extends above a foundation 320. A pair of spaced cast concrete or plastic panels 322 and 324 has partially embedded therein a first pair of clevis 326 and 328, spaced from a second pair of clevis 330 and 332. Each clevis 326, 328, 330 and 332 has an exposed portion which extends outward from a first end 334 of the panels 322 and 324, and are formed with aligned holes. A third pair of spaced clevis 336 and 338 are also partially embedded in the panels 322 and 324, with exposed portions thereof extending outward from a second end 340 of the panels, and are formed with aligned holes.

The holes of the first, second and third pairs of the clevis are aligned and placed over the cast concrete post 318 to attach the panels 322 and 324 together. Decorative caps (not shown) may be placed on top of the posts 318. The panels 322 and 324 can be formed such that interfacing portions of the respective ends 334 and 340 are in engagement to provide a compression butt between the adjacent panels.

Figure 17:
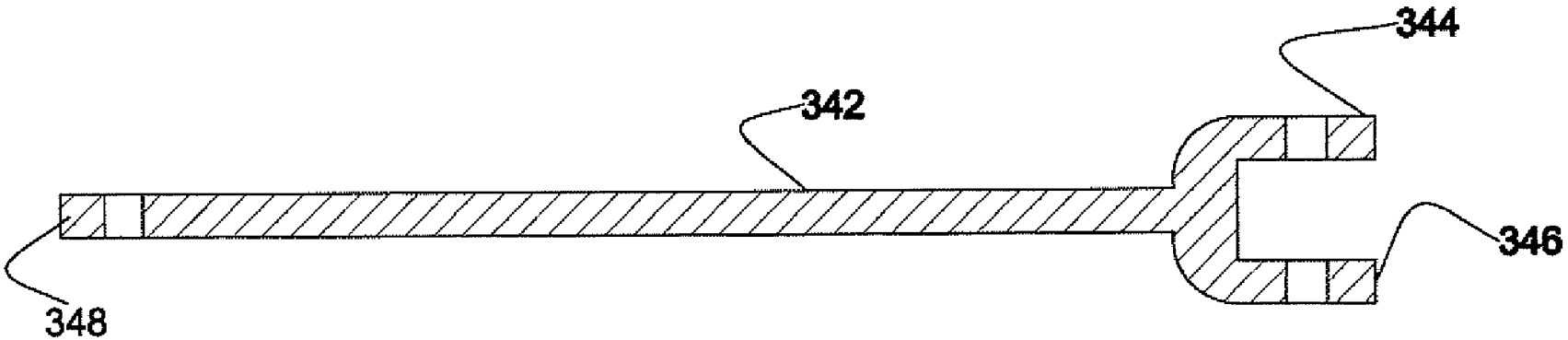
FIG. 17 is a sectional view showing a linking member of the type shown in FIG. 16 in accordance with certain principles of the invention.

Referring to FIG. 17, a tension member 342 is formed with a prescribed length, and with a clevis 344 having aligned holes at a first end 346 of the member. The tension member 342 is straight at a second end 348 of the member, which is formed with a single hole.

Figure 18:
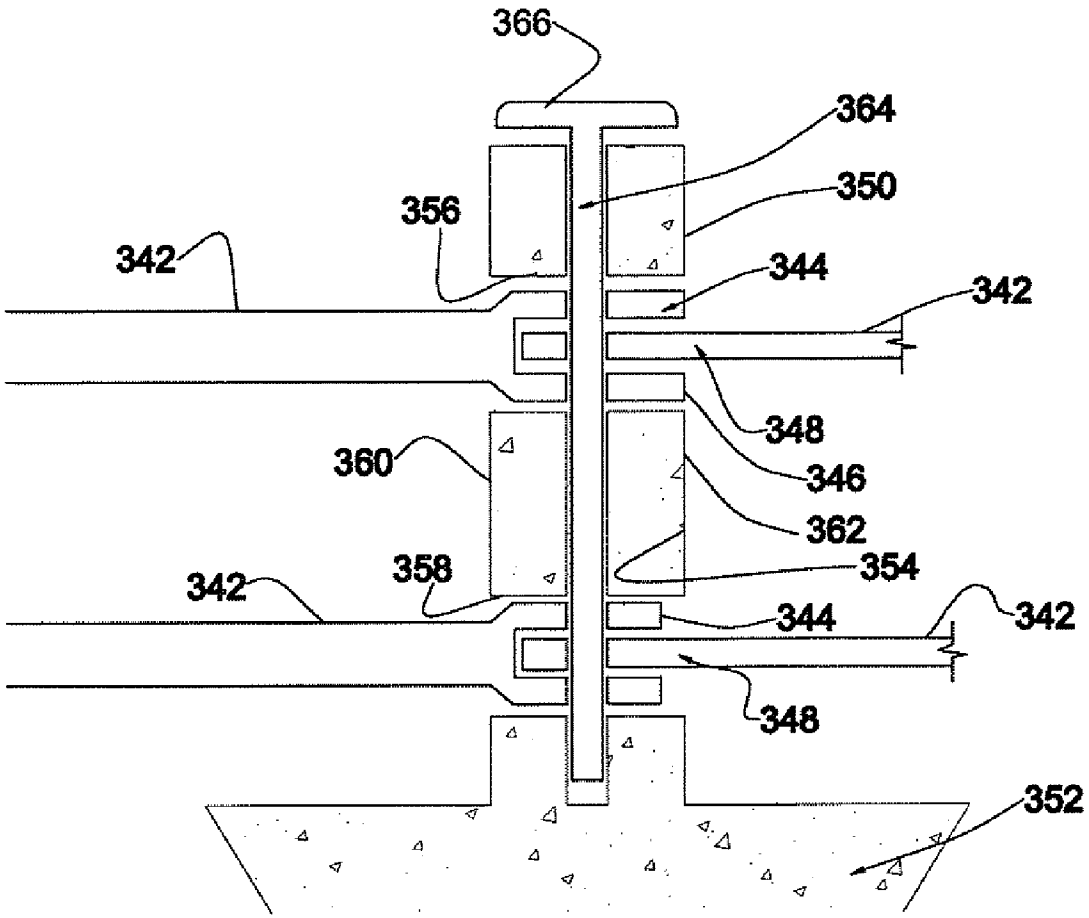
FIG. 18 is a sectional view showing a foundation and an integrally formed post with openings for receipt of linking members of the type shown in FIG. 17 in accordance with certain principles of the invention.

Referring to FIG. 18, a post 350 is formed integrally with a foundation 352, and extends upward therefrom. The post 350 is formed with a vertical core 354, and with a pair of spaced through holes 356 and 358, which are laterally of, and in communication with, the core.

A first of the tension members 342 of FIG. 17 is manipulated to insert the respective clevis 344, at the first end 346 of the tension member, into the hole 356 of the post 350 from a first side 360 of the post, with the vertical core 354 being aligned with the holes of the clevis. A second of the tension members 342 is manipulated to insert the second or straight end 348 into an opening formed within the clevis 344, from a second side 362 of the post 350, with the hole of the second end being aligned with the vertical core 354 and the holes of the clevis. The clevis 344 of a third one of the tension members 342, and the second end 348 of a fourth one of the tension members, is assembled within the hole 358 of the post 348 in similar fashion.

A locking pin 364, having a head 366, is inserted into the vertical core 354 of the post 350, from the top of the post, and through aligned holes of the two clevis 344 and the two second ends 348 to retain the tension members 342 in assembly with the post.

Figure 19:
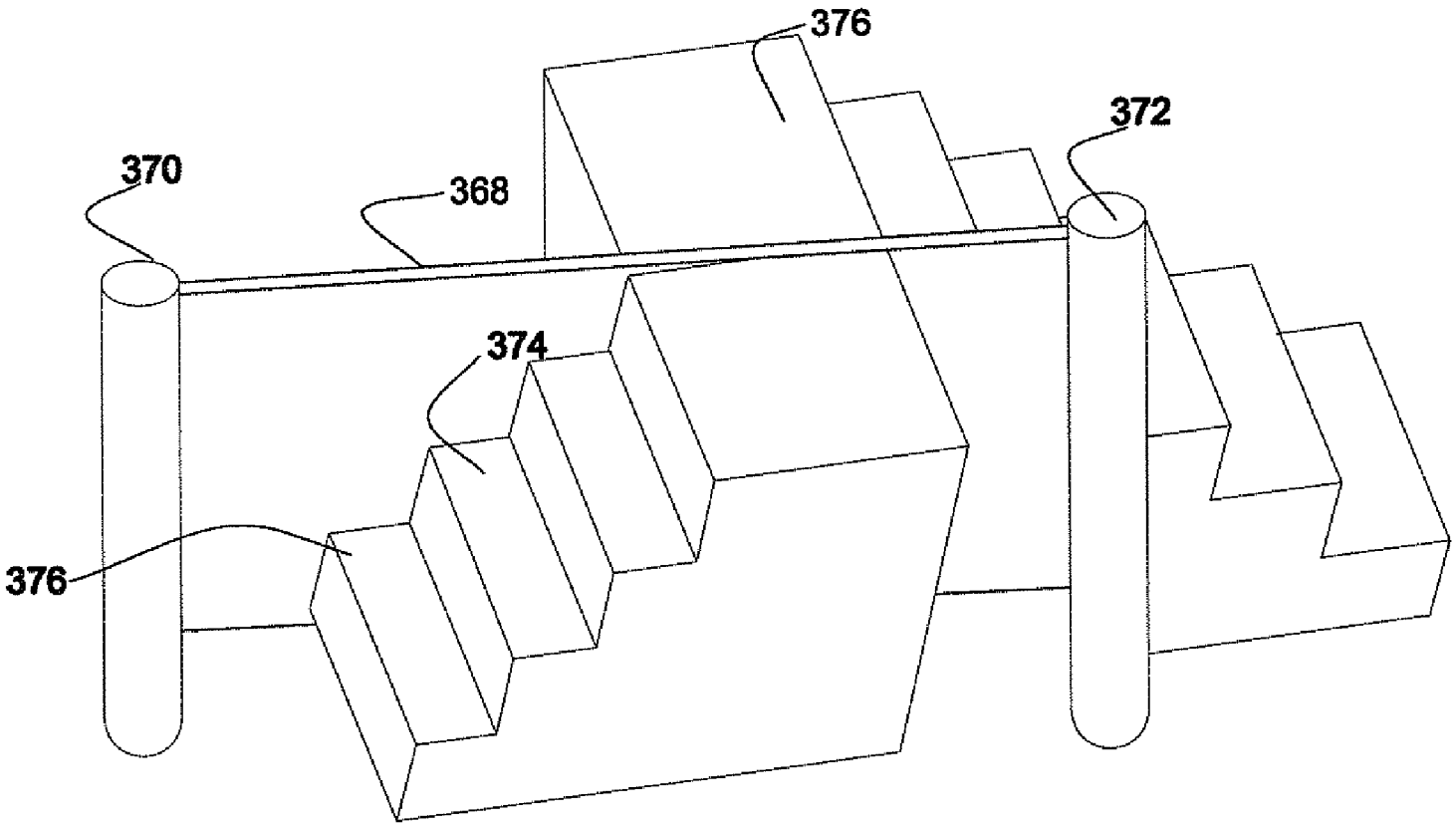
FIG. 19 is a perspective view showing a step structure or ramp formed integrally with a gate panel to allow passage for pedestrians in accordance with certain principles of the invention.

As shown in FIG. 19, a cast concrete or plastic panel 368 extends between two spaced posts 370 and 372, and is cast integrally with stairs 374 and 376 on opposite sides of the panel to provide a passage for authorized pedestrians to pass over the panel. In lieu of the stairs 374 and 376, a pair of ramps (not shown) could be cast integrally with, and on opposite sides of, the panel 368 to provide a passage for authorized wheelchair-bound persons to pass over the panel.

Figure 20:
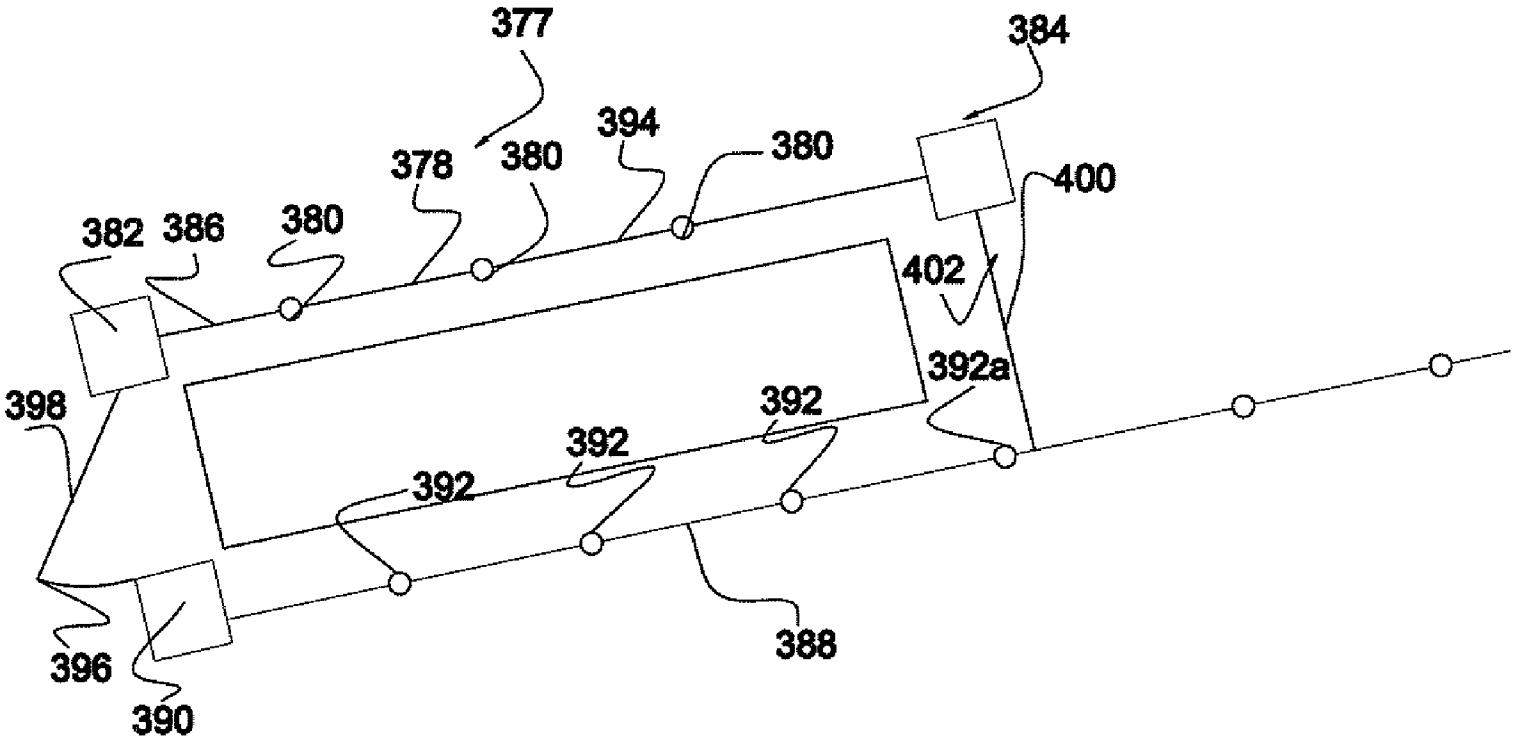
FIG. 20 is a top view showing a gated system formed as a portion of a barrier to allow vehicle passage in a canal-lock-like arrangement in accordance with certain principles of the invention.

Referring to FIG. 20, a "canal lock" gate system 377 includes an end section of a first fence 378 formed by a series of spaced intermediate posts 380, located between two end posts 382 and 384, with a continuous tension member 386 extending between the intermediate and end posts. A beginning section of a second fence 388 is formed by a beginning end post 390 and a series of spaced intermediate posts 392, with continuous tension member 394 extending the intermediate and end posts.

The end section of the first fence 378 is spaced from and generally parallel to the beginning section of the second fence 388. A first gate 396, including tension members 398, is mounted along one side thereof to the end post 382 for pivoting movement, and is latchable to the end post 390. A second gate 400, including tension members 402, is mounted along one side thereof to the end post 384 for pivoting movement, and is latchable to an intermediate post 392*a* of the second fence 388.

The gates 396 and 400 can be controlled in the manner of controlling canal gates of a waterway canal to allow selective passage of an authorized vehicle.

Figure 21:
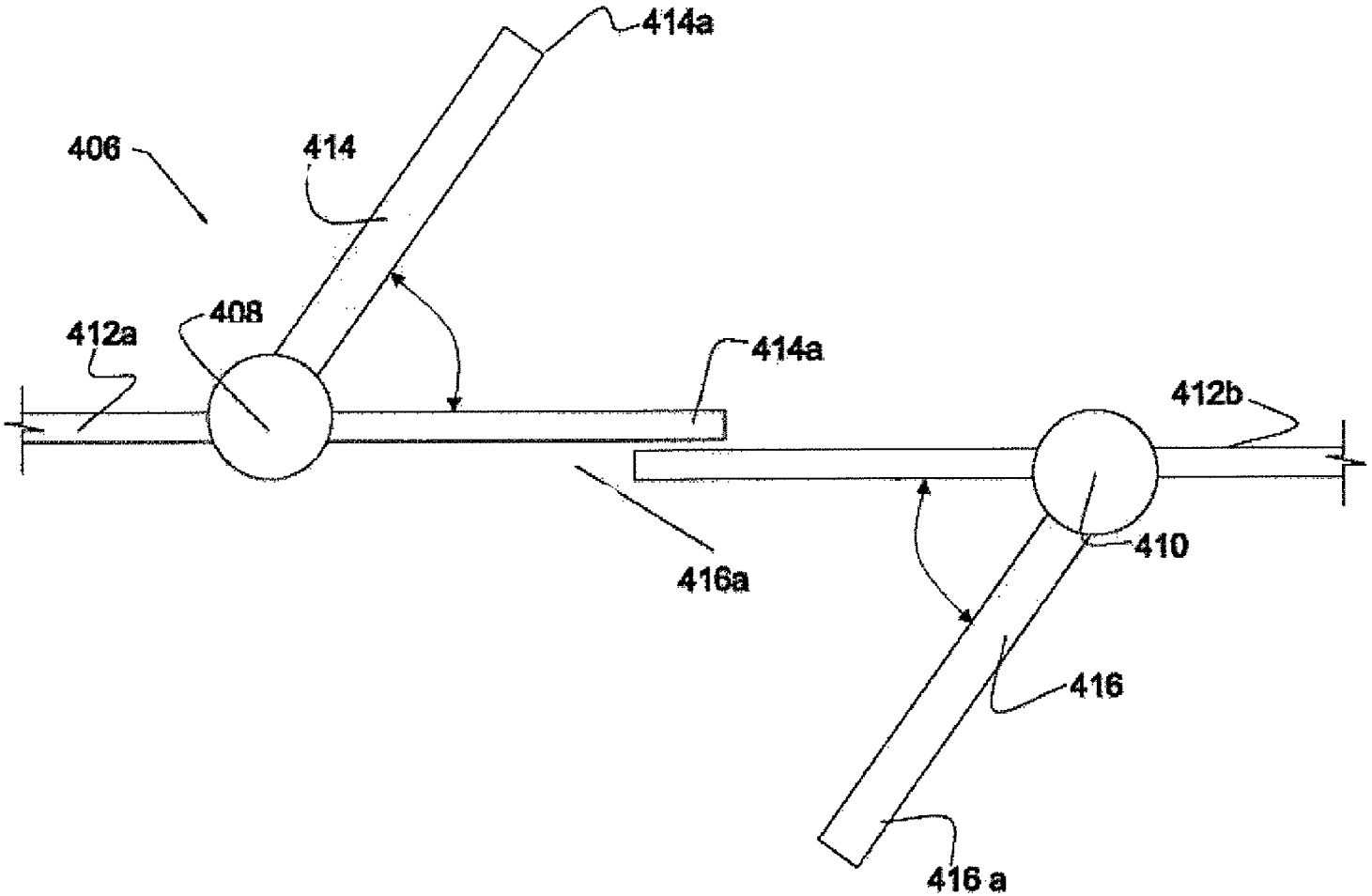
FIG. 21 is a top view showing a gated system including two spaced posts each of which supports a respective one of a pair of gates which overlap at a junction of the pair of gates in accordance with certain principles of the invention.

As shown in FIG. 21, a fence 406 having a tension cable system and a gated passage, is formed by a first post 408 and a spaced second post 410, with tension cables 412*a* and 412*b* extending away from the respective posts 408 and 410. A first gate section 414 is mounted for pivoting movement to the first post 408. A second gate section 416 is mounted for pivoting movement to the second post 410.

When the gate sections 414 and 416 are in a closed position, an extended end portion 414*a* of the first gate section 414 overlaps an extended end portion 416*a* of the second gate section 416. In the closed position, the gate sections 414 and 416 are secured to each other by a connector of any of a number of known connectors.

Figure 22:
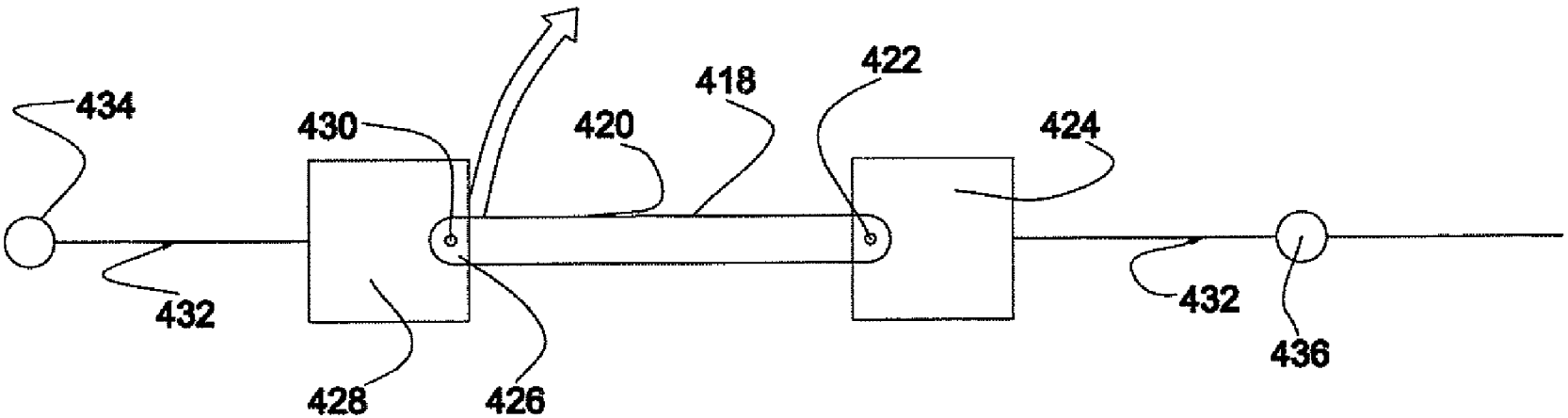
FIG. 22 is a top view showing a gated system extending between two spaced posts, with a gate being pivotally mounted to one of the posts and latchable to the other post by a pin in accordance with certain principles of the invention.

As shown in FIG. 22, a gate 418 is formed by tension members 420, with a first end 422 of the gate attached to a first gate post 424 for pivotal movement relative to the post. A second end 426 of the gate 418 is formed with latch member (not shown), which is latchable to a second gate post 428 by a multi-pin facility 430. Additional tension members 432 extend from the gate posts 424 and 428 to, and beyond, intermediate posts 434 and 436, respectively.

Figure 23:
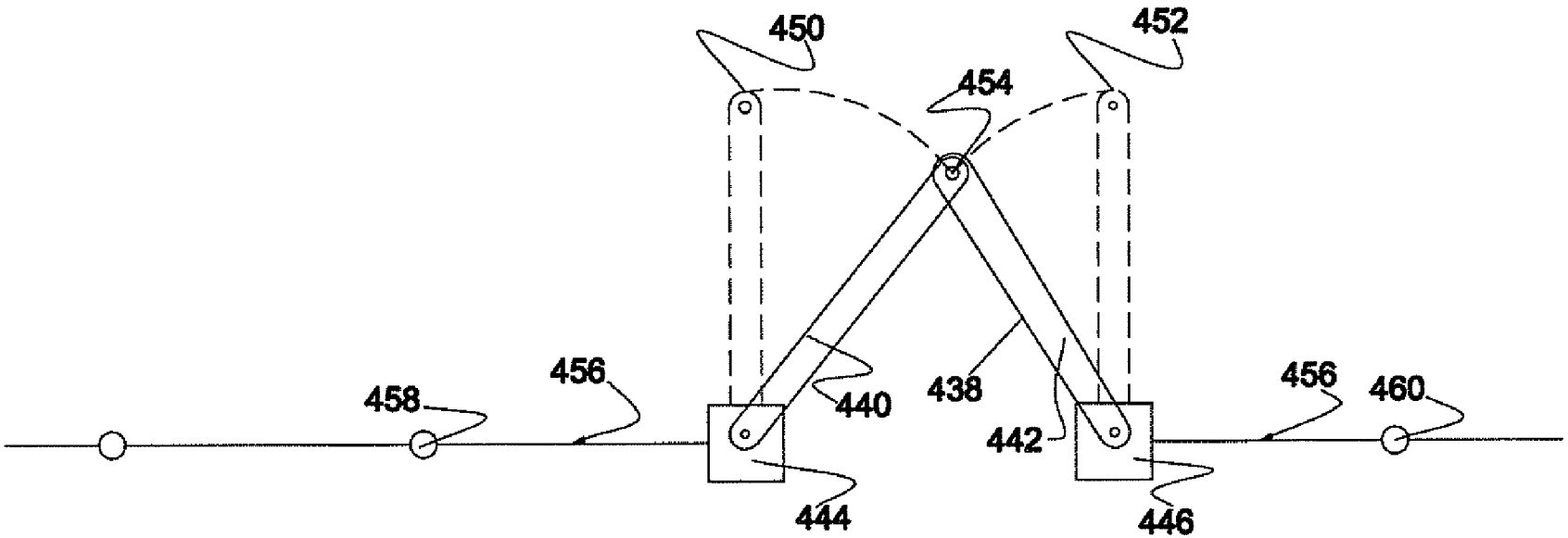
FIG. 23 is a top view showing a gated system including two spaced posts each of which support one end of a respective one of a pair of gates in accordance with certain principles of the invention.

Referring to FIG. 23, in a barrier fence, a gate 438 is formed by two gate sections 440 and 442, each of which are pivotally attached to two gate posts 444 and 446, respectively, spaced apart by a prescribed distance. Each of the gate sections 440 and 442 is formed as a tension member, without panels, and extend from the respective posts 444 and 446 by a distance greater than the prescribed distance.

The gate sections 440 and 442 are formed with free ends 450 and 452, respectively, each of which are formed with vertically-spaced end fingers (not shown). The end fingers of the free end 450 are formed in a first set of vertically-spaced planes, and the end fingers of the free end 452 are formed in a second set of vertically-spaced planes, which are offset from the first set of planes by the thickness of the end fingers. When the free ends 450 and 452 are moved into vertical alignment, as shown in FIG. 23, the end fingers of the free end 450 interleave with the end fingers of the free end 452, to vertically align through holes formed in each of the end fingers.

When the gate 438 is closed, and the end fingers of the free ends 450 and 452 are interleaved together, a multi-shear latching pin 454 is inserted into and through the vertically-aligned through holes of the end fingers to secure the gate in a closed position. If an unauthorized vehicle attempts to enter beyond the barrier fence, and impacts the secured gate 438, the gate sections 440 and 442, and the multi-shear pin 454, are of sufficient strength to prevent the vehicle from passing through the gate. If an authorized vehicle is to pass through the gate 438, the multi-shear pin 454 is vertically withdrawn from the aligned through holes of the end fingers of the free ends 450 and 452, the gate sections 440 and 442 are pivoted apart, and the authorized vehicle is allowed to pass through the gate.

The barrier fence further includes tension members 456 which extend from the gate posts 444 and 446 through, and beyond, intermediate posts 458 and 460, respectively.

Figure 24:
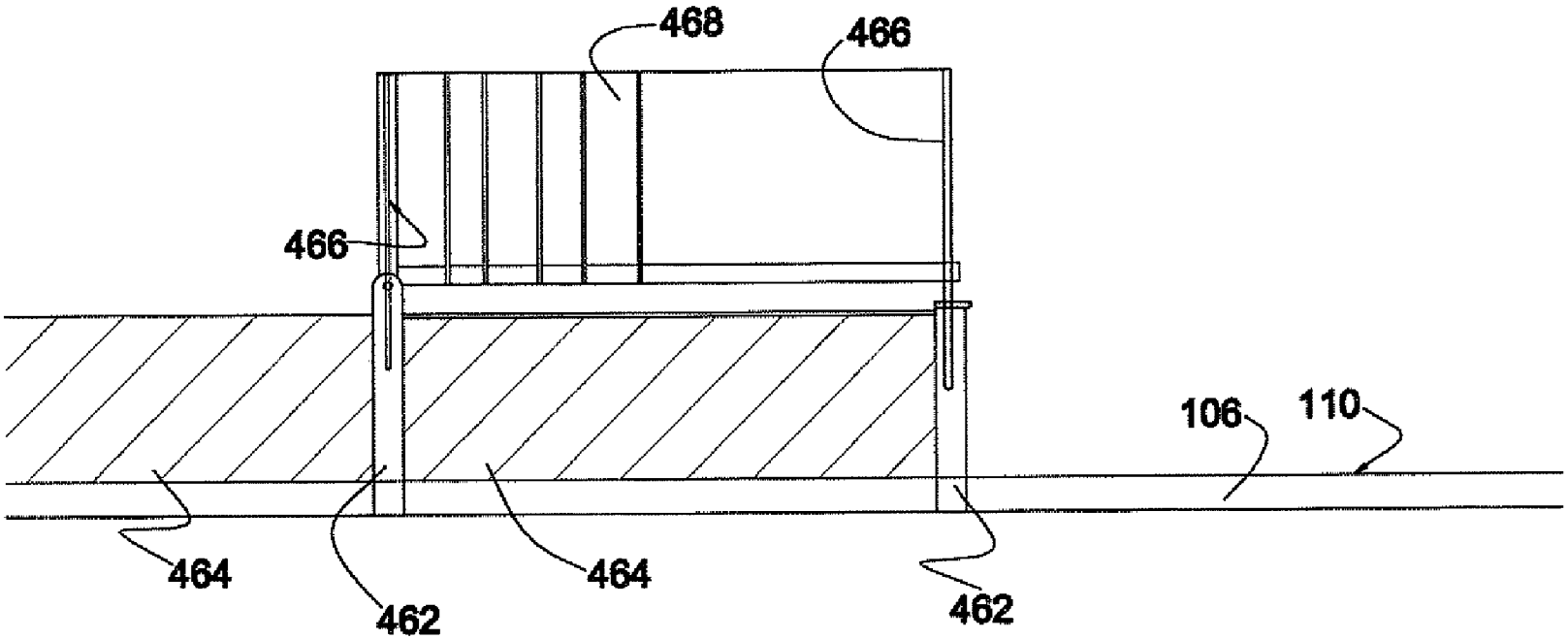
FIG. 24 is a front view showing a pair of spaced posts with a vehicle restrainer extending therebetween and a pedestrian restrainer attached to, and extending between, a pair of spaced rods extending, respectively, from tops of the pair of posts in accordance with certain aspects of the invention.

As shown in FIG. 24, a plurality of spaced intermediate barrier posts 462 (two shown) support a plurality of sections 464 of a vehicle fence, which may be composed of tension members and/or panels. The fence is generally three feet in height from the ground level 110.

Each of a plurality of spaced rods 466 is mounted in the top of a respective one of the posts 462, with adjacent pairs of the rods providing support for individual sections 468 of a pedestrian fence between the rods. The top of the pedestrian fence is located generally six feet from the ground level 110. The sections 468 of the pedestrian fence may be formed from iron work, expanded metal, chain links, and the like, and may be formed as a lattice.

Figure 25:
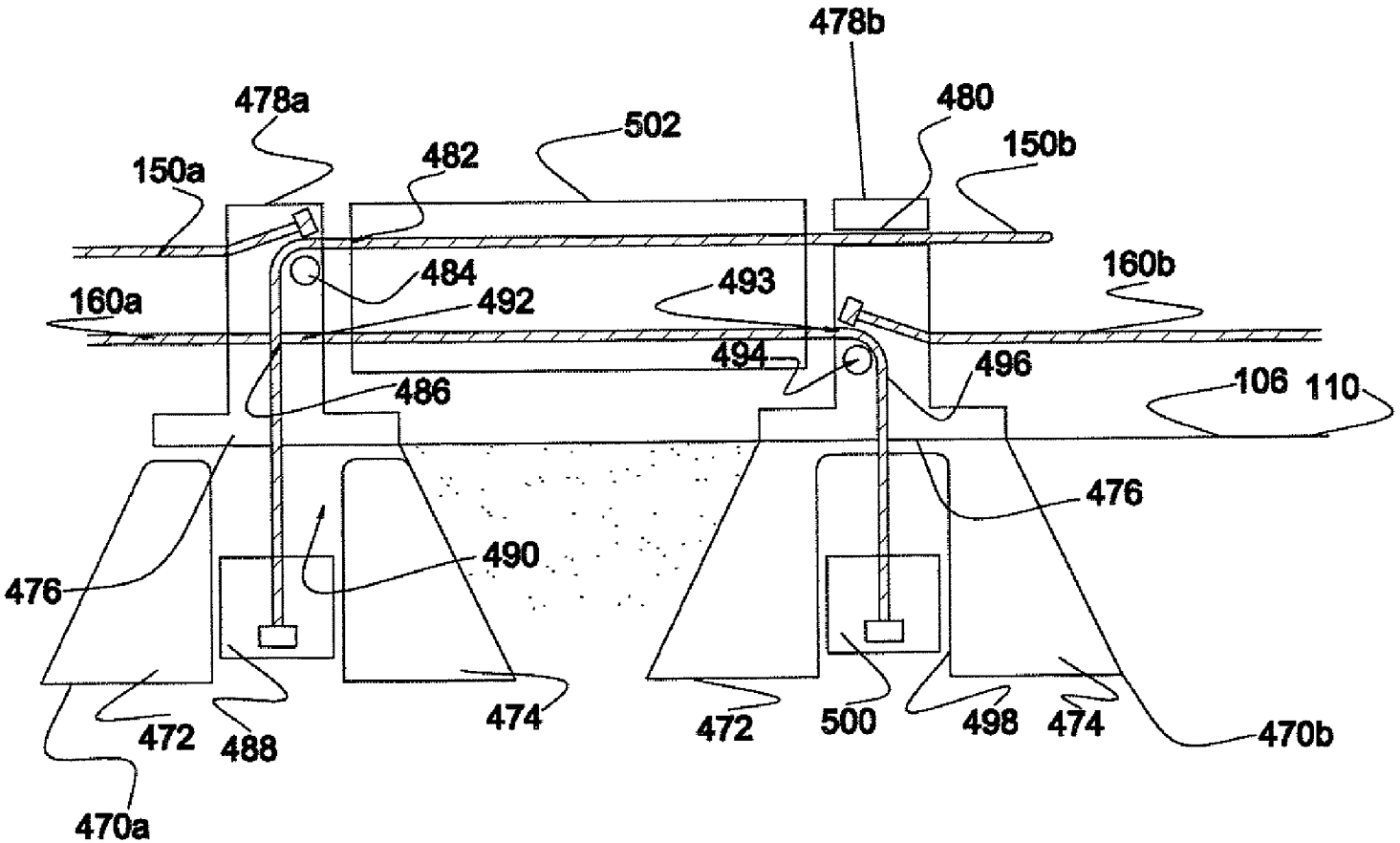
FIG. 25 is a sectional view showing a pair of spaced foundation members supporting a respective pair of posts with tension cables weighted at one end and extending between the posts in accordance with certain principles of the invention.

As shown in FIG. 25, each of two foundation assemblies 470*a* and 470*b* is formed with two spaced side sections 472 and 474, and an integrally formed linking section 476, which straddles the side sections at the top thereof. Each of two posts 478*a* and 478*b* is placed on, or cast integrally with, a respective one of the two foundation assemblies 470*a* and 470*b*.

A right end of a first tension cable 150*a* is secured to the post 478*a*. A second tension cable 150*b* extends from a location (not shown) to the right of FIG. 25, where a right end of the cable is secured to a post (not shown), also at the location, in the same manner that the visible right end of cable 150*a* is secured to the post 478*a*, as described above. The tension cable 150*b* extends through an opening 480 formed through the post 478*b*, into an opening 482 formed in the post 478*a*, and over a roller 484 located within a hollow in the post 478*a*. The tension cable 150*b* continues through a vertical core 486 of the post 478*a*, exits from the bottom of the post 478*a*, and to a left end of the cable which is attached to a weight 488 located in a space 490 between the spaced side sections 472 and 474 of the foundation assembly 470*a*.

The tension cable 160*a* has a left end which is attached to a post (not shown) to the left of FIG. 25, and extends through an opening 492 in the post 478*a*, into an opening 493 in the post 478*b*, over a roller 494 in a hollow of the post 478*b*, and into a vertical core 496 formed in the post 478*b*. The cable 160*a* exits from the bottom of the post 478*b* and extends into a space 498, between the spaced side sections 472 and 474, and is attached at its right end to a weight 500. A panel 502 is placed over the tension cables 150*b* and 160*a* which extend between the posts 478*a* and 478*b*. The weights 488 and 500 provide a tensioning of the respective tension cables 150*b* and 160*a*, and provide a counter weight which prevents the passage of an unauthorized vehicle through the panel 502.

Figure 26:
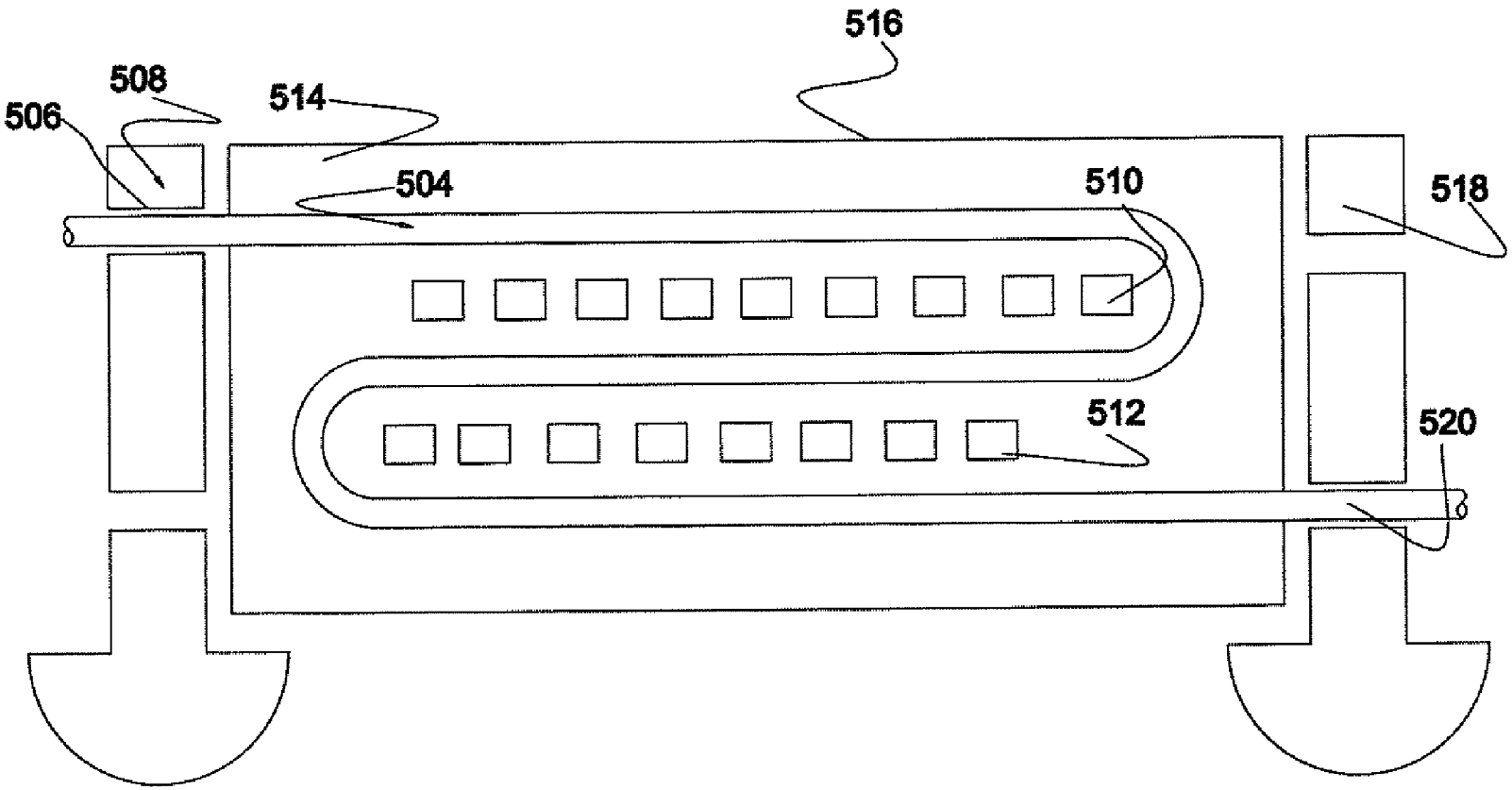
FIG. 26 is a front view showing a pair of spaced posts with two interfacing spaced panels therebetween having a plurality of shear elements between the panels and a tension cable arranged about the shear elements in a serpentine fashion in accordance with certain principles of the invention.

As shown in FIG. 26, a tension cable 504 extends through an upper opening 506 of a first intermediate post 508. The cable 504 is threaded in a serpentine fashion about a first row of spaced shear posts 510 and a second row of spaced shear posts 512, which are spaced from the first row of shear posts. The shear posts 510 and 512, and the threaded portion of the cable 504, are located between spaced panels 514 (one shown) of a clamshell panel assembly 516, which extends between the first intermediate post 508 and a spaced second intermediate post 518. The cable 504 exits from between the panels 514 and extends through a lower opening 520 of the second intermediate post 518. The spaced panels 514 and the shear posts 510 and 512 can be formed as a unitary concrete arrangement.

When an unauthorized vehicle impacts the panel assembly 516, the stressed cable 504 begins to break some of the shear posts 510 and 512 from their formation with the panels 514. However, the impact force of the vehicle is insufficient to break all of the shear posts 510 and 512, and the vehicle is prevented from passing through the panel assembly 516.

Additionally, a second tension cable (not shown) could be threaded about two other rows of shear posts (not shown) in the same manner as the cable 504.

As an alternative, a given length of a tension cable (not shown) could be secured at one end thereof to the post 508, and the opposite end thereof secured to the post 518, with intermediate portions of the given length of cable being threaded in a serpentine fashion about two rows of shear posts (not shown) in the same manner as the tension cable 504.

Figure 27:
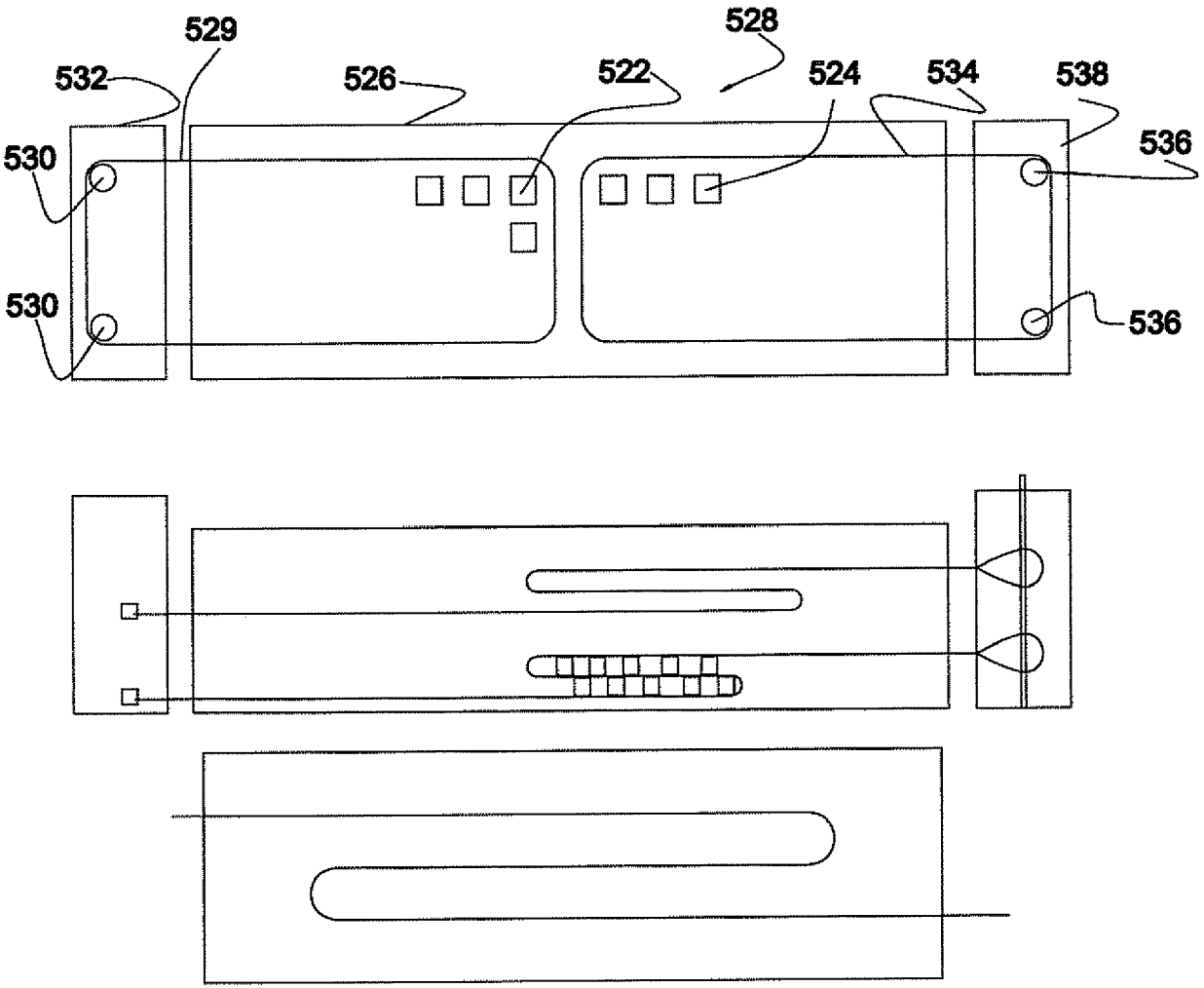
FIG. 27 is a front view showing a pair of spaced posts with two interfacing spaced panels therebetween having a plurality of shear members between the panels and each of two tension cables arranged in an endless loop about a respective one of the pair of posts and respective ones of the shear members in accordance with certain principles of the invention.

Referring to FIG. 27, a first set of energy-absorbing bosses 522, and a second set of energy-absorbing bosses 524, extend between spaced panels 526 (one shown) of a clamshell panel assembly 528. A first endless tension cable 529 extends around the first set of bosses 522 and a pair of spaced retention members 530 extending from an intermediate post 532. A second endless tension cable 534 extends around the second set of bosses 524 and a pair of retention members 536 extending from an intermediate post 538.

When an unauthorized vehicle impacts the panel assembly 528, some of the shear posts 522 and 524 will be sheared, but a sufficient number of the shear posts will remain intact to prevent the vehicle from passing through the panel assembly.

Figure 28:
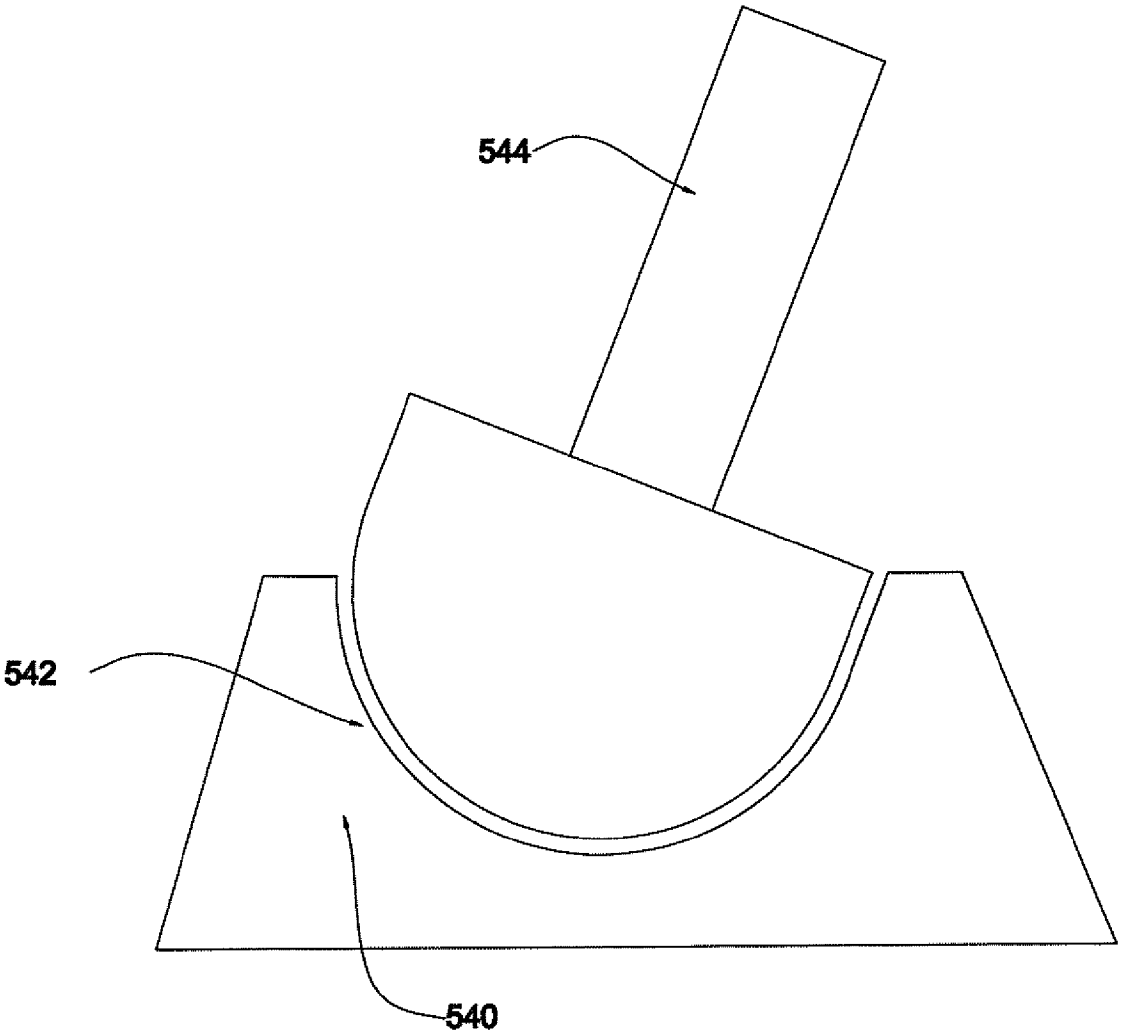
FIG. 28 is a front sectional view showing an assembly of a foundation, formed with a recess in a curved cup-like configuration, and a post formed with a base in a shape complementary to the configuration of, and rockably mounted in, the recess in accordance with certain principles of the invention.

As shown in FIG. 28, a foundation 540 is formed with a concave barrel-like recess 542, which is open at the top. A post 544 is formed with a barrel-like base 546, which is complementary to, and situated in, the recess 542. When a vehicle fence (not shown), which includes intermediate posts such as the post 544, is impacted by an unauthorized vehicle, the post 544 will rock to a position as shown in phantom to absorb the energy of the impact, and will return to the upright position by gravity when the vehicle is removed.

Figure 29:
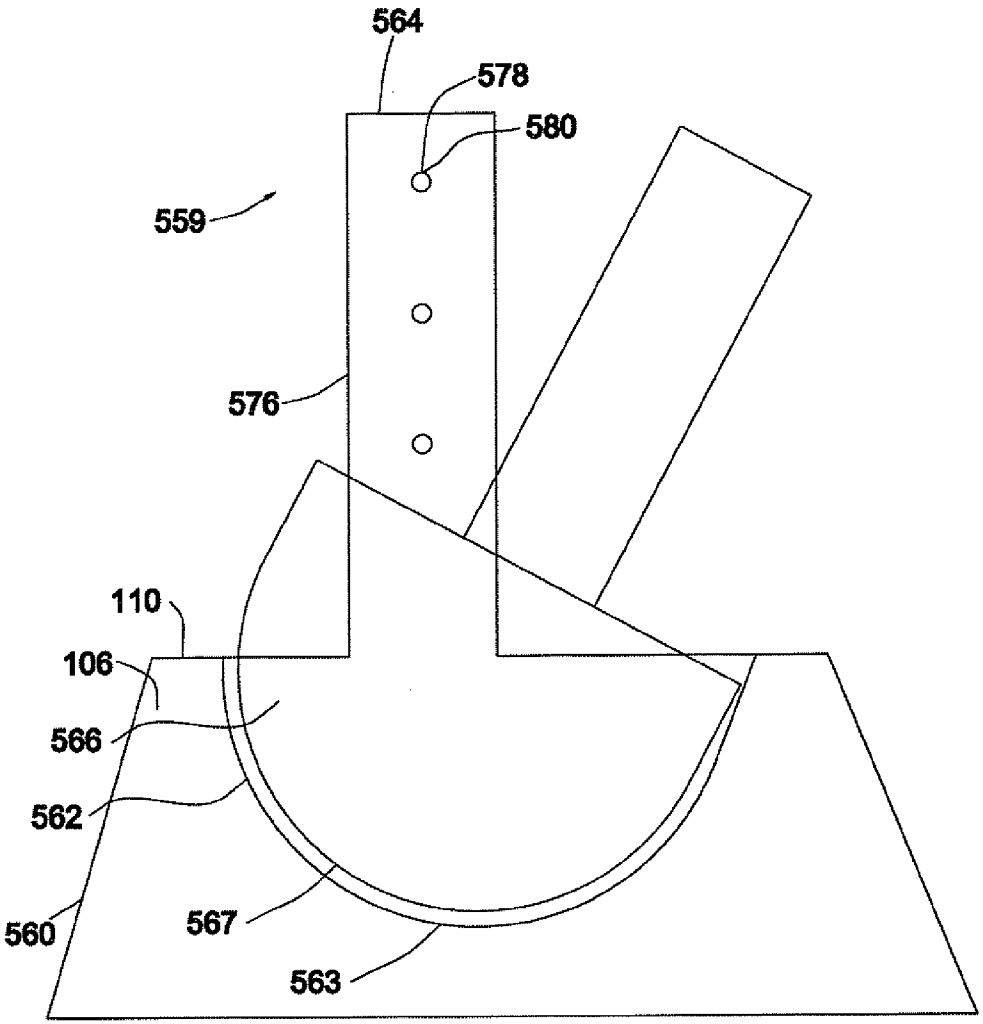
FIG. 29 is a side sectional view showing a foundation and post assembly similar to the assembly of FIG. 28 where the configuration of the foundation recess and post base, as viewed from the side, are curved in one plane for rockability from front to rear of the assembly in accordance with certain principles of the invention.

Referring to FIG. 29, an intermediate foundation/post assembly 559 includes a foundation 560 formed with a open-top recess 562, which is generally concave as viewed from the side of the foundation, with the recess being formed with a bottom 563. A post 564 is formed with a base 566 which, as viewed from the side thereof, is complementary to the side-view configuration of the recess 562, and is formed with a bottom 567, which does not extend to the bottom 563 of the recess 562. With this concave-like structure, the post 564 is allowed to rock from front to back with respect to the foundation 560.

Figure 30:
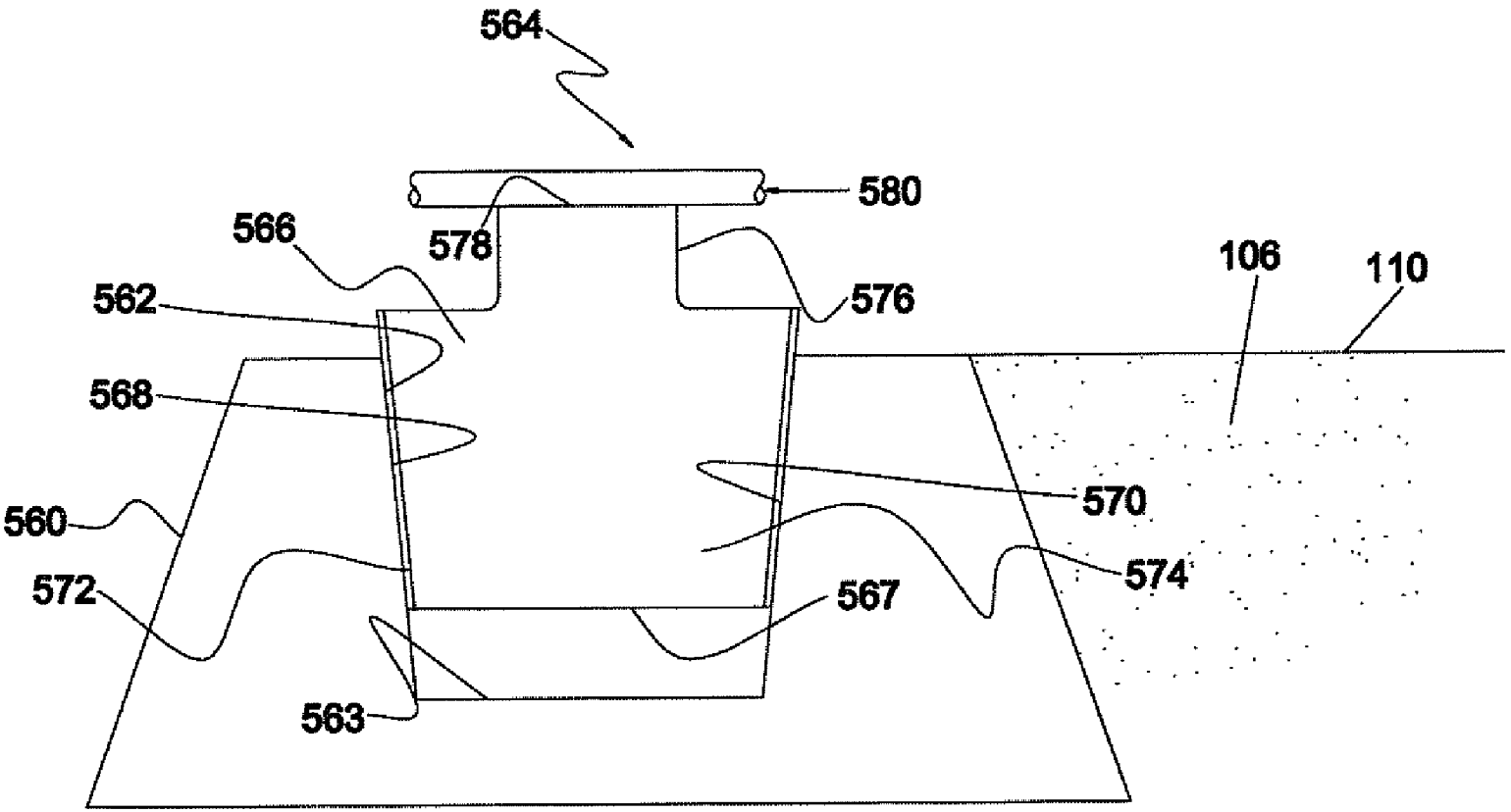
FIG. 30 is a front sectional view showing the foundation and post assembly of FIG. 29 where the configuration of the foundation recess and the post base, as viewed from the front, are tapered for wedging assembly in a non-rockable fashion from side to side in accordance with certain features of the invention.

As viewed in FIG. 30, from the front of the foundation 560 of FIG. 29, the open-top recess 562 is formed with inwardly tapered, spaced, interfacing walls 568 and 570 from the bottom 563 to the top thereof. Also, as viewed from the front in FIG. 30, the base 566 of the post 564 is formed on opposite sides thereof with inwardly tapered walls 572 and 574, from top to bottom thereof which are complementary to the tapered walls 568 and 570 of the recess 562. With this structural arrangement, the base 566 is wedged in the recess 562, with the bottom 567 of the base 566 being spaced above the bottom 563 of the recess 562. With this wedging structure, the post 564 is precluded from moving from side to side relative to the foundation 560.

The post 564 is formed with a beam 576 which extends upward from, and integrally with, the base 566. A plurality of through openings 578 are formed through the beam 576 to provide passage for tension cables 580 therethrough.

Figure 31:
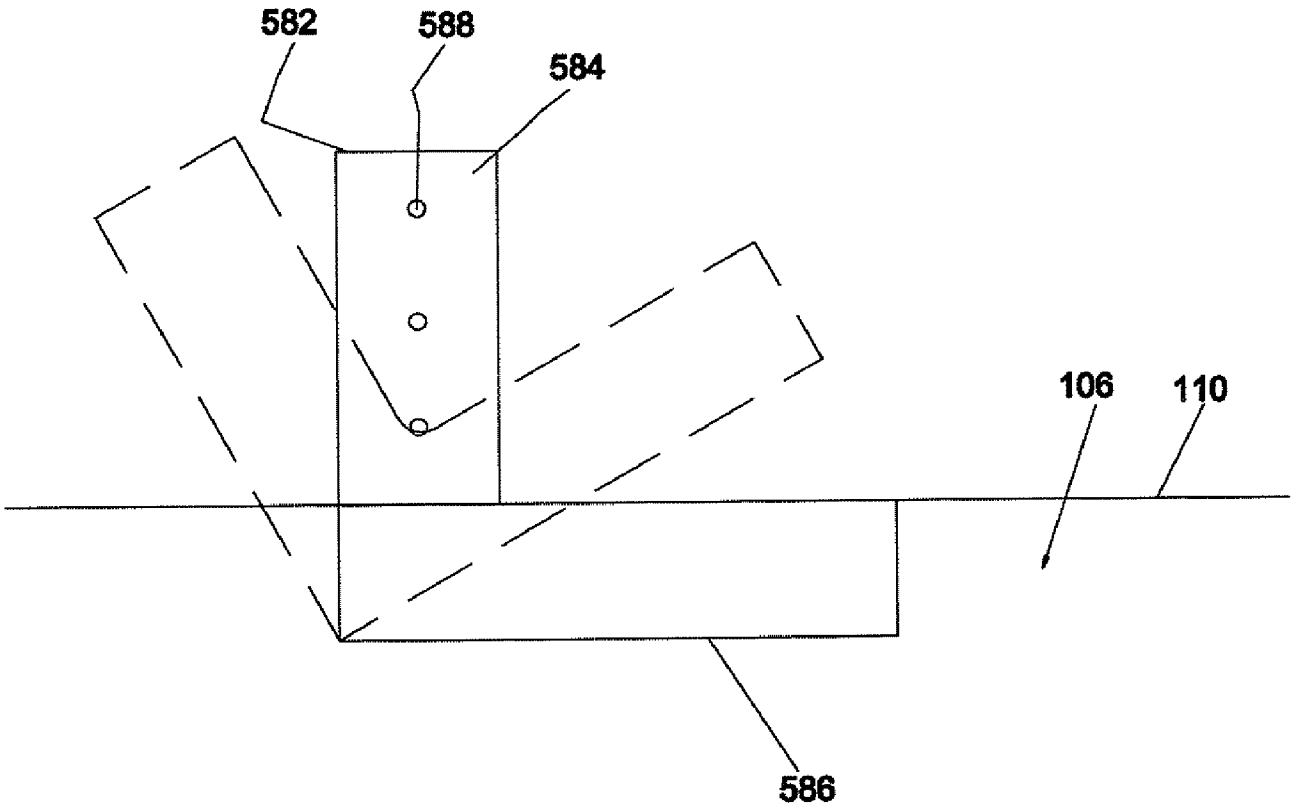
FIG. 31 is a side view showing an integral post and foundation formed in an "L" shaped configuration in accordance with certain principles of the invention.

Referring to FIG. 31, an intermediate, L-shaped foundation and post assembly 582, which is similar to the assembly 186 shown in FIG. 6, includes a post 584 integrally formed with a foundation 586. The post 584 is formed with openings 588 for receipt of tension cables (not shown). When the post/foundation assembly 582 is assembled as a component of a barrier fence, the post 584 extends upward from the foundation 586, which is located in the soil 106 slightly below ground level 110.

When a vehicle impacts, and attempts to pass beyond, the tension cables, the cables are moved in the direction of travel of the vehicle whereby the posts 584 of two spaced post/foundation assemblies 582 are moved to position as shown in phantom in FIG. 31. At the same time, the foundations 586 of the two spaced post/assemblies 582 revolves partially to pivot the foundations 586 out of the soil 106 to the position shown in phantom. As the foundations 586 pivot out of the soil 106 to engage the under carriage of the vehicle, thereby elevating and lifting the vehicle upward from ground level 110, and preventing the vehicle from proceeding past the barrier fence.

Figure 32:
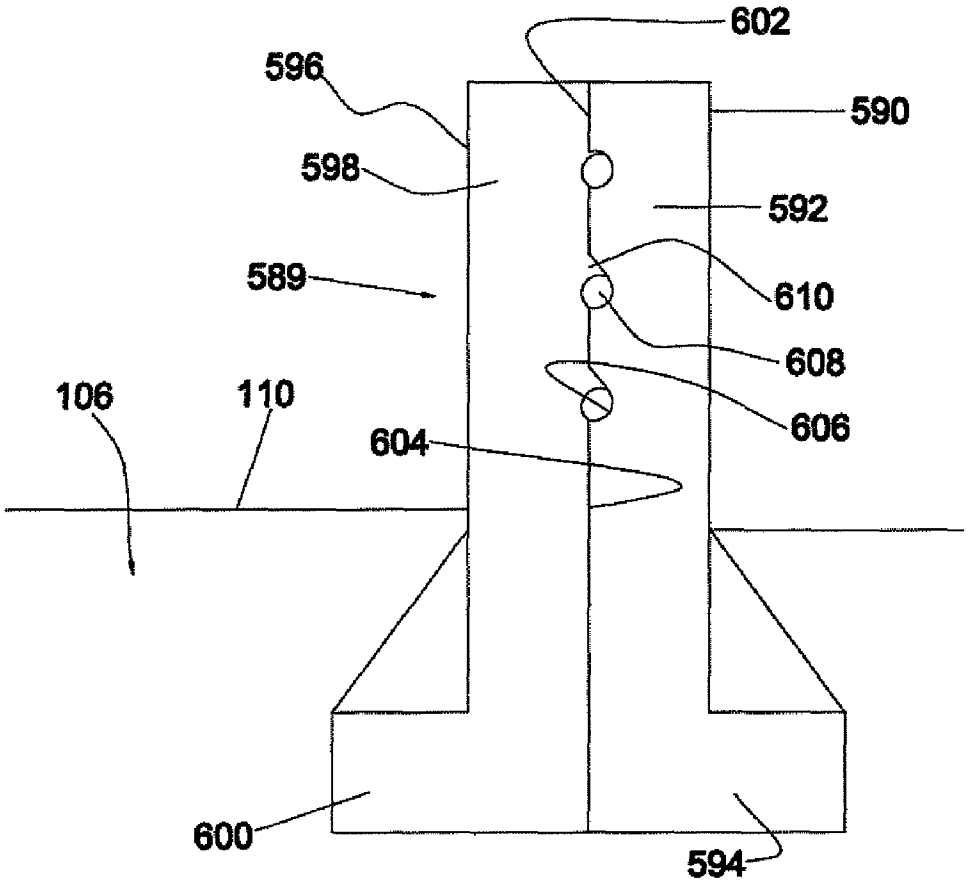
FIG. 32 is a side view of a two-part post and foundation assembly with a first post formed with spaced grooves and a second post formed with spaced ribs which enter the grooves to retain tension cables within the grooves in accordance with certain principles of the invention.

Another intermediate foundation and post assembly 589 is shown in FIG. 32, and includes a first L-shaped post/foundation unit 590. The unit 590 includes a post 592 formed integrally with a foundation 594, with the foundation and a lower portion of the post being in the soil 106 below the ground level 110. The assembly 589 further includes a second post/foundation unit 596, which is formed in a reverse-L-shaped configuration. The unit 596 includes a post 598 formed integrally with a foundation 600, with the foundation and a lower portion of the post being in the soil 106 below the ground level 110. An inward surface 602 of the first unit 590 is in interfacing engagement with an inward surface 604 of the second unit 596.

A plurality of spaced grooves 606 are formed in the surface 602 of the post 592 for receipt of tension cables 608. A corresponding plurality of spaced ribs 610 extend from the surface 604 of the post 598, partially into the grooves 606 to retain the tension cables 608 within the grooves.

Figure 33:
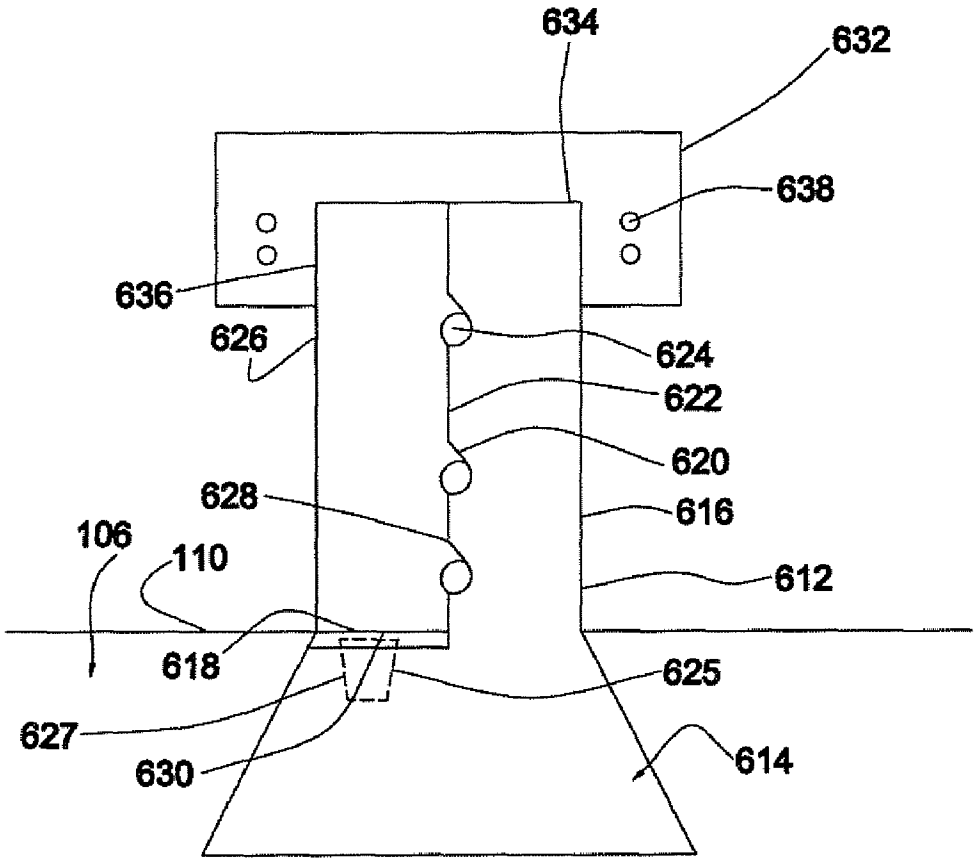
FIG. 33 is a side view of a post formed integrally with a foundation and having spaced grooves for receiving tension cables with a cover positioned over the grooves and a cap placed over the top of the post and cover in accordance with certain principles of the invention.
Figure 34:
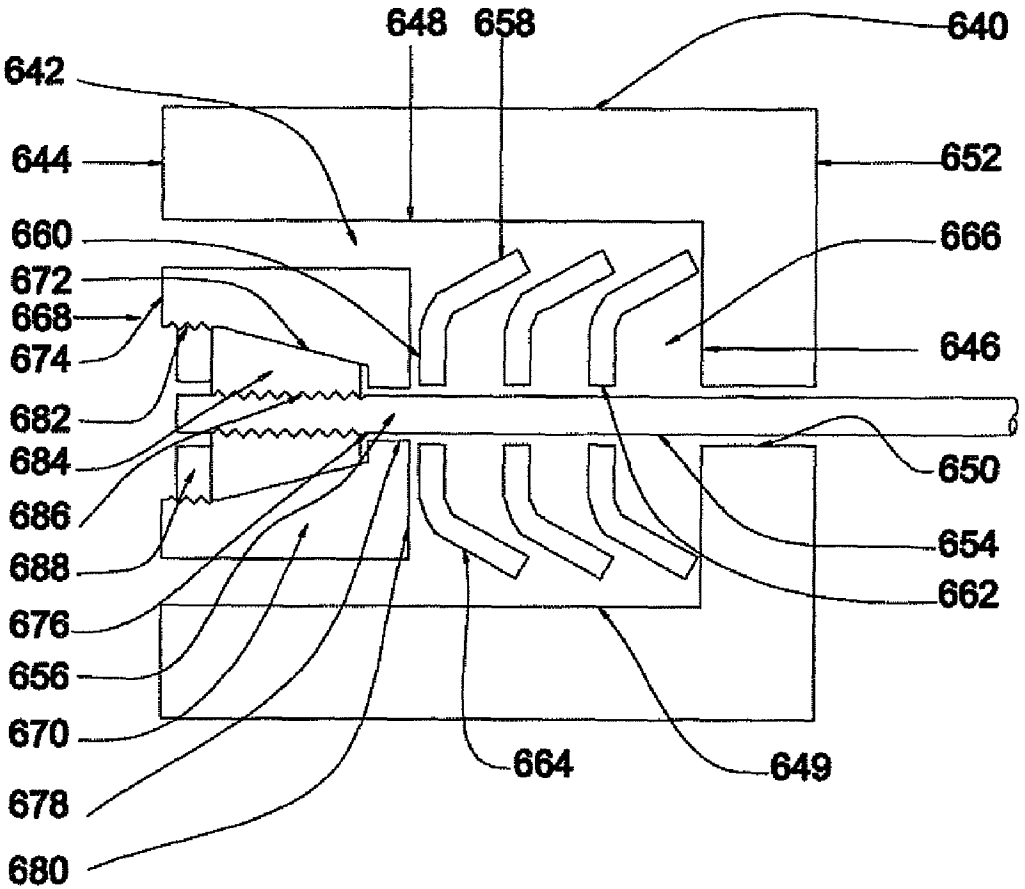
FIGS. 34 and 35 are sectional views showing an assembly of a tension cable extending through a post with an end of the cable supporting crushable elements between the post and an end cable clamp in accordance with certain principles of the invention.

With respect to the following description of the structures shown in FIGS. 33 and 34, it is noted that the bottom of the structure shown in FIG. 33 overlaps the top of the structure shown in FIG. 34. It is to be understood that the illustrations of FIGS. 33 and 34 relate to two different and distinct structures, and the overlapping portions of FIGS. 33 and 34 are not intended to show that there is any connection between the two structures.

As shown in FIG. 33, an intermediate foundation and post assembly 612 is formed with a foundation 614, which is located within the soil 106, and a post 616 extending upward from the foundation. The foundation 614 is also formed with a shelf 618, which is generally planar with the ground level 110 of the soil 106. A plurality of spaced grooves 620 are formed in an inward surface 622 of the post 616 for receipt of tension cables 624. A side cover 626, or side cap, is formed with a flat inward surface 628, which interfaces with the inward surface 622 of the post 616 to cover the plurality of grooves 620 and thereby retain the tension cables 624 within the grooves.

In a first embodiment of the side cover 626, the cover is formed with a flat bottom surface 630, which is located and supported on the shelf 168 of the foundation 614. In a second embodiment of the side cover 626, a bucket-shaped bore 625 is formed in the shelf 618 of the foundation 614, and a bucket-shaped projection 627, having a shape complementary to the shape of the bore, is formed on, and extends downward from, the bottom surface 630 of the side cover 626. In assembly, the projection 627 is located within the bore 625 to preclude lateral shifting of the bottom of the side cover 626 relative to the foundation 614.

A cap 632 is formed with a recess 634 in the underside thereof. The recess 634 is formed with a continuous side wall 636, which is positioned over, and is generally in the configuration of, the exterior of the upper portions of the assembled post 616 and the side cover 626. With this complementary structure, and with respect to both the first embodiment and the second embodiment of the side cover 626, the cap 632 retains the side cover with the post 616. In addition, the cap 632 is formed with tie bars 638 to strengthen the cap.

Figure 34A:
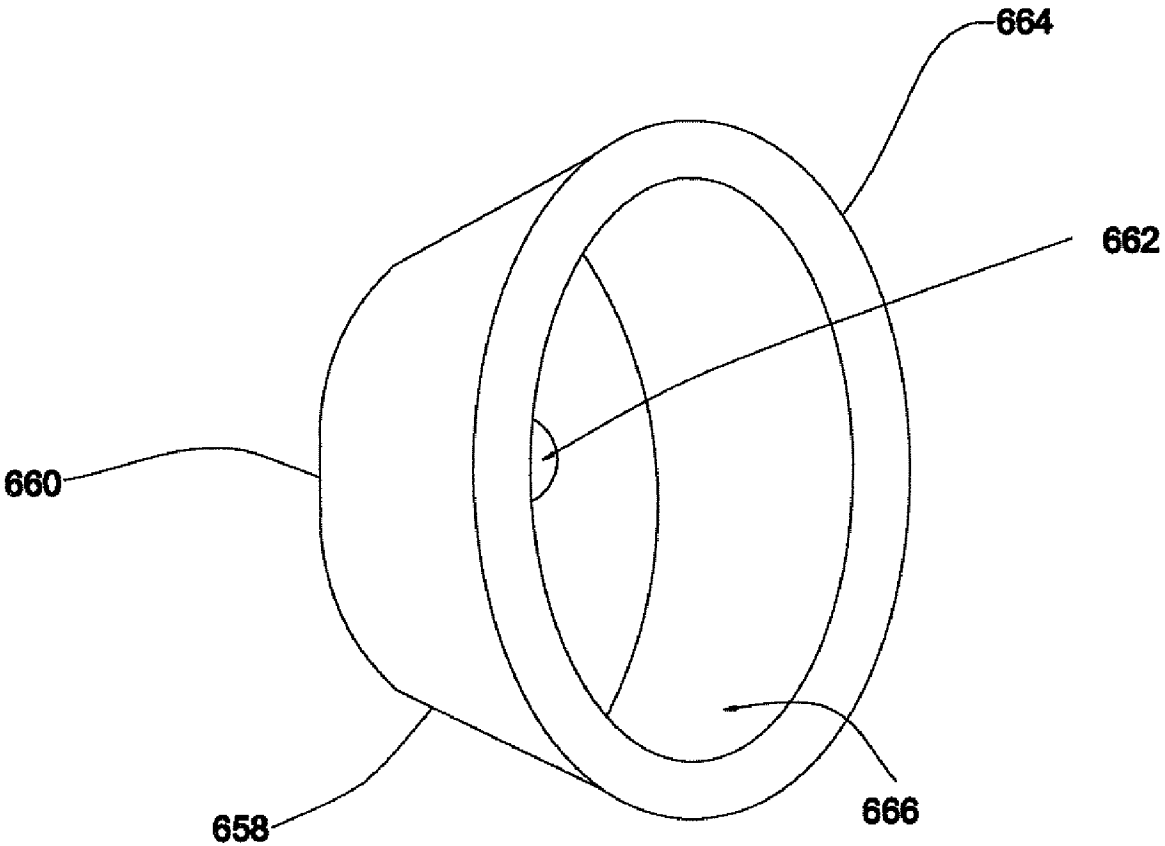
FIG. 34*a* is a perspective view showing a crushable element that may be used in at least one embodiment of energy absorbing means in accordance with certain principles of the invention.

Referring to FIGS. 34 and 34*a*, an end post 640, as viewed from a side thereof, is formed with a recess 642 in one side 644 of the post. The recess 642 is formed with a floor 646, and an upper wall 648 and a lower wall 649. It is noted that the recess 642 could also be formed with side walls, which, in combination with the upper wall 648 and the lower wall 649, form a continuous wall of the recess. The post 640 is also formed with a hole 650, which is in communication with the recess 642 and which extends through a portion of the post from the floor 646 of the recess to another side 652 of the post.

An intermediate portion of a tension cable 654 is located within the hole 650, and extends from opposite ends of the hole. An end portion 656 of the cable 654 extends from the hole 650, through the recess 642, and slightly out of the recess, where the cable is threaded. In an arrangement similar to that of FIG. 1, and with reference to FIG. 34*a*, each of a plurality of energy absorbers 658, which may be crushable elements composed of a ductile material, is formed in the configuration of the frustum of a cone, and is formed with a base 660 having an axial hole 662 extending through the base. Each of the plurality of energy absorbers 658 is formed with a continuous side wall 664 which tapers outwardly from the base 660 at a prescribed angle to define a recess 666.

The plurality of energy absorbers 658 are arranged in a stack, with the holes 662 thereof being aligned and positioned over the end portion 656 of the cable 654. In this arrangement, the recesses 666 of the stacked energy absorbers are facing toward the floor 646 of the post 640, with the open end of the innermost cup being located adjacent the floor. A cable clamp assembly 668 includes a clamping element 670, which is formed with a tapered-wall recess 672 in one end 674 thereof, and a recess floor 676. A hole 678 is formed through the element 670 between the floor 676 and another side 680 of the element. A portion 682 of the recess 672, which is contiguous with the one side 674, is also threaded. An externally tapered segment 684, which is in the configuration of the frustum of a cone, is formed with a hole 686 which includes at least one raised tooth to clampingly engage with the cable. A ring nut 688 is threaded on the peripheral surface thereof. This describes one such means of securing the end of a tension member. It should be noted that there are many suitable means that are within the scope of the invention, including means that are well known in the art, to secure the end of the cable.

After the plurality of energy absorbers 658 have been stacked onto the cable 654, the clamping element 670 is placed over the cable to sandwich the energy absorbers between the clamping element and the floor 646 of the post 640. Thereafter, the tapered segment 668 is clamped onto a portion of the cable 654, and is moved snugly into the tapered recess of the element 670. The ring nut 688 is then threadedly assembled within the threaded portion 682 of the recess 672 of the element 670 to thereby retain the clamp assembly 668 in the assembled position, and to maintain the plurality of energy absorbers 658 in the stacked arrangement on the cable 654.

If an unauthorized vehicle attempts to proceed through a barrier fence with the plurality of energy absorbers 658, the cable 654 is pulled in a direction, which results in the clamp assembly 668 being moved farther into the recess 642 of the post 640. As the clamp assembly 668 is moved farther into the recess 642, at least some of the energy absorbers 658, if not all, will be crushed to absorb the energy resulting from the moving vehicle engaging the cable 654. In this manner, as clamping means 668 moves over a distance within recess 642, impeded by energy absorbers 658, the vehicle is decelerated over a period of time. The longer the distance clamping means 668 moves within the recess, the longer the period of time in which the vehicle is decelerated. Increasing the distance within the recess, and, coordinately, the period of time in which the vehicle is decelerated will, in turn, lower the force necessary to decelerate the vehicle, which in turn reduces the force applied to the cable. In this manner, the vehicle may be prevented from moving through the barrier fence.

To return the barrier fence to a vehicle-impediment mode, the clamp assembly 668 is removed from the end of the cable 654, the crushed energy absorbers 658 are removed, the cable 654 is retensioned, another plurality of energy absorbers 658 are installed, and the clamp assembly is repositioned to retain the newly-installed energy absorbers within the recess 642 of the post 640.

Figure 35:
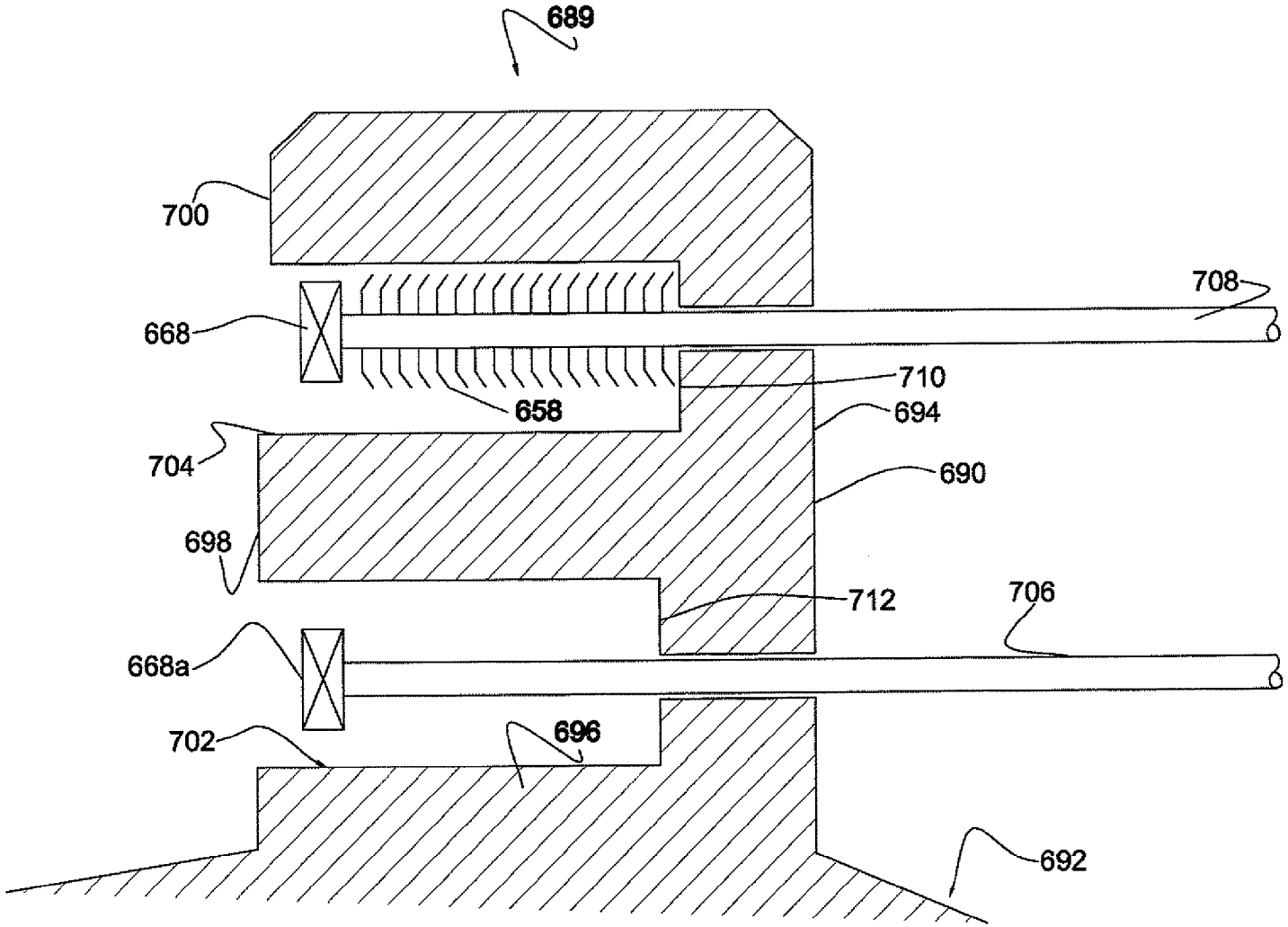

Referring to FIG. 35, in an arrangement similar to that of FIG. 34, an end foundation and post assembly 689 includes a post 690, which is formed integrally with a foundation 692, and which is also formed with a beam 694 and three spaced arms 696, 698 and 700, extending laterally from the beam. Openings 702 and 704 are formed by the spacing of the arms 696, 698 and 700. End portions of a pair of tension cables 706 and 708 extend through spaced openings formed in beam 694, and into respective ones of the openings 702 and 704. Respective sets (one shown) of a plurality of the energy absorbers 658 (FIG. 34) are stacked on the tension cables 706 and 708, and are held in place by respective cable clamp assemblies 668 and 668*a*.

While the energy absorbers 658 are shown only in opening 704 between the cable clamp 668 and a base floor 710 of the opening 704, a similar stack of the energy absorbers also would be placed over the tension cable 706 in the opening 702, and are captured between a cable clamp 668*a* and a base floor 712 of the opening 702. When a moving unauthorized vehicle engages the tension cables 706 and 708, the cables are pulled to the right, as viewed in FIG. 35, whereby the cable clamp assemblies 668 and 668*a* are moved farther into the respective openings 702 and 704. The energy absorbers 658, in each of the openings 702 and 704, are thereby squeezed and some, if not all, of the energy absorbers are crushed to bear the brunt of the forces resulting from the vehicle engaging the tension cables 706 and 708. The crushed energy absorbers 658 are replaced with uncrushed energy absorbers, as described above, when the barrier fence is to be restored to the vehicle-impediment state.

Figure 36:
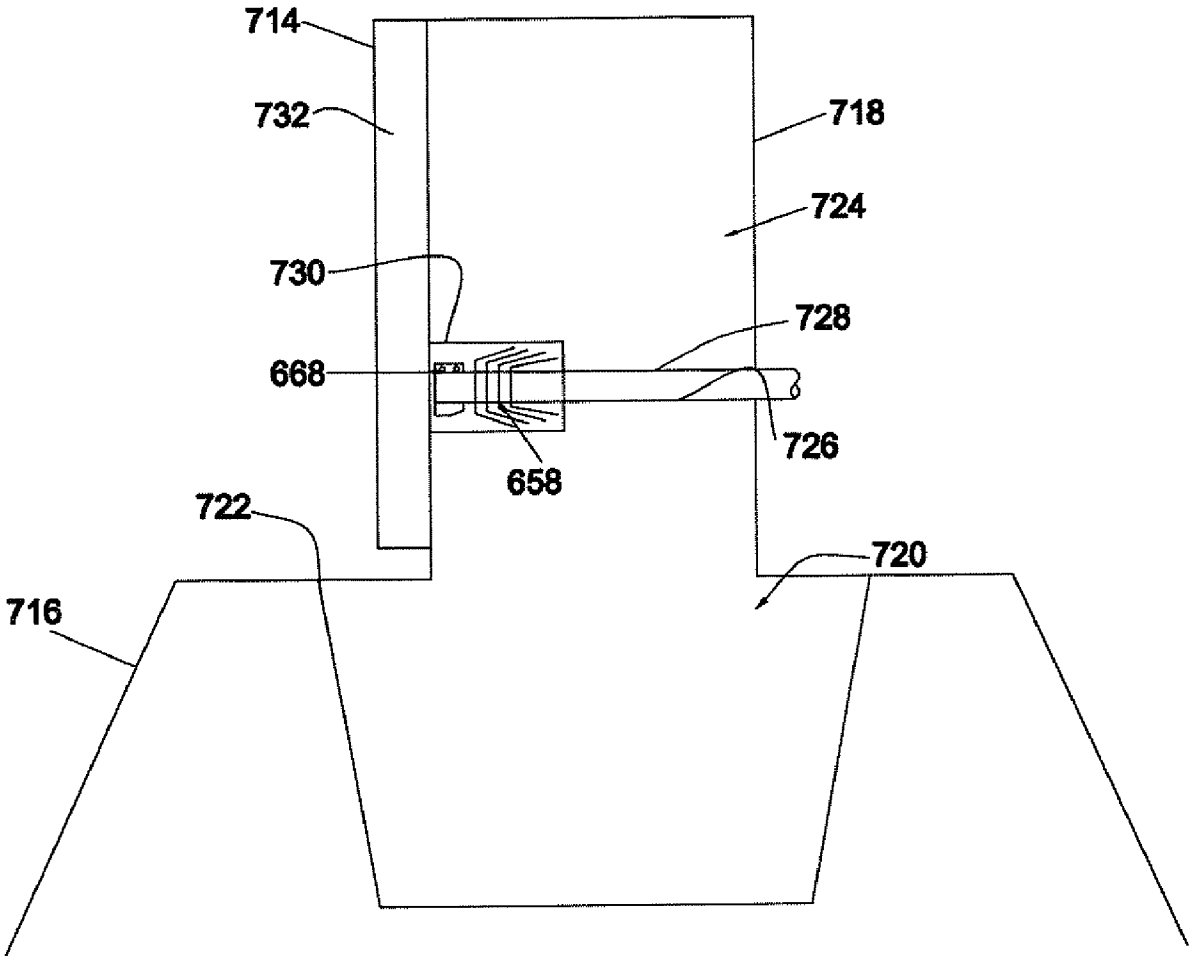
FIG. 36 is a sectional view showing a post and tension cable assembly with crushable elements over an end of the cable located within a recess in the post with a cover over the recess in accordance with certain principles of the invention.

Referring to FIG. 36, an end foundation and post assembly 714 includes a foundation 716 and a post 718, with a base 720 of the post wedged in a recess 722 of the foundation. A beam 724 of the post 718 is formed with an opening 726, in which the end of a tension cable 728 is located. In a manner similar to that illustrated in FIG. 35, the energy absorbers 658 are positioned about the end of the tension cable 728, and are located within an opening 730 formed in the beam 724. The cable clamp assembly 668 is attached to the end of the cable 728. Further, a cover 732 is held against one wall of the beam 724 to cover the opening 726.

When an unauthorized vehicle attempts to pass through the barrier fence, which includes the end foundation/post assembly 714, the vehicle engages and stretches the tension cable 728, whereby some or all of the energy absorbers 658 are crushed to absorb the energy resulting from the vehicle engaging the tension cable.

Figure 37:
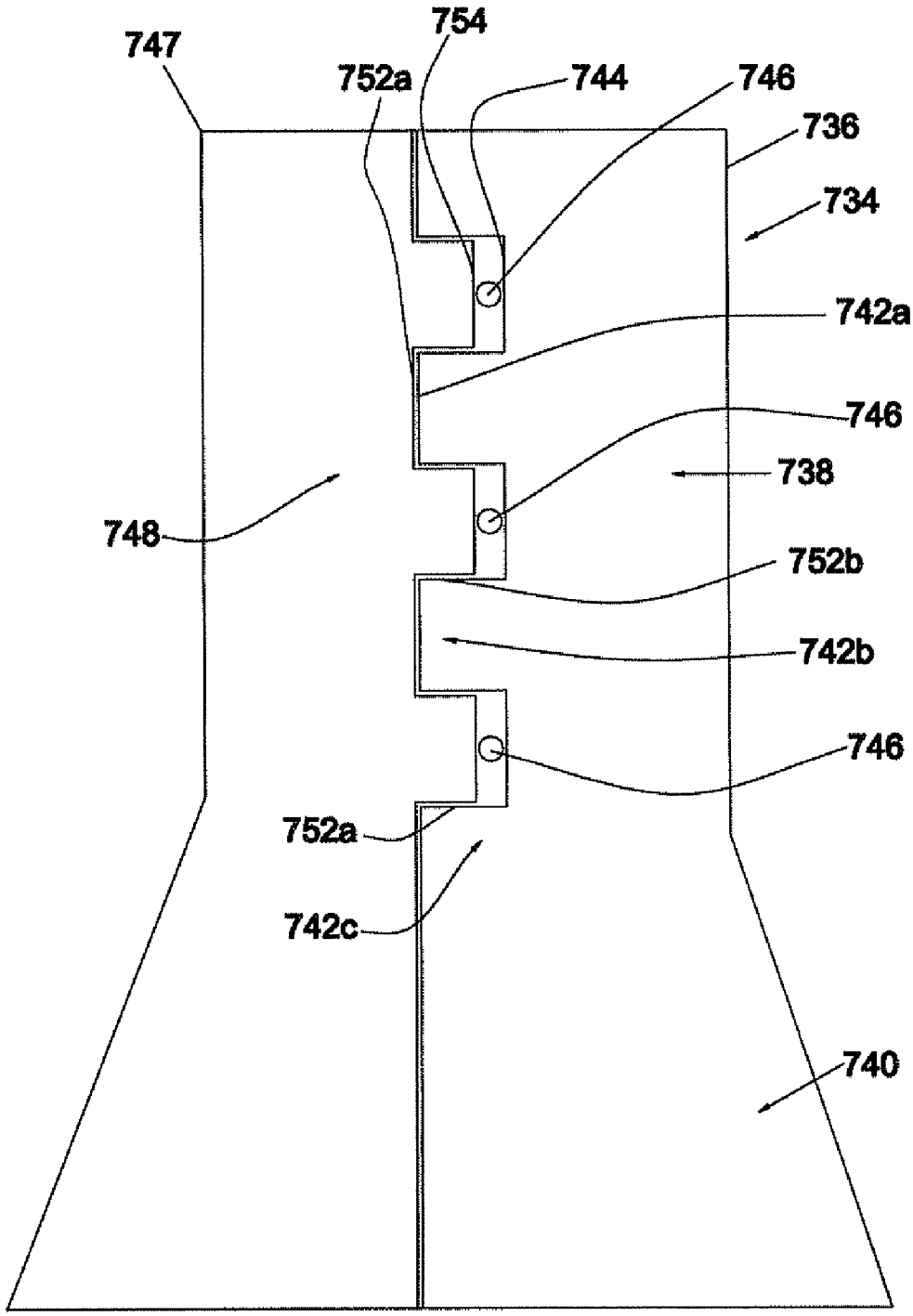
FIG. 37 is a side view and FIG. 38 is a front sectional views showing two post sections combinable to form a post with three shear elements extending from one face of a first of the post sections and into accommodating recesses formed in a second of the post sections and a tension cable threaded around the shear elements in a serpentine fashion, similar to the arrangement shown in FIG. 26, in accordance with certain principles of the invention.

As shown in FIG. 37, an intermediate foundation and post assembly 734 includes a first unit 736 having a beam 738 and an integral foundation 740, with three vertically-spaced projections 742*a*, 742*b* and 742*c* extending from one wall 744 thereof.

Figure 38:
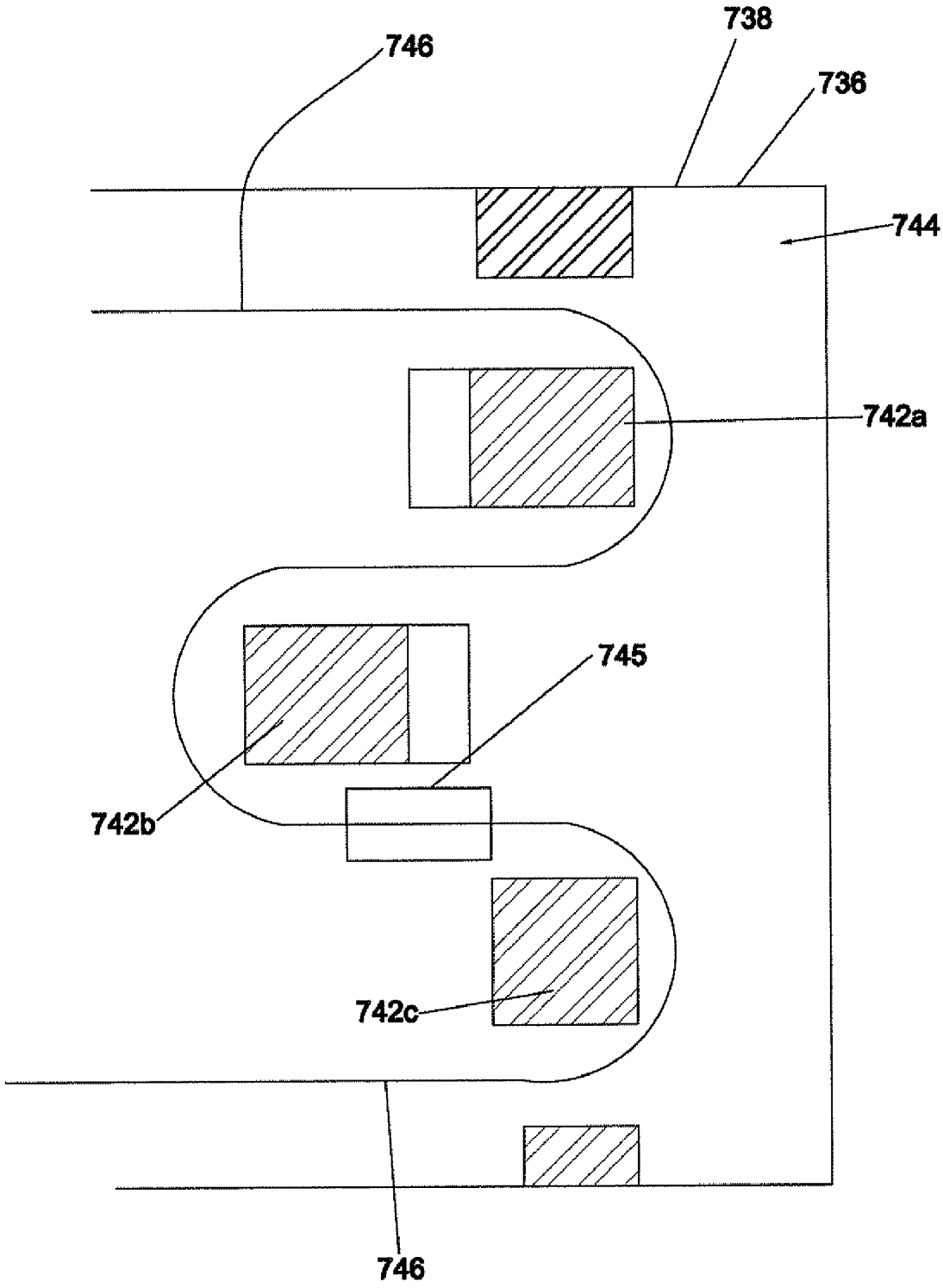

Referring to FIG. 38, the projections 742*a* and 742*c* are vertically aligned, and the projection 742*b* is offset from vertical alignment with the projections 742*a* and 742*c*. A single tension cable 746 is placed about the projections 742*a*, 742*b* and 742*c* in a serpentine fashion. If desired, the tension cable 746 can be formed by two tension cables, the ends of which can be connected by use of a cable coupler 745 to effectively provide a single strand.

Referring again to FIG. 37, the assembly 734 further includes a second unit 747 having a beam 748 and a foundation 750, with spaced recesses 752*a*, 752*b* and 752*c* formed in one wall 754 of the beam in a pattern for partial receipt of respective projections 742*a*, 742*b* and 742*c*. As shown in FIG. 37, the depth of the recesses 752*a*, 752*b* and 752*c* is less than the distance the projections 742*a*, 742*b* and 742*c* extend from the wall 744 to allow the cable 746 to be retained between the walls 744 and 754.

When an unauthorized vehicle engages the tension cable 746, the cable is stressed about the projections 742*a*, 742*b* and 742*c*, whereby one or more of the projections break away from the beam 736 to absorb the energy resulting from the vehicle engaging the cable. The assembly 734 can be restored to the vehicle-impediment mode by replacing the first unit 736, with the broken projections 742*a* 742*b* and 742*c*, with a unit having unbroken projections.

It is noted that the structure described above, with respect to FIGS. 37 and 38, could be formed between panels (not shown) which extend between space foundation and post assemblies.

Referring to FIGS. 39, 39*a*, 40 and 40*a*, an "I" beam 756 of a foundation and post assembly 758 is formed in an "I" shaped cross section, including flanges 760 and 762 at opposite ends of a linking web 764. A plurality of panels 766 are arranged between spaced assemblies 758, and can be formed with different end structures to fit into a space 768 between the flanges 760 and 762 of the "I" beam 756, and adjacent the web 764. For example, the panels 766 could be formed with convex ends 770, which allow the panel ends to be mounted in the space 768 to follow the sloping topography of the ground level 110 (FIGS. 39 and 39*a*), offset spaced beams 756 (FIG. 40), and aligned beams (FIG. 40*a*) on level or sloping topography. The beam 756 could be formed with pockets (not shown) which are formed in the side of the beam, in place of the continuous space 768. The end 770 of each of the panels 766 would then be placed in a respective pocket.

Figure 41:
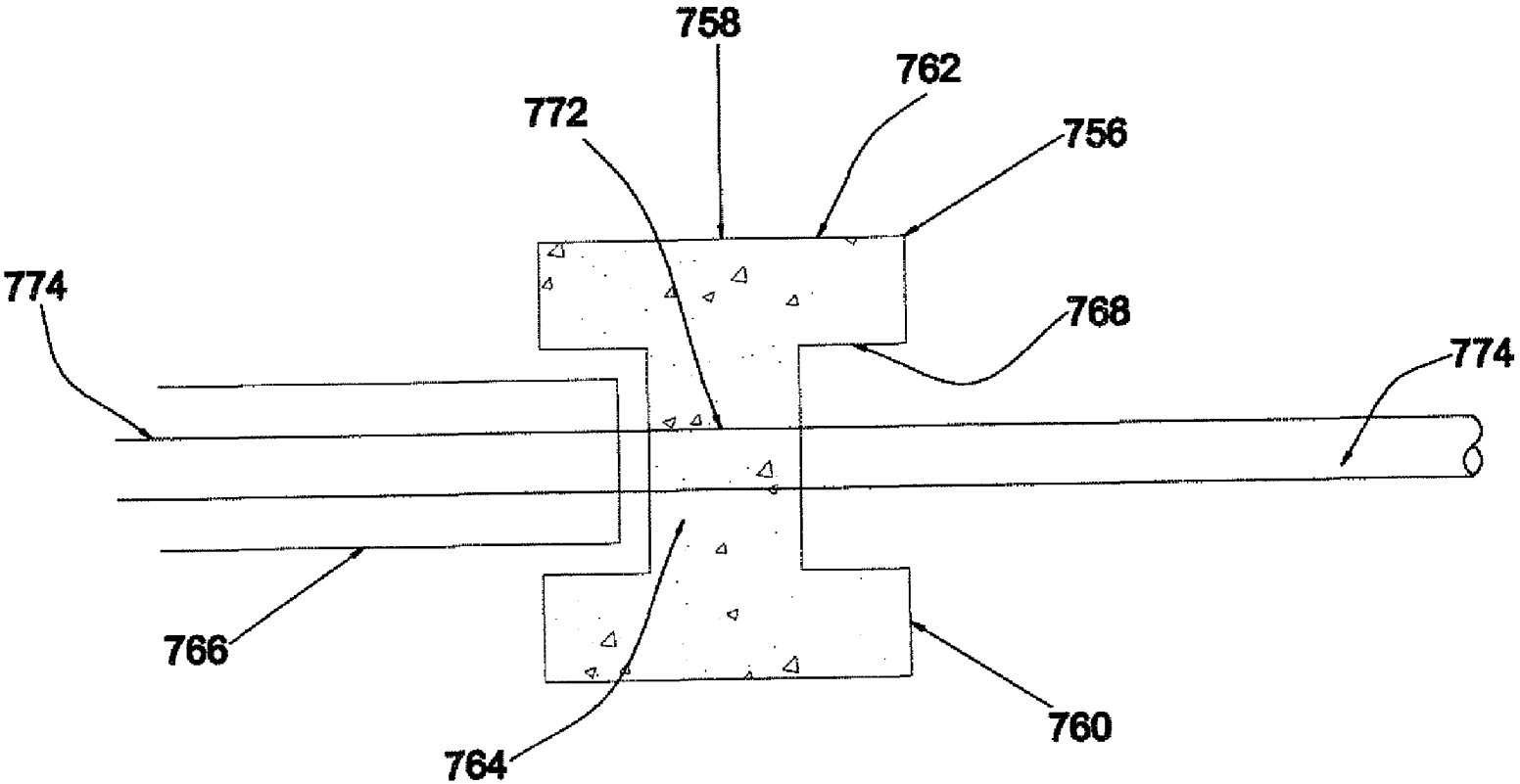

As shown in FIG. 41, the web 764 of the "I" beam 756 is formed with a through passage 772 for receipt of a tension cable 774, which also extends through the panel 766. The exterior of the panels 766 can be formed decoratively to enhance the aesthetics of a barrier fence which includes the panels. Also, the panels 766 can be formed of material which serves as a vehicle impediment of a barrier fence. Further, the panels 766 provide concealment for the tension cables 774, which could otherwise be unsightly if not concealed.

Figure 42:
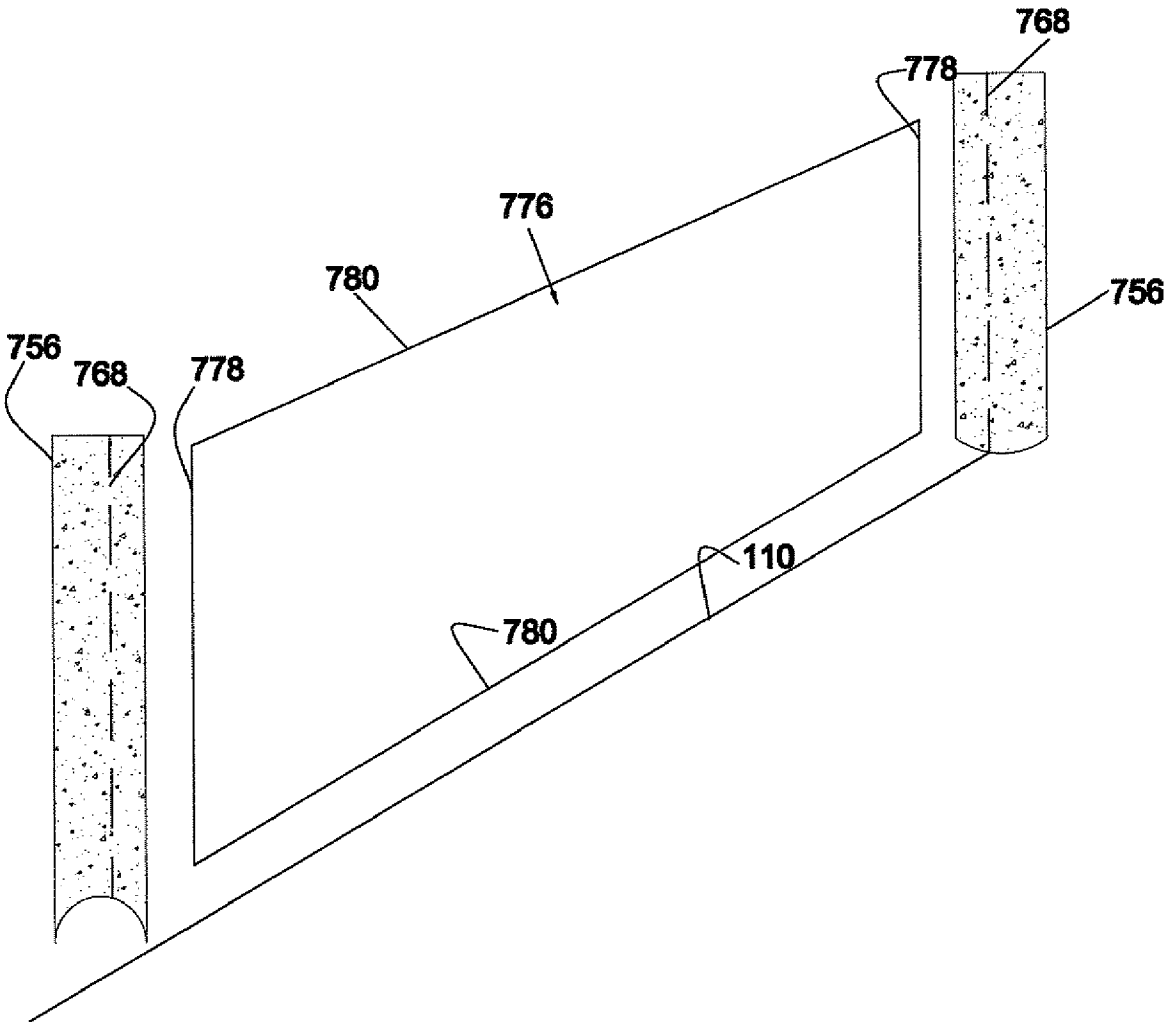
FIG. 42 is a front view showing a pair of spaced posts located on a sloped topography and a panel formed with angular end sections which fit into grooves of the posts in accordance with certain principles of the invention.

Referring to FIG. 42, a panel 776 is formed in the shape of a parallelogram, which results in vertical ends 778 of the panel, and angled sides 780. The vertical ends 778 of the panel 776 fit into the space 768 of spaced "I" beams 756, and the angled sides 780 follow the slope of the ground level 110.

Figure 43:
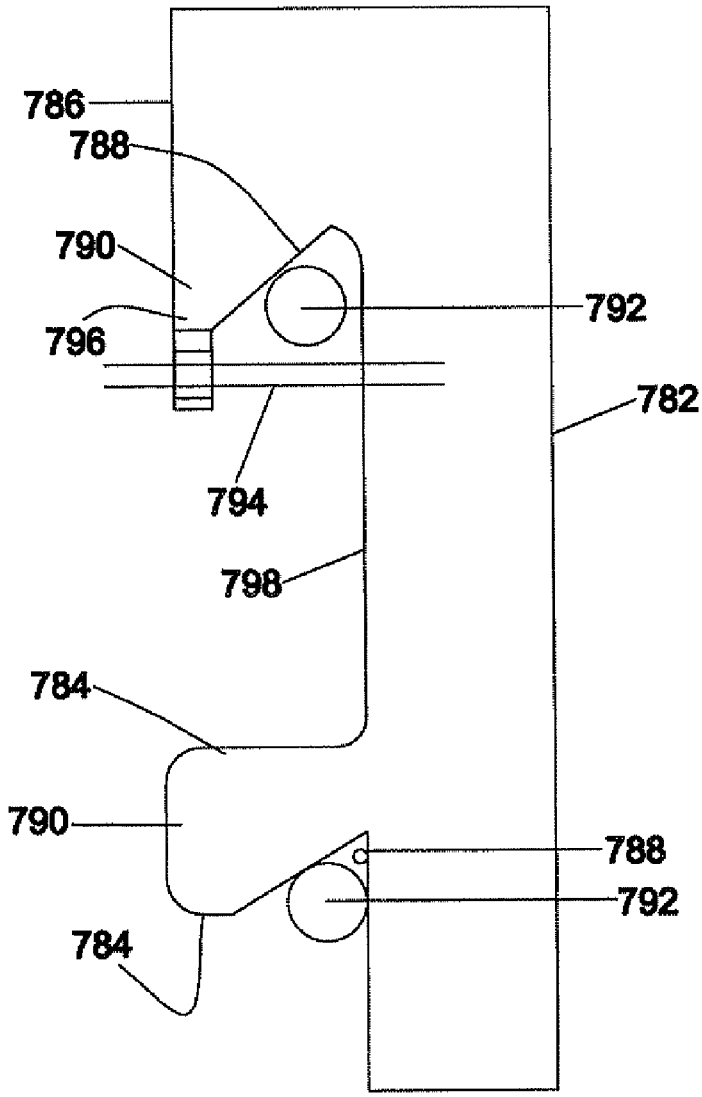
FIG. 43 is a sectional view showing a panel having a spaced horizontal rib extending from one face of the panel with a slot formed in the underside of the rib for receipt of a tension cable therein and a retainer pin or bolt secured under the slot in accordance with certain principles of the invention.

As shown in FIG. 43, a panel 782 is formed with a plurality of spaced recesses 784 are formed in an outer wall 786 of the panel. Each of the recesses 784 is formed upwardly with a pocket 788, which is in communication with the respective recess. An overhanging section 790 is thereby formed in the panel 782 between each of the pockets 788 and the wall 786 of the panel. Tension cables 792 are placed within, and strung along the length of respective ones of the pockets 788. Retainers 794, such as bolts or pins, are attached to a lower portion 796 of the overhanging sections 790 and an inward wall 798 of each of the recesses 784, to retain the tension cables 792 with the panel 782.

Figure 44:
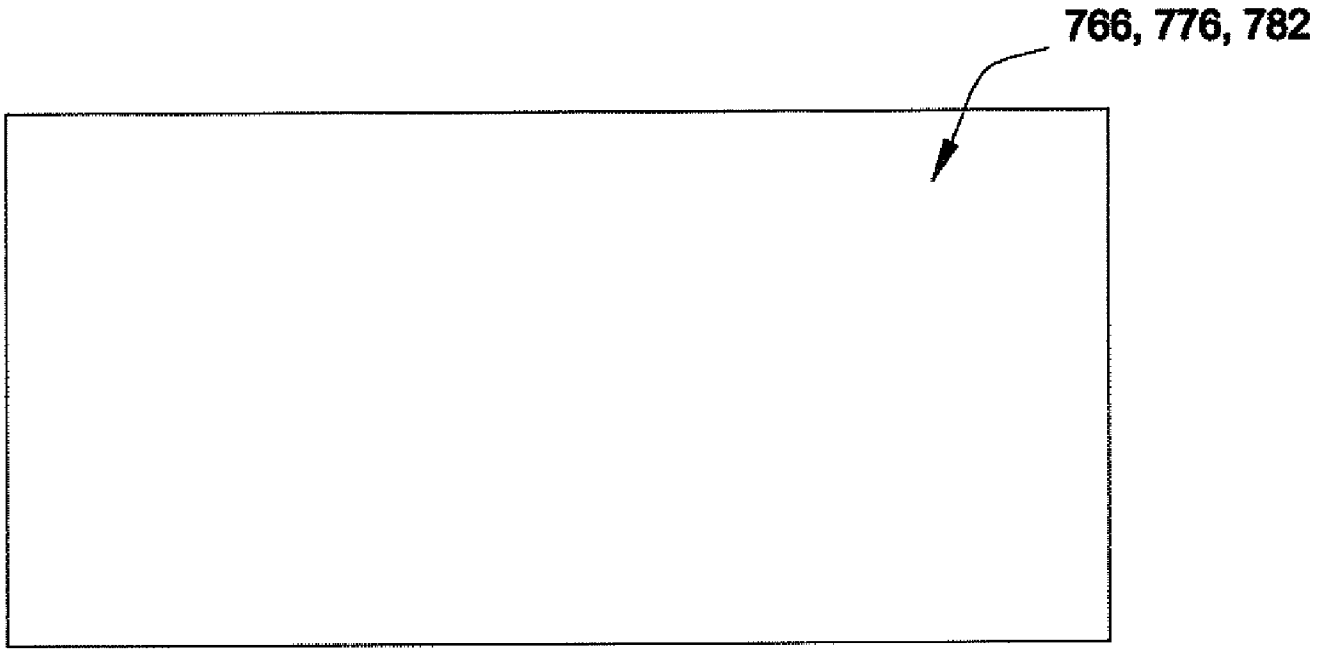
FIGS. 44 through 49 are front views showing different arrangements and surface treatment of panels used with barrier systems for decorative purposes in accordance with certain principles of the invention.
Figure 45:
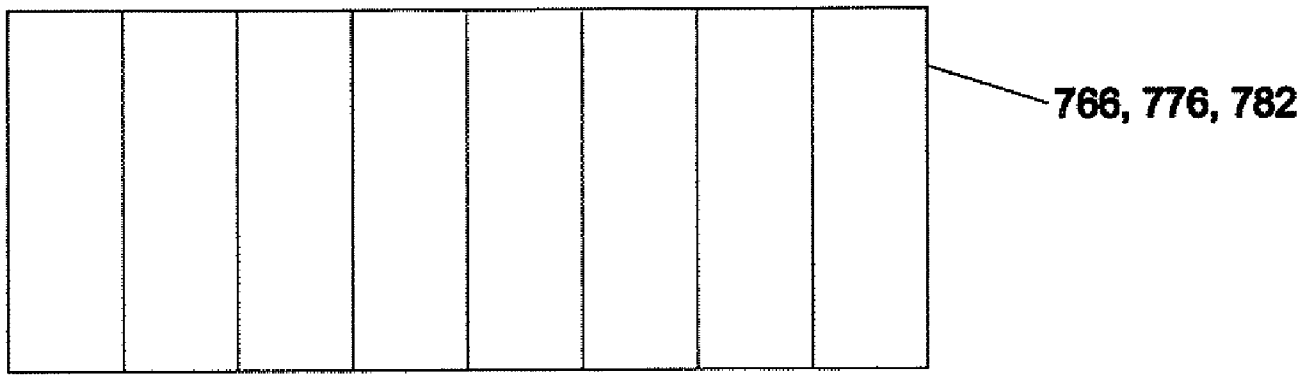
Figure 46:
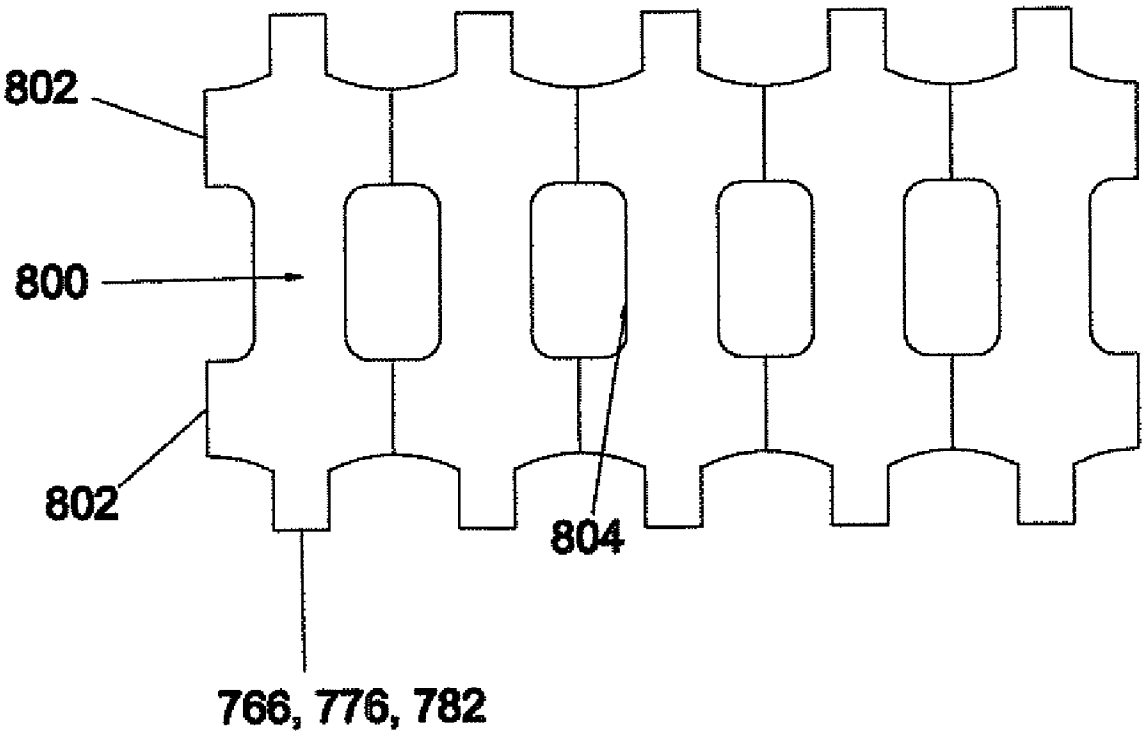
Figure 48:
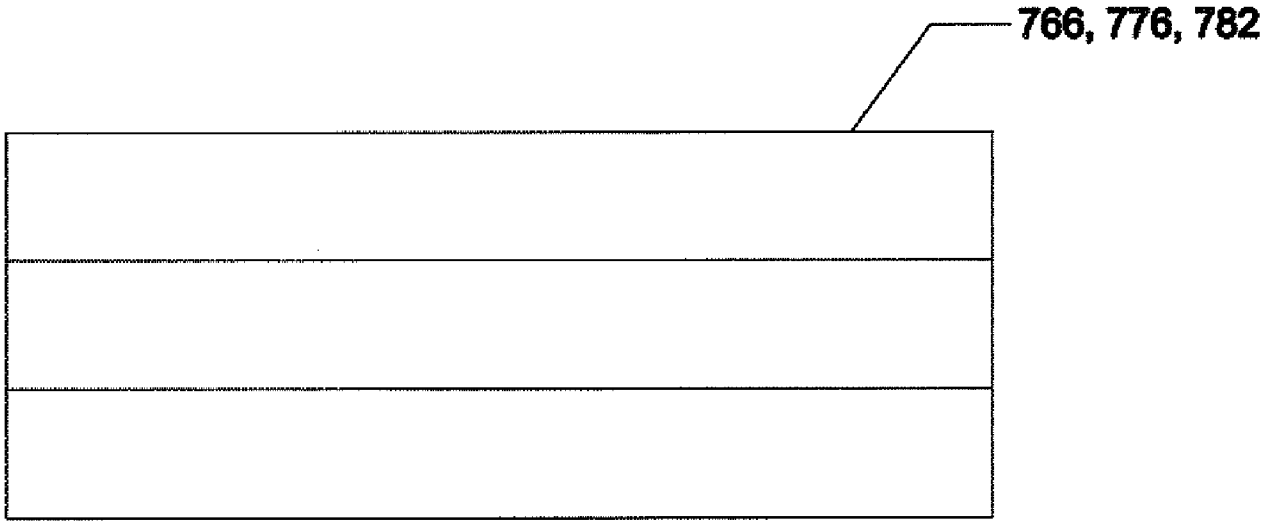

The panels 766 (FIG. 39), 776 (FIG. 42), and 782 (FIG. 43) could be surface treated and/or physically shaped to enhance the aesthetics of any barrier fence formed thereby. For example, referring to FIG. 44, the exterior surface of the panels 766, 776, and 782 could be textured, have graphic or textured designs, or be formed in attractive geometrical shapes. As illustrated in FIGS. 45 and 48, the panels 766, 776, and 782 could be arranged vertically or horizontally, respectively. As shown in FIG. 46, each of the panels 766, 776, and 782 could be formed with a vertical center section 800, and a plurality of spaced arms 802 extending horizontally from opposite sides of the center section.

Figure 47:
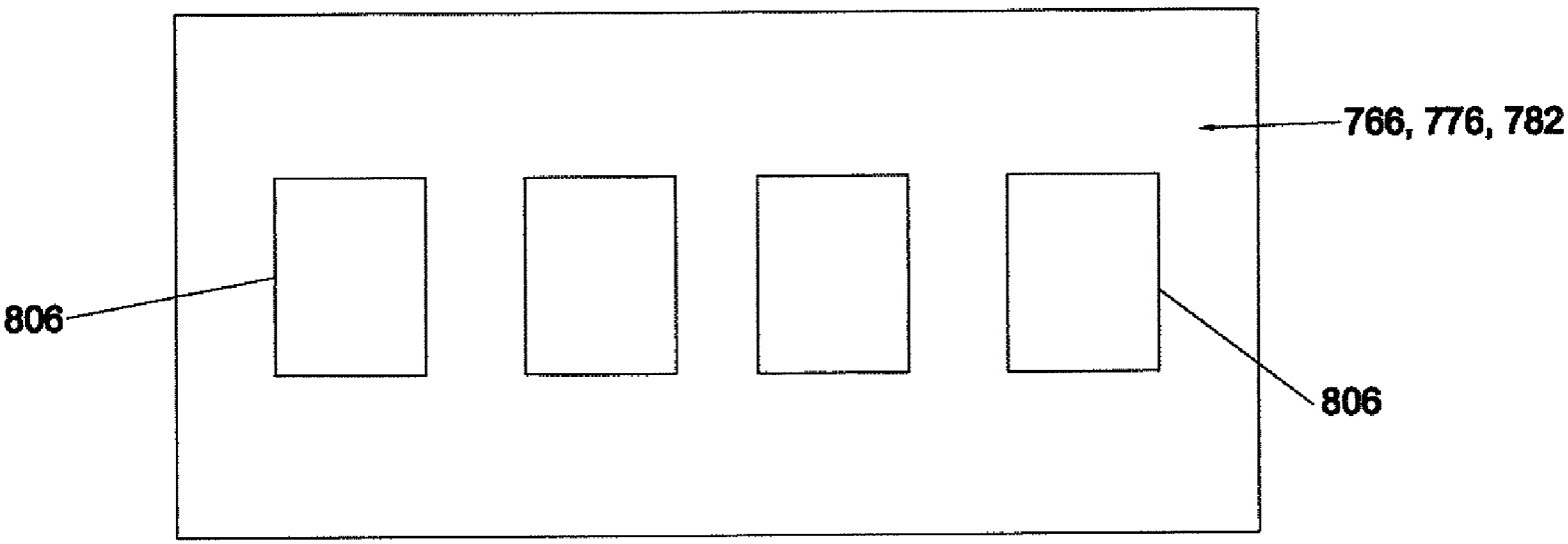
Figure 49:
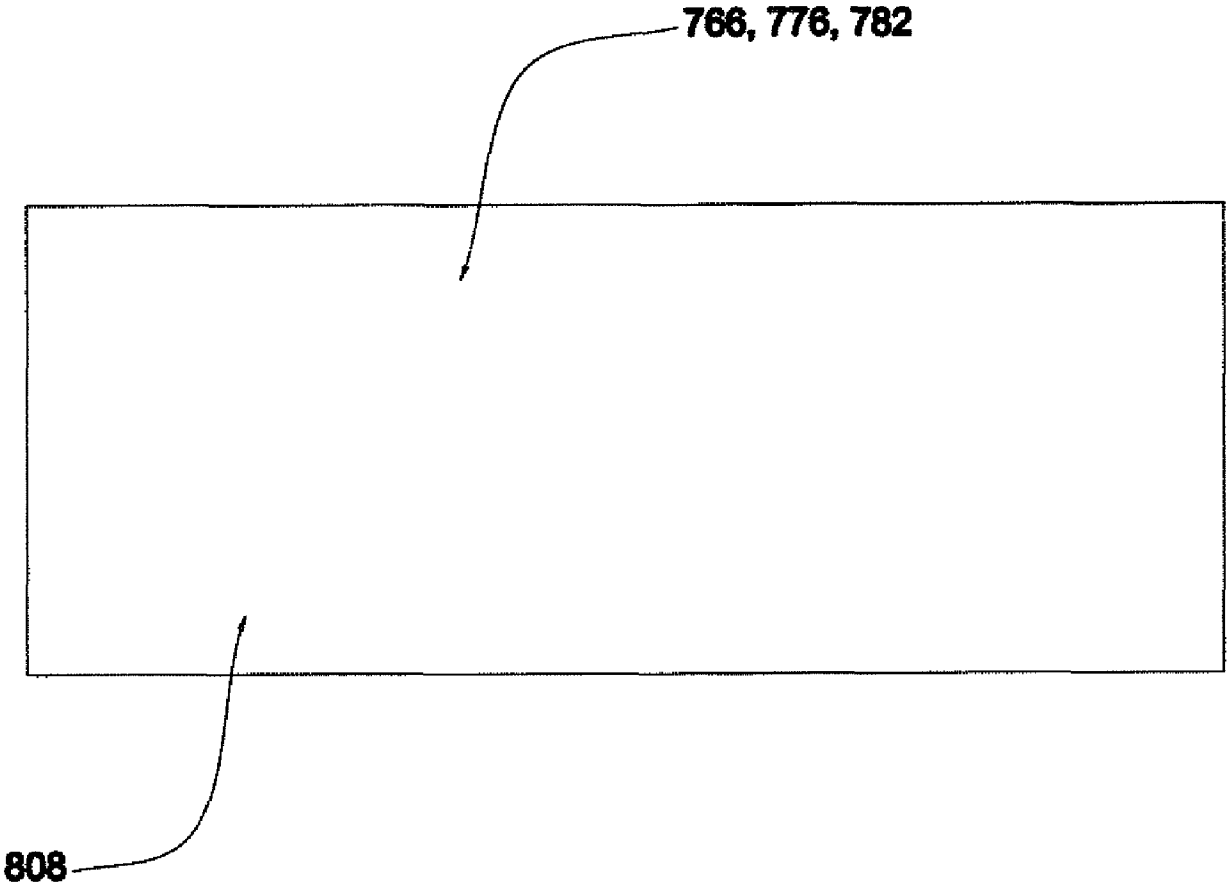
Figure 50:
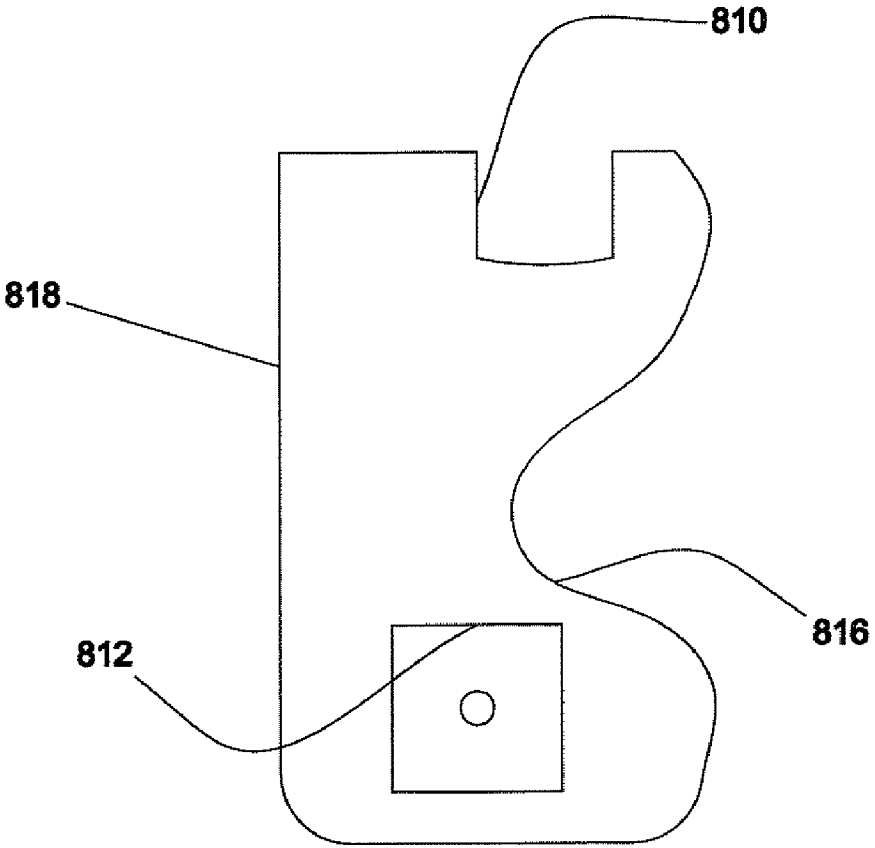
FIG. 50 is an end view showing a panel formed with a planter, a cable chase and a contoured front surface in accordance with certain principles of the invention.

The panels 766, 776, and 782 could then be assembled, as shown in FIG. 46, with the arms 802 of adjacent panels being in engagement to form openings 804 between the center sections 800 of the adjacent panels. As shown in FIG. 47, the panels 766, 776, and 782 could be formed with decorative patterns of through openings 806 of the same or alternating shapes. Referring to FIG. 49, the panels 766, 776, and 782 could be formed with an exterior surface 808, which is convex or concave. As shown in FIG. 50, an end view of the panels 766, 776, and 782 reveals a recess 810 in the top of the panels, which can be used as a planter; a through passage 812 which forms a chase for tension cables and/or wires; and a profiled surface 816 or a flat surface 818.

Figure 51:
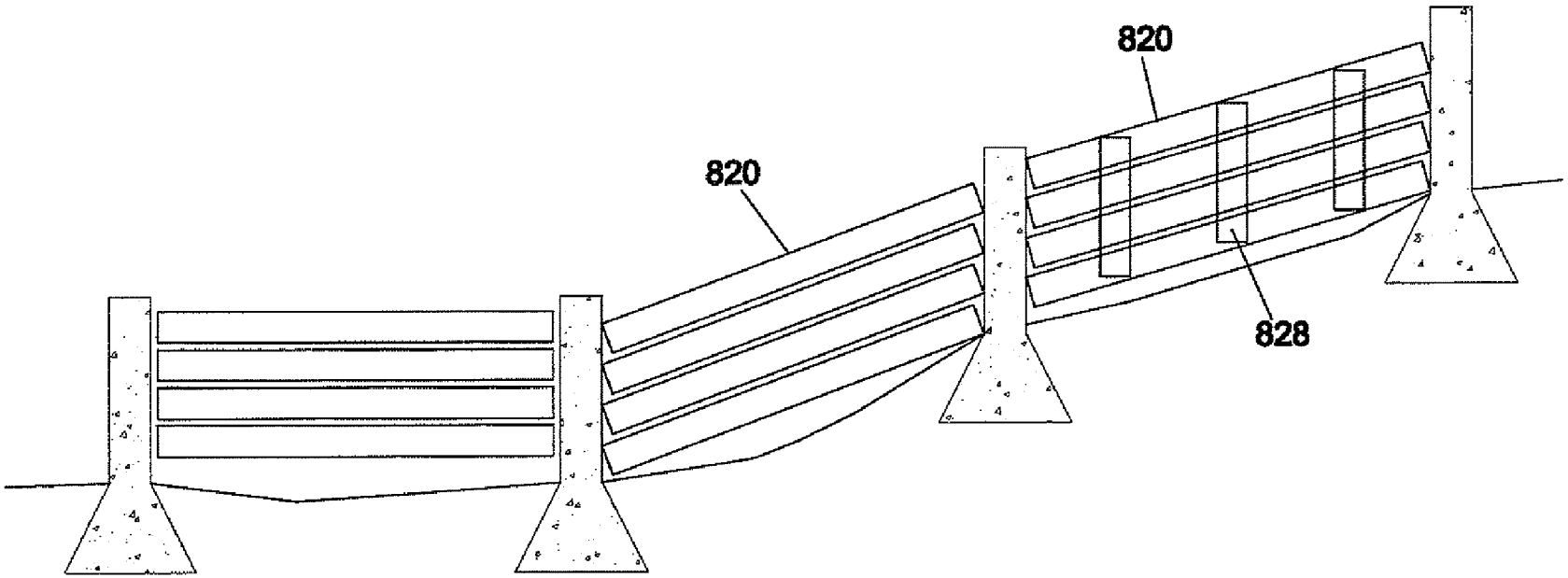
FIG. 51 is a front view of parallel panels mounted between a pair of posts and held together by retainer straps in accordance with certain principles of the invention.
Figure 52:
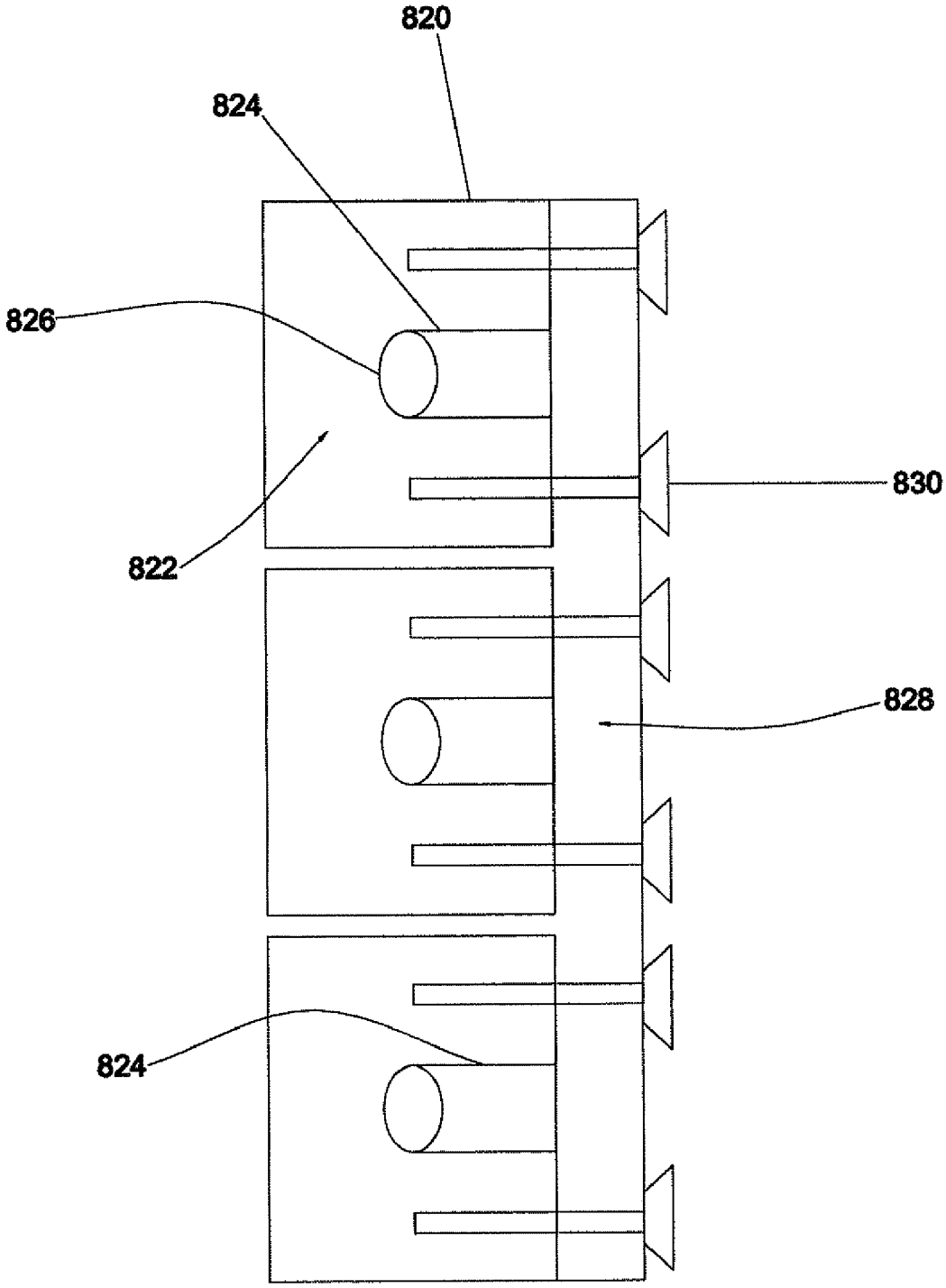
FIG. 52 is a sectional view showing the assembled panels and one retainer strap of FIG. 51 with anchor devices securing the strap with the panels in accordance with certain principles of the invention.

Referring to FIGS. 51 and 52, each of a plurality of panels 820 formed, in part, by a rail 822 with a "C" shaped cross section. The "C" shaped cross section results in the formation of "C" shaped channels 824, which extend along the length of the rails 822 for receipt of tension cables 826 therethrough. The plurality of panels 820 are completed by a retainer strap 828, which is placed over the openings of the "C" shaped channels 824, thereby covering the openings to retain, and conceal, the tension cables 826 within the channels. The retainer straps 828 are attached to the rails 822 by the use of pins, bolts or anchors 830. It is noted that the retainer straps 828 could be a single strap which extends across all of the channel openings of the plurality of rails 822, or could be individual straps, with each of the straps being attached to a respective one of the plurality of rails.

Figure 53:
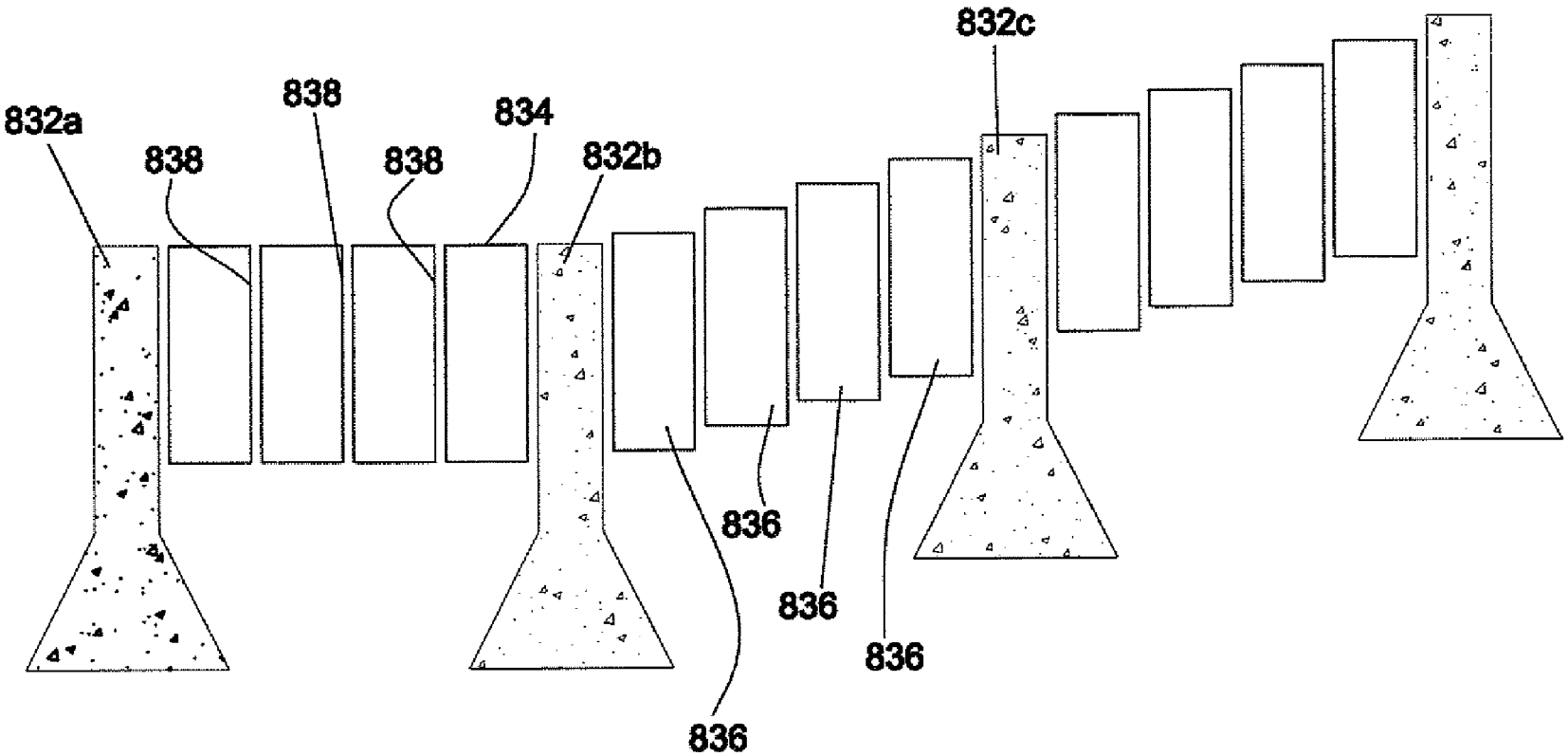
FIG. 53 is a front view showing a pair of posts, and a plurality of vertically oriented panels arranged in a stepped row between a pair of posts in accordance with certain principles of the invention.

As shown in FIG. 53, a plurality of posts 832*a*, 832*b*, and 832*c* are equally spaced (e.g., approximately eight feet apart) along the formation of a section of a barrier fence. Where there is no slope in the terrain, such as that between the posts 832*a* and 832*b*, a panel 834, formed with a width of eight feet, can be used between the posts 832*a* and 832*b*. Where there is a slope in the terrain, such as that between the posts 832*b* and 832*c*, four panels 836, each formed with a width of two feet, can be assembled in ascending fashion to accommodate the rise in that portion of the barrier fence due to the slope of the terrain. Note that the single panel 834 can be formed with three spaced vertical stripes or grooves 838. In effect, this provides an appearance that the single panel 834, having a width of eight feet, is formed by four separate panels, each having a width of two feet. This enhances the aesthetics of the barrier fence by establishing uniformity in appearance between the single panel 834 and the four separate panels 836.

Figure 54:
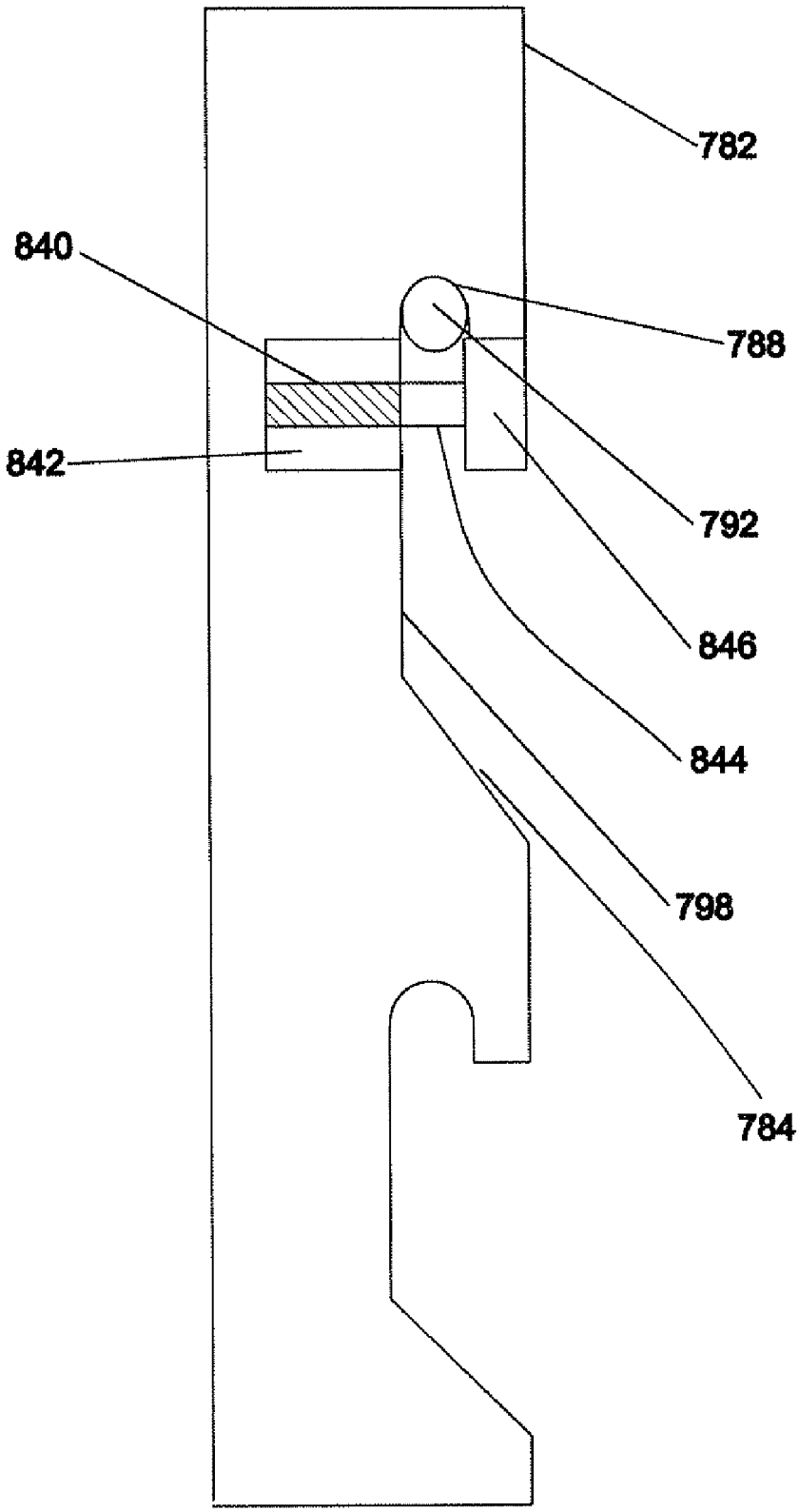
FIGS. 54 and 55 are sectional end views showing one of the plurality of panels of FIG. 51 with slots formed in each of the panels for receiving tension cables therein, and retention means under the slots in accordance with certain principles of the invention.

Referring to FIG. 54, in an end view of the panel 782 (FIG. 43), a pocket 840 is formed in the inner wall 798 of the recess 784. A concrete anchor 842 is mounted securely in the pocket 840, and a bolt 844 is driven into the concrete anchor to retain the tension cable 792 within the pocket 788. Also, the bolt 844 is formed with a tamper-proof head 846.

Figure 55:
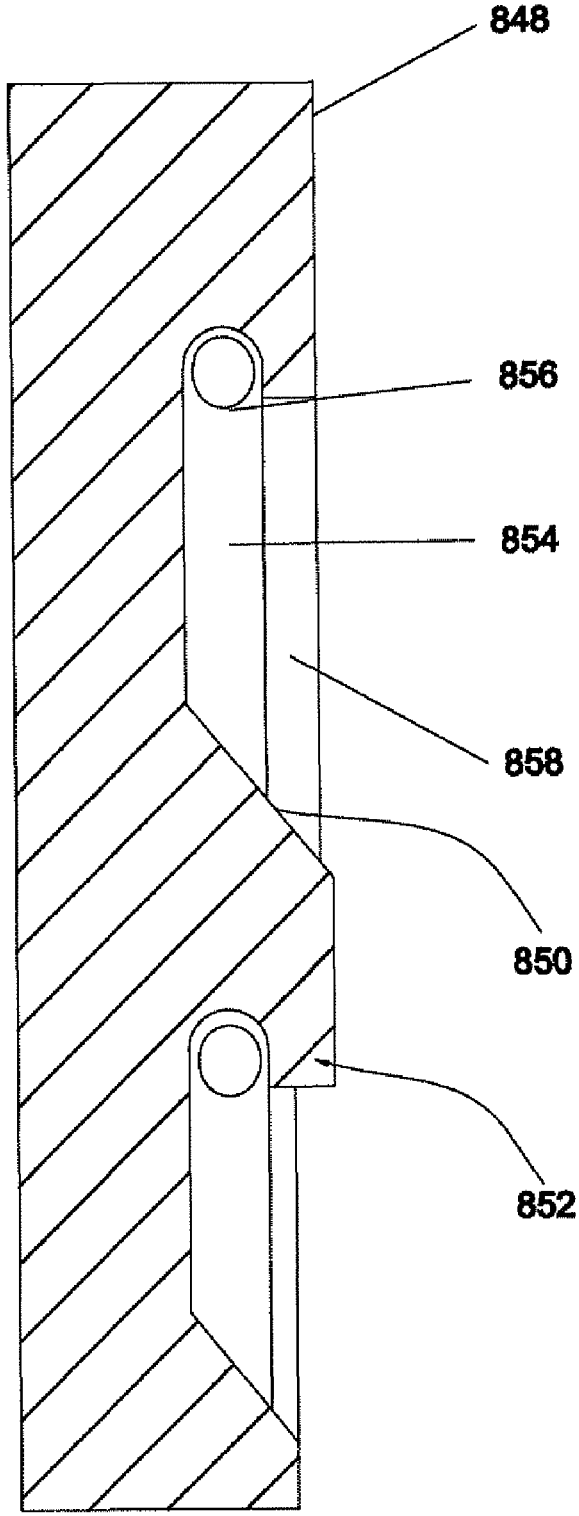

Referring to FIG. 55, in an end view of a panel 848, a recess 850 having opposed tapered walls is formed in one wall 852 of the panel. A pocket 854 is formed in the panel, upwardly from the recess 850, for receipt of a tension cable 856. A concrete retainer block 858 is formed with tapered sides, which are complementary to the tapered opposed tapered walls of the recess 850. The block 858 is inserted into the recess 850, and is held in place by a tamper-proof bolt, to retain the tension cables 856 within the pocket 854.

Figure 56:
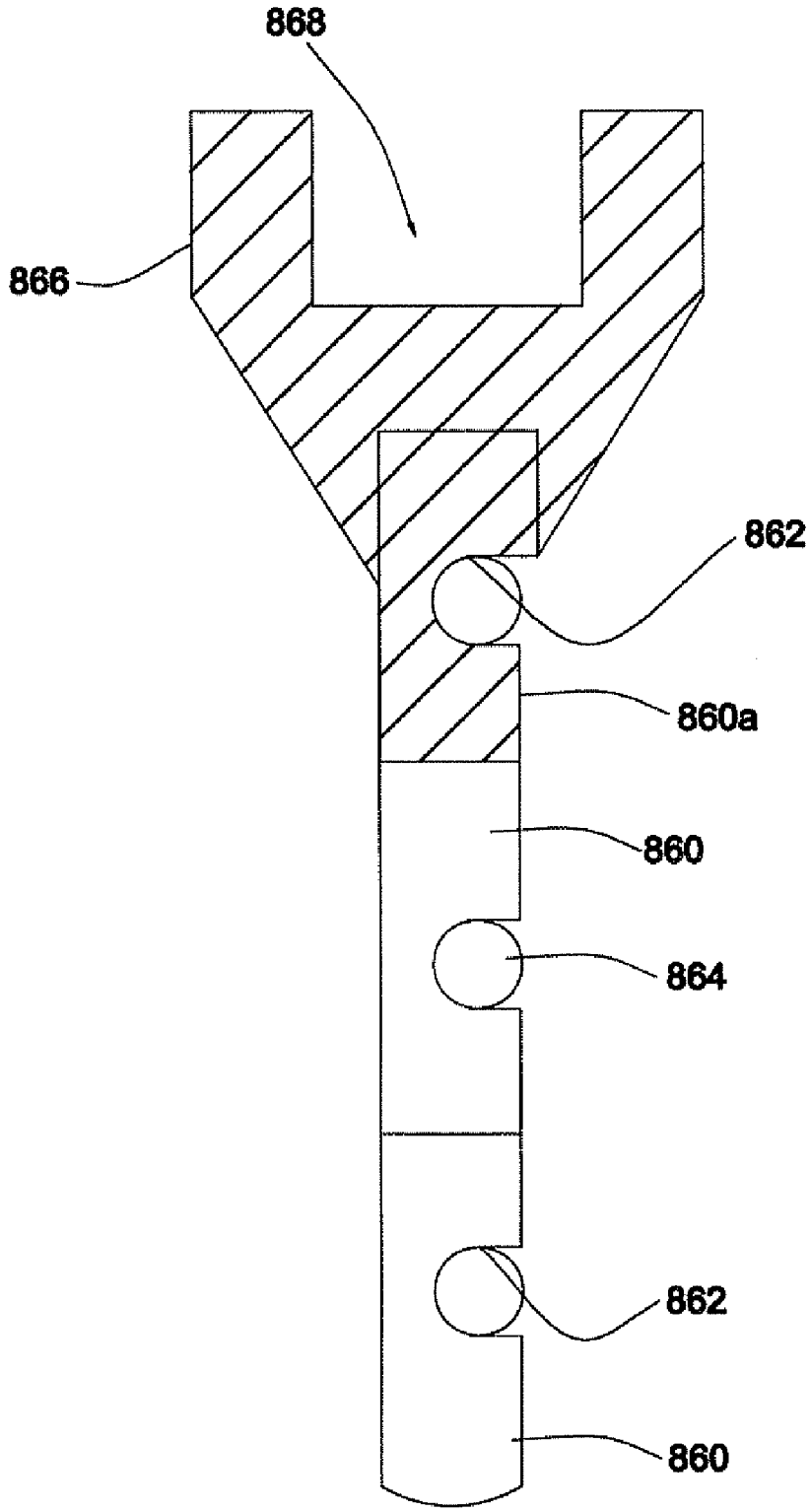
FIG. 56 is a side sectional view showing a plurality of stacked panel beams each of which is formed with a slot therein for receipt of a tension cable with the upper beam formed with a recess in the top thereof for receipt of a decorative plant in accordance with certain principles of the invention.

Referring to FIG. 56, in and end view, a barrier fence includes a plurality of panels 860, which are stacked for arrangement between spaced posts or beams (not shown). Each panel 860 is formed with a horizontal groove 862 on a common wall thereof for receipt of tension cables 864. The uppermost panel 860*a* is formed with a laterally enlarged top 866, and has a recess 868 formed therein, which extends from one end to the opposite end of the panel. The recess 868 can be used as a planter for aesthetic purposes. The illustration of FIG. 56 can also represent stacked sections of a post or beam, with a planter at the top.

Figure 57:
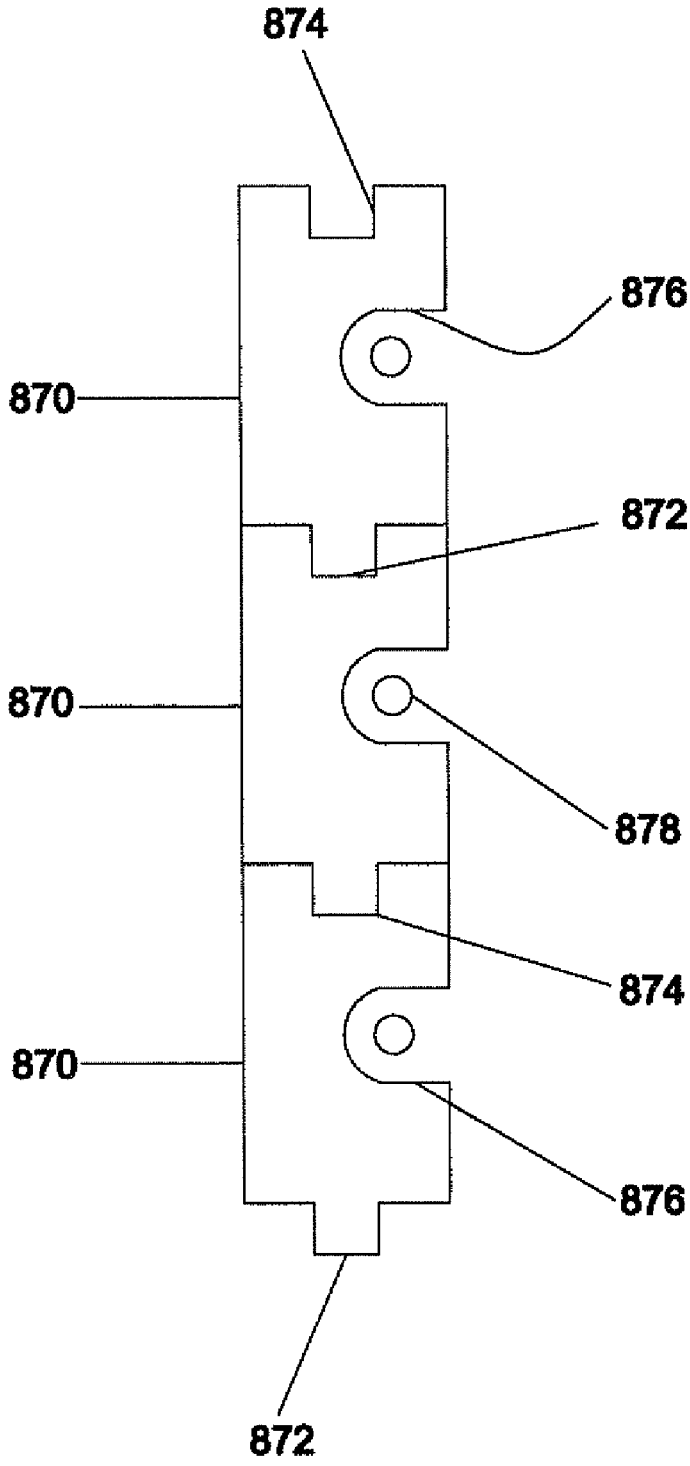
FIG. 57 is a side sectional view showing a plurality of stacked panel beams which are formed with interlocking ribs and recesses in accordance with certain principles of the invention.

Referring to FIG. 57, in an end view, a barrier fence includes a plurality of panel sections 870, each of which is formed at the bottom thereof with keying rib 872 extending from one end of the section to the opposite end thereof. Each of the panel sections 870 is formed with a keying groove 874, which extends from one end of the section to the opposite end thereof. The panel sections 870 are stacked such that the keying rib 872 of each section is placed within the keying groove 874 of the section therebelow, to lock the sections together in the formation of a panel. Each of the panel sections is formed with a side groove 876 for receipt of a tension cable 878 therein. The illustration of FIG. 57 could also represent keyed sections of a beam or post.

Figure 58:
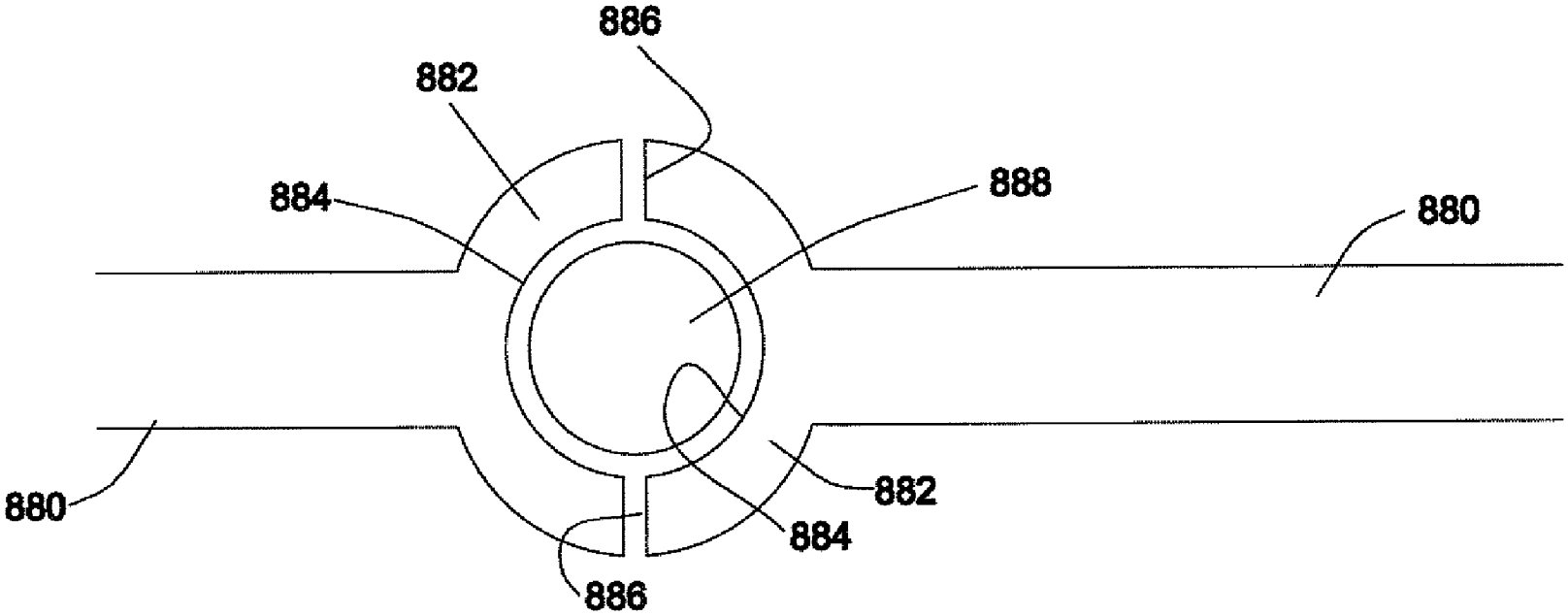
FIG. 58 is a top view showing a post with end portions of adjacent panels wrapped around the post in a complementary manner, similar to the rod-like post and panel arrangement of FIG. 9, in accordance with certain principles of the invention.

Referring to FIG. 58, in a barrier fence similar to that illustrated in FIG. 9, each of two panels 880 is formed with an enlarged-end head 882, which extends from top to bottom of the panel. A generally semi-circular groove 884 is formed in a free-end edge 886 of the head 882. The two panels 880 are assembled with a post 888, which is formed generally with a round cross section. Generally, the interfacing grooves 884 of the two assembled panels 880 conform to the size and shape of the post 888 such that the heads 882 of the two panels wrap around the post. Upon assembly of the panels 880 with the post 888, the free-end edges 886 of each of the panels 880 compressingly engage with each other to facilitate a firm closure about the post. It is noted that the cross section of the post 888 and the configuration of the interfacing grooves 884 do not have to be circular, but could be of any other complementary configuration or could be of dissimilar configurations provided that the post is contained within the interfacing grooves.

Figure 59:
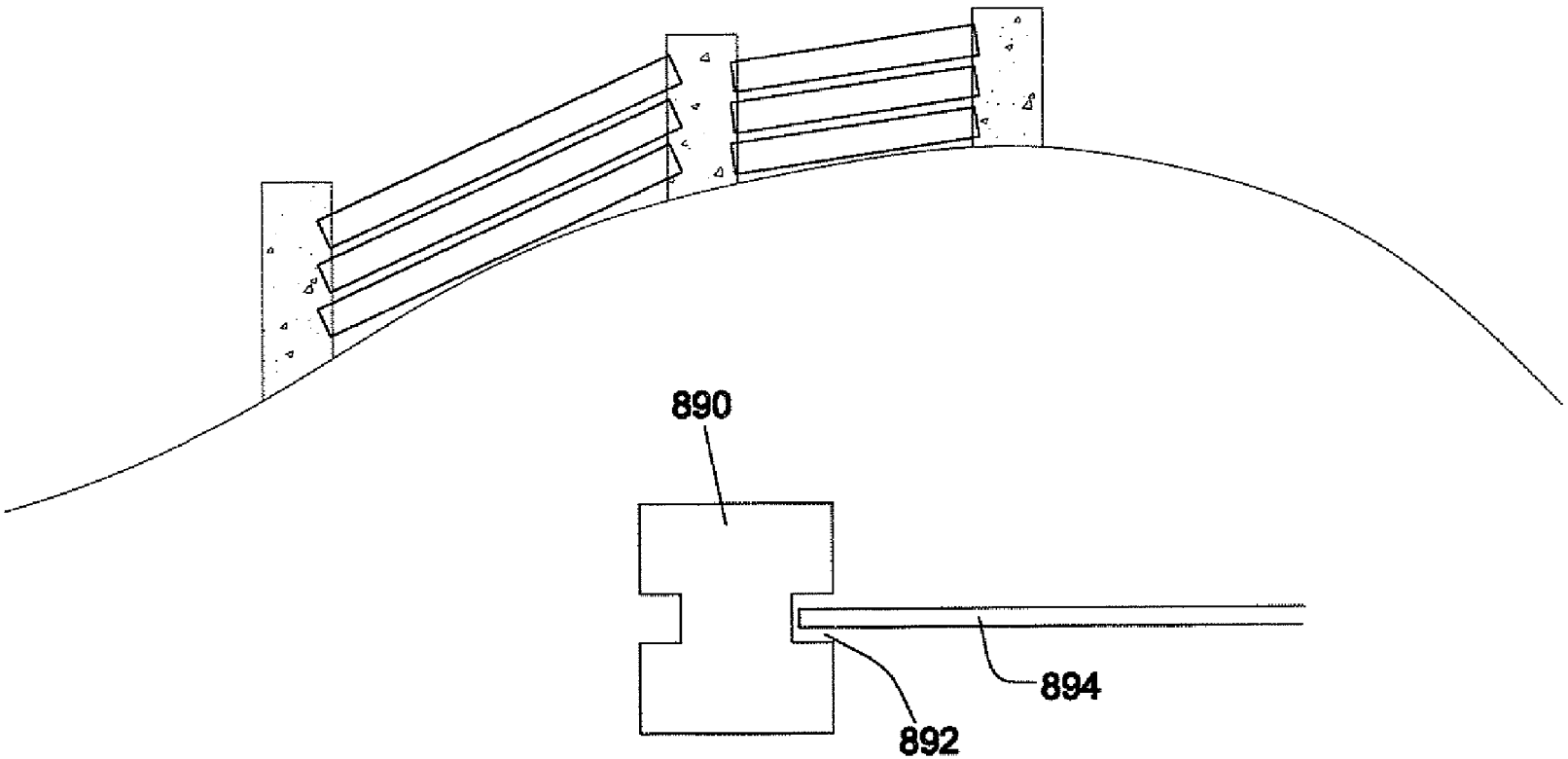
FIG. 59 is a top view showing a post formed with a longitudinal slot of a given width with an end of a panel slidingly inserted and held in the slot in accordance with certain principles of the invention.

As shown in FIG. 59, in a top view, each side of a post 890 is cast with a groove 892, the width of which is approximately the same as the thickness of a panel 894. Two panels 894 (one shown) are assembled within respective ones of the grooves 892 with a sliding fit.

Figure 60:
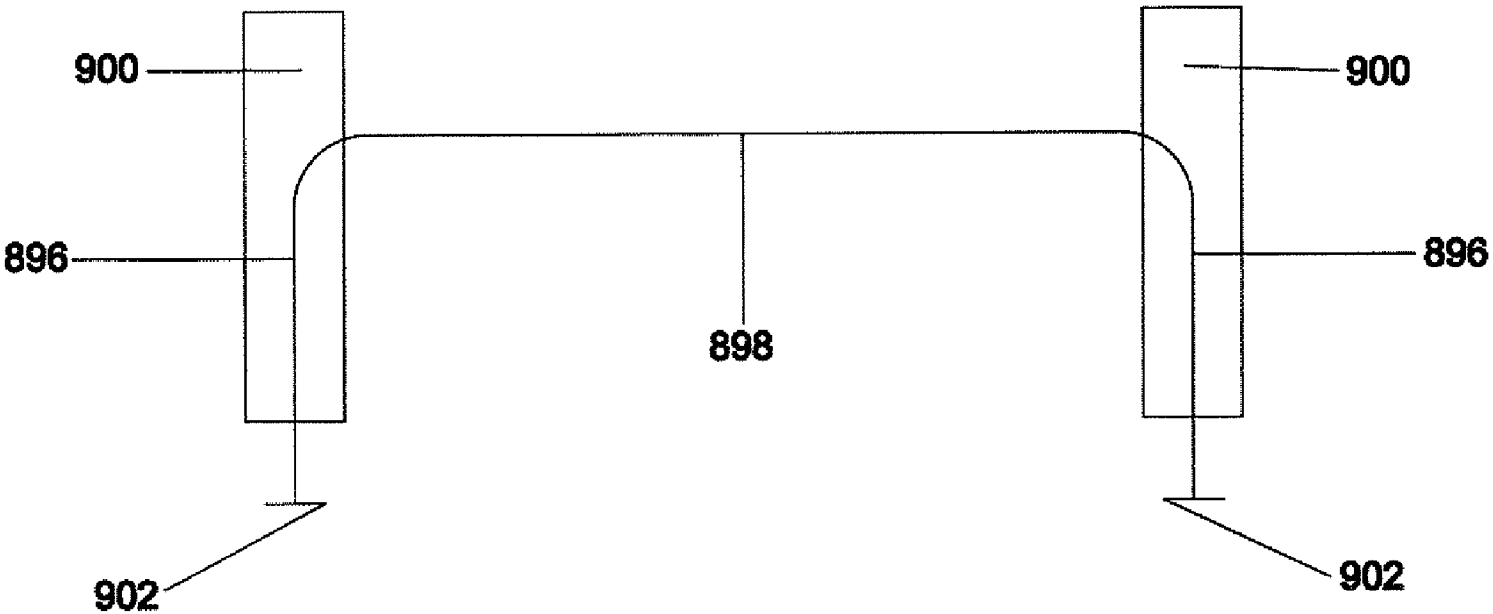
FIG. 60 is a front view showing a pair of spaced posts with a tension cable anchored at opposite ends thereof and extending vertically through, and horizontally between, the posts in accordance with certain principles of the invention.

As shown in FIG. 60, spaced portions 896 of a tension cable 898 are assembled generally coaxially within two spaced posts 900, such that the cable portions are anchored within the posts. This arrangement places a force in compression on the posts 900. In addition, the ends of the cable 898 may be attached to movable weights 902 to absorb energy of a vehicle engaging the cable.

Figure 39:
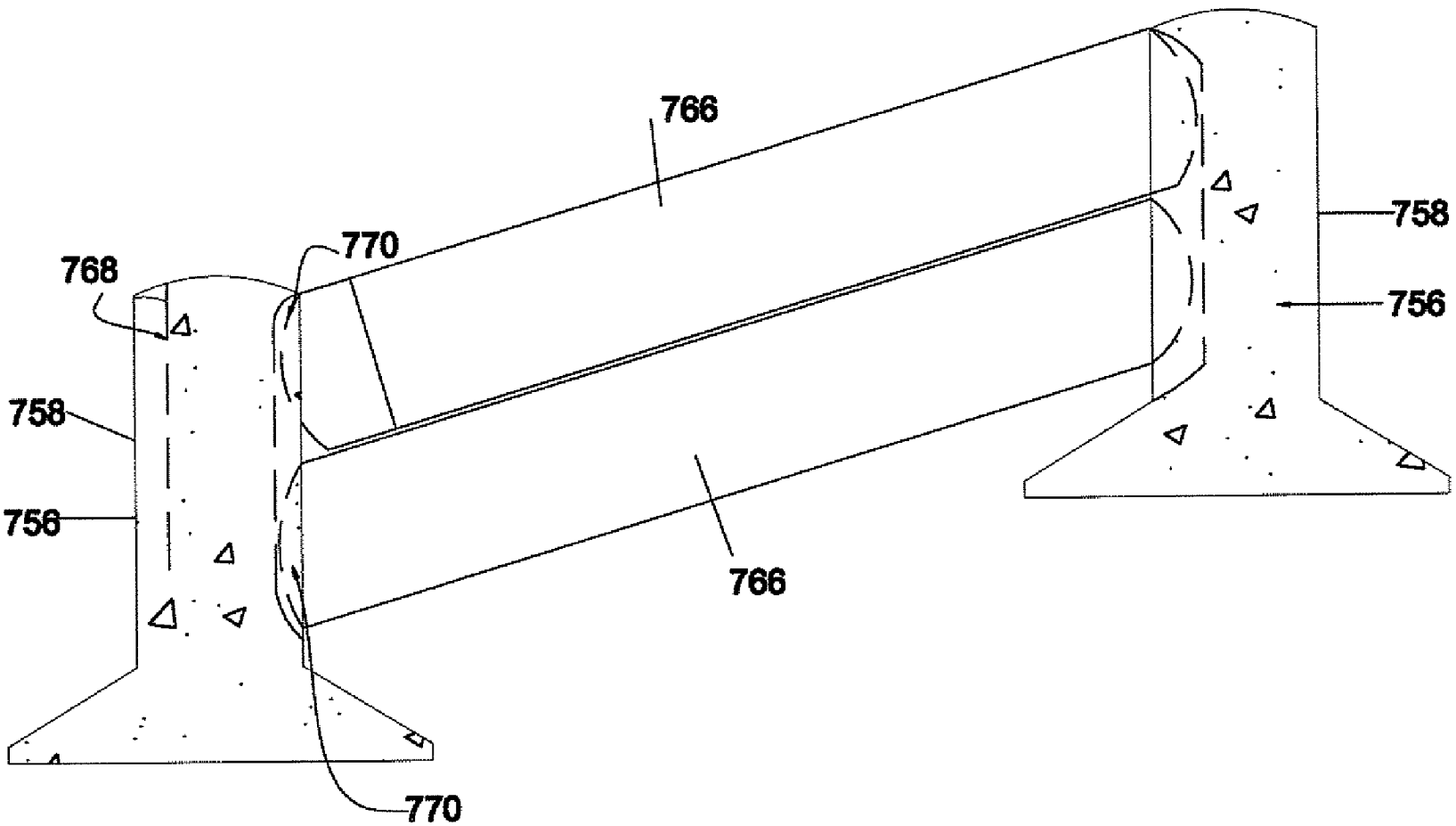
FIGS. 39, 39*a*, 40, 40*a* and 41 are partial views showing spaced "I" beam posts formed with longitudinal spaces for receipt of convex ends of decorative panels which conceal tension cables extending between the posts in accordance with certain principles of the invention.
Figure 39A:
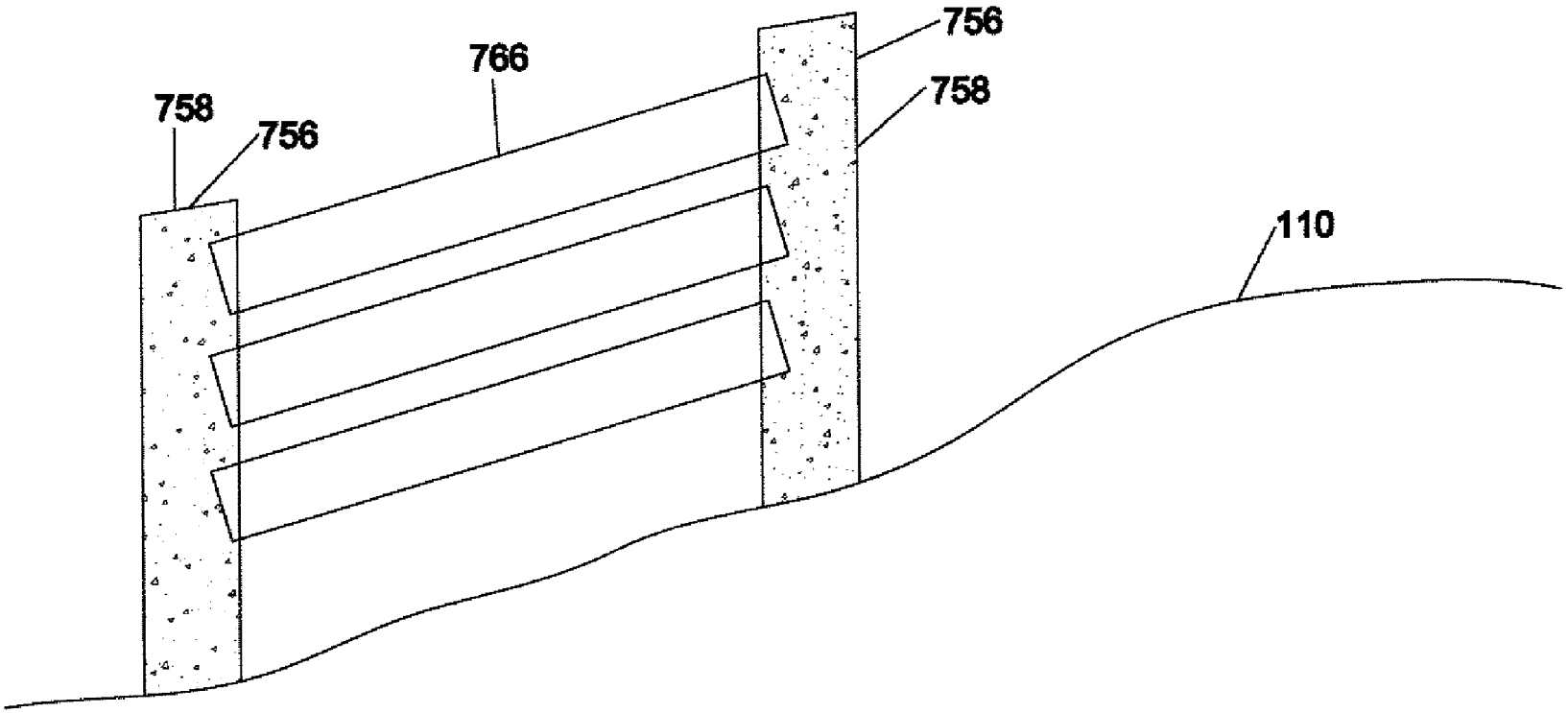
Figure 40:
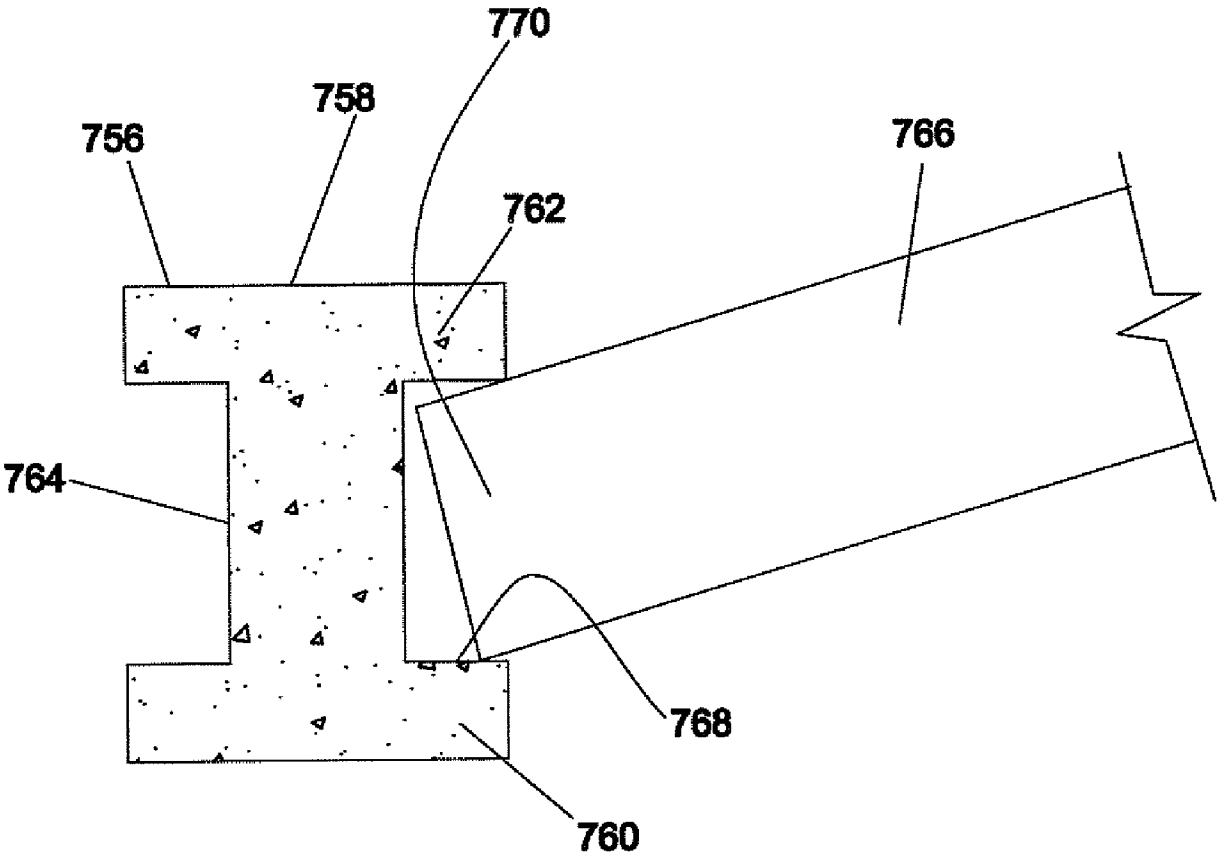
Figure 40A:
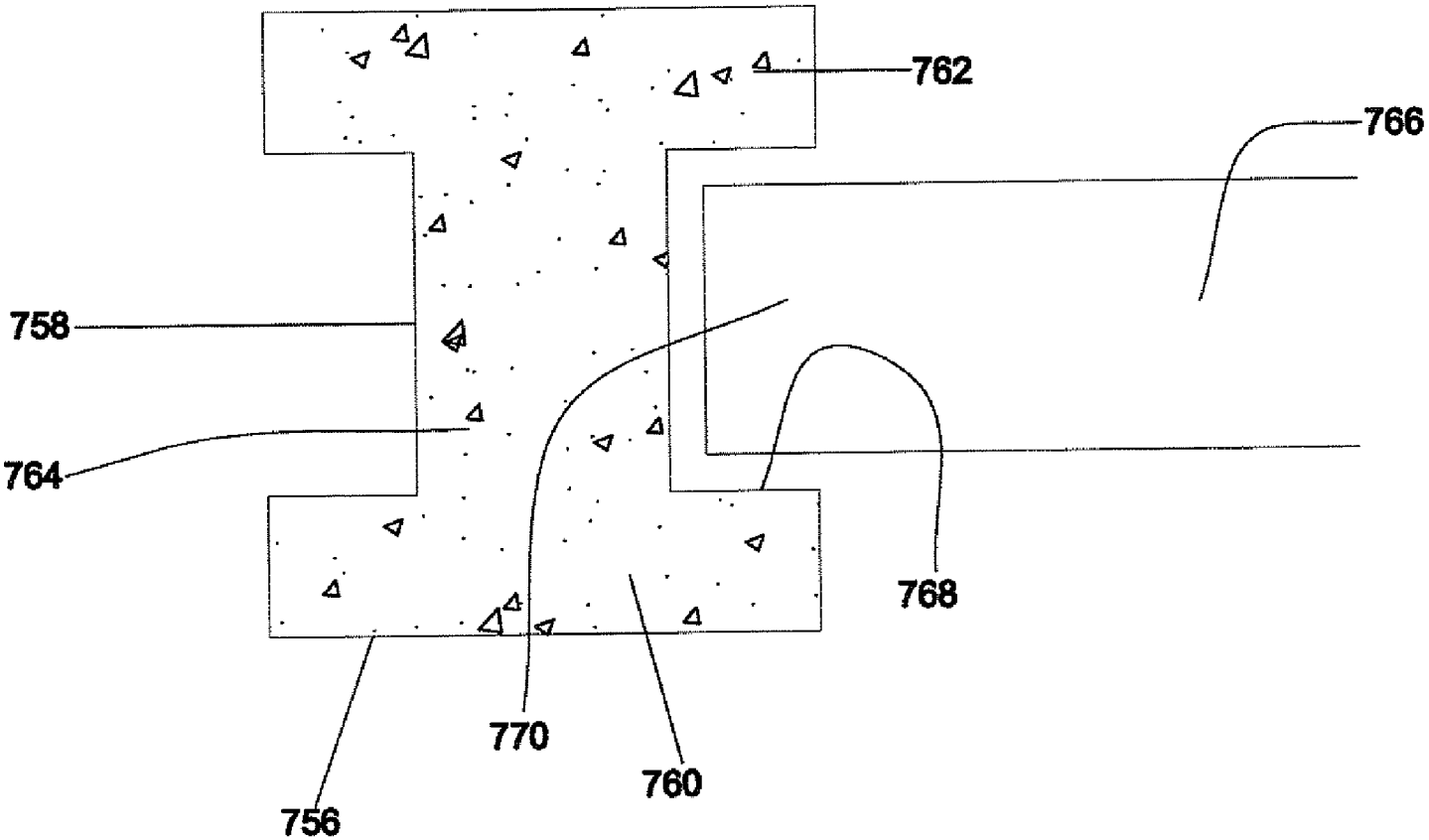
Figure 61:
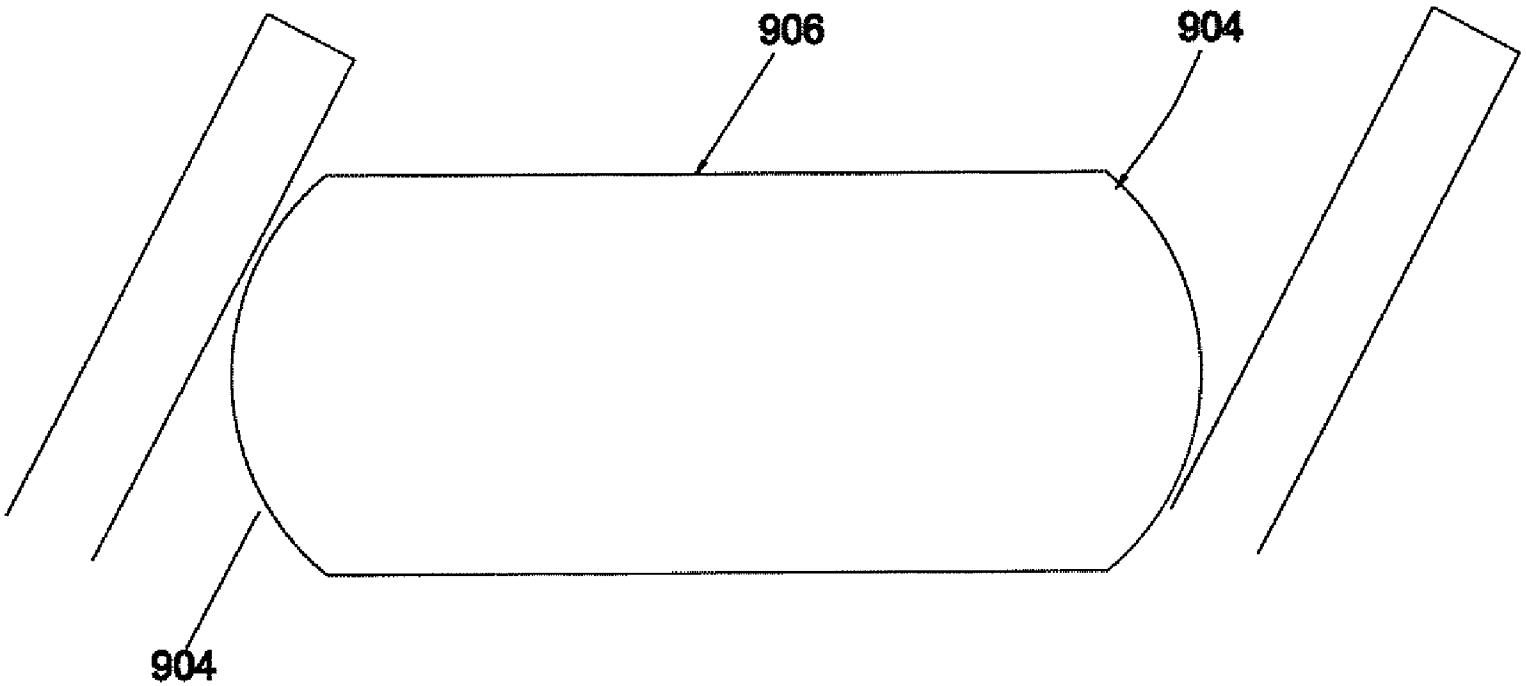
FIG. 61 is a front view showing a panel having convex ends in accordance with certain principles of the invention.

Referring to FIG. 61, in a manner similar to that of FIG. 39, opposite ends 904 of a panel 906 are each formed in a convex configuration to facilitate vertical displacement of the panel due to changes in the ground-level topography.

Figure 62:
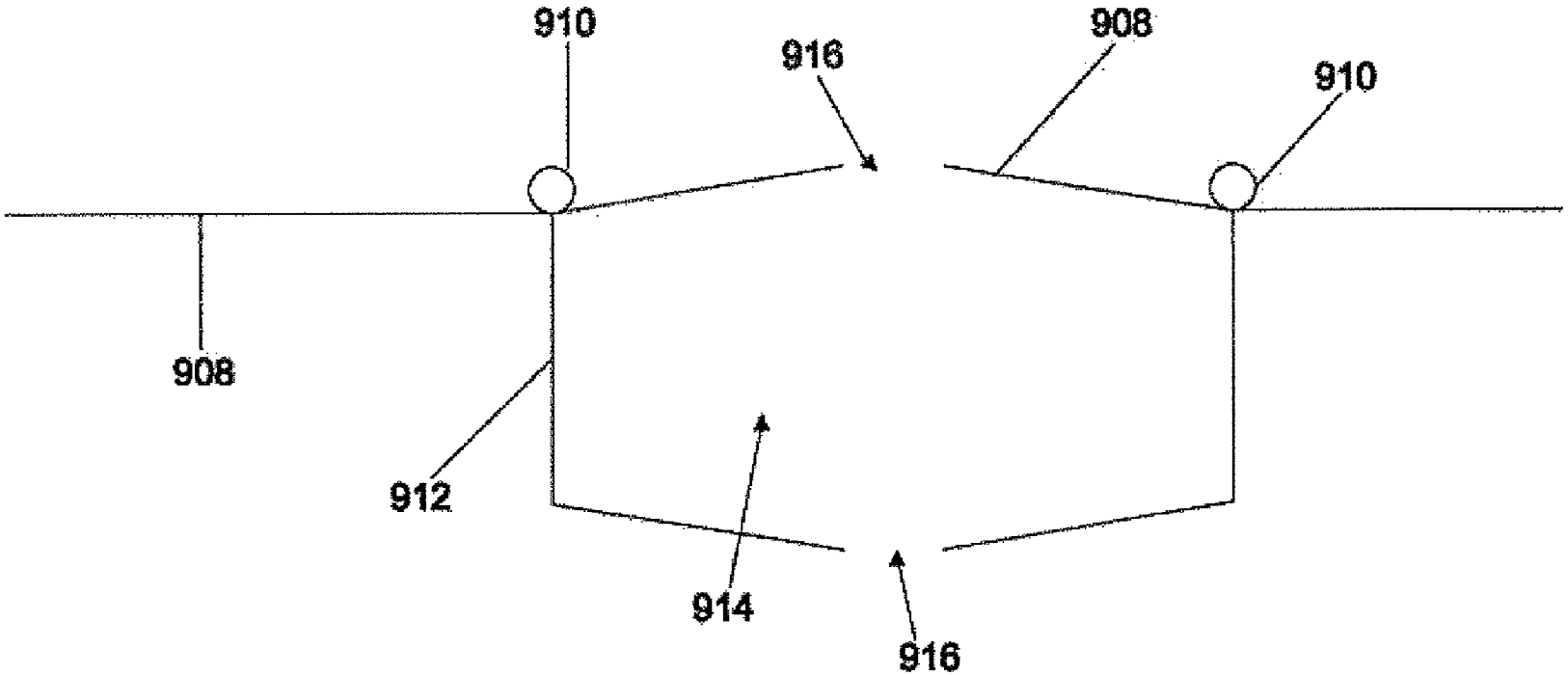
FIG. 62 is a top view of a security-clearance holding pen, similar to that shown in FIG. 20, in accordance with certain principles of the invention.

Referring to FIG. 62, in an arrangement similar to that illustrated in FIG. 20, a first set of tension cables 908 form a barrier fence, which includes two spaced posts 910. The cables 908 define a secured area beyond which unauthorized vehicles are not allowed. A second set of cables 912, of lighter weight than the first set of tension cables 908, extend outward from the posts 910 to a second set of posts similar to posts 910 (not shown) to form a security-clearance holding pen 914. Gate openings 916 are formed in each of the sets of cables 908 and 912 to allow for the entry of a vehicle into the pen 914 and, if authorized, then into the secured area. In a manner similar to that of FIG. 19, steps could be provided over the cables 908, or a tunnel below the cables, for pedestrian traffic.

Figure 63:
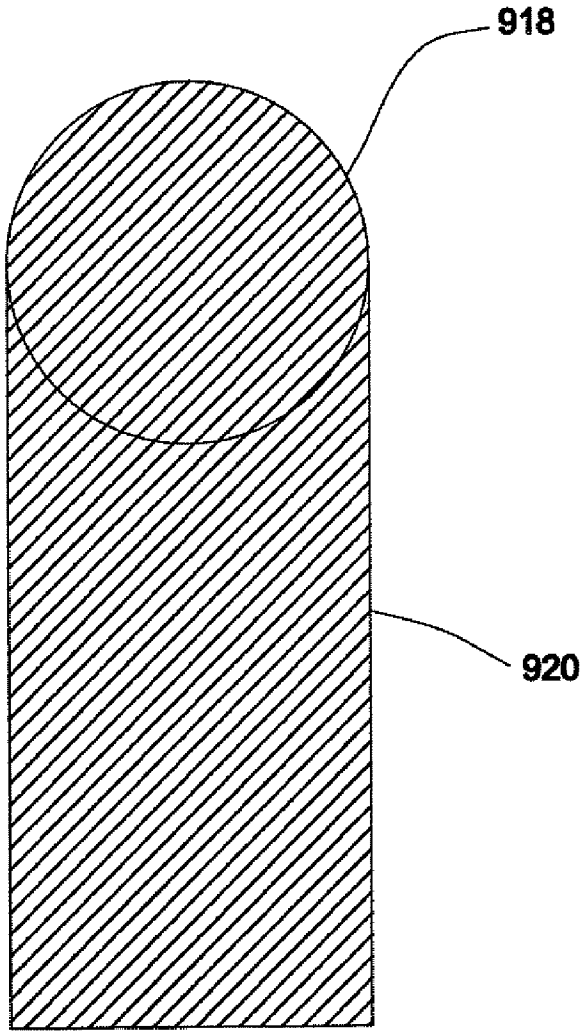
FIG. 63 is a front sectional view of a post having a rounded top in accordance with certain principles of the invention.

As shown in FIG. 63, a top 918 of each of a plurality spaced posts 920 (one shown), of a barrier fence, is rounded for aesthetic purposes. Panels (not shown), which are located between the posts 920, may also be rounded at the top thereof.

Figure 64:
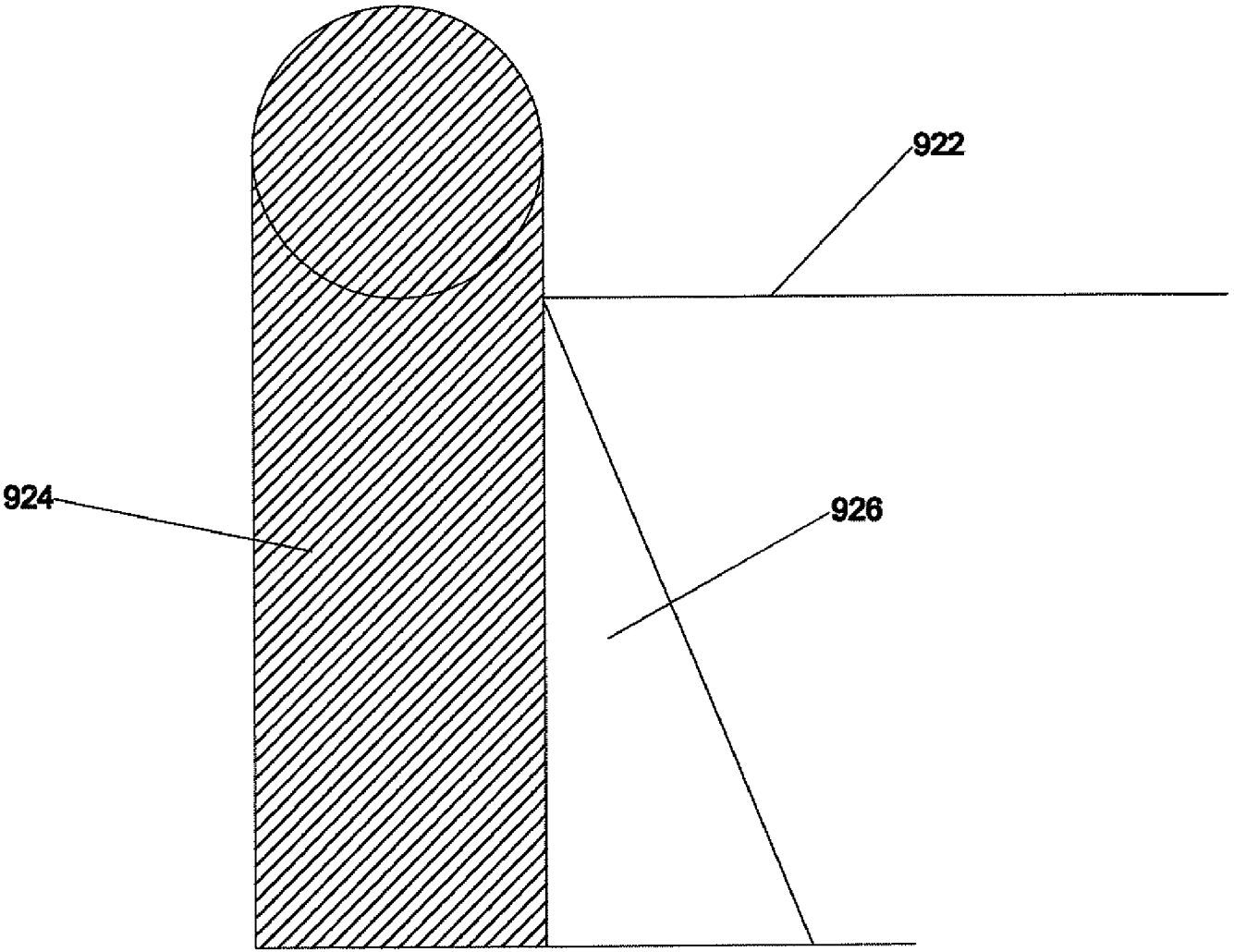
FIG. 64 is a side sectional view showing a post having a rounded top and a gusset extending laterally from the post and positioned to counteract any forces of a taut tension cable in accordance with certain principles of the invention.
Figure 64A:
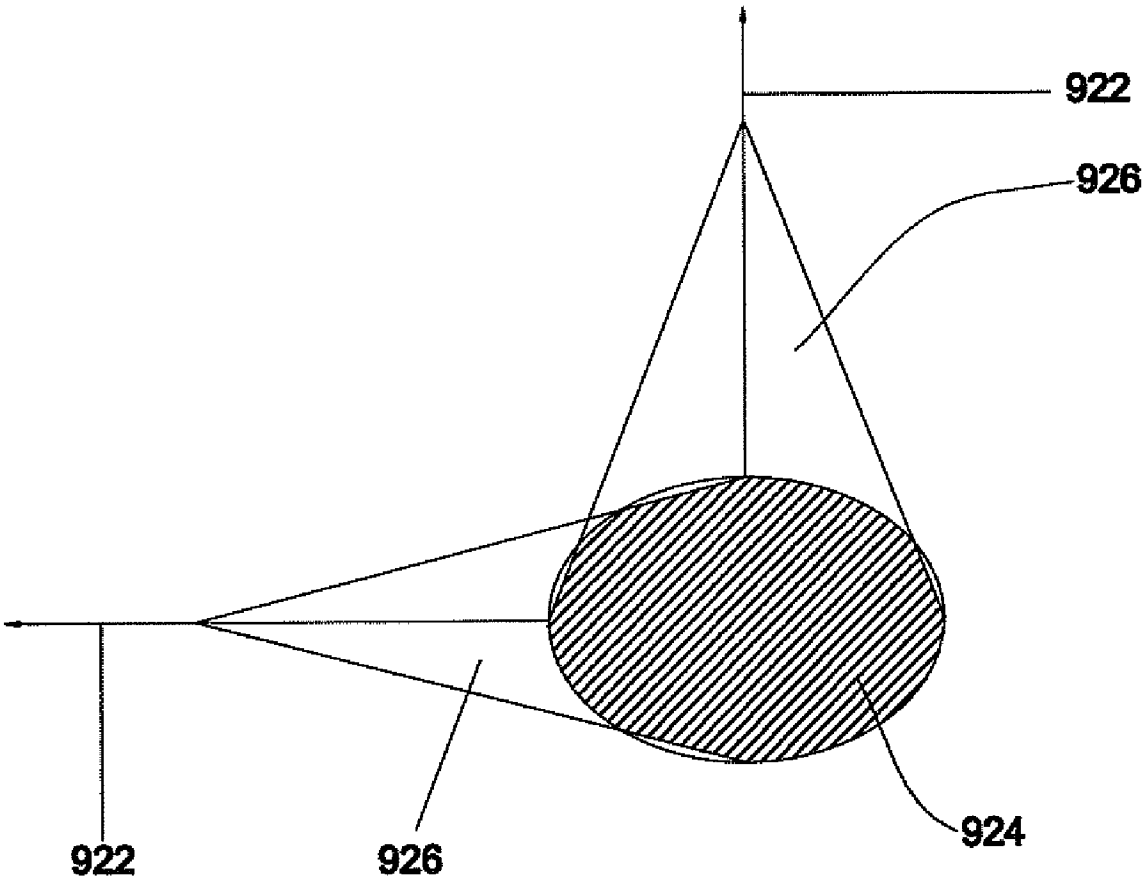
FIG. 64*a* is a top sectional view showing a pair of spaced gussets located at a corner post in accordance with certain principles of the invention.

Referring to FIG. 64, a tension cable 922 extends from a given side of a post 924. A gusset 926 is attached to the given side of the post 924 to counteract forces encountered when the cable is pulled taut. As shown in FIG. 64*a*, if the post 924 is a corner post, gussets 926 would be attached to the sides of the post from which the cable 922 extends.

Figure 65:
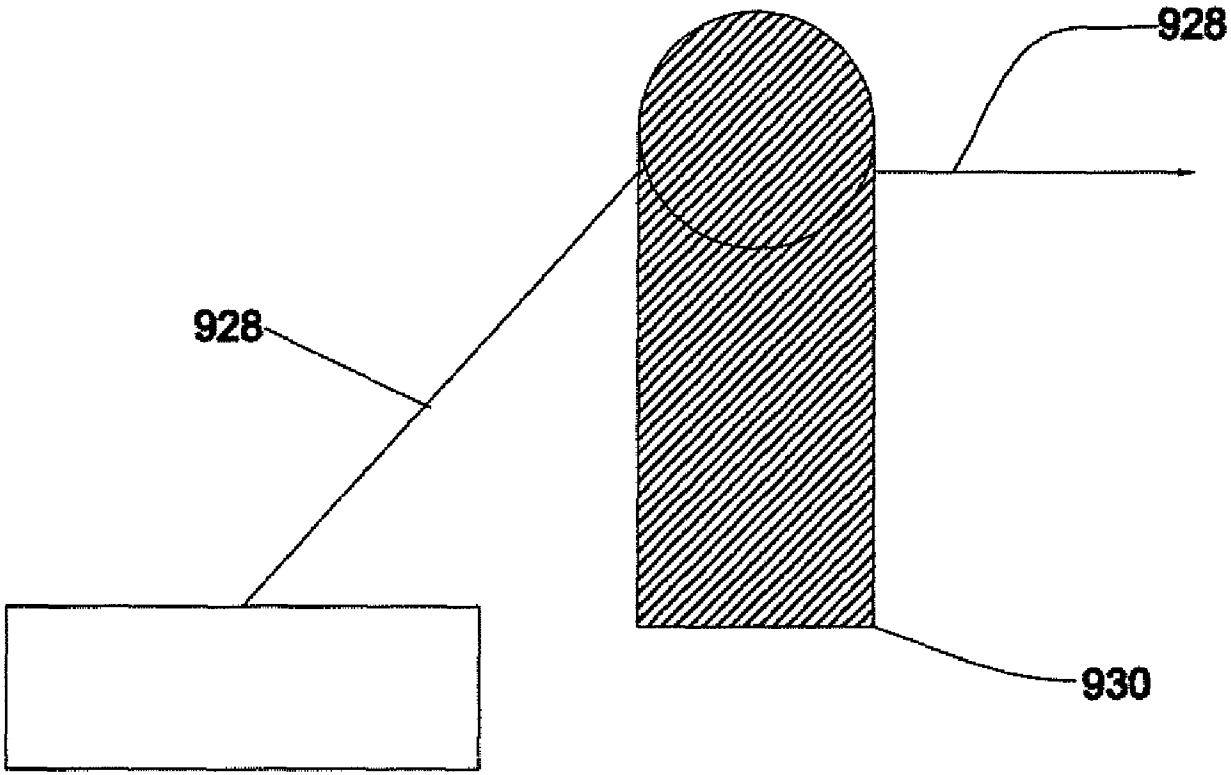
FIG. 65 is a front sectional view showing a tension cable extending through a post, with an end of the cable being anchored to the ground.
Figure 65A:
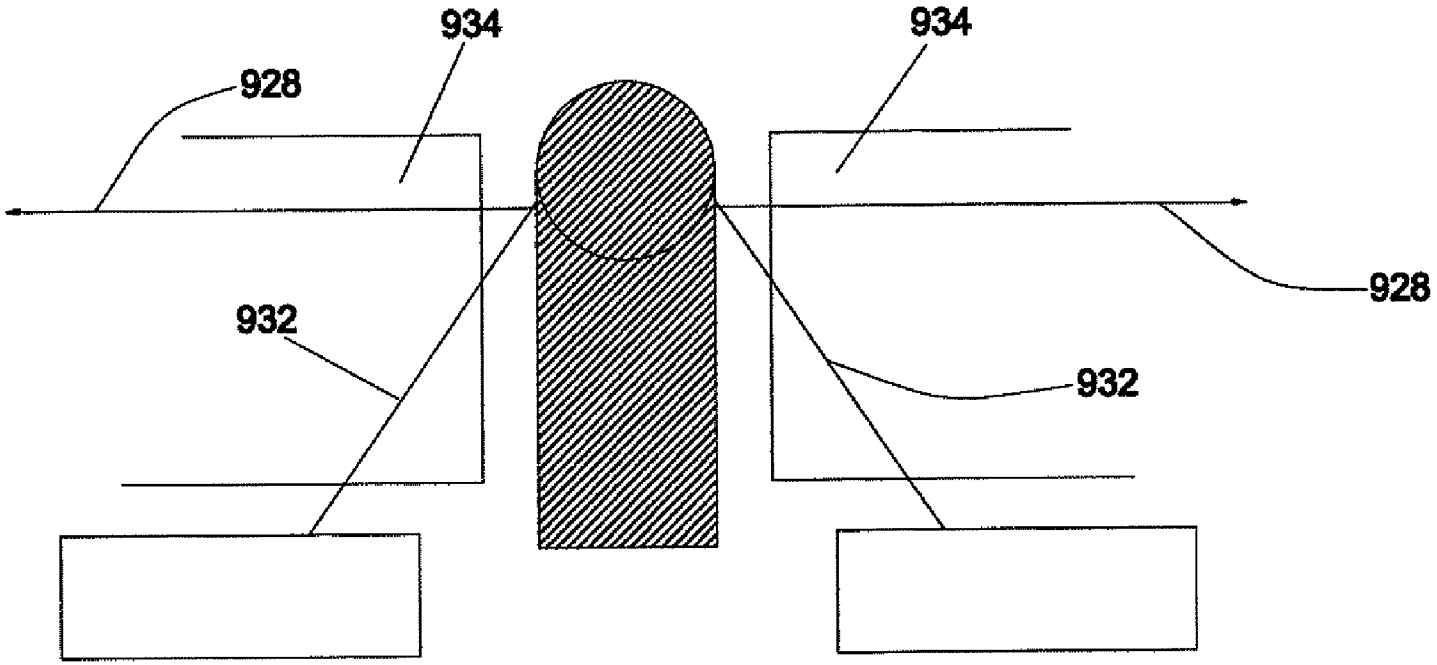
FIG. 65*a* is a side sectional view showing an intermediate post having with two separate tension cables passing therethrough with end of each cable being anchored to the ground in accordance with certain principles of the invention.

Referring to FIGS. 65 and 65*a*, a tension cable 928 extends from one side of a post 930 in a given direction. An anchor cable 932 is attached at one end thereof to an upper portion of the post 930, on a side of the post opposite the one side thereof. An opposite end of the anchor cable 932 is attached to the ground. When each of two tension cables 928 extends from opposite sides of the post 930, two anchor cables 932 are attached at one end thereof to the same opposite sides of the post from which the tension cables extend. The opposite ends of the anchor cables 932 are attached to the ground. The tension cables 928 can be selectively concealed within panels 934 for decorative purposes.

Figure 66:
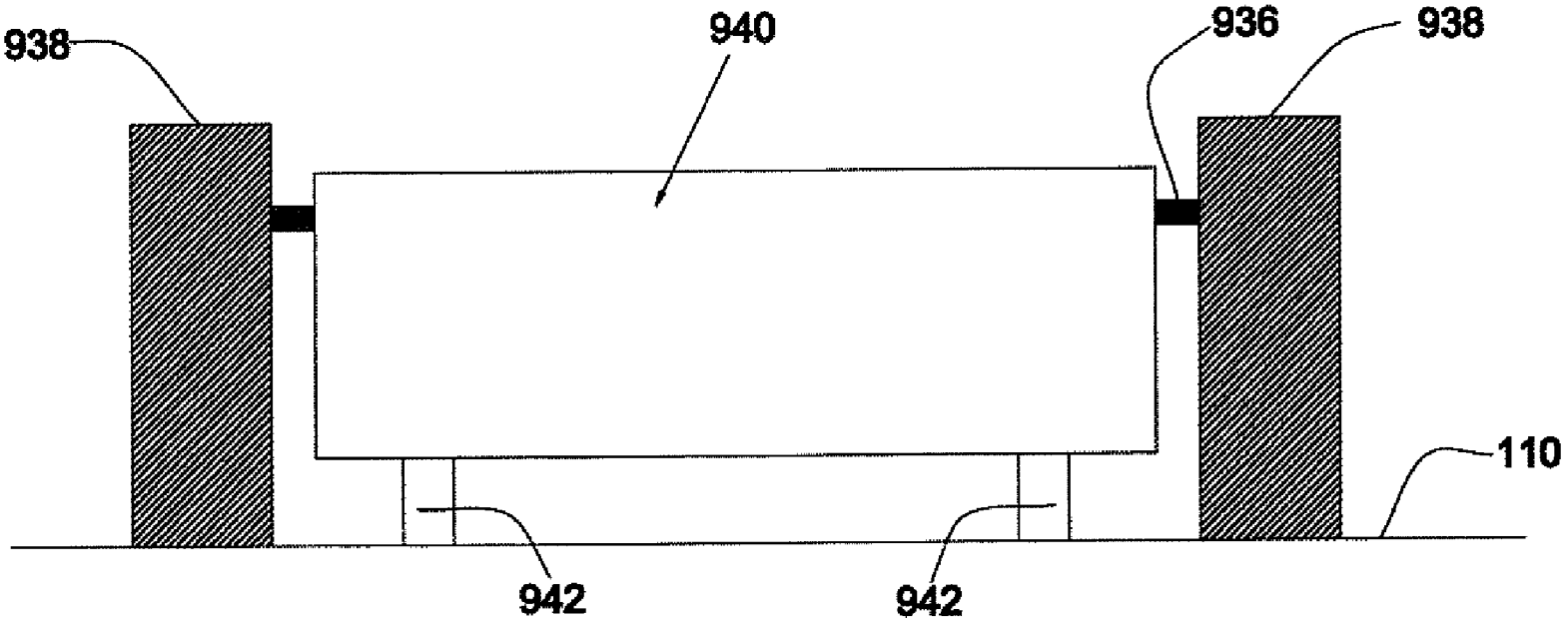
FIG. 66 is a front view of a panel extending between a pair of spaced posts with support legs extending below the panel to the ground to support the panel in accordance with certain principles of the invention.

Referring to FIG. 66, a tension cable 936 extends between two spaced posts 938, with an intermediate portion of the cable being concealed within a decorative panel 940. A pair of legs 942 are attached at the tops thereof to the bottom of the panel 940, with the bottoms of the legs resting on the ground level 110. In this manner, the panel 940 is supported by the ground level 110, through the legs 942, to minimize forces exerted on the panel as a result of the cable 936 being contained within the panel. This principle is similar to the principle noted above wherein the bottom of each of the panels 252 (FIG. 12) could be extended to the ground level 110 for support of each panel thereby.

Figure 67:
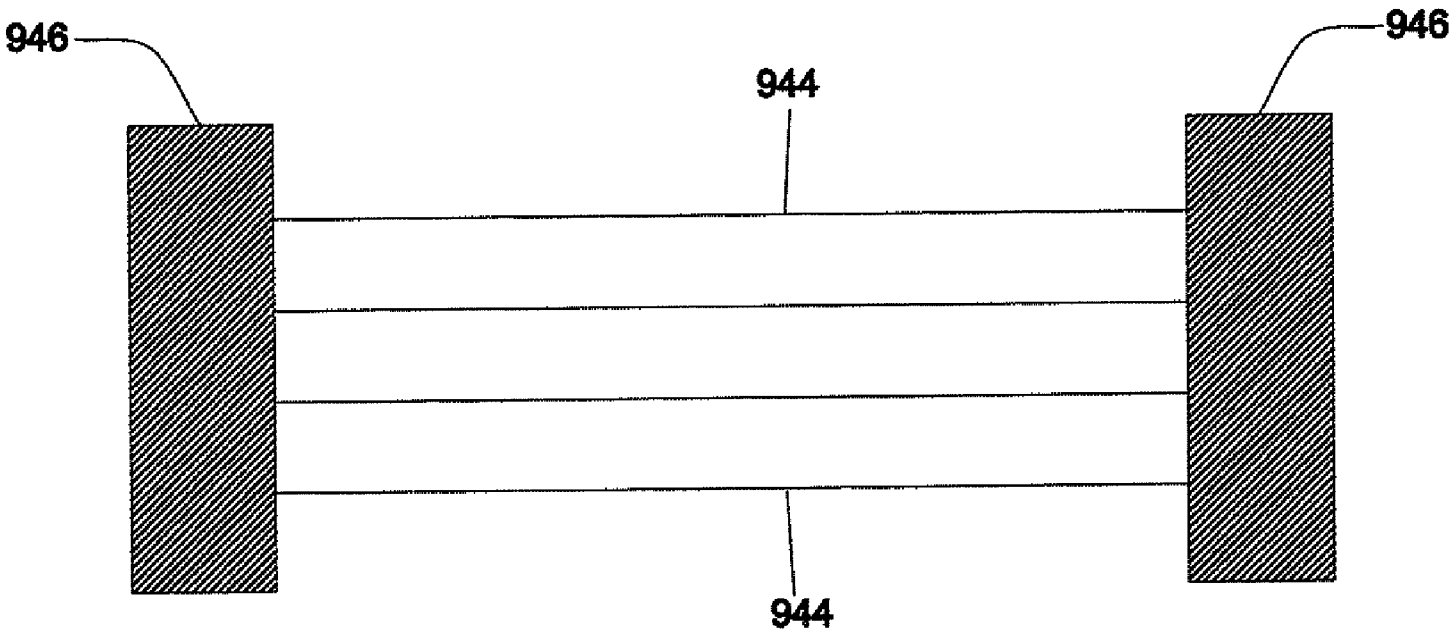
FIG. 67 is a front view showing a pair of spaced posts with multiple tension cables extending therebetween in lieu of a single larger cable in accordance with certain principles of the invention.

Referring to FIG. 67, occasionally, the diameter of a single tension cable, contemplated for use in a barrier fence to oppose the passage of an unauthorized vehicle, is too large for such a use. In such instances, a plurality of smaller tension cables 944, extending between a pair of spaced posts 946 can be used in place of the single large cable, provided that the smaller cables combine to present at least the same opposition to the passage of the vehicle as the opposition presented by the single large cable.

Figure 68:
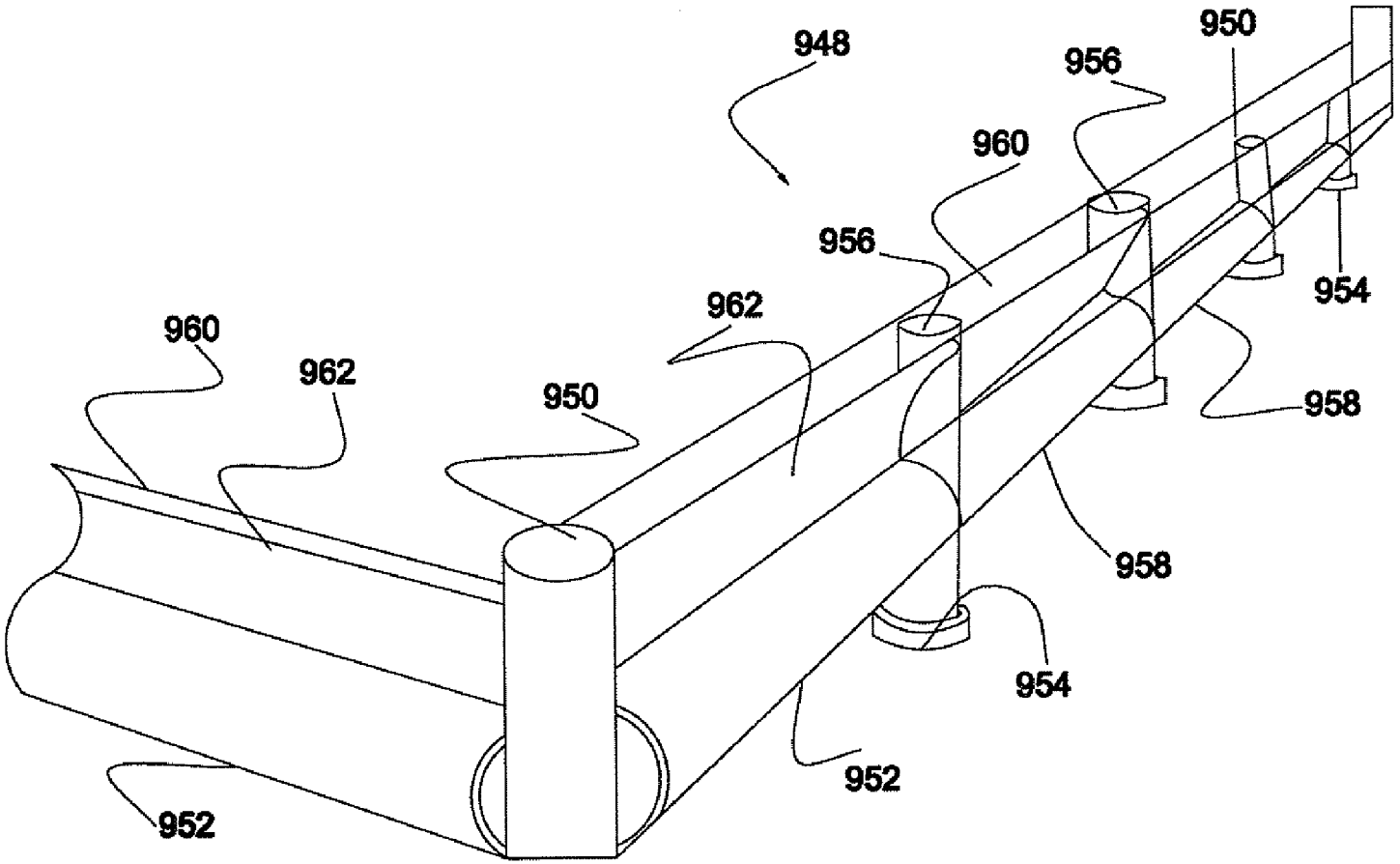
FIG. 68 is a perspective view of the decorative exterior of a barrier fence in accordance with certain principles of the invention.

As shown in FIG. 68, a barrier fence 948 is formed by a plurality of spaced foundation and post assemblies 950, with decorative and aesthetically-pleasing panels 952 extending between the assemblies. Each of the plurality of assemblies 950 includes a foundation 954 and an integrally formed post 956. Each of the panels 952 is formed by a lower cylindrical section 958, a generally flat horizontal top rail section 960, and an intermediate flat section 962 extending vertically between the lower section and the top rail section. Tension cables (not shown) can be concealed within the panels 952. The sections 958, 960 and 962 of each panel 952 can be integrally cast as a single unit, or can be separate elements which are assembled to form the panel.

Figure 69:
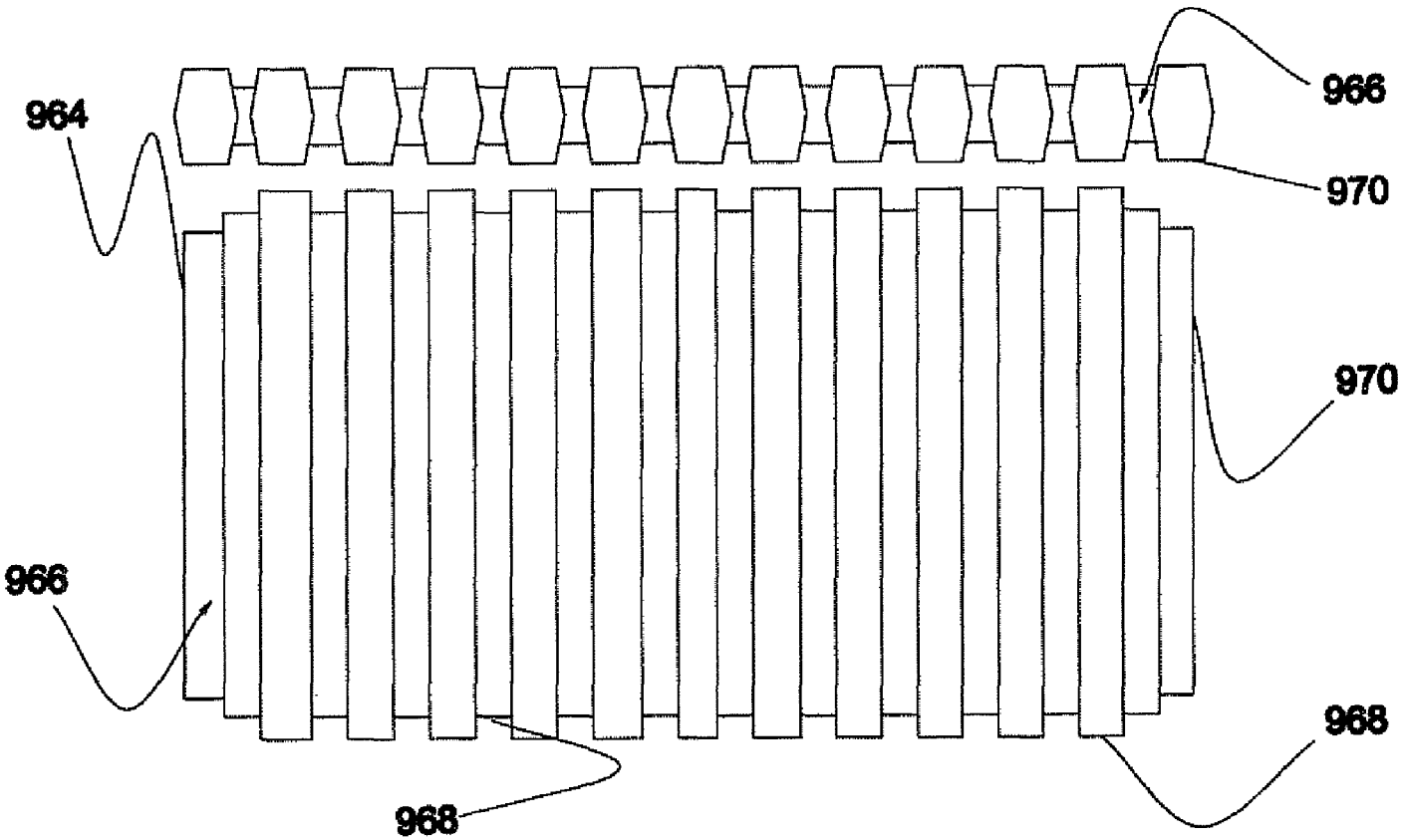
FIGS. 69, 70 and 71 are each a front view and top view of a decorative exterior of a panel, similar to that of FIG. 44, in accordance with certain principles of the invention.

As shown in FIG. 69, a decorative panel 964 includes a rectangularly shaped centerpiece 966, with a plurality of spaced pickets 968 extending from the bottom to the top of the centerpiece. Decorative caps 970 are placed over the ends of each the pickets 968 at the top and bottom thereof.

Figure 70:
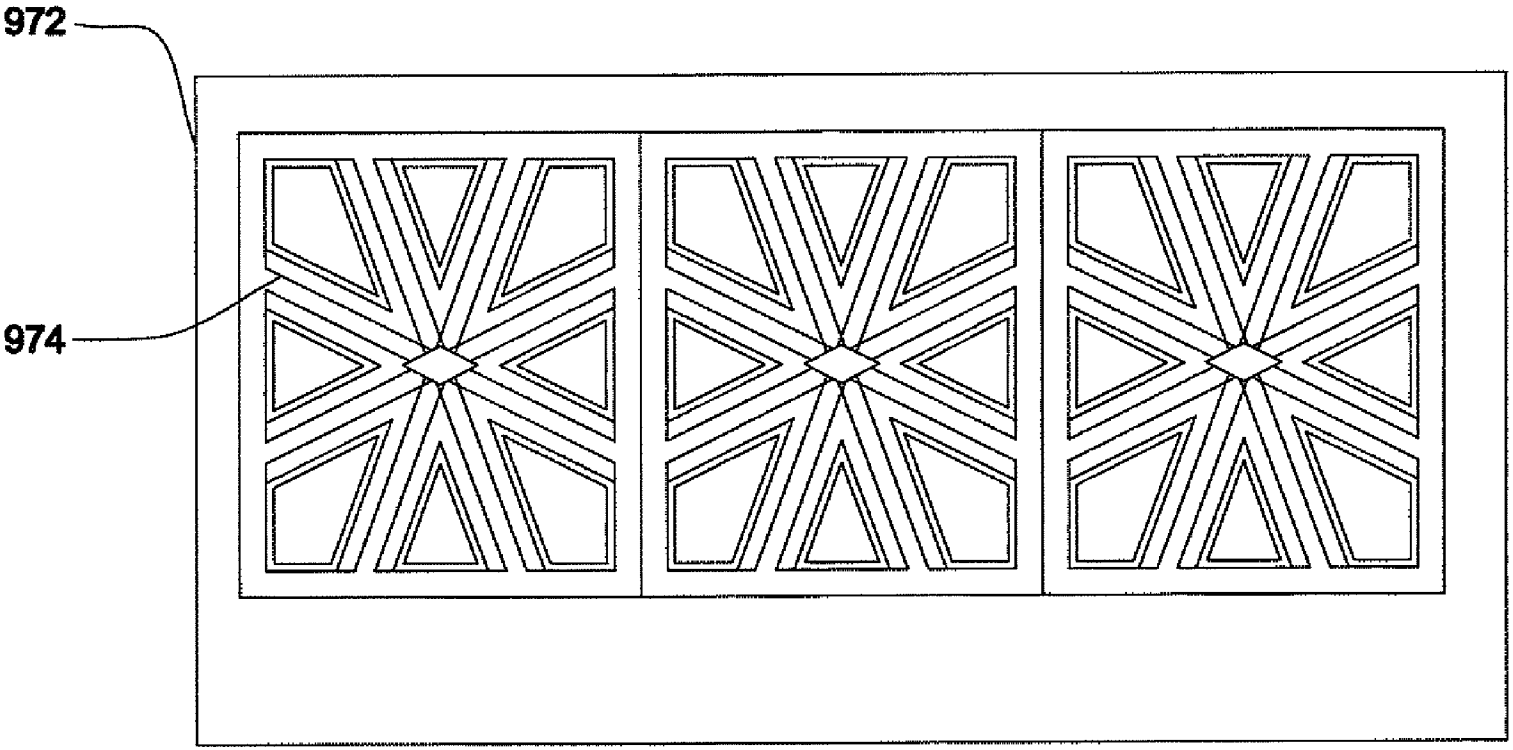

As shown in FIG. 70, a decorative panel 972 formed in a rectangular shape, with geometrical designs 974 located on a major surface of the panel.

Figure 71:
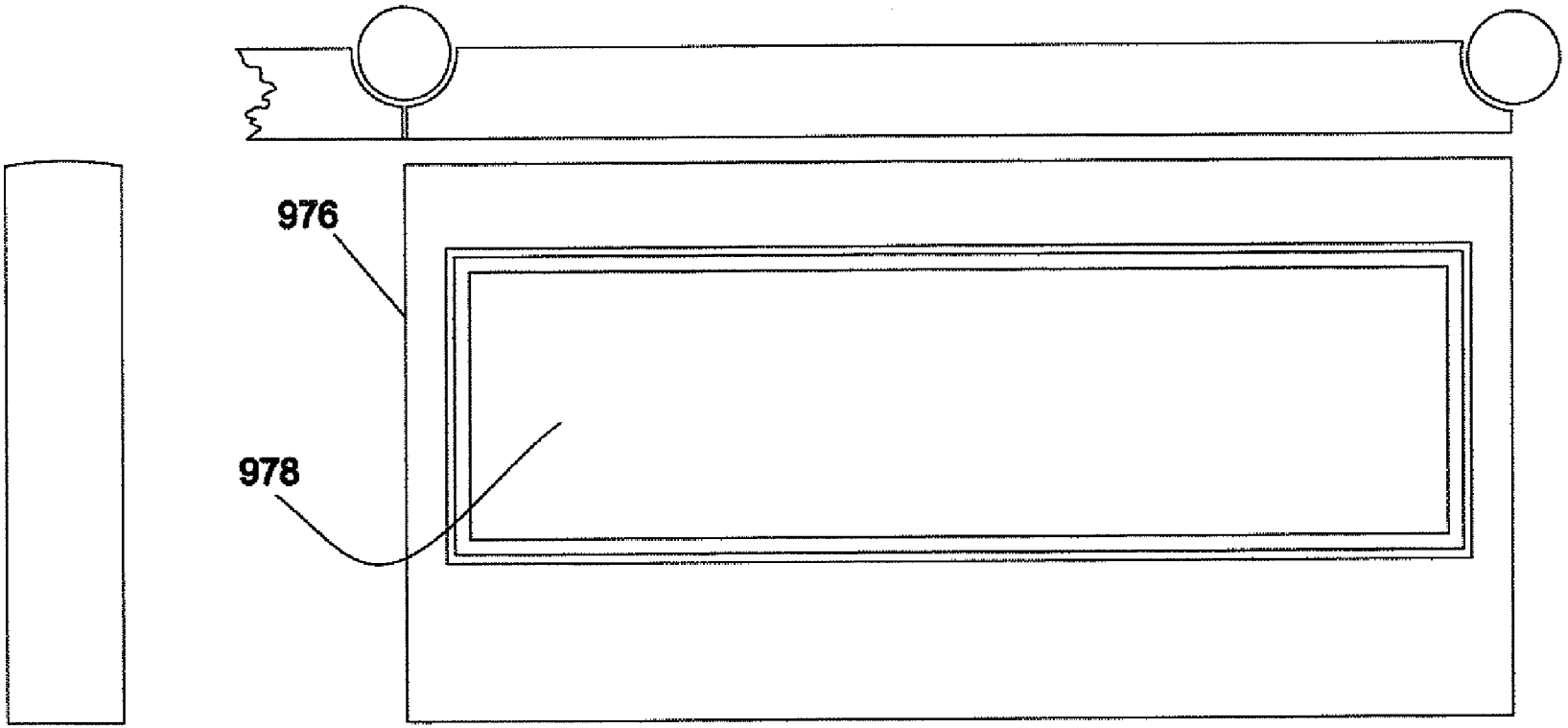

As shown in FIG. 71, a decorative panel 976 formed in a rectangular shape, with a portion of a major surface of the panel having decorative artwork 978 formed thereon.

Figure 72:
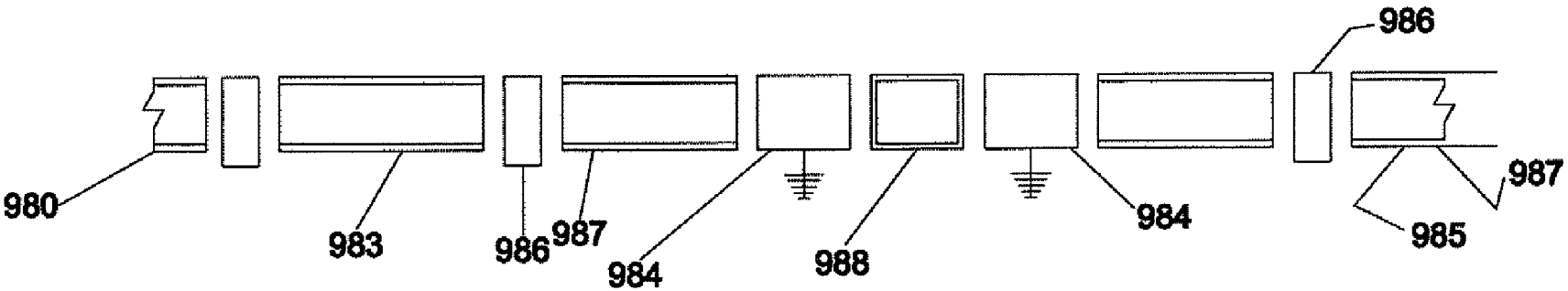
FIG. 72 is a front view.
Figure 73:
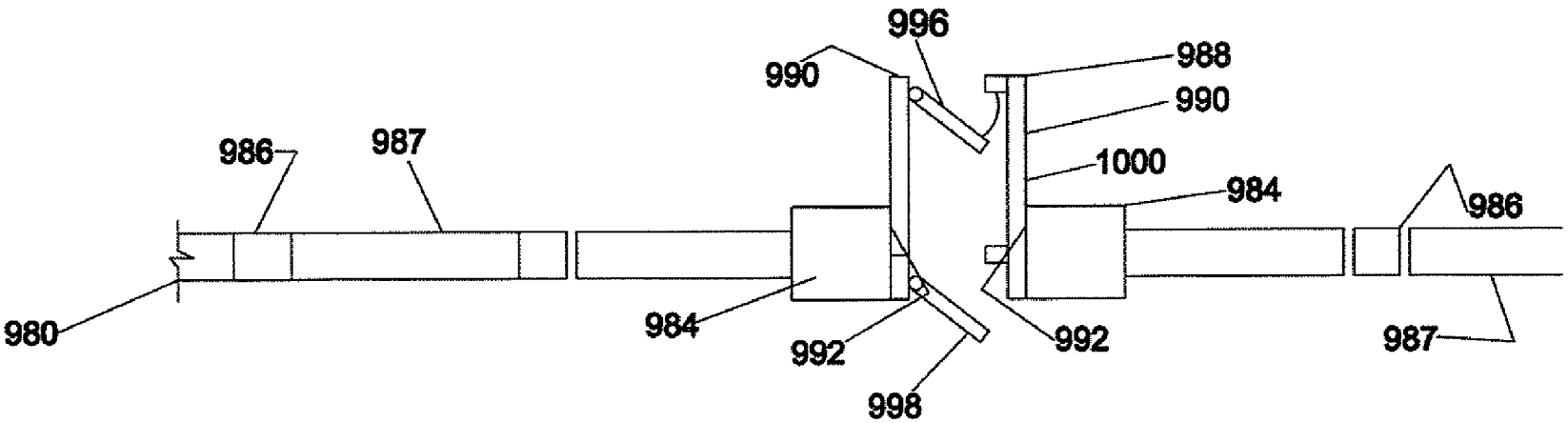
FIG. 73 is a top view, of a barrier fence which includes a pedestrian security-check pen, similar to that in FIGS. 20 and 62, in accordance with certain principles of the invention.

Referring to FIGS. 72 and 73, a barrier fence 980 includes two spaced end posts 984, which are anchored to the ground. A plurality of intermediate posts 986, which can be unanchored, are spaced from each other, and from the end posts 984. Two sets of tension cables 983 and 985 are strung from respective ones of the end posts 984 and through the intermediate posts 986, as illustrated in FIG. 72. The tension cables 983 and 985 are concealed in a plurality of panels 987 located between adjacent intermediate posts 986 and between each of the end posts 984 and the adjacent intermediate post.

A pedestrian security-check pen 988 is formed by a pair of spaced pen walls 990, which extend from, and are parallel with, interfacing walls 992 of the end posts 984. A securable, and normally closed, outboard door 996 is located at an outboard end of the pen 988, and between spaced outboard ends of the pen walls 990. A securable, and normally closed, inboard door 998 is located at an inboard end of the pen 988, and between spaced inboard ends of the pen walls 990. The pen walls 990, and the doors 996 and 998 are made from a material such as steel, or other material and construction, so as to be resistant to a battering ram, a fire axe, a sledge hammer, or the like.

In use, a pedestrian requests entry through the door 996 by use of for example, an intercom. The door 996 can be unlocked by an attendant by use of a remote-actuated magnetic lock assembly (not shown), thereby allowing the pedestrian to advance into the pen 988, whereafter the door may be locked. A sensing device 1000, such as, for example, a video camera, is trained, for example, on features of the pedestrian's face for review by security personnel from a remote location. If the pedestrian is recognized as being authorized for entry, the inboard secured door 998 is unlatched by use, for example, of a remotely-actuated magnetic lock (not shown) to allow passage of the authorized pedestrian therethrough. If the pedestrian is not authorized to enter beyond the barrier fence 980, the door 998 remains latched. As noted above, the outboard door 996 may be locked after the pedestrian has entered the pen 988. If it is determined that the pedestrian is not authorized to enter beyond the barrier fence 980, and the outboard door 996 has been locked after the pedestrian has entered the pen 988, the pedestrian is thereby detained within the pen 988 for further action by the security personnel.

Other types of known sensing devices can be used in place of the video camera, including devices for examining various features of the anatomy of the pedestrian. For example, such sensing devices could examine the pedestrian's eyes, fingertips (fingerprints), and the like, and compare such observed features with characteristic anatomical data of authorized pedestrians previously stored in a computer. Also, an explosive-proximity sensor (not shown) could be located within the pen 988 to sense whether the pedestrian is contaminated, in some manner, with an explosive material. If the pedestrian's anatomical features are not recognized, or any trace of explosives are detected, the door 998 remains latched, and the pedestrian is not allowed to enter the secured area beyond the barrier fence 980. As noted above, the unauthorized pedestrian can be retained within the pen 988 by the locking of both doors 996 and 998 for further action by the security personnel.

Figure 74:
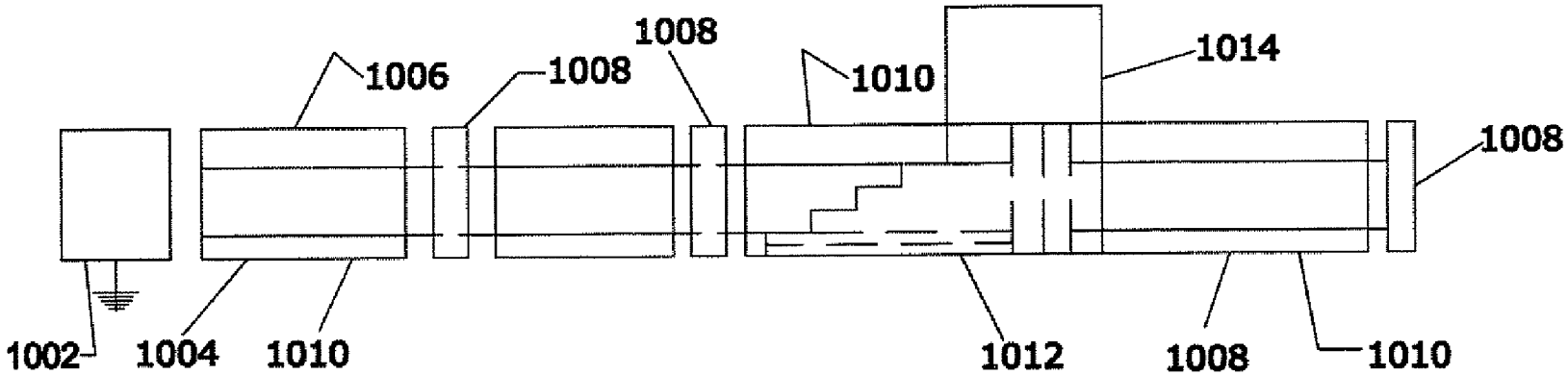
FIG. 74 is a front view of a barrier fence which includes steps adjacent the fence, similar to that of FIG. 24, leading to a pedestrian security-check pen, of the type shown in FIGS. 72 and 73, located above the fence, all in accordance with certain principles of the invention.

Referring to FIG. 74, an end post 1002 of a barrier fence 1004 is anchored to the ground, and tension cables 1006 extend from the end post through intermediate posts 1008, with the cables being conceal within a plurality of panels 1010 located between the intermediate posts. A stairway 1012 is located adjacent a portion of the barrier fence 1004, on an unsecured side thereof. A pedestrian security-check pen 1014 extends from the top of the stairway 1012, over the highest elevation of the barrier fence 1004, and to the secured side of the fence. The pen 1014 is structured essentially identically to the pen 988, as shown in FIG. 73. If a pedestrian seeks entry into the secured area beyond the barrier fence 1004, the pedestrian ascends the stairway 1012, and proceeds as described above with respect to the pen 988.

The security-check facility, as illustrated in FIG. 74, does not require costly anchored end posts such as that illustrated in FIGS. 72 and 73.

Figure 75:
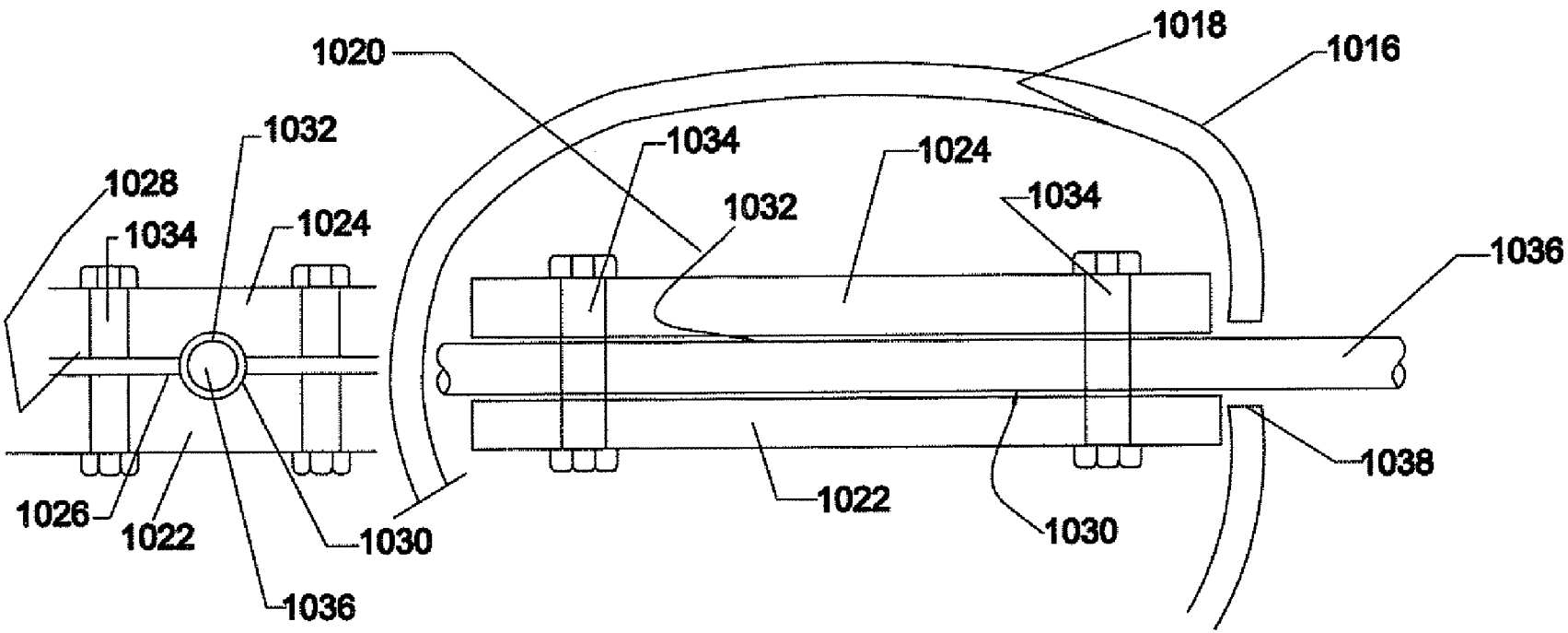
FIG. 75 is a top view showing an end post of a barrier fence including a brake-pad restraining arrangement within the end post for restraining a tension cable, or wire rope, when a portion of the cable, outside of the post, is impacted by a moving vehicle, in accordance with certain principles of the invention.

Referring to FIG. 75, an end post 1016 of a barrier fence is formed with a hollow interior 1018, and is shown with a top thereof removed to reveal a brake-pad restraining arrangement 1020 contained within the end post. The end post 1016 can be composed of concrete, or similar material. The brake-pad restraining arrangement 1020 includes a pair of brake pads or plates 1022 and 1024, which are constrained within the end post 1016 in a stacked arrangement such that respective surfaces 1026 and 1028 thereof are interfacing. The brake plates 1022 and 1024 can be composed of any material, such as metal, ceramic, or the like, which will provide a frictional interface.

The interfacing surfaces 1026 and 1028 may be formed with respective longitudinal arcuate grooves 1030 and 1032, which interface with each other when the respective surfaces are interfacing. A plurality of fastening elements 1034, such as Allen head cap screws and matching nuts, are strategically placed through the pair of plates 1022 and 1024 to retain the pair of plates in the stacked arrangement.

The barrier fence also includes at least one tension cable 1036, or wire rope, which extends between, for example, a pair of the end posts 1016 (one shown). As shown, a portion of the tension cable 1036 extends through an opening 1038 in, and into the interior of, the end post 1016, and is located within the interfacing arcuate grooves 1030 and 1032 of the brake plates 1022 and 1024, respectively, and is clamped therebetween under a prescribed restraining force provided by the plurality of fastening elements 1034. It is within the scope of the invention that surfaces 1026 and 1028 have planar surfaces and clamp on a flat plate which is attached to the cable by any of a number of suitable fastening means such as, for example, a shackle.

When a vehicle impacts the portion of the tension cable 1036 between the spaced end posts 1016, the clamped portions of the cable, within the end posts, are allowed to move slightly axially within the arcuate grooves 1030 and 1032, and under the prescribed restraining force, in a manner similar to a restraining force of an "arresting cable" used to brake an incoming aircraft on the flight deck of an aircraft carrier. Under a frictional braking force of the brake-pad restraining arrangement 1020, the vehicle is stopped after traveling a short distance following impact with the tension cable 1036.

The brake plates 1022 and 1024 can be composed of any material including, for example, metal, ceramic, leather, fabric, composites, or the like, which will facilitate the frictional braking of the axial movement of the tension cable 1036 within the brake-pad restraining arrangement 1020, when the vehicle impacts the cable.

Figure 76:
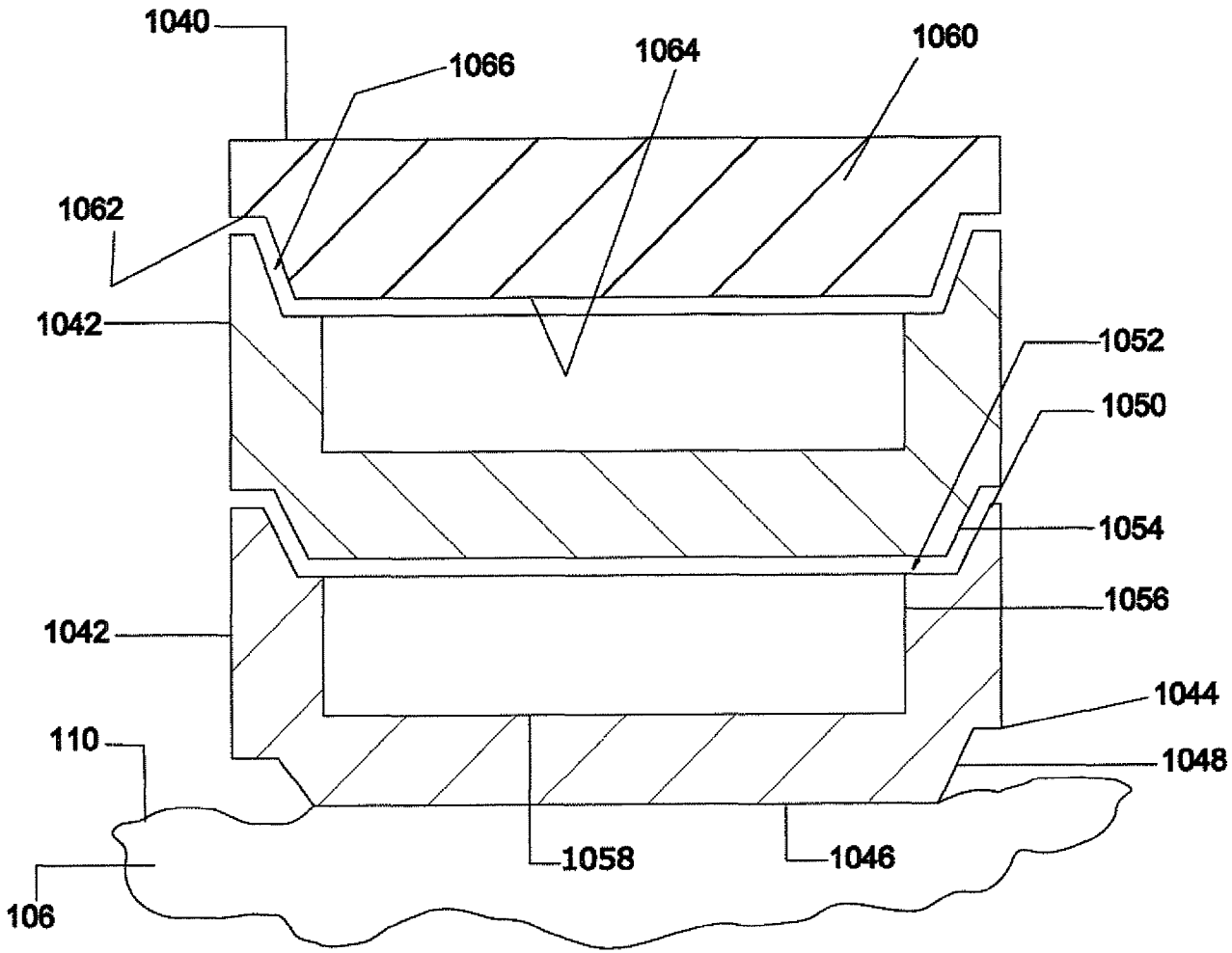
FIG. 76 is side sectional view showing a shock-absorbing end post of a barrier fence formed by a plurality of stackable tub-like modules, which may be filled with silica, sand, stone, or the like, with a top cover on the upper-most module, in accordance with certain principles of the invention.

As shown in FIG. 76, an end post 1040 of a barrier fence is formed by a plurality of stackable tub-shaped modules 1042 (two shown), which may be composed of concrete or the like. The number of modules 1042 to be stacked to form the end post 1040 is optional, and is determined by the designer of the barrier fence. The end post 1040 is setting on the ground level 110 of the soil 106, and may be secured to a below-ground-level foundation. Each of the modules 1042 is formed with an undershoulder 1044 and a base 1046, which is spaced from, and parallel with, the undershoulder. Each module 1042 is further formed with a bevelled surface 1048, which links the undershoulder 1044 with the base 1046.

Each of the modules 1042 is also formed with a top edge 1050 and a and a recessed ledge 1052, which is spaced from, and parallel with, the top edge, and a bevelled surface 1054, which links the top edge and the recessed ledge. Each module

1042 is formed with a tub-like opening 1056, which extends from top edge 1050 to a floor 1058 of the module, spaced inboard from, and parallel with, the base 1046 thereof.

The undershoulder 1044, the base 1046 and the bevelled surface 1048, and the top edge 1050, the recessed ledge 1052 and the bevelled surface 1054, are formed in a complementary fashion to facilitate the stacking of the modules 1042 in such a manner so as to preclude lateral shifting of one module relative to adjacent modules.

A lid 1060, also composed of concrete or the like, is formed with an undershoulder 1062, a base 1064 and a linking bevelled surface 1066, to facilitate positioning of the lid over, and partially into, the opening 1056 of the uppermost module 1042 of the plurality of stacked modules.

Figure 77:
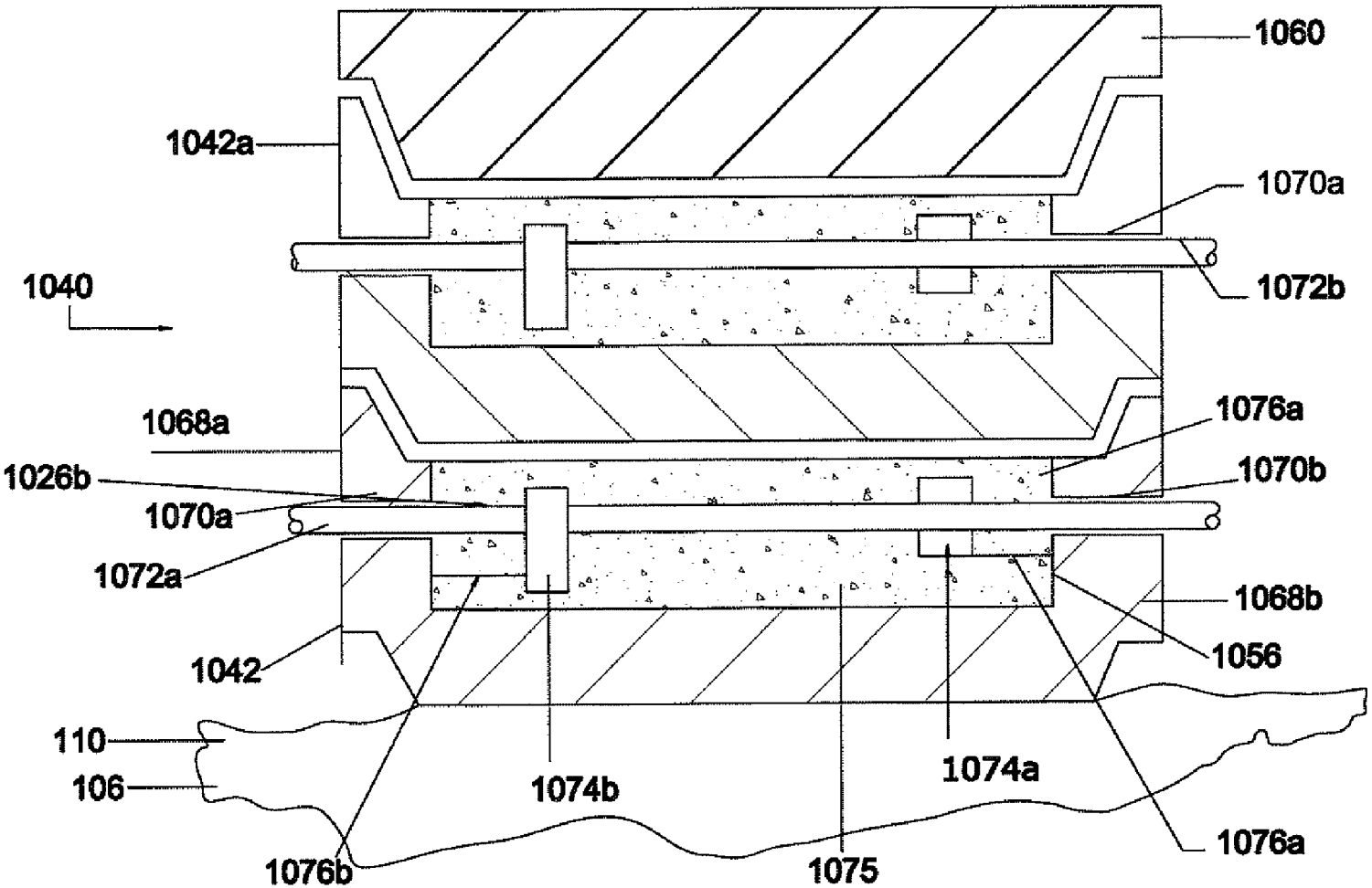
FIG. 77 is side sectional view of the shock-absorbing end post of FIG. 76 showing one or more tension cables extending through spaced side walls of stacked modules of FIG. 76, with disc-like shock absorbers mounted on the cables and embedded within the silica, sand, stone, or the like, in accordance with certain principles of the invention.

Referring to FIG. 77, spaced opposing side walls 1068*a* and 1068*b* of each module 1042 are formed with cable passages 1070*a* and 1070*b*, respectively. Bach of a pair of tension cables 1072*a* and 1072*b* is formed with an exterior section, outside of the module 1042, and an interior section within the module. The tension cable 1072*a* extends from a location outside of the module 1042, through the cable passage 1070*a*, into the opening 1056, and nearly to the side wall 1068*b*. Similarly, the tension cable 1072*b* extends from a location outside of the module 1042, through the cable passage 1070*b*, into the opening 1056, and nearly to the side wall 1068*a*.

Figure 77A:
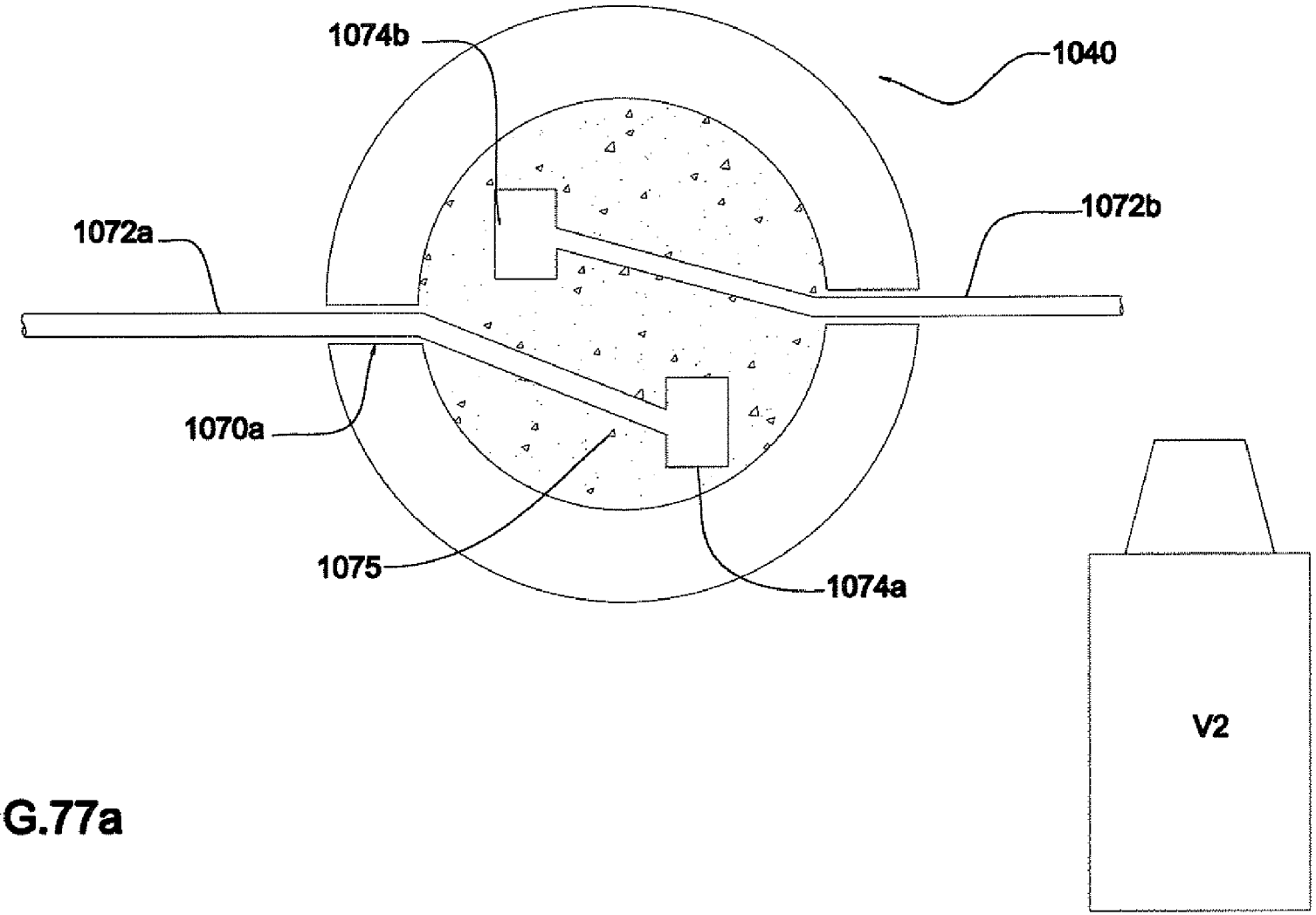
FIG. 77*a* is a top view of one of the stacked modules of FIG. 77 showing the arrangement of the disc-like shock absorbers and tension cables within each module.

As shown in FIGS. 77 and 77*a*, a pair of spaced shock-absorbing discs 1074*a* and 1074*b* are located within the opening 1056 of the module 1042, and are attached to interior ends of the tension cables 1072*a* and 1072*b*, respectively. Thereafter, the tub-like opening 1056 of each module 1042 is filled with a viscous material such as, for example, dry or liquid silica 1075, in a pure or an impure form. In this manner, the discs 1074*a* and 1074*b*, and the interior sections of the respective cables 1072*a* and 1072*b*, are buried within the silica. The opposite ends of the exterior sections of the tension cables 1072*a* and 1072*b* are attached to other tensioning facilities, which could be shock absorbing discs located in other silica-filled modules of end posts spaced from the end post 1040.

Each of a pair of sacrificial tensioning links 1076*a* and 1076*b* is attached, at one end thereof, to an adjacent interior wall of the opening 1056, and, at an opposite end thereof, to a respective one of the discs 1074*a* and 1074*b*. Such attachment of the sacrificial tensioning links 1076*a* and 1076*b* insures that the respective discs 1074*a* and 1074*b* are retained at a desired location within the tub-like opening 1056, at least during a period when the silica 1075 is being deposited into the tub-like opening.

Referring to FIG. 77*a*, when the exterior section of the tension cable 1072*a* is impacted by a vehicle V1, the cable is stretched axially to move the disc 1074*a* within the silica 1075, whereby the shock of the vehicle impact with the cable is absorbed by the silica and the end post 1040. Similarly, when the exterior section of the tension cable 1072*b* is impacted by a vehicle V2, the cable is stretched axially to move the disc 1074*b* within the silica 1075, whereby the shock of the vehicle impact with the cable is absorbed by the silica and the end post 1040. It is noted that, while the plan view of FIG. 77*a* shows that the end post 1040, and each module 1042 of the end post, are round or circular, they could be formed in other shapes, such as, for example, square or rectangular.

Figure 78:
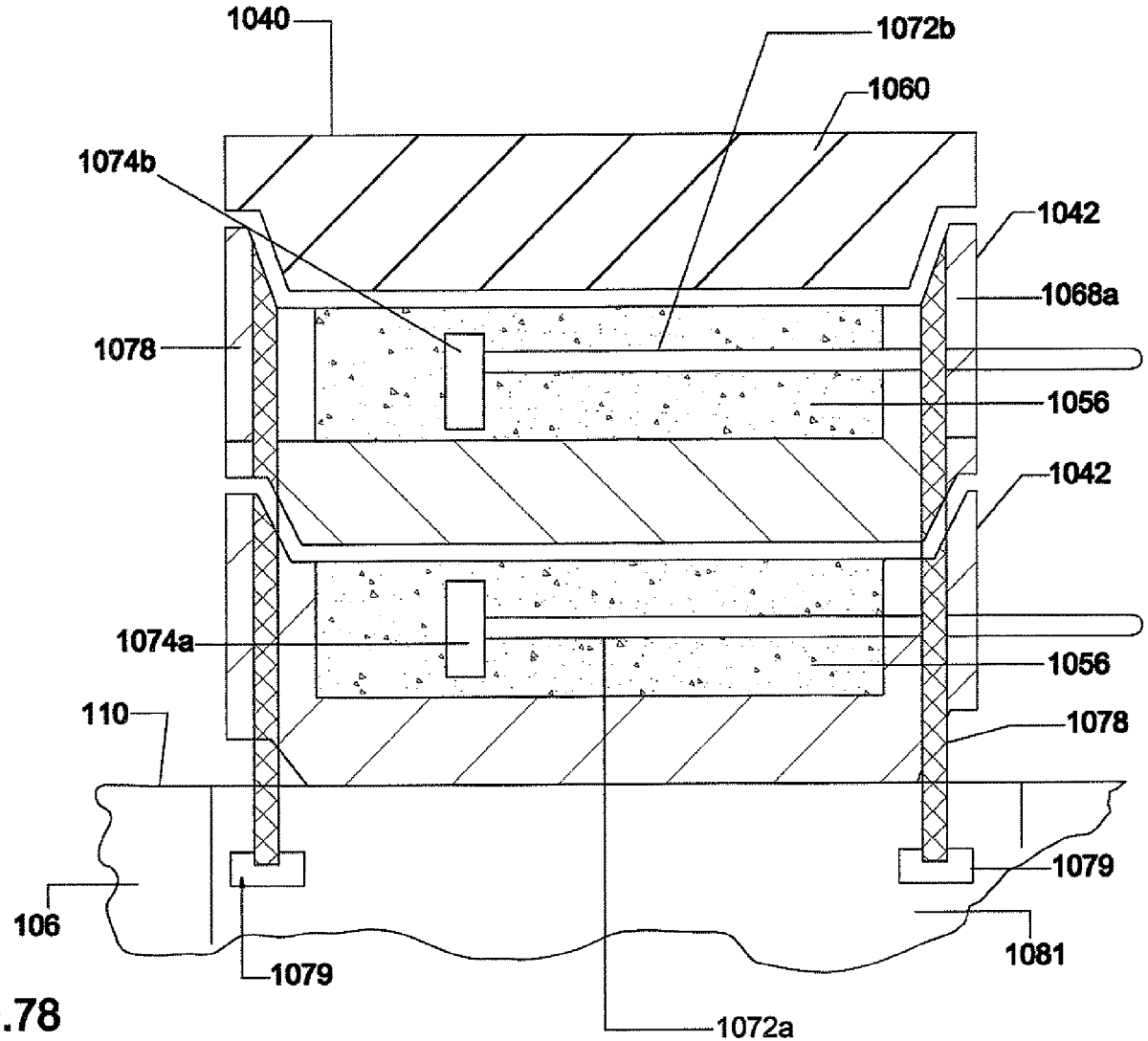
FIG. 78 is a front sectional view showing the stacked modules of FIG. 76 having steel tension members extending through side walls of the modules to secure the modules together and to facilitate anchoring the pins, and thereby the modules, to a subterranean anchor, in accordance with certain principles of the invention.

As shown in FIG. 78, a plurality of tension members 1078 (two shown) are located around the perimeter of the stacked modules 1042, with each member extending through the stacked modules. A lower end of each tension member 1078 is attached to a retainer 1079, which, in turn, is embedded in a concrete anchor footer 1081, extending into the soil 106, below the ground level 110.

For illustration purposes, the cable 1072*b* extends into the opening 1056 of the uppermost module, and is secured to the disc 1074*b*. If a vehicle impacts the cable 1072*a*, and pulls the disc 1074*b* to the right, as described above, the uppermost module 1042 would roll, or tip, to the right, and disturb the integrity of the post 1040. However, the mounting arrangement of the tension members 1078 prevents any rollover of the uppermost module 1042 when the cable 1072*b* is impacted by the vehicle.

It is noted that each of the modules 1042 of the post 1040, of FIG. 78, could include the discs 1074*a* and 1074*b*, secured to associated cables 1072*a* and 1072*b*, respectively, with the discs and module-enclosed portions of the cables, buried in the silica, in the manner shown in FIG. 77. With this fully complemented assembly, the tension members 1078 would preclude any rollover of the modules, in the manner described above.

Figure 79:
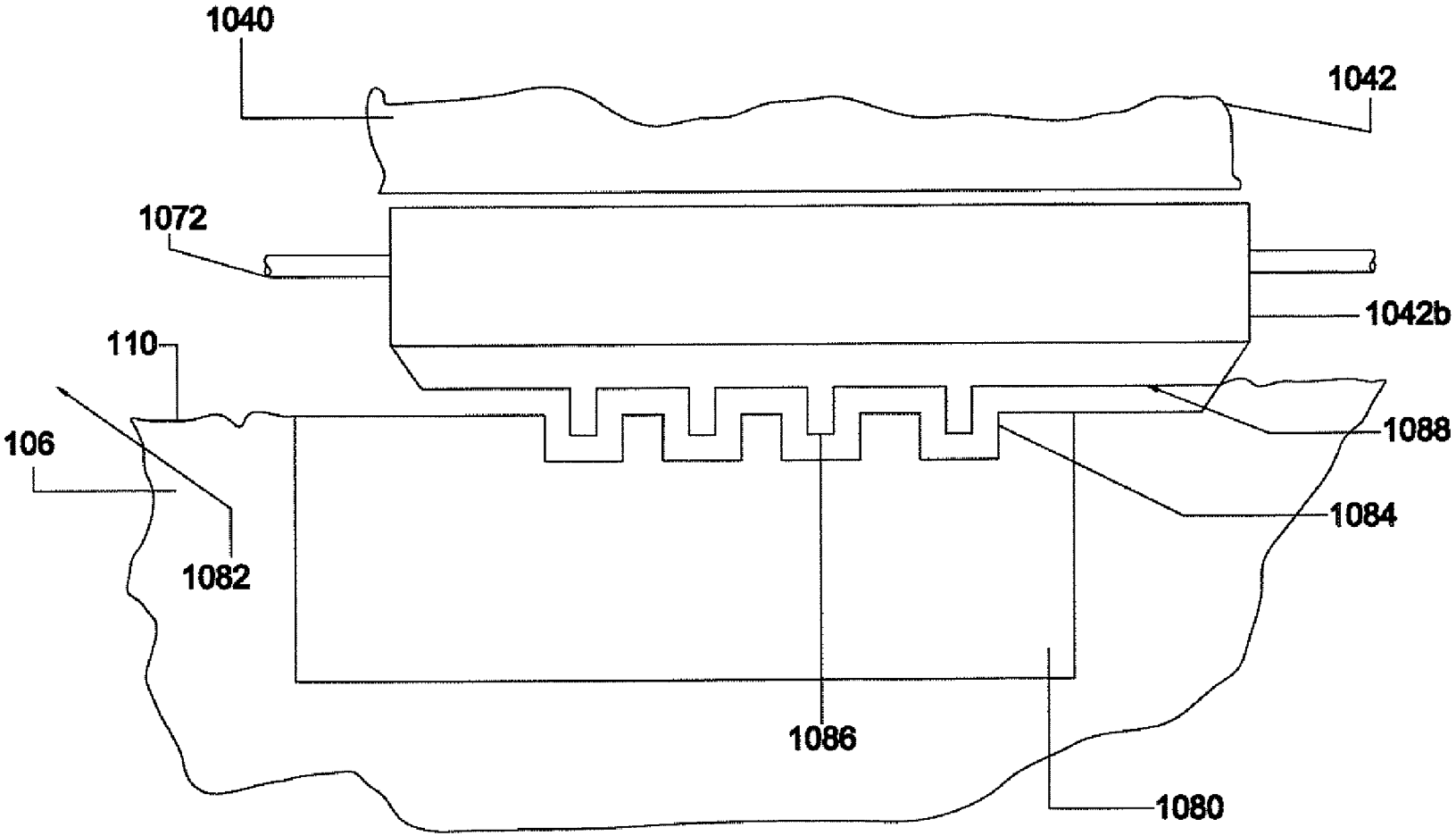
FIG. 79 is a front view showing the stacked modules of FIG. 76 formed with a plurality of spaced projections which extend into a corresponding plurality of spaced openings formed in a subterranean anchor in accordance with certain principles of the invention.

Referring to FIG. 79, a subterranean concrete anchor 1080 is located within the soil 106, with an upper surface 1082 of the anchor being in the plane of the ground level 110. A plurality of spaced notches 1084, or channels, are formed in the upper surface 1082 of the anchor 1080. The end post 1040 includes the plurality of stacked modules 1042, with the lowermost module formed with a plurality of projections 1086, or ribs, in an undersurface 1088 thereof, which extend away from the undersurface.

In assembly, the projections 1086, or the ribs, of the lowermost module 1042*b* are located within the notches 1084, or channels, of the subterranean anchor 1080, to thereby anchor the end post 1040. This technique of anchoring the end post 1040 is particularly useful in areas where the soil 106 is weak.

Figure 80:
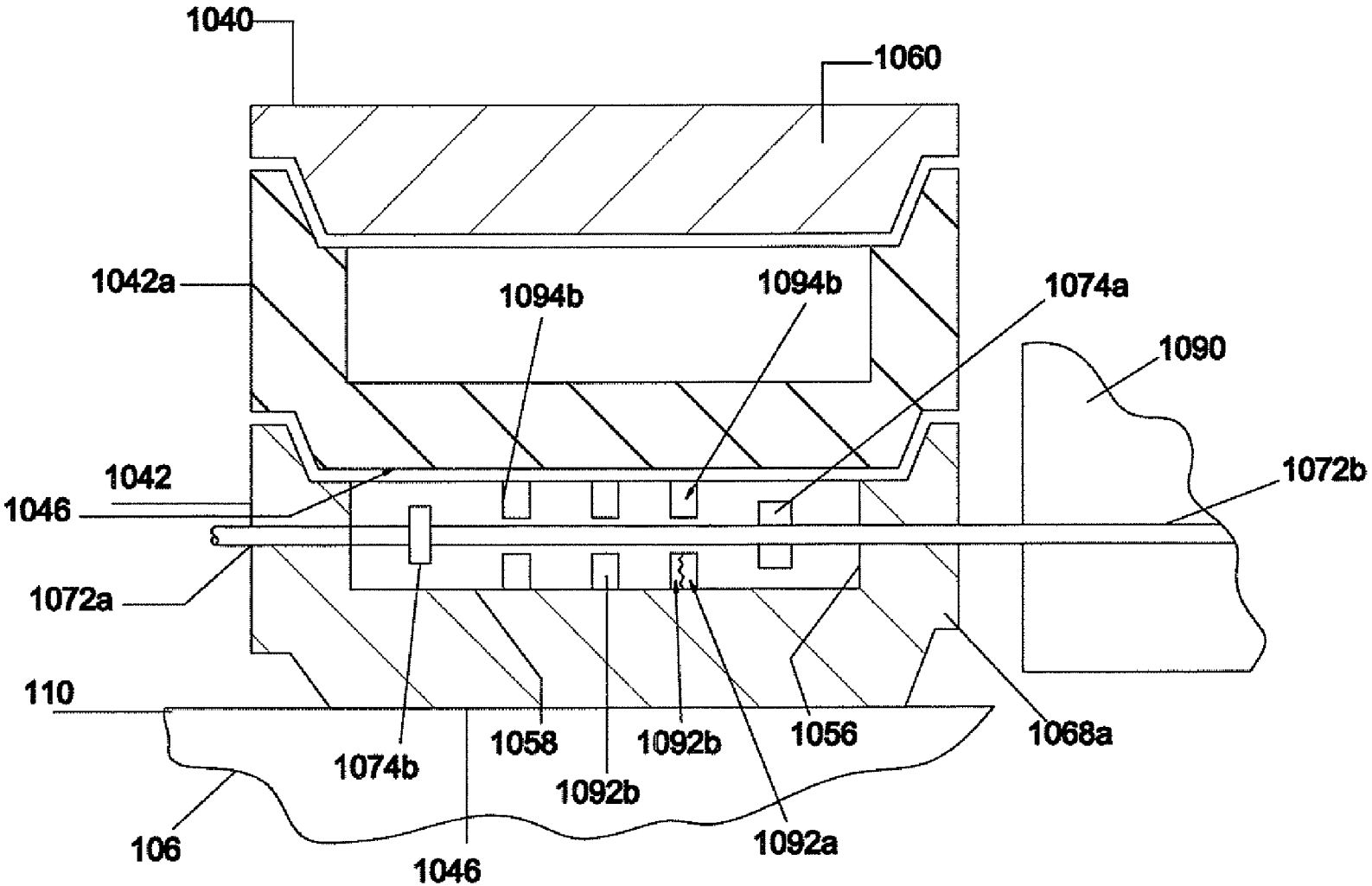
FIG. 80 is a side sectional view showing a plurality of sacrificial projections extending upward from a floor of an opening of a lower module, and downward from an undersurface of an immediate superjacent module, or top lid, to assist in the absorption of any shock resulting from an impact of a vehicle with the tension cable, in accordance with certain principles of the invention.

Referring to FIG. 80, the end post 1040 of the barrier fence includes the plurality of stacked modules 1042 and 1042*a*, and the lid 1060, in the manner described above. With respect to the module 1042, each of the tension cables 1072*a* and 1072*b* extends into the opening 1056 of the module, and is coupled to a respective one of the discs 1074*a* and 1074*b*, in the manner described above. Each of the cables 1072*a* and 1072*b* extends from the module 1042, and is coupled to a respective panel 1090 (one shown).

A first plurality of spaced sacrificial projections 1092*b* are formed integrally with the floor 1058 of the lowermost, or first, module 1042, and extend upward into the opening 1056 of the module, toward, but spaced from and below, the cable 1072*b*. A second plurality of spaced sacrificial projections 1094*b* are formed integrally with the undersurface 1046 of the superjacent, or second, module 1042*a*, which is stacked immediately above the first module 1042. The second plurality of projections 1094*b* of the second module 1042*a* extend downward into the opening 1056 of the first module 1042, toward, but spaced from and above, the cable 1072*b*, and are located in vertical alignment with the first plurality of projections.

The first plurality of projections 1092*b*, and the second plurality of projections 1094*b*, which are in vertical alignment, are located in a path of movement of the disc 1074*b* to the right, as viewed in FIG. 80.

Each of the projections 1092*b* and 1094*b* are strengthened in their formation with the floor 1058 and the undersurface 1046 of the respective modules 1042 and 1042*a* by sections of rebar, which extend through the projections and into adjacent portions of the respective modules.

When a vehicle impacts the tension cable 1072*b*, or an associated panel 1090, the portion of the cable 1072*b*, within the opening 1056 of the first module 1042, is stretched axially, whereby the single disc 1074*b* moves to the right toward, and begins to engage, the projections 1092*b* and 1094*b*. Upon continued movement of the single disc 1074*b* to the right, the projections 1092*b* and 1094*b* are broken away from formation with the floor 1058 and the undersurface 1046, respectively, of the respective modules 1042 and 1042*a*. In this manner, the sacrificial projections 1092*b* and 1094*b*, in conjunction with the moving single disk 1074*b*, provide absorption of the shock resulting from the impact of the vehicle with the cable 1072*b* or the associated panel 1090.

This arrangement can be repeated in successively higher modules 1042, with the uppermost module and the lid 1060 ultimately forming the support for the projections 1092*b* and 1094*b*, respectively, which are located in the opening 1056 of the uppermost module.

A third plurality of spaced sacrificial projections 1092*a* (one partially shown) are formed integrally with the floor 1058 of the lowermost, or first, module 1042, and extend upward into the opening 1056 of the module, toward, but spaced from and below, the cable 1072*a*. A fourth plurality of spaced sacrificial projections 1094*a* (one partially shown) are formed integrally with the undersurface 1046 of the superjacent, or second, module 1042*a*, which is stacked immediately above the first module 1042. The fourth plurality of projections 1094*a* of the second module 1042*a* extend downward into the opening 1056 of the first module 1042, toward, but spaced from and above, the cable 1072*b*, and are located in vertical alignment with the first plurality of projections.

The third plurality of projections 1092*a*, and the fourth plurality of projections 1094*a*, are located in a path of movement of the disc 1074*a* to the left, as viewed in FIG. 80, and are situated behind the first plurality of projections 1092*b*, and the second plurality of projections 1094*b*, respectively.

The third plurality of projections 1092*a*, and the fourth plurality of projections 1094*a*, in conjunction with movement of the single disk 1074*a* to the left as viewed in FIG. 80, provide absorption of the shock resulting from the impact of a vehicle with the cable 1072*a*, in the manner described above with respect to the first plurality of projections 1092*b* and the second plurality of projections 1094*b*.

Again, this arrangement can be repeated in successively higher modules 1042, with the uppermost module and the lid 1060 ultimately forming the support for the projections 1092*a* and 1094*a*, respectively, which are located in the opening 1056 of the uppermost module.

Figure 81:
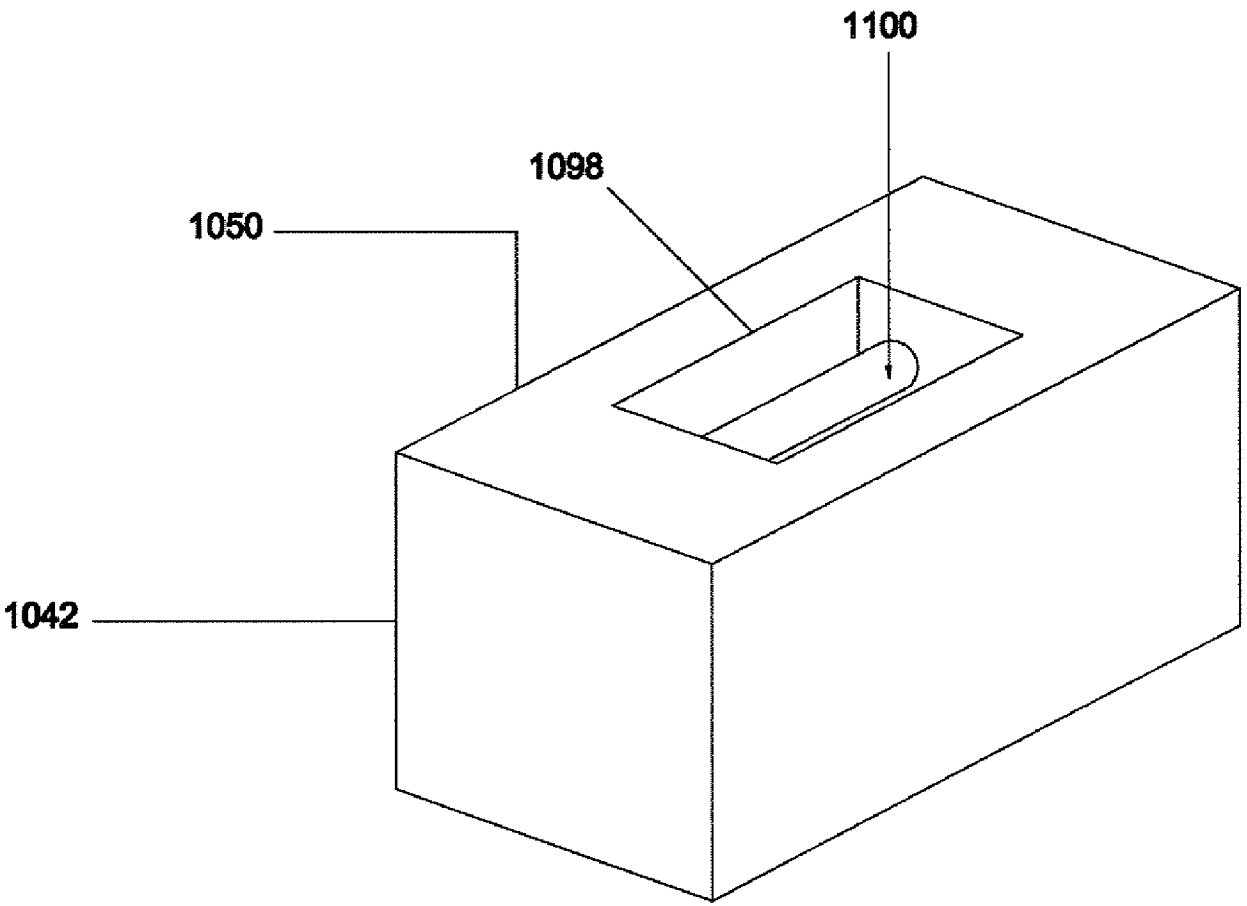
FIG. 81 is a perspective view showing one of a plurality of wells formed strategically in upper edges of one of the modules of FIG. 76, with a lifting bar or lug secured with each well, in accordance with certain principles of the invention.

As shown in FIG. 81, a portion of one module 1042 is shown with a well 1098 formed in a portion of the top edge 1050 thereof. A lifting bar 1100, or any other lifting member, such as an eye bolt, is mounted, and secured, within the well 1098. A plurality of the wells 1098, each with the lifting bar 1100, are formed at spaced locations in the top edge 1050 of each module 1042, about the top perimeter thereof, to facilitate handling of the module during the stacking of the modules to form the end post 1040.

Figure 82:
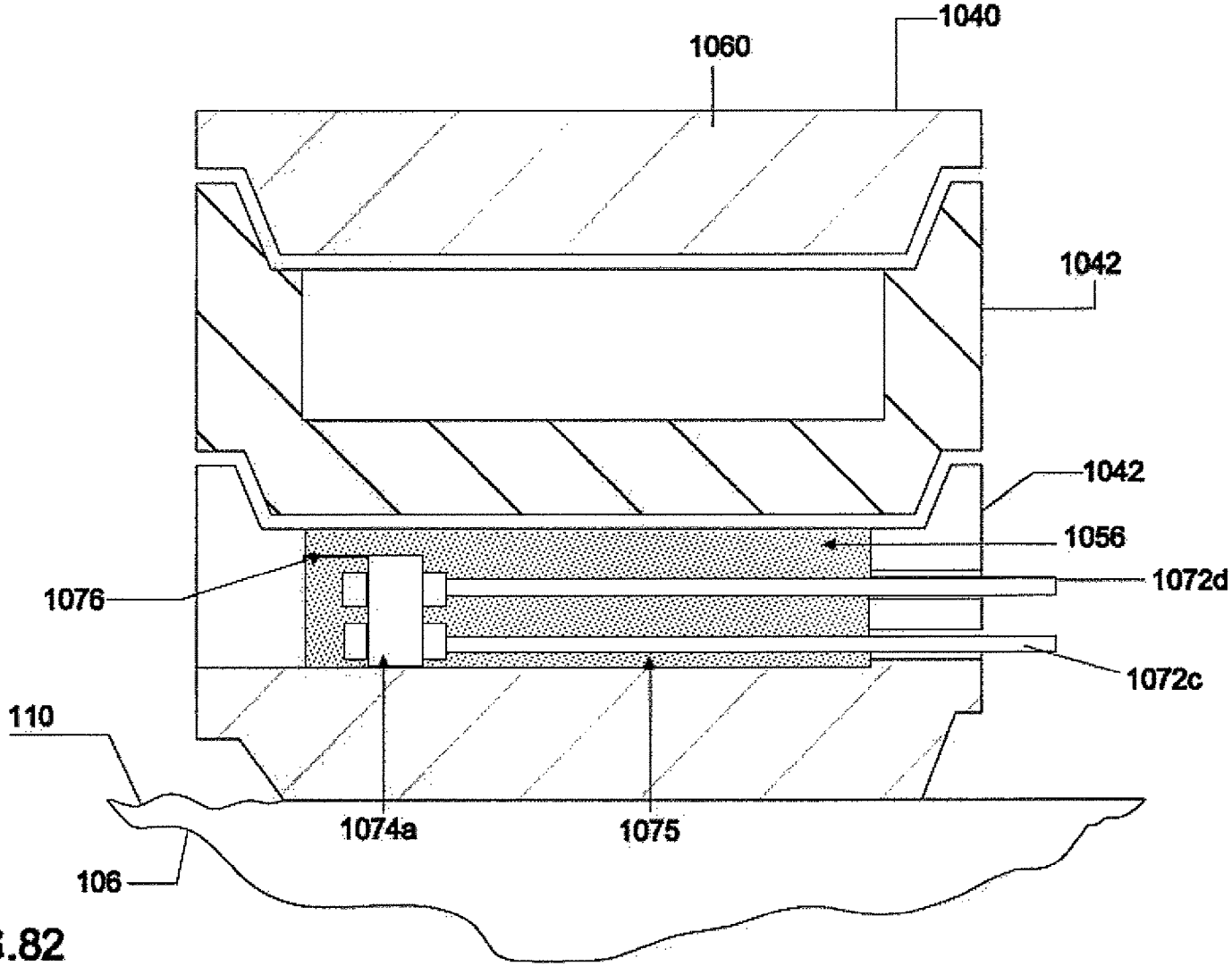
FIG. 82 is a front sectional view showing one of the modules of FIG. 77 with two laterally-spaced tension cables attached to a single disc-like shock absorber in accordance with certain principles of the invention.

Referring to FIG. 82, the end post 1040 of the barrier fence includes the stacked modules 1042 as described above. End portions of a pair of tension cables 1072*c* and 1072*d* are spatially located within the opening 1056 of a lowermost one of the modules 1042. The ends of each of the pair of spaced cables 1072*c* and 1072*d* are attached to spaced portions of a common disc 1074*a*. Silica 1075 is deposited within the opening 1056 of the lowermost module 1042, thereby burying the disc 1074*a* and the end portions of the cables 1072*c* and 1072*d* within the silica.

The cables 1072*c* and 1072*d* extend outward from the opening 1056, and form an exterior portion of the barrier fence. The sacrificial tensioning link 1076 is attached, at one end thereof, to an interior wall of the opening 1056, and at an opposite end to the common disc 1074*a*, to insure that the disc is retained at a desired location within the opening 1056, at least during a period when the silica 1075 is being deposited into the opening.

When exterior portions of the tension cables 1072*c* and 1072*d* are impacted by a vehicle, the cables are stretched axially to move the common disc 1074*a* within the silica 1075, whereby the shock of the vehicle impact with the cables is absorbed by the silica and the end post 1040. Upon movement of the common disc 1074*a*, the sacrificial link 1076 is broken, which does not deleteriously affect the shock absorbing reaction described above.

The arrangement with the common disc 1074*a*, and the pair of cables 1072*c* and 1072*d*, can be repeated within the openings 1056 of the plurality of stacked modules 1042.

Figure 83:
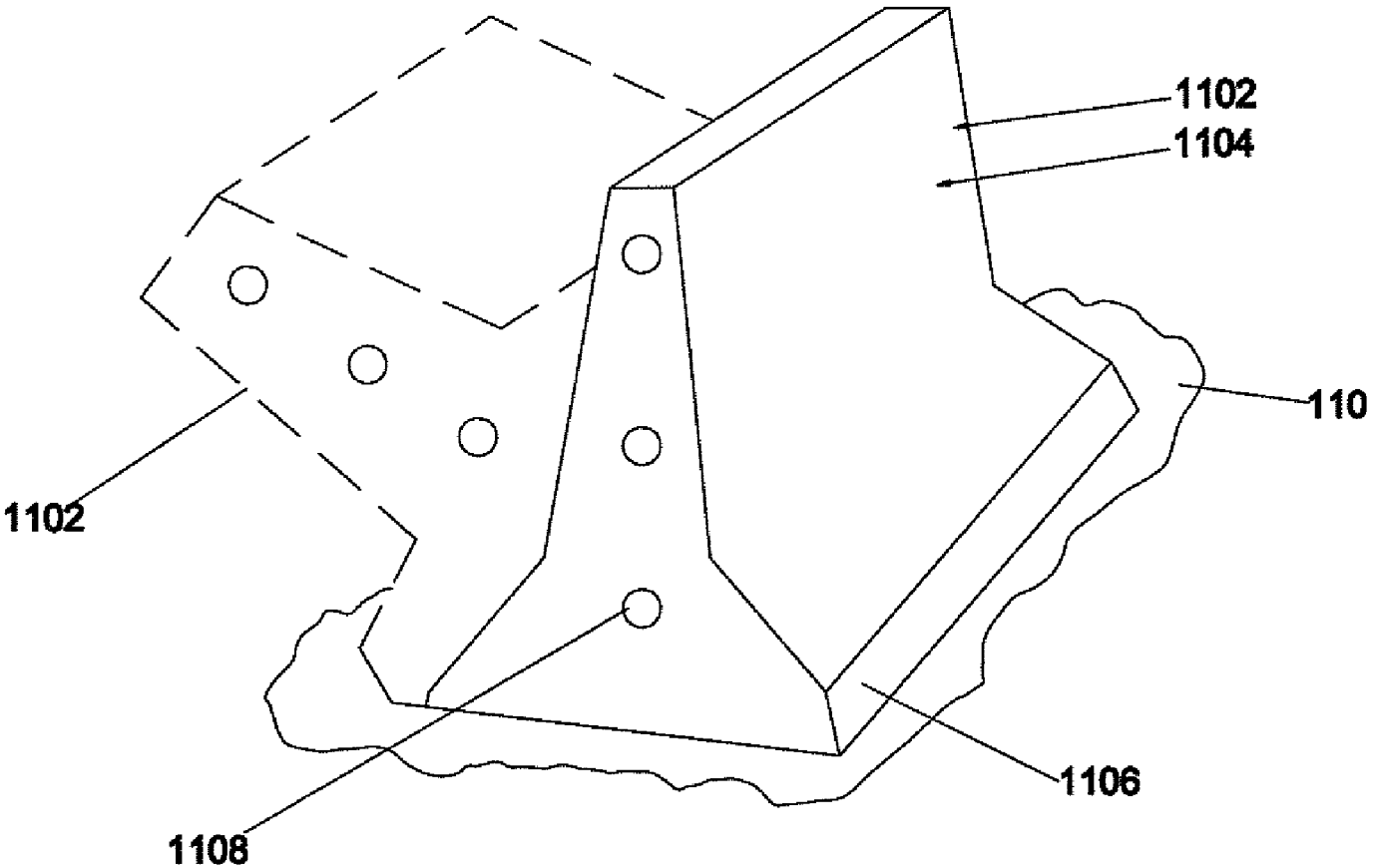
FIG. 83 is a perspective sectional view showing a barrier fence formed by a base and an integral impact wall extending perpendicularly from the base, with tension cables extending through the fence, in accordance with certain principles of the invention.

As shown in FIG. 83, an intermediate post 1102 of a barrier fence is formed with an upstanding beam 1104 and a pedestal or foot 1106 which is resting on the soil at ground level 110. The beam 1104 of the post 1102 is formed with a plurality of spaced cable passages 1108, which provide through-passage for a corresponding plurality tension cables (not shown) of the barrier fence.

When a vehicle impacts the intermediate post 1102, the post will slide, or will roll as shown in phantom in FIG. 83, depending on the parameters of the intermediate post. When the intermediate post 1102 rolls, the portion of the foot, which is farthest from the vehicle, will dig into the soil, and the portion of the foot, which is closest to vehicle, will pivot upward into destructive engagement with the undercarriage of the vehicle. During the rolling of the intermediate post 1102, the plurality of the tension cables are stressed to slow, and stop, the continued movement of the vehicle.

Figure 84:
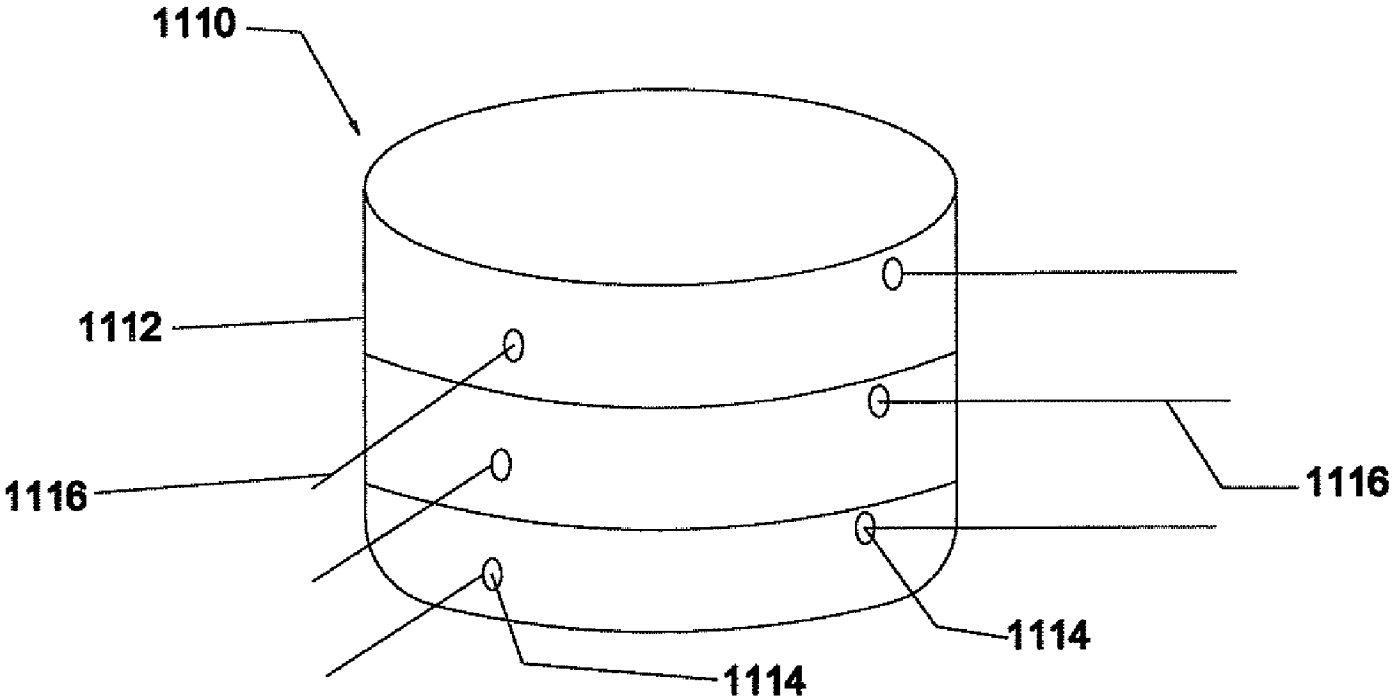
FIG. 84 is a perspective view showing a round end post with tension cables extending in different directions from the end post in accordance with certain principles of the invention.

Referring to FIG. 84, a round end post 1110, of a barrier fence, is formed by stacking a plurality of circular modules 1112. Each of the modules 1112 is formed with cable passages 1114, which can be arranged in such a manner that tension cables 1116 enter the end post 1110 from a first direction, pass through the end post, and can be directed in any selected direction, which is different from the first direction, upon exiting the end post.

Figure 85:
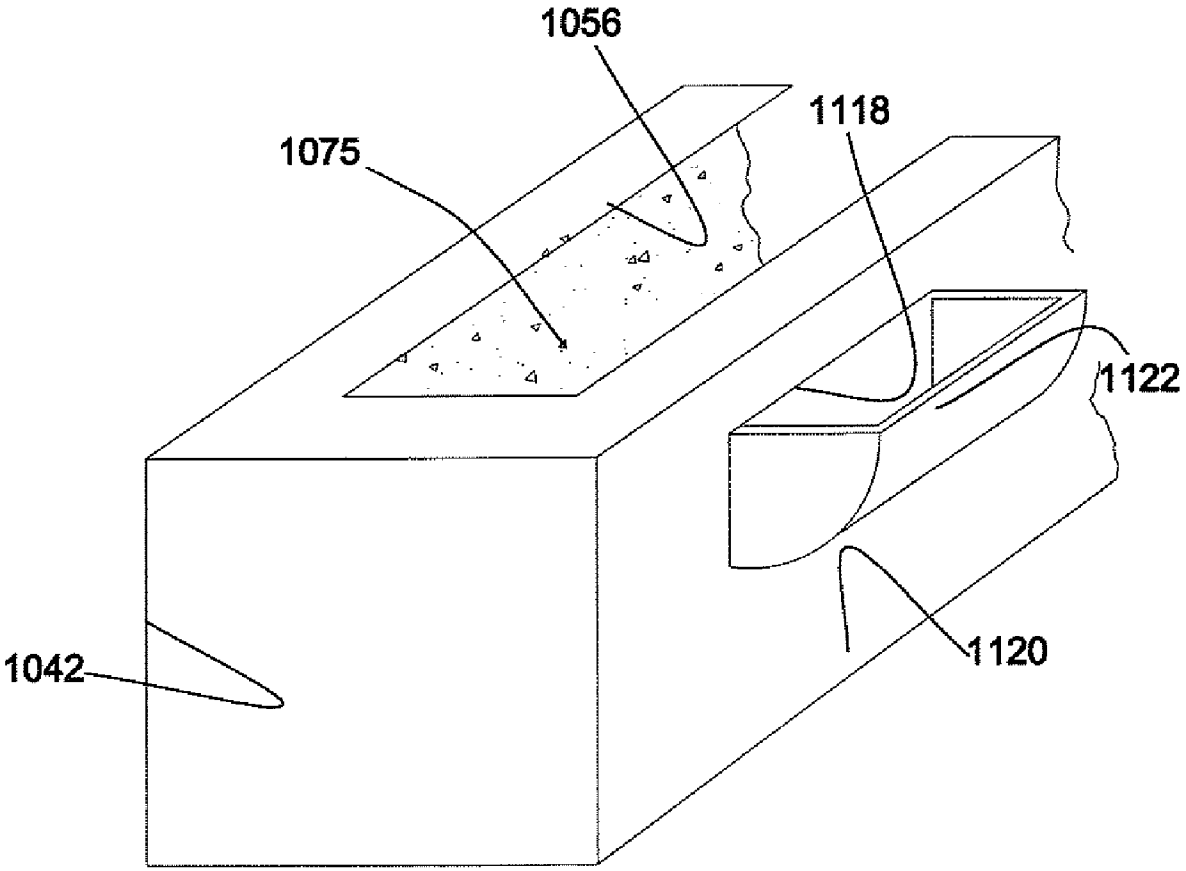
FIG. 85 is a partial perspective view showing one of the modules of FIG. 76, with a side window for depositing silica into the module, and a detachable funnel for facilitating the depositing of the silica, in accordance with certain principles of the invention.

As shown in FIG. 85, the module 1042 is formed with a window 1118 in a side wall 1120 thereof. A detachable funnel 1122, formed generally in a quarter-round cross-section, is positionable adjacent the window 1118, to facilitate the timely deposit of the silica 1075 into the opening 1056 of the module 1042, as described above with respect to FIGS. 77 and 82.

Figure 86:
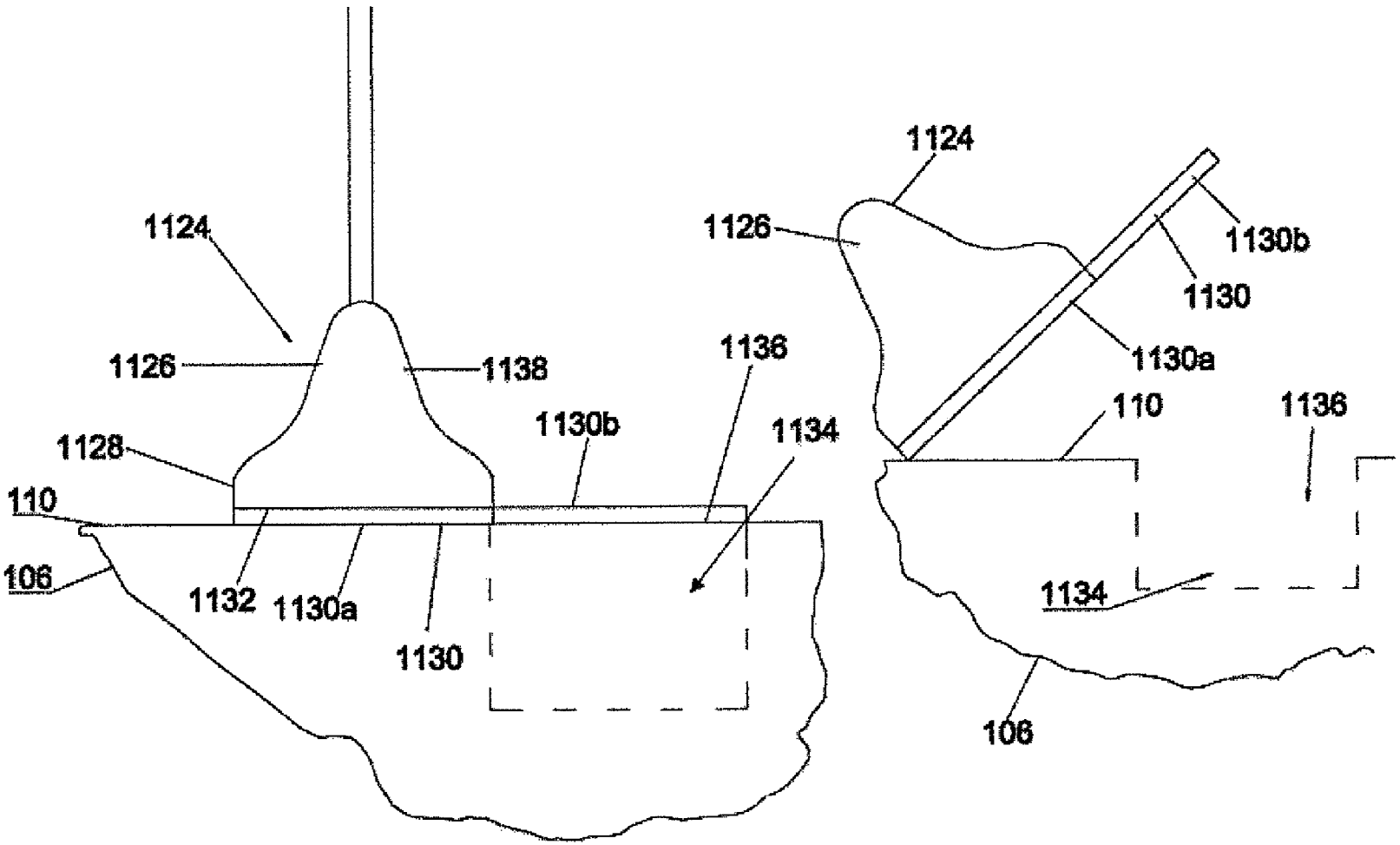
FIG. 86 is a side view showing a redundant barrier arrangement which includes a fence formed with a base and an integral wall, and a base plate having a first portion secured to an underside of the base, and a second portion extending in a direction away from one side of the base of the wall, in accordance with certain principles of the invention.

Referring to FIG. 86, an intermediate post 1124 of a barrier fence is formed with an upstanding beam 1126 and a pedestal or foot 1128. A first portion 1130*a* of a flat plate 1130 is secured to an undersurface 1132 of the foot 1128, with a second portion 1130*b* of the flat plate extending in cantilever in a direction away from the foot.

A channel, moat, trench, or ditch 1134 is formed in the soil 106 along a length of the fence with an opening 1136 at ground level 110. The assembly of the first portion 1130*a* of the flat plate 1130, and the intermediate post 1124, is placed on the ground at ground level 110, immediately adjacent or over the opening 1136 of the channel 1134 along the length of fence, with the first portion 1130*a* of the flat plate resting at least partially on the ground and covering the channel 1134, and the second portion 1130*b* of the flat plate being located over, and covering, the channel along the length of fence.

With this arrangement, the second portion 1130*b* of the flat plate 1130 extends from a channel-side 1138 of the intermediate post 1124.

When a vehicle approaches the channel-side 1138 of the intermediate post 1124, and impacts the post, or cables and fence panel adjacent the post, the post and the plate 1130 will slide over the ground, away from the channel 1134, to thereby expose the now-open channel. If, thereafter, a second vehicle attempts to approach the intermediate post 1124 from the channel-side 1138, forward portions of the second vehicle will fall into the open channel 1134, and be precluded from advancing beyond the channel.

When impacted by the vehicle, the intermediate post 1124 could roll instead of sliding, whereby the post and the plate 1130 are pivoted to expose the open channel 1134.

With this arrangement, whether the intermediate post 1124 slides or rolls upon impact by a vehicle, a redundant barrier is established to preclude movement of two successive vehicles beyond the intermediate post and the channel 1134.

It is noted that the redundancy principle of the post 1124 and the channel 1134, as described above, could function without the use of the flat plate 1130. For example, the width of the foot 1128 of the post 1124 could be formed with a sufficient dimension that the foot would be placed over, or straddle, and conceal the channel 1134. When the post 1124 is impacted by a vehicle, the post would tip, roll or slide away from the channel 1134, thereby exposing the redundant barrier of the channel to a second vehicle.

Figure 87:
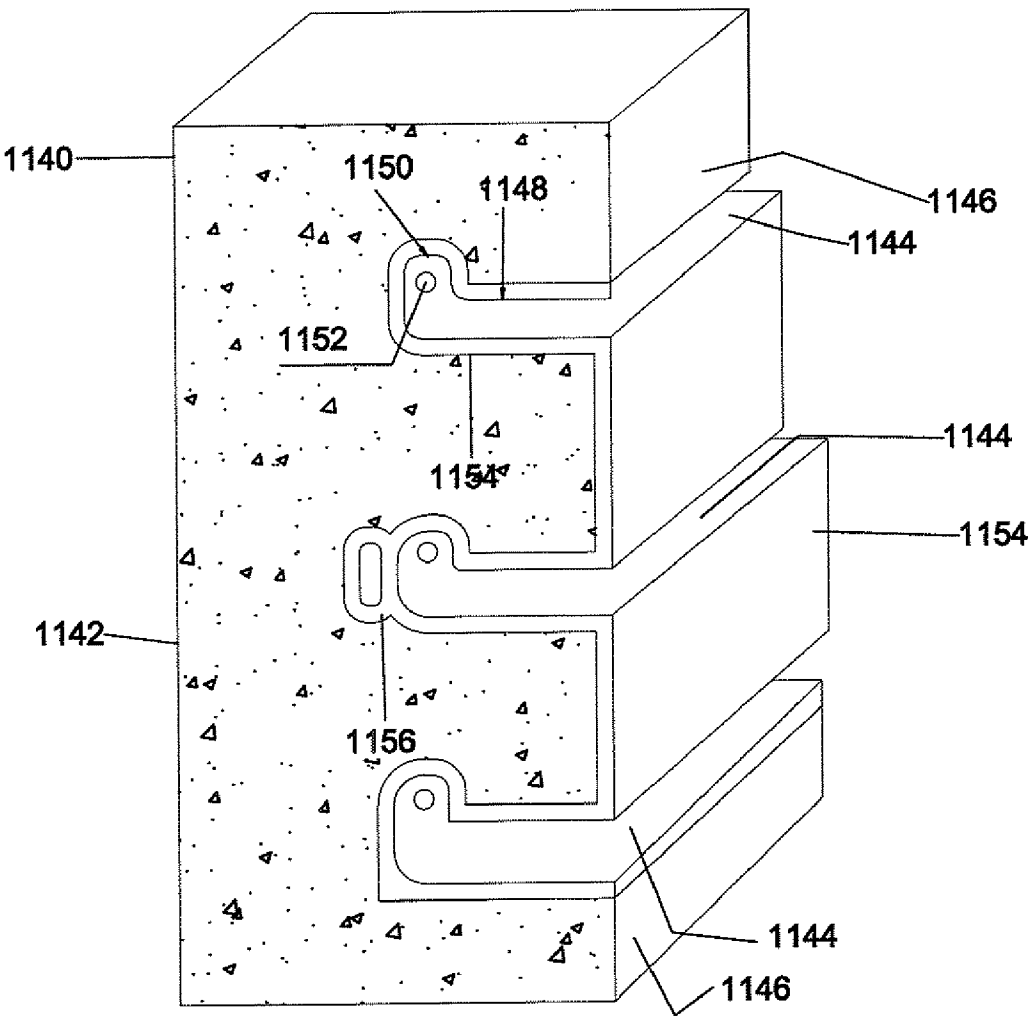
FIG. 87 is a perspective sectional view showing a reinforced concrete panel having a decorative face on one exterior wall, with a preformed plastic insert captured within the panel to form spaced passages for receipt of tension cables, in accordance with certain principles of the invention.

As shown in FIG. 87, an intermediate panel 1140 of a barrier fence is formed, in a casting operation, from reinforced concrete, by pouring fluid concrete into a cavity of a mold, which, upon curing of the concrete, forms the panel in a desired shape. During the casting process, the panel 1140 is formed with a decorative face on one side 1142 thereof, and is formed with a plurality of "L" slots 1144 on a side 1146 of the panel opposite from the one side. Each of the "L" slots 1144 are formed with a long-leg opening 1148, which is perpendicular with the side 1146, and a short-leg opening 1150 which is perpendicular with the long-leg opening.

When attempts are made to remove the cured concrete panel 1140 from the cavity of the mold, difficulty may be encountered due to the manner in which the mold is configured to facilitate the forming of the short-leg openings 1150. To alleviate any difficulty during the removal of the finished concrete panel 1140 from the mold cavity, and prior to the pouring of the fluid concrete into the cavity, an integral preform 1154 is manufactured in the configuration of the plurality of the "L" slots 1144.

As the fluid concrete is poured into the cavity of the mold, the fluid concrete forms about the exterior of the preform 1154. After curing of the concrete in the configuration of the panel 1140, the preform 1154 is now captured with the panel, and the formed assembly of the cured concrete and the preform can be easily removed from the cavity as an integral unit.

It is noted that the integral preform 1154 could be composed of PVC, aluminum, steel, or any other suitable material.

In similar fashion, a passage 1156 can be included within the cast concrete for placement of electrical or optical wiring.

When assembling the panel 1140 with each of a plurality of tension cables 1152, each of the cables is inserted in, and moved through, the long-leg opening 1148 of a respective one of the plurality of "L" slots 1144, and then, with relative movement between the cable and the panel, the cable is moved into the respective short-leg opening 1150. In this manner, the intermediate panel 1140 is hung from the plurality of tension cables 1152.

Shapes and configurations, other than those of the long leg openings 1148 and the short leg openings 1150, of the "L" slots 1144, could be employed to provide facility for hanging the intermediate panel 1140 on the tensions cables 1152.

Figure 88:
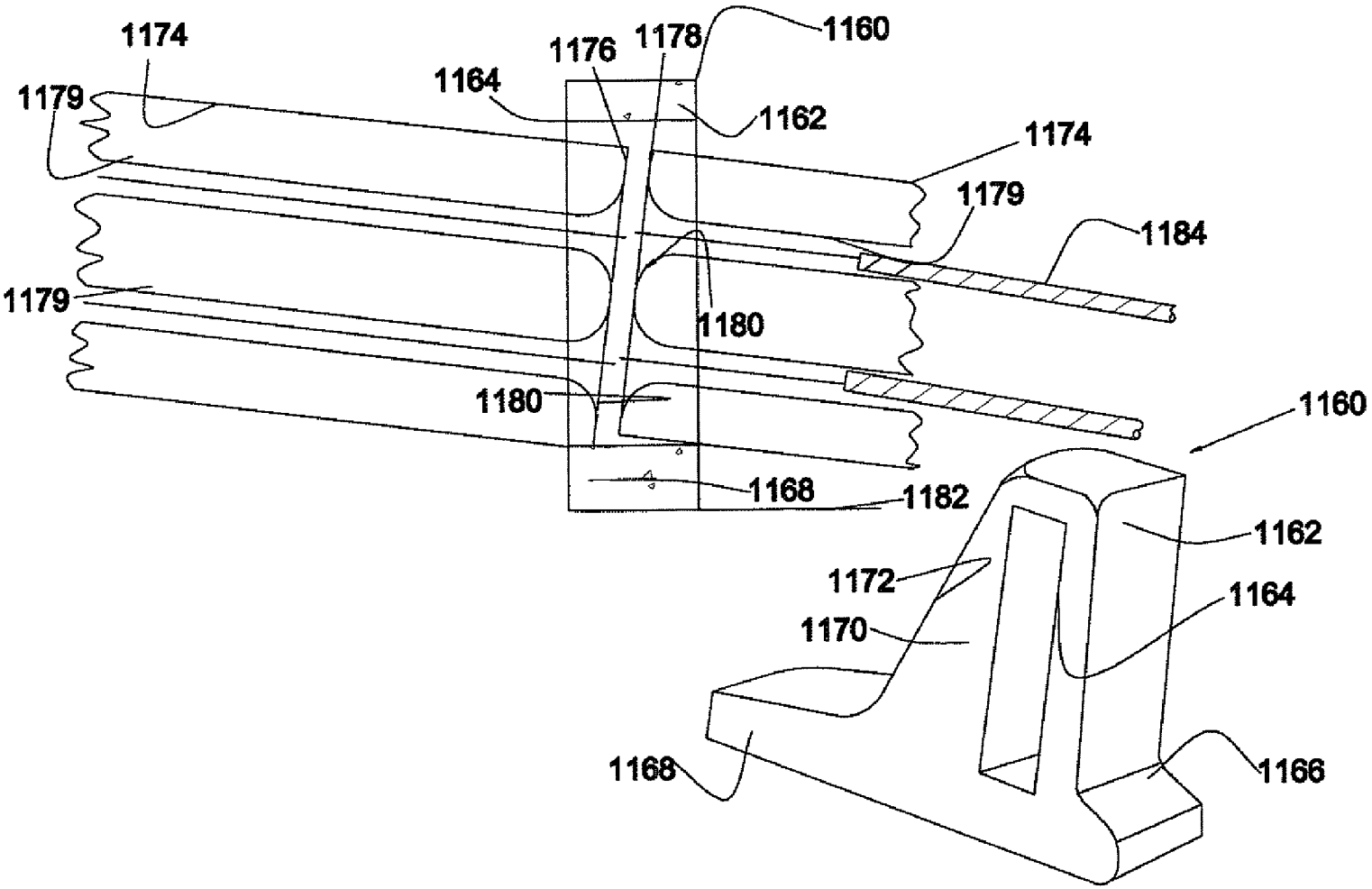
FIG. 88 is a combined perspective view and a sectional view showing a post for supporting adjacent ends of two serial panels, with structure for supporting the panels in alignment with a sloping terrain while locating the post in a vertical orientation independent of the sloping terrain.

Referring to FIG. 88, each of a plurality of posts 1160, of a barrier fence, is formed with a beam 1162 having a vertically-elongated side passage 1164 formed therethrough, which is formed with a prescribed top-to-bottom dimension. The post 1160 is formed with a foundation comprising a short foot 1166, which extends laterally, in a first direction, from a base of the beam 1162, and a long foot 1168, which extends laterally from the base of the beam in a second direction opposite the first direction. The beam 1162 is formed with an enlarged section 1170, above the long foot 1168, with the enlarged section being formed with a sloping surface 1172 extending downward and outward from a top of the beam.

Each of a plurality of panels 1174, of the barrier fence, is formed with a top-to-bottom dimension, which is less than the prescribed top-to-bottom dimension, with each panel extending between opposite ends 1176 and 1178 thereof. A plurality of cable passages 1179, or conduits, are formed in each panel 1174, and extend between the opposite ends 1176 and 1178 of the panel. At each of two ends of each of the cable passages 1179, the passage is formed with an opening 1180, which is flared, at least upward and downward.

In the formation of the barrier fence, a plurality of the posts 1160 are spaced along a sloping terrain 1182, with each post being mounted in a vertical orientation. With respect to each post 1160, the opposing ends 1176 and 1178 of two adjacent panels 1174 are located within the vertically-elongated passage 1164 of the post.

Due to the sloping terrain 1182, adjacent, spaced vertically-oriented posts 1160 will be mounted at different levels over the sloping terrain. As noted above, the vertically-elongated passage 1164 of the post 1160 is formed with the prescribed top-to-bottom dimension, which is greater than the top-to-bottom dimension of the panels 1174. This allows serial post-mounted panels 1174 to be mounted angularly with respect to the vertically-oriented posts 1160, whereby the panels follow the slope of the terrain, as illustrated, while the posts remain in the vertical orientation.

With the sloping arrangement of adjacent panels 1174, the centerlines of the respective passages 1179 of the panels are offset and not aligned, as illustrated. Therefore, a continuous length of a tension cable 1184, which extends through the respective passages 1179 of adjacent panels 1174 will also be offset at the juncture of the adjacent panels.

To accommodate the offset condition of the tension cable 1184, at the juncture of the adjacent panels 1174, the respective passages 1179 of adjacent panels 1174 are formed with the upward and downward flared openings 1180, as described above. In this manner, the tension cable 1184 is allowed to form a jog at the juncture of the adjacent panels 1174, but the portions of the cable, which are located within the respective passage 1179 of each panel, essentially are aligned with the centerline within the respective passage.

It is noted that the openings 1180 could also be formed with flared portions in other directions, besides upward and downward, such as, for example, funnel-shaped, to accommodate other directional misalignments of the centerlines of the passages 1179.

When a high-speed vehicle impacts the barrier fence, the posts 1160 could be moved as a result of such an impact, which could result in stretching and lateral movement of the tension cables 1184. Also, the panels 1174 could shift in such a manner that the centerlines of the passages 1179 could be offset still farther from the offset misalignment illustrated in FIG. 88.

If the openings 1180 were not flared, and the panels 1174 are impacted by the high-speed vehicle, the relative shifting of the panels and the tension cables 1184 could cause the cables to engage sharp corners at the entry and exit ports of the openings, thereby subjecting the cables to deleterious stresses, resulting in damage to, and even severing of, the cables.

Since the openings 1180 of the panels 1174 are flared, as noted above, the portions of the cables 1184, which are located within the area of the flared openings, are allowed to move laterally with minimal stress, and without engaging any sharp corners of the panels. In this manner, the flared openings 1180 provide a stress relief for the tension cables 1184 when the barrier fence is impacted by a high-speed vehicle.

Figure 89:
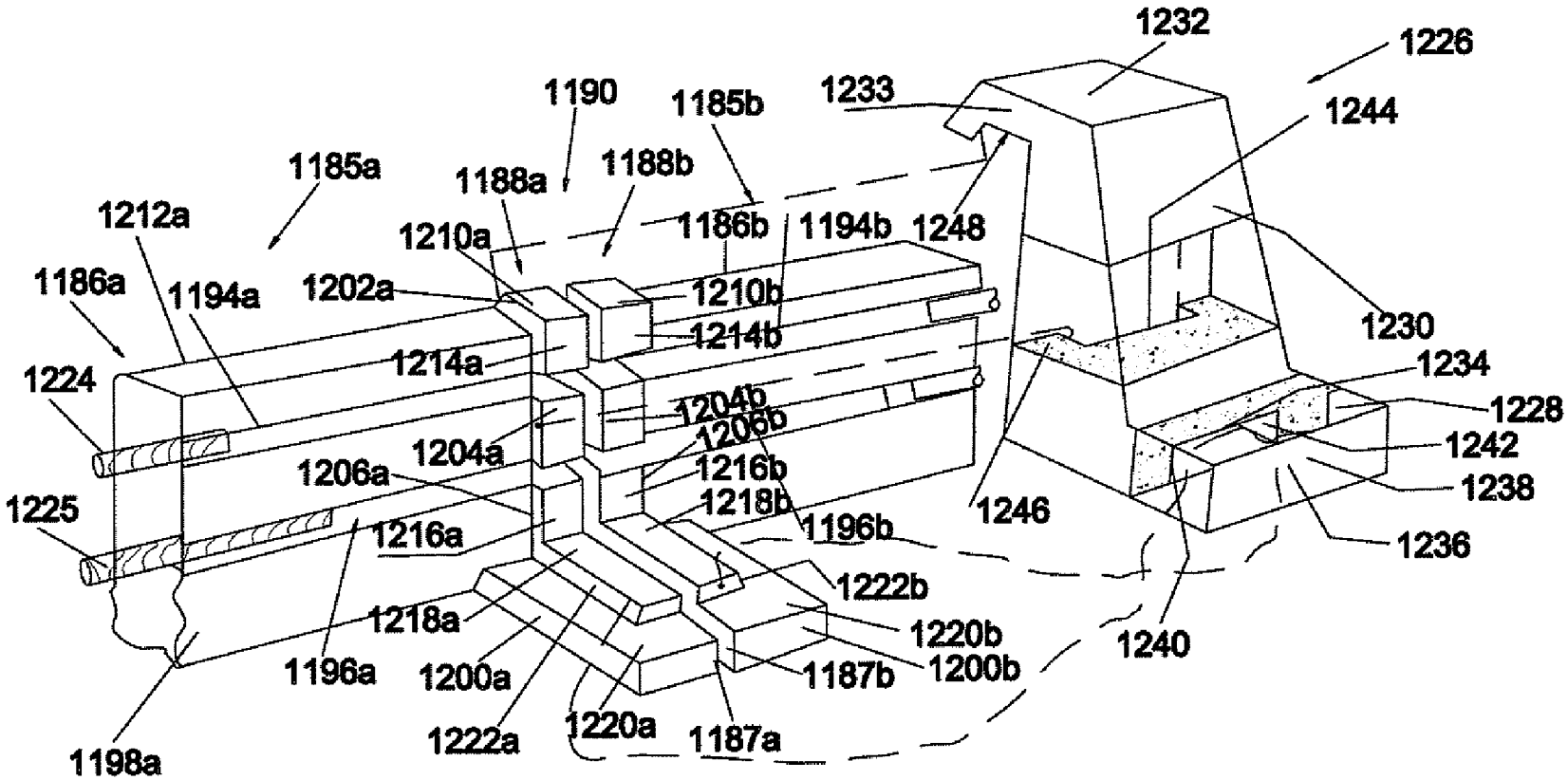
FIG. 89 is a perspective view showing two serial panels having preformed end structure which cooperates with complementary structure of a common intermediate post to retain assembly of adjacent panels, where the post also functions as a keeper for retaining tension cables, or wire ropes, within aligned grooves of a plurality of the panels.

As shown in FIG. 89, adjacent integrally-formed panel/post modules 1185*a* and 1185*b*, of a barrier fence, are formed with panels 1186*a* and 1186*b*, respectively, and with post-like structures 1188*a* and 1188*b*, respectively, at opposing ends thereof. The modules 1185*a* and 1185*b* are formed with interfacing end surfaces 1187*a* and 1187*b*, respectively, and are assembled in an end-butting arrangement where the post-like structures 1188*a* and 1188*b*, respectively, combine to form an intermediate post 1190 of the barrier fence.

The structure of the modules 1185*a* and 1185*b* are nearly identical. Therefore, the detailed description below will be limited to the module 1185*a*, with numerals which identify structural features of the module 1185*a* being followed by the suffix "a." It is to be understood that, in FIG. 89, the same numerals, with the suffix "b," will be used to identify identical or similar structural features of the module 1185*b*.

A pair of spaced cable passages 1194*a* and 1196*a* are formed in a rear face 1198*a* of the module 1185*a*. The module 1185*a* is formed with a pedestal 1200*a*, having a prescribed width and a prescribed length, which extends from a lower portion of the rear face 1198*a*, with a bottom of the pedestal being flush with remaining portions of a bottom of the module 1185*a*.

The post-like structure 1188*a* of the module 1185*a* is formed with a plurality of vertically-aligned spaced projections 1202*a*, 1204*a* and 1206*a*, each of which have an end surface which forms a portion of the end surface 1187*a* of the module 1185*a*. The projection 1202*a* includes an upper section 1210*a*, which extends upward from a top face 1212*a* of the module 1185*a*, and a rear section 1214*a*, which extends outward from the rear face 1198*a* of the module. The projection 1204*a* extends outward from the rear face 1198*a* of the module 1185*a*. The projection 1206*a* includes an upper rear section 1216*a* and a lower rear section 1218*a*, both of which extend from the rear face 1198*a* of the module 1185*a*.

The lower rear section 1218*a* extends rearward farther than the upper rear section 1216*a*, and is formed integrally with an upper surface 1220*a* of the pedestal 1200*a*. Also, the lower section 1218*a* is formed with a width and a length which are less than the prescribed width and the prescribed length, respectively. Further, an outboard side surface 1222*a* of the lower rear section 1218*a* is bevelled, at a prescribed angle, outward from top to bottom thereof.

It is noted that, as illustrated in FIG. 89, the modules 1185*a* and 1185*b* are spaced slightly apart to show the various structural features thereof. When the modules 1185*a* and 1185*b* are to be assembled, in the process of forming the barrier fence, the interfacing end surfaces 1187*a* and 1187*b* may be moved into abutting engagement to form the intermediate post 1190. Thereafter, a pair of tension cables 1224 and 1225 are placed laterally into the aligned cable passages 1194*a* and 1194*b*, and 1196*a* and 1196*b*.

A keeper 1226 is formed integrally with a base section 1228, an intermediate beam section 1230, and a top section 1232. A forward edge of the top section 1232 is formed with a downturn 1233. A bottom channel 1234 is formed in a bottom surface 1236 of the base section 1228, and extends in a rearward direction toward, but not through, an exterior rear surface 1238 of the base section 1228. Spaced, interfacing side walls 1240 and 1242 of the bottom channel 1234 are bevelled at an angle which is complementary to the prescribed bevel angle of the side surfaces 1222*a* and 1222*b* of the modules 1185*a* and 1185*b*, respectively.

A front channel 1244 is formed in a front surface 1246 of the intermediate beam section 1230, and extends, from a location where the front channel communicates with the bottom channel 1234, toward, but not through, the top section 1232 of the keeper 1226. While not illustrated in FIG. 89, an undersurface channel could be formed in an undersurface 1248 of the top section 1232 of the keeper 1226, which, at a rear end thereof, is in communication with the front channel 1244, and which extends toward, but not through, the downturn 1233.

Following the assembling of the modules 1185*a* and 1185*b* in the abutting relationship as described above, the keeper 1226 is placed over, and onto, the intermediate post 1190. Eventually, the bottom surface 1236 of the keeper rests on the upper surfaces 1220*a* and 1220*b* of the pedestals 1200*a* and 1200*b*, respectively. As the keeper 1226 is moved into place, the bottom channel 1234 is positioned onto the lower projection 1218*a* and 1218*b*, with the bevelled walls 1240 and 1242 of the bottom channel locating onto the bevelled outboard side surfaces 1222*a* and 1222*b*. In addition, the front channel 1244 is located about the rear sections 1214*a* and 1214*b* of the projections 1202*a* and 1202*b*, respectively, the projections 1204*a* and 1204*b*, and the upper rear sections 1216*a* and 1216*b* of the projections 1206*a* and 1206*b*, respectively. Further, the undersurface channel of the top section 1232 is located about the upper sections 1210*a* and 1210*b* of the projections 1202*a* and 1202*b*.

In this manner, the keeper 1226 is firmly and snugly assembled with the intermediate post 1190 to hold the panel/post modules 1185*a* and 1185*b* in the assembled relationship, and also to cover adjacent portions of the cable passages 1194*a*, 1194*b*, 1196*a* and 1196*b* to retain the cables 1224 and 1225 within the passages.

It is noted that the opposite end of the module 1185*a*, which end is not shown, could be formed with a post-like structure identical to the post-like structure 1188*b* for abutting assembly with a post-like structure identical to the post-like structure 1188*a* of an adjacent module. Similarly, the opposite end of the module 1185*b*, which end is not shown, could be formed with a post-like structure identical to the post-like structure 1188*a* for abutting assembly with a post-like structure identical to the post-like structure 1188*b* of an adjacent module. In this manner, a plurality of the modules 1185*a* and 1185*b* can be arranged in serial abutting assembly, with the keepers 1226 assembled therewith, to form continuous sections of the barrier fence.

Figure 90:
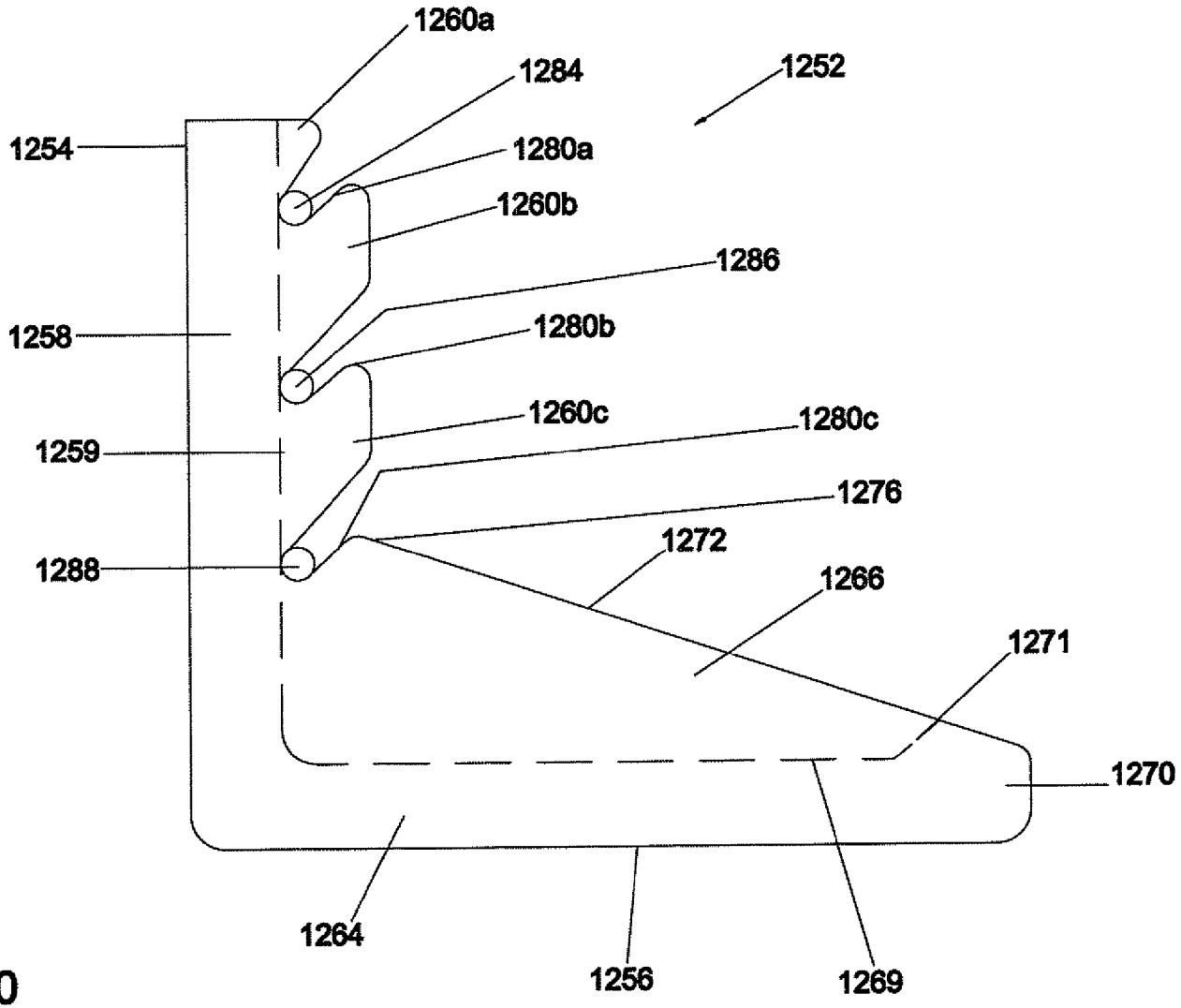
FIG. 90 is a side view showing a combination precast panel and post unit formed with holding slots for supporting a plurality of tension cables therein.
Figure 91:
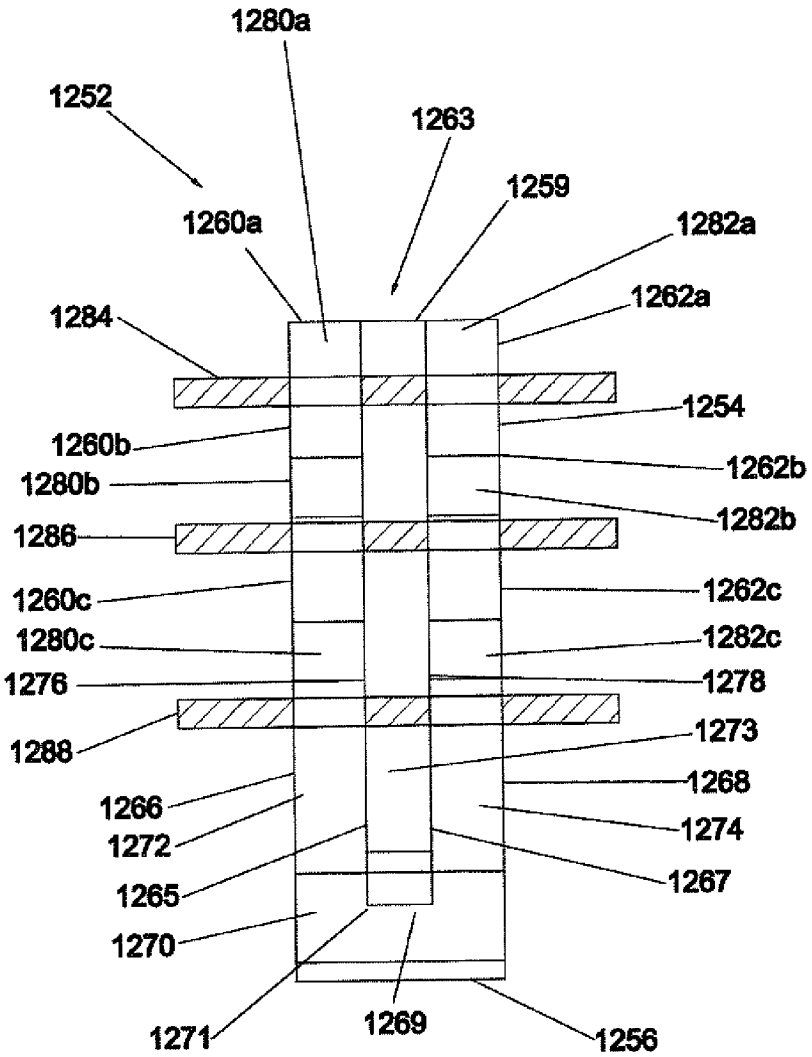
FIG. 91 is a rear view showing tension cables located within the holding slots of the combination precast panel and post unit of FIG. 90.
Figure 93:
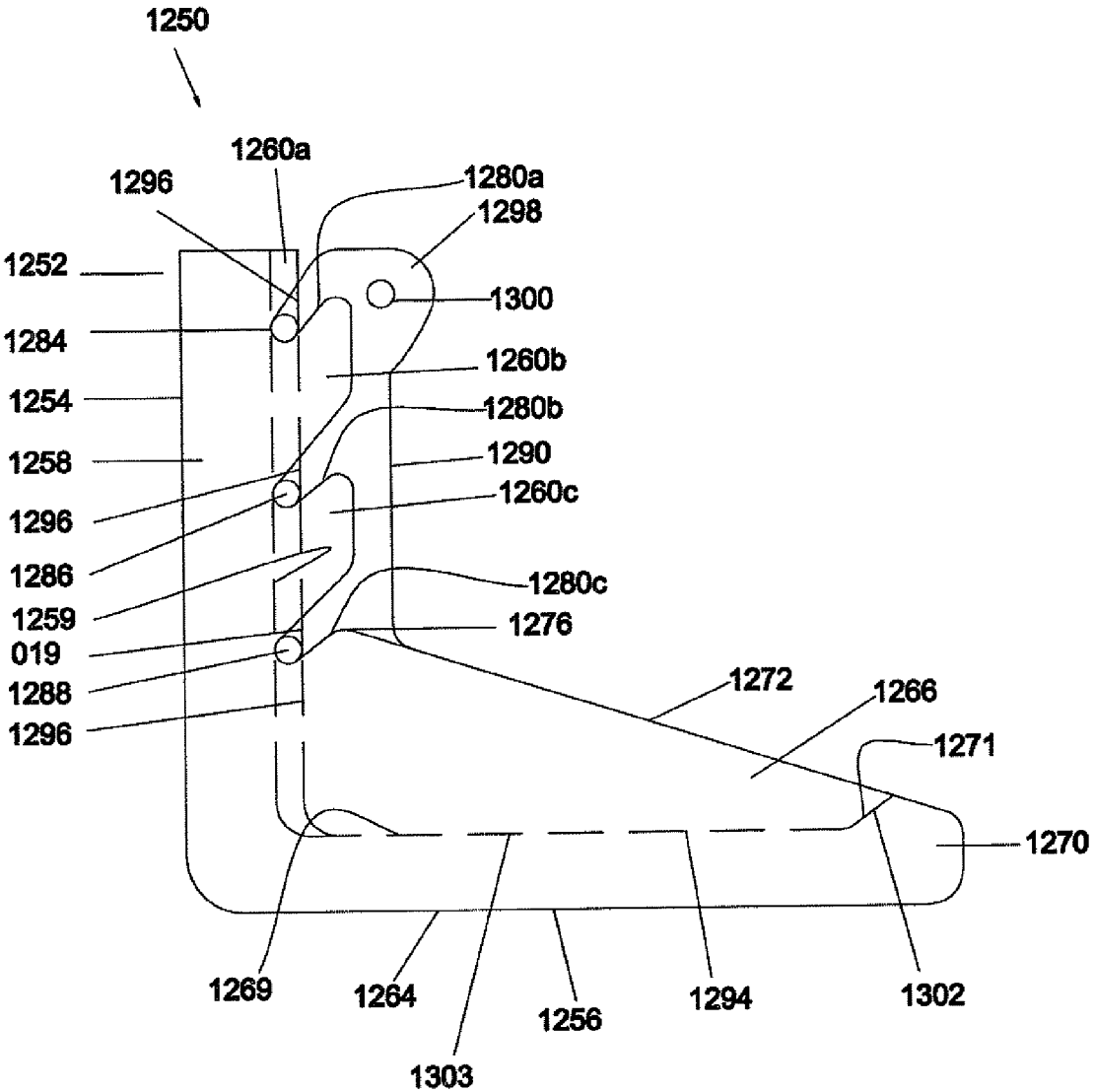
FIG. 93 is a side view showing the keeper of FIG. 92 in cable-retaining assembly with the combination precast panel and post unit of FIG. 90.

As shown in FIG. 93, a combination precast panel and post unit 1250 includes an "L" shaped member 1252, having a vertical leg 1254 and a horizontal leg 1256, and an "L" shaped keeper 1290. Referring to FIGS. 90 and 91, the vertical leg 1254 of the "L" shaped member 1252 is formed by a solid front portion 1258 having a rear surface 1259. A first set of three vertically-spaced tabs 1260*a*, 1260*b* and 1260*c* extend in a rearward direction from a rear vertical section of the solid front portion 1258 of the vertical leg 1254, adjacent one side thereof. As shown in FIG. 91, a second set of three vertically-spaced tabs 1262*a*, 1262*b* and 1262*c* extend in a rearward direction from a rear vertical section of the solid front portion 1258 of the vertical leg 1254, adjacent a side thereof which is opposite the one side.

As shown in FIG. 91, three pairs of the tabs 1260*a* and 1262*a*, 1260*b* and 1262*b*, and 1260*c* and 1262*c*, are spaced horizontally apart by a prescribed distance, which results in the formation of a vertical nesting channel 1263 adjacent the vertical leg 1254.

Referring again to FIGS. 90 and 91, the horizontal leg 1256 of the "L" shaped member 1252 extends integrally rearward from a lower portion of the vertical leg 1254. The horizontal leg 1256 is formed with a solid bottom portion 1264, and with horizontally spaced side walls 1266 and 1268, which extend upward from the solid bottom portion. The side walls 1266 and 1268 are spaced apart by the prescribed distance, and have interfacing surfaces 1265 and 1267, respectively. A floor 1269 is formed in the horizontal leg 1256 above the solid portion 1264, and extends between lower portions of the interfacing surfaces 1265 and 1267 of the spaced side walls 1266 and 1268, respectively.

The horizontal leg 1256 is also formed with a solid rear portion 1270, which is integral with, and extends upward from, the solid bottom portion 1264 of the horizontal leg. The solid rear portion 1270 is formed with a front interior surface 1271, of a prescribed concavity, extending between a rearward portion of the spaced side walls 1266 and 1268. The front interior surface 1271 joins, and blends with, the floor 1269. The floor 1269, the front interior surface 1271, and the interfacing surfaces 1265 and 1267 of the horizontal leg 1256 form a horizontal nesting chamber 1273, which communicates with the vertical nesting channel 1263.

The horizontally spaced side walls 1266 and 1268 are formed with upper surfaces 1272 and 1274, respectively, which rise upward, at a prescribed slope angle, from the solid rear portion 1270 to respective forward ends 1276 and 1278 of the upper surfaces, which are spaced below the tabs 1260*c* and 1262*c*, respectively.

The tabs 1260*a*, 1260*b*, 1260*c*, and the forward end 1276 of the side wall 1266, are vertically spaced and shaped to form three vertically spaced slots 1280*a*, 1280*b* and 1280*c*, each of which extend downward and forward from an entry passage thereof. The tabs 1262*a*, 1262*b*, 1262*c*, and the forward end 1278 of the side wall 1268, are vertically spaced and shaped to form three vertically spaced slots 1282*a*, 1282*b* and 1282*c*, each of which extend downward and forward from an entry passage thereof. Each respective pair of the slots 1280*a* and 1282*a*, the slots 1280*b* and 1282*b*, and the slots 1280*c* and 1282*c*, are horizontally spaced and aligned, and receive three tension cables 1284, 1286 and 1288, respectively.

Figure 92:
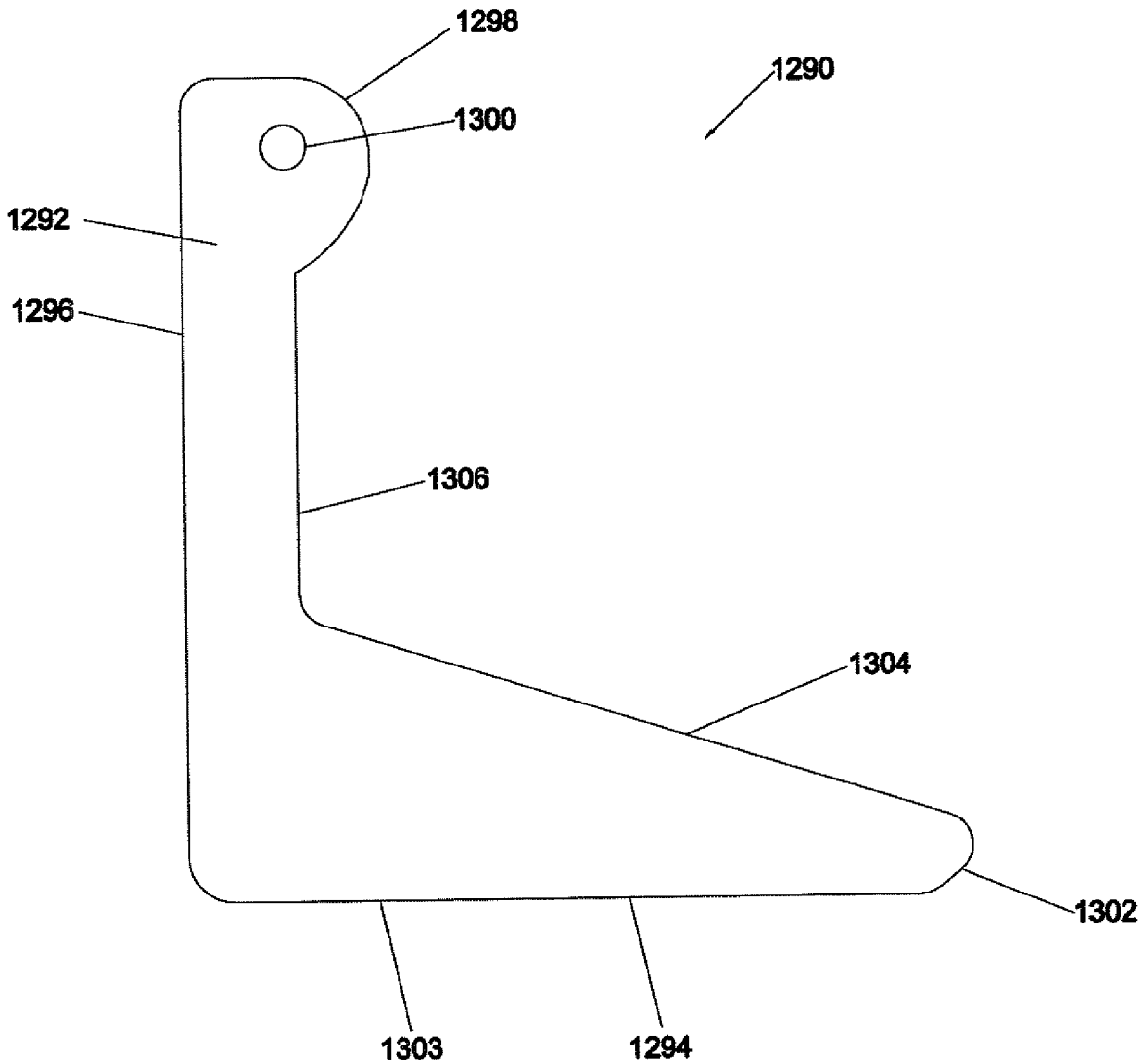
FIG. 92 is a side view showing a keeper formed with structure for nesting with complementary structure of the combination precast panel and post unit of FIG. 90 for retaining the tension cables within the holding slots.

Referring to FIG. 92, the "L" shaped keeper 1290 is formed with a vertical leg 1292 and a horizontal leg 1294, and with a width slightly less than the above-noted prescribed distance. The vertical leg 1292 is formed with a front face 1296, and with an enlarged head 1298, at an upper end thereof, having a lifting eye 1300 formed therethrough. The horizontal leg 1294 is formed integrally with, and extends from, a lower portion of the vertical leg 1292, rearward to a rear end 1302 of the horizontal leg. An exterior surface of the rear end 1302 of the horizontal leg 1294 is formed with a convexity, which is complementary to the above-noted prescribed concavity. Also, the horizontal leg 1294 is formed with a bottom surface 1303 and an upper surface 1304, which rises from the rear end 1302, at the above-noted prescribed slope angle, to a juncture with a rear face 1306 of the vertical leg 1292.

Referring the FIGS. 92 and 93, after the cables 1284, 1286 and 1288 have been placed in the respective adjacent pairs of the slots 1280*a* and 1282*a*, 1280*b* and 1282*b*, and 1280*c* and 1282*c*, the keeper 1290 is manipulated, by use of the lifting eye 1300, to place the vertical leg 1292 of the keeper into the vertical nesting channel 1263, and to place the horizontal leg 1294 of the keeper into the horizontal nesting channel 1273.

With this arrangement, portions of the front face 1296 of the keeper 1290 engage portions of the cables 1284, 1286 and 1288, which appear in the vertical nesting channel 1263, to capture the portions of the cables between the front face of the keeper and the rear face 1259 of the solid portion 1258 of the vertical leg 1254. In this manner, the cables 1284, 1286 and 1288 are retained within the respective pairs of the slots 1280*a* and 1282*a*, 1280*b* and 1282*b*, and 1280*c* and 1282*c*. Further, a gravitational force maintains the horizontal leg 1294 of the keeper 1290 within the horizontal nesting channel 1273 to retain the keeper in assembly with the "L" shaped member 1252, and thereby retain the cables 1284, 1286 and 1288 with the combined precast panel and post unit 1250.

Figure 94:
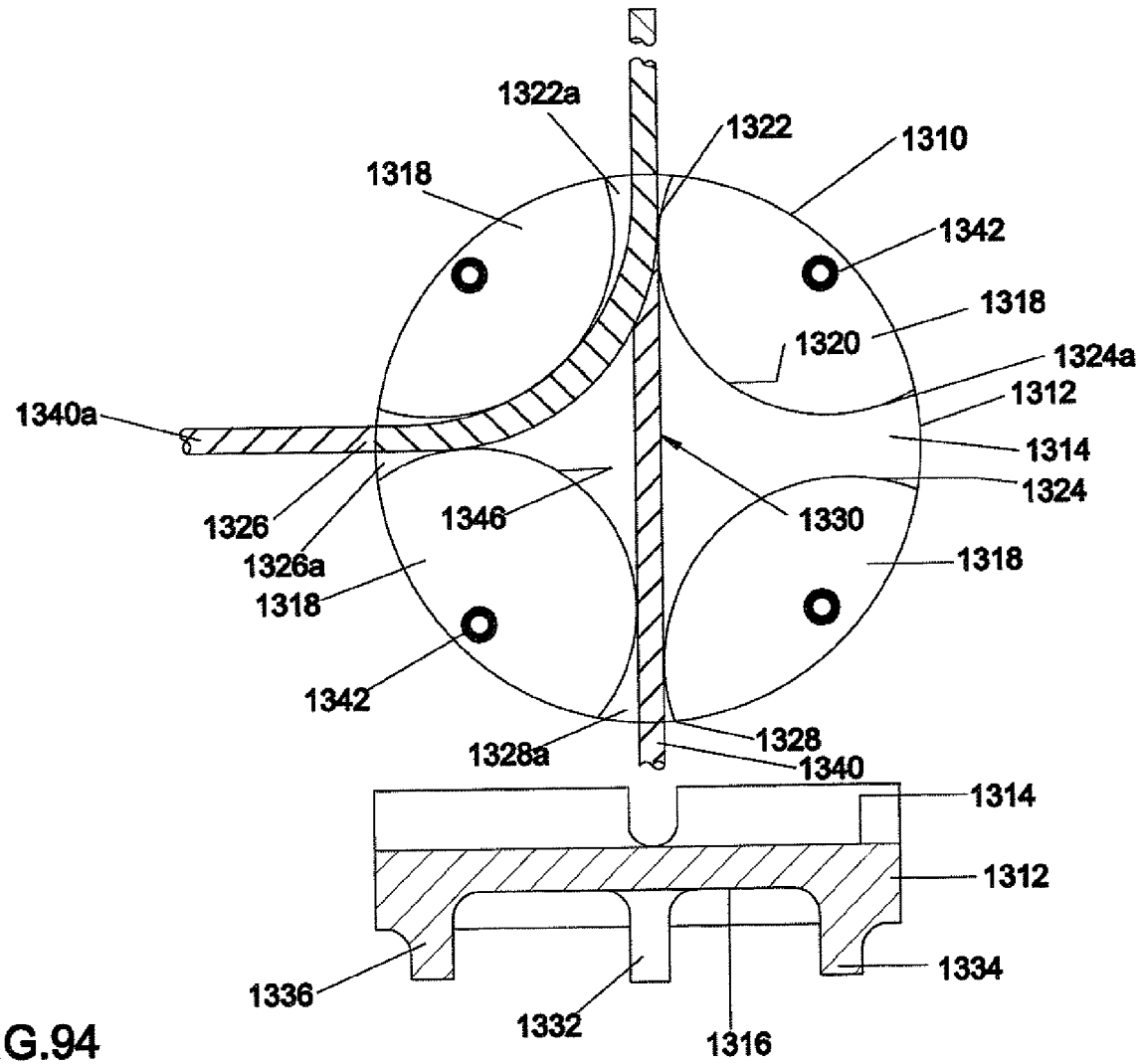
FIG. 94 is a top view and side sectional view showing one of a plurality of stackable sections, which, when stacked, form an intermediate anchor post for supporting a plurality of tension cables, with each section having a cable-entry port in communication, through open-top cable passages, with all of a plurality of cable exit ports, which may be in direct or angular alignment with the cable entry port, and with each section formed with a plurality of spaced legs extending from the underside thereof and into the cable passages for retaining the cables within the passages.

Referring to FIG. 94, a plurality of stackable modules 1310 (one shown) can be stacked to form an intermediate anchor post. Each of the modules 1310 is formed with an intermediate solid planar layer 1312, having an top surface 1314 and a bottom surface 1316. Four spaced half-round pedestals 1318 extend upward from the top surface 1314, with peripheral circular walls 1320 of the pedestals facing generally toward a center of the top surface.

With this arrangement, four cable passages 1322, 1324, 1326, and 1328 are each formed by a space between the closest portions of the peripheral circular walls 1320 of adjacent pairs of the pedestals 1318. The four cable passages 1322, 1324, 1326 and 1328 communicate with a respective cable port 1322*a*, 1324*a*, 1326*a* and 1328*a*, with all of the cable passages communicating with a common central region 1330, defined generally by the widest spacing between non-adjacent opposing pedestals 1318. Due to the peripheral circular design of the pedestals 1318, each of the cable ports 1322*a*, 1324*a*, 1326*a* and 1328*a* are formed with a flared opening.

In one example of assembling a cable 1340 with the module 1310, the cable is passed directly through the aligned cable passages 1322 and 1328. In another example of assembling a cable 1340*a* with the module 1310, the cable is passed through the cable passages 1322 and 1326, whereby the pass-through of the cable is at a right angle.

Three spaced legs 1332, 1334, 1336, and a fourth leg which does appear in FIG. 94 ("the non-illustrated leg"), extend downward from the bottom surface 1316 of the intermediate layer 1312, and are located in alignment with the cable passages 1322, 1324, 1326 and 1328, respectively, of the module 1310. When an upper module 1310 is stacked atop a lower module, the spaced legs 1332, 1334, 1336, and the non-illustrated leg, of the upper module will locate within the respective cable passages 1322, 1324, 1326, and 1328 of the lower module. In this manner, any portion of any cable, such as the cable 1340, which is located in any of the cable passages 1322, 1324, 1326 and 1328, will be pressed into, and retained in, the cable passage by the respective legs 1332, 1334, 1336, and the non-illustrated leg.

When forming an intermediate anchor post using a plurality of the modules 1310 as described above, a post support base (not shown) is first placed into position on a support, such as, for example, an anchor footer, and a required number of the stackable modules 1310 are placed atop the support base. During the stacking process, cables 1340 are placed in a desired pass-through arrangement within each module, after each module has been placed on the stack, and before the next successive module is placed on the stack. A cap (not shown), formed with four legs, arranged in the same manner as the legs 1332, 1334, 1336 and the non-illustrated leg, and extending downward from a bottom surface of the cap, is placed onto the uppermost stackable module 1310, whereby the legs of the cap press and retain the cable 1340 of the uppermost stackable module with the assembled post.

Each of the stackable modules 1310, and the base and the cap, of each post is formed with a plurality of tie bolt holes 1342, which are alignable upon assembly of the base, the modules and the cap. Each of a plurality of tension members (not shown), of the type identified above and in FIG. 78 as the tension member 1078, is assembled with a retainer and an anchor footer as described above. As the base, the modules 1310 and the cap are assembled as described above, the tie bolt holes 1342 are located over the tension members to retain the completed anchor post in the manner described above with respect to the tension members 1078.

It is noted that, while the above-described module 1310 is designed to facilitate a direct cable pass-through, or a right angle cable pass-through, of the cables 1340 and 1340*a*, respectively, other designs, using the above-described principle, could be employed to facilitate other angular pass-throughs.

Figure 95:
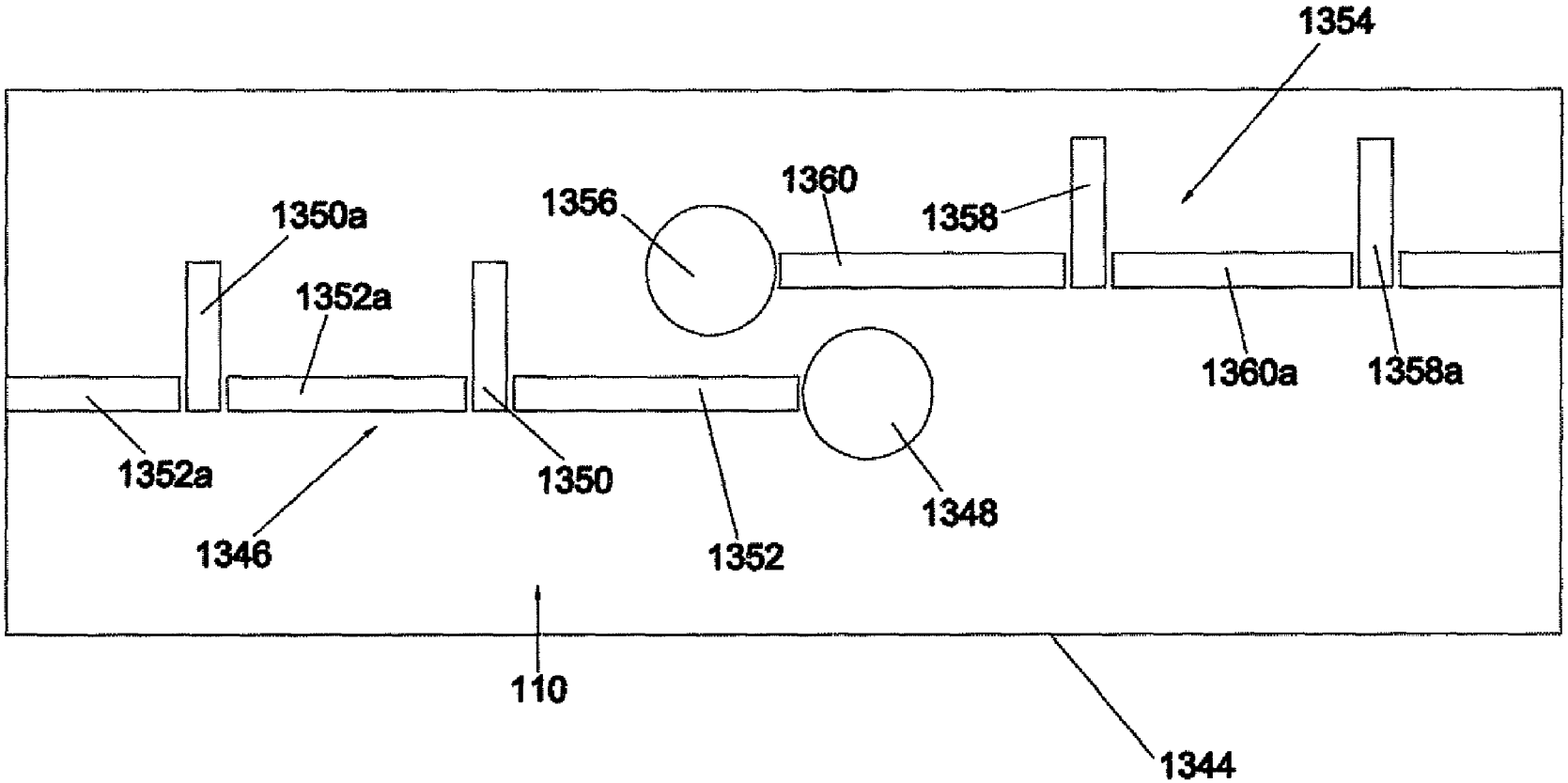
FIG. 95 is a top view showing a plurality of panels and intermediate posts, and a pair of spaced end posts, in an arrangement for providing a pedestrian passage while protecting against the unauthorized passage of a vehicle.

Referring to FIG. 95, a pedestrian passage arrangement 1344 includes a first barrier fence section 1346, which includes an end post 1348, a first spaced intermediate post 1350, and a first panel 1352 located between the end post and the intermediate post. Successive spaced intermediate posts 1350*a*, and panels 1352*a* extend serially from the first intermediate post 1350. Tension cables (not shown) extend from the end post 1348 through the intermediate posts 1350 and 1350*a* and the panels 1352 and 1352*a*.

Further, the pedestrian passage arrangement 1344 includes a second barrier fence section 1354, which includes an end post 1356, a first spaced intermediate post 1358, and a first panel 1360, located between the end post and the intermediate post. Successive spaced intermediate posts 1358*a*, and panels 1360*a* extend serially from the first intermediate post 1358. Tension cables (not shown) extend from the end post 1356 through the intermediate posts 1358 and 1358*a* and the panels 1360 and 1360*a*.

The first barrier fence section 1346 is located in a first plane, which extends vertically upward from the ground level 110, and the second barrier fence section 1354 is located in a second plane which extends vertically upward from the ground level. The first plane and the second plane are parallel, and are spaced apart.

The end posts 1348 and 1356 are diagonally offset from each other, by a prescribed distance, such that the end post 1348 is located in a third plane, which extends vertically upward from the ground level 110, and which is perpendicular to the first and second planes. With this arrangement, the end post 1348 is spaced, within the third plane, by a third-plane distance, from the first panel 1360 of the second barrier fence section 1354.

Also, with the diagonal offset of the end posts 1348 and 1356, the end post 1356 is located in a fourth plane, which extends vertically upward from the ground level 110, and which is perpendicular to the first and second planes. With this arrangement, the end post 1356 is spaced, within the fourth plane, by a fourth-plane distance, from the first panel 1352 of the first barrier fence section 1346.

In this manner, the spaces defined by each of the prescribed distance, the third-plane distance, and the fourth-plane distance, are sufficient to allow a pedestrian to pass therethrough, but are not sufficient to allow a vehicle to pass therethrough.

Figure 96:
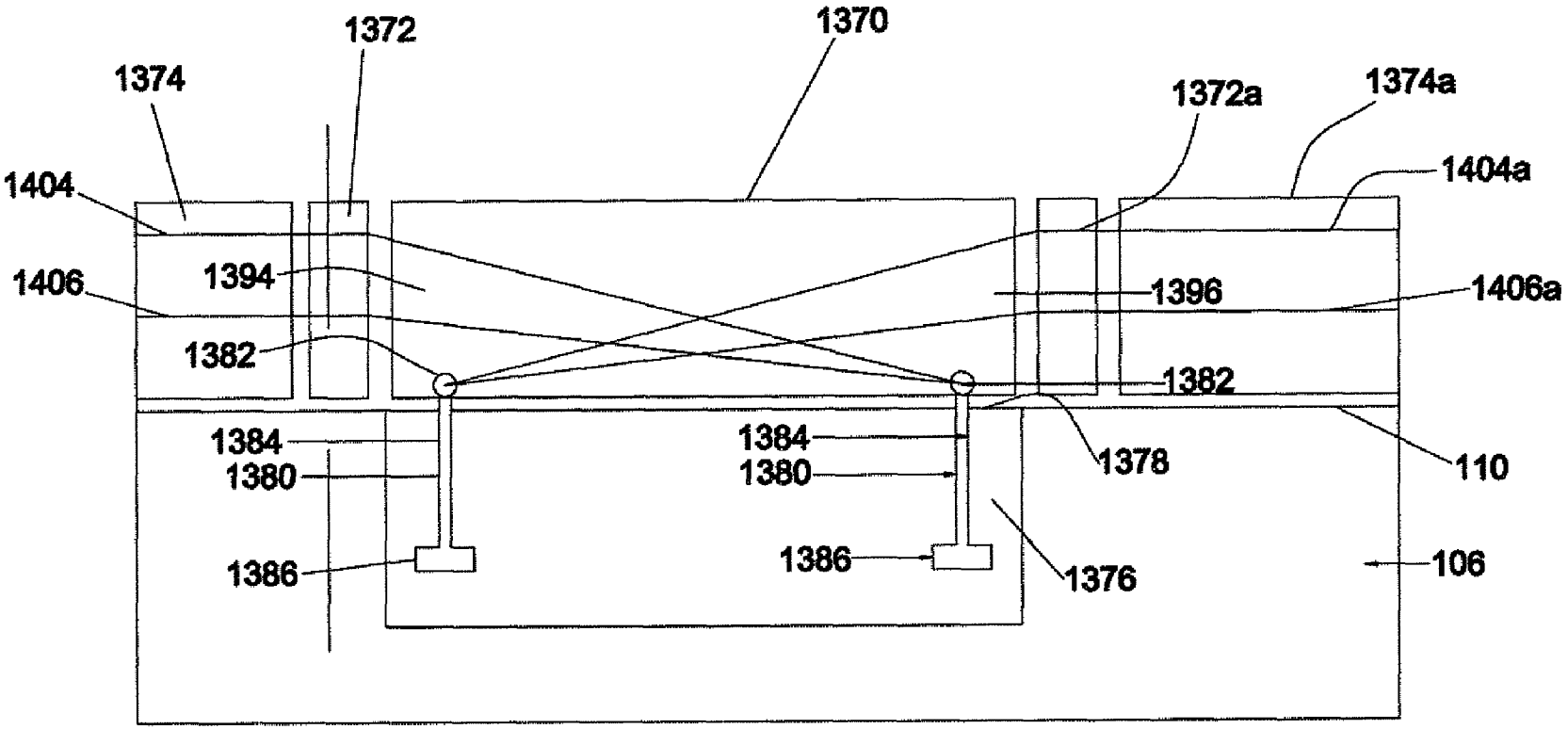
FIG. 96 is a front view showing a barrier fence, with parts removed, having a panel and an intermediate post on each side of an end post, with tension cables extending into opposite sides of the end post, which are secured to eyebolts located within the end post and mounted in an anchor below the end post.

Referring to FIG. 96, a barrier fence includes an end post 1370, intermediate posts 1372 and 1372*a*, which are adjacent opposite sides of the end post, and a pair of panels 1374 and 1374*a*, which are located adjacent outboard sides of the intermediate posts 1372 and 1372*a*, respectively.

A concrete anchor 1376 is located within the soil 106, and supports the end post 1370, which is resting on an upper surface 1378 thereof flush with the ground level 110. Eyebolt 1380 is formed integrally with eye 1382 at one end of a long shank 1384. The shank 1384 extends from the eye 1382 to an opposite end of the shank, which is attached to a retainer 1386. A major portion of the shank 1384 and the retainer 1386 of each of the eye bolts 1380 are embedded, and retained, in the anchor 1376.

Figure 97:
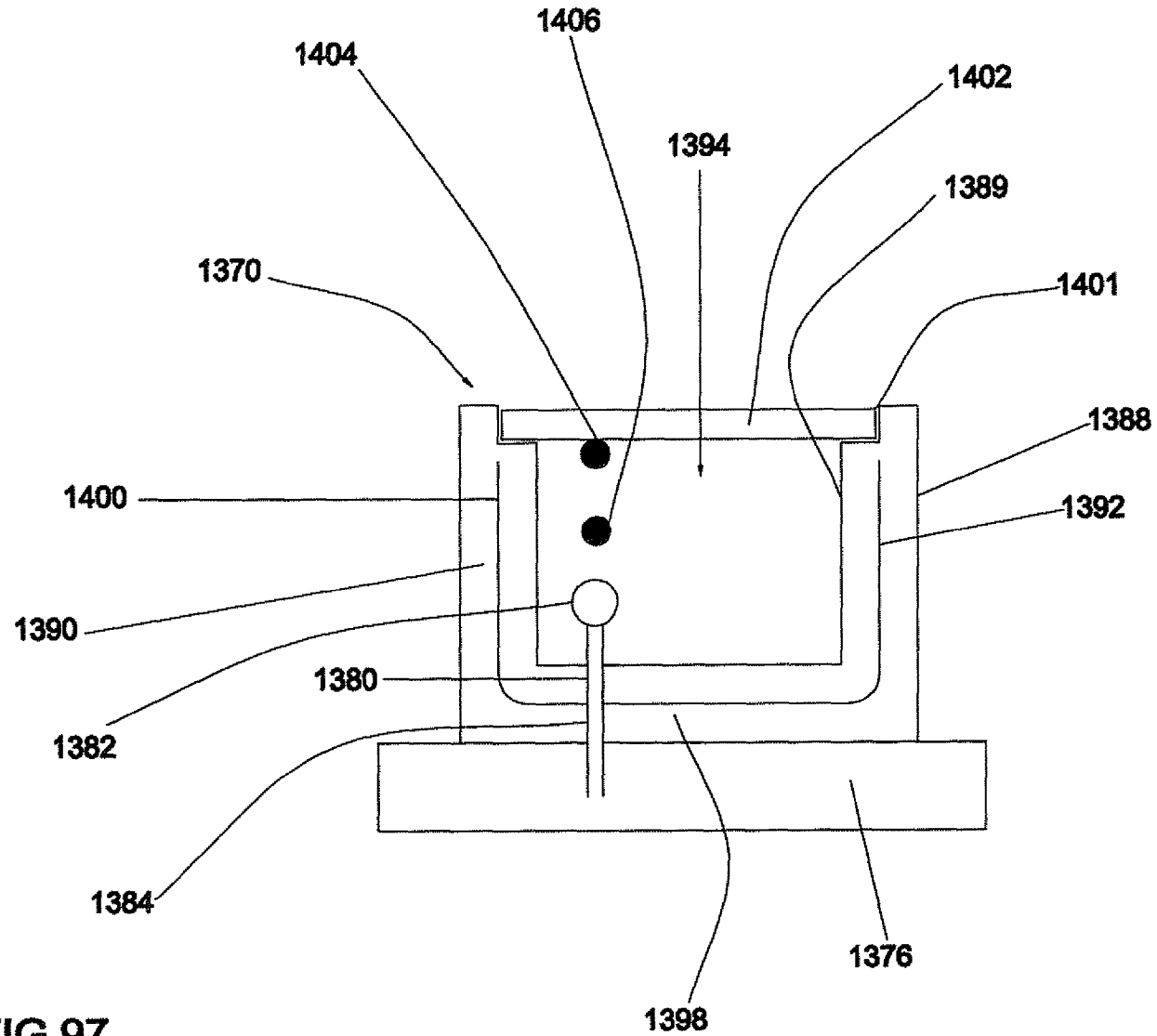
FIG. 97 is a side view showing a first embodiment of the end post of FIG. 96.

Referring to FIG. 97, a first embodiment of the end post 1370 includes a tub 1388 having a front wall 1390, a rear wall 1392, a first side wall 1394, a second side wall 1396 (FIG. 96), and a floor wall 1398. The tub 1388 forms an open well 1389, in which is located the eye 1382 and a short length of the shank 1384, of each of the eye bolts 1380. Several sections of rebar 1400 are strategically placed within the walls 1390, 1392, 1394, 1396 and 1398 of the tub 1388 for strengthening of the tub. Also, a ledge 1401 is formed along an inboard upper edge of the walls 1390, 1392, 1394 and 1396 to support a cover 1402.

It is noted that the outer major surfaces of the first side wall 1394 and the second side wall 1396, of the tub 1388, form opposite sides of the end post 1370, which are widely spaced sides. The distance between the widely spaced sides of the end post 1370 is significantly greater than the distance between opposite sides of a conventional end post, and is comparable to the side-to-side distance of the panels 1374 and 1374*a*.

As shown in FIGS. 96 and 97, with the cover 1402 removed, a first pair of tension cables 1404 and 1406 extend through the panel 1374 and the intermediate post 1372, through openings formed through the side wall 1394, into the well 1389 of the tub 1388, and are angled downward nearly to the second side wall 1396. Ends of the respective cables 1404 and 1406, which are within the well 1389 of the tub 1388, are secured to the eye 1382 of the eye bolt 1380.

Also, a second pair of tension cables 1404*a* and 1406*a* extend through the panel 1374*a* and the intermediate post 1372*a*, through openings formed through the second side wall 1396, into the well 1389 of the tub 1388, and are angled downward and extend nearly to the first side wall 1394. Ends of the respective cables 1404*a* and 1406*a*, which are within the well 1389 of the tub 1388, are secured to the eye 1382 of the eye bolt 1380.

Thereafter, the well 1389 of the tub 1388 is filled with a heavy and removable material such as, for example, silica, sand, stone, or the like. The cover 1402 is then placed on the ledge 1401 to complete the formation of the first embodiment of the end post 1370, with the ends of the cables 1404, 1406, 1404*a* and 1406*a* secured in place.

Figure 98:
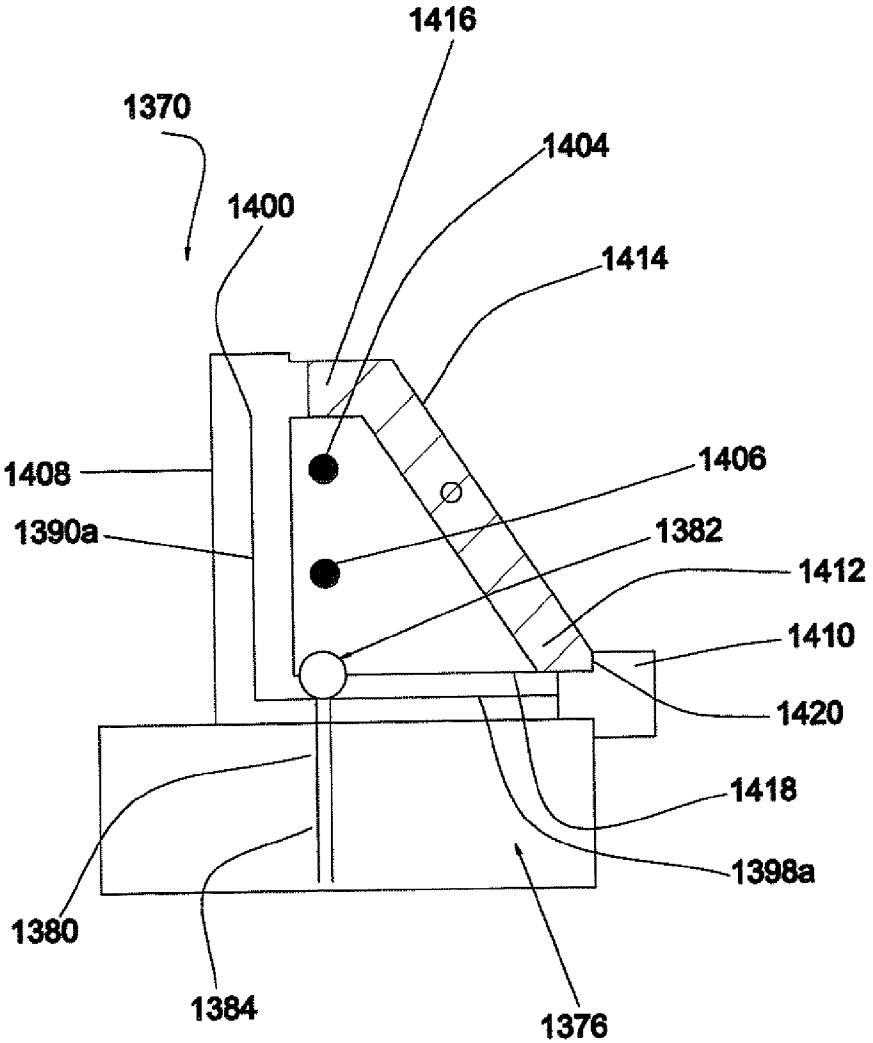
FIG. 98 is a side view showing a second embodiment of the end post of FIG. 96.

Referring to FIGS. 96 and 98, a second embodiment of the end post 1370 includes an "L" shaped member 1408, which is formed by a front wall 1390*a* and a floor wall 1398*a*, and which extends between widely spaced sides, as viewed in FIG. 96, in a manner similar to the front wall 1390 and the floor wall 1398, respectively, of the tub 1388 (FIG. 97). An outboard edge of the floor wall 1398*a* of the "L" shaped member 1408 is formed with an upturned portion 1410, which extends between the widely spaced sides of the member. An inside surface of the upturned portion 1410, and the adjacent portion of an upper surface of the floor wall 1398*a*, combine to form a pocket 1412, which extends between the widely spaced sides of the "L" shaped member 1408. Several sections of rebar 1400 are strategically placed within the walls 1390*a* and 1398*a* of the "L" shaped member 1408 for strengthening thereof.

The second embodiment of the end post 1370 also includes a cap 1414, which is formed with an elbow 1416 along one end edge thereof and with angled end faces 1418 and 1420 along an opposite end edge thereof. The free or outboard end of the elbow 1416 is placed against an upper inside face of the front wall 1390*a*, and the angled end faces 1418 and 1420 are placed in the pocket 1412. In this manner, the cap 1414 is retained in a lean-to arrangement with the "L" shaped member 1408. With this structure, widely spaced sides of the second embodiment of the end post 1370 are open.

Prior to placing the cap 1414 in the position shown in FIG. 98, the first pair of tension cables 1404 and 1406 extend through the panel 1374 and the intermediate post 1372, through a first and adjacent one of the spaced open sides of the second embodiment of the end post 1370, and are angled downward and extend nearly to a second one of the spaced open sides. Ends of the respective cables 1404 and 1406, are secured to the eye 1382 of the eye bolt 1380

Also, the second pair of tension cables 1404*a* and 1406*a* extend through the panel 1374*a* and the intermediate post 1372*a*, through the second of the spaced open sides of the second embodiment of the end post 1370, and are angled downward nearly to the first of the spaced open sides of the second embodiment of the end post 1370. Ends of the respective cables 1404*a* and 1406*a* are secured to the eye 1382 of the eye bolt 1380. Thereafter, the cap 1414 is placed in the position shown in FIG. 98.

It is noted that, while the single end post 1370, the pair of intermediate posts 1372 and 1372*a*, and the pair of panels 1374 and 1374*a*, are the only components illustrated in FIGS. 96, 97, and 98, additional end posts, intermediate posts and panels would be employed to complete the barrier fence.

In each of the above-described first and second embodiments of the end post 1370, the manner of anchoring the barrier fence will minimize any overturning moment. In addition, these embodiments are easily assembled, easily repairable, and provide an attractive appearance. Further, with the size of the end post 1370 blending with the size of the panels 1374 and 1374*a*, a common decorative theme amongst the panels and the end posts can be followed.

Figure 99:
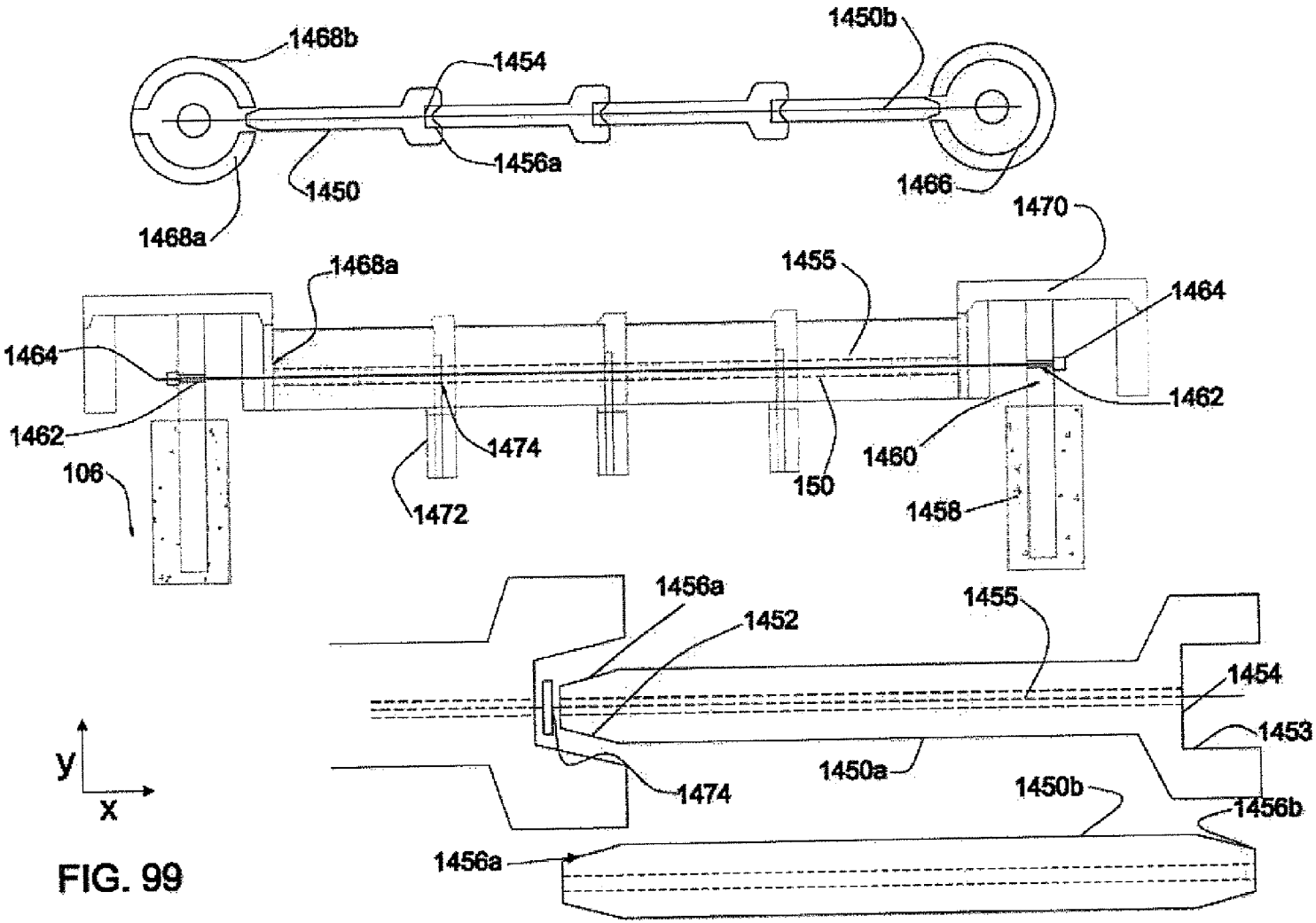
FIG. 99 is a combination plan view and side view of a barrier fence having a panel and intermediate post integrated into one component in accordance with certain principles of the invention.

Referring to FIG. 99, a barrier fence is shown with a post 1460, a foundation 1458 for post 1460 embedded in soil 106, a sleeve passage 1462 through post 1460, enclosures 1468*a*, 1468*b*, and 1466, and a cover 1470 for enclosures 1468*a*, 1468*b*, and 1466. Fence panels 1450 are shown with a panel portion 1450*a* and a tongue portion 1456*a* having tapered sides 1452. The panel 1450 also has a groove portion 1454 with sides 1453 to receive the tongue portion of an adjacent panel. The sides 1453 of the groove are of a dimension such that the barrier fence may be positioned on uneven terrain without allowing the tongue portion 1456*a* to leave the groove portion, thus preventing unwanted access to the cable 150. The panel 1450 also has at least one conduit 1455 formed within the structure of the panel. A panel 1450*b* is shown having two tongue portions 1456*a* and 1456*b*. The barrier fence also has intermediate posts 1474 preferably made from a rigid material such as steel plate of a size to provide rigidity to the barrier fence when a force is applied to the fence in a "Y" direction, as shown in FIG. 99. Intermediate post 1474 is located in a preferably rigid square or rectangular sleeve 1472. The size of the intermediate post in the "X" direction, as shown in FIG. 99, is substantially smaller than the sleeve 1472 in the "X" direction allowing for component and assembly dimensional tolerance variations. The intermediate post 1474 size in the "Y" direction is nearly the same but slightly smaller than the internal size of the sleeve 1472 in the "Y" direction. At least one cable is through sleeve 1462 in a first end post, through conduit 1455 in each panel, through sleeve 1462 in a second end post, and finally secured with a cable termination 1464. It is within the scope of the invention that the cable termination 1464 may be an energy absorber or energy absorbing means, such as has been described previously.

Figure 100:
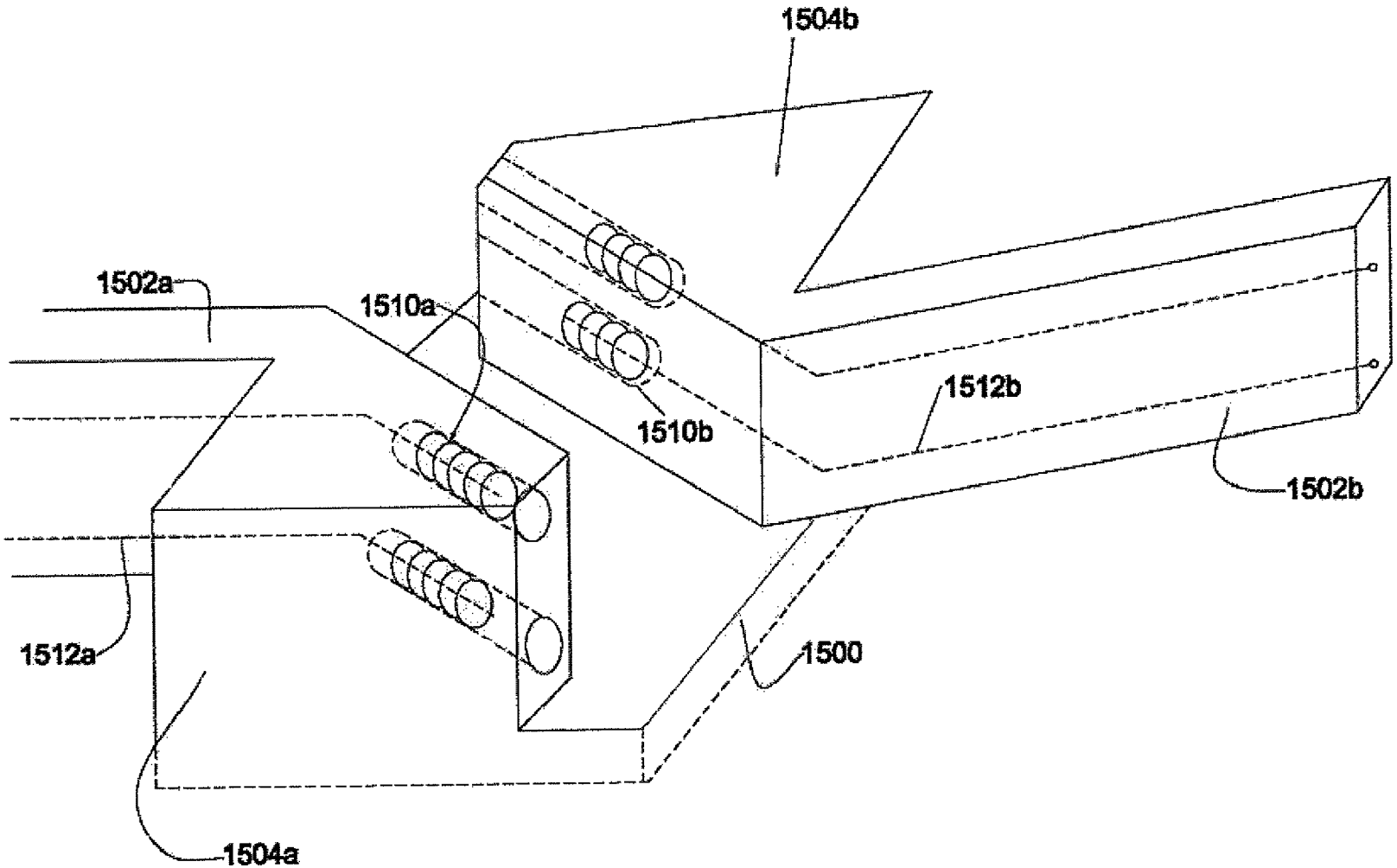
FIG. 100 is a perspective view of a barrier fence with a passageway allowing passage by people but not vehicles in accordance with certain principles of the invention.

As shown in FIG. 100, a barrier fence comprises panels 1502*a* and 1502*b*, end post 1504*a*, and end post 1504*b*. The end posts 1504*a* and 1504*b* are attached to support 1500, which may be at, above, or below ground level. The panels and end posts are held together with cables 1512*a* and 1512*b*. Cables 1512*a* and 1512*b* may terminate with energy absorbing means 1510*a* and 1510*b*. End posts 1504*a* and 1504*b* are spaced apart a distance which may allow people to pass through the barrier fence but narrow enough to prevent vehicle passage, such distance being usually greater than 2 feet but less than 6 feet.

Figure 101:
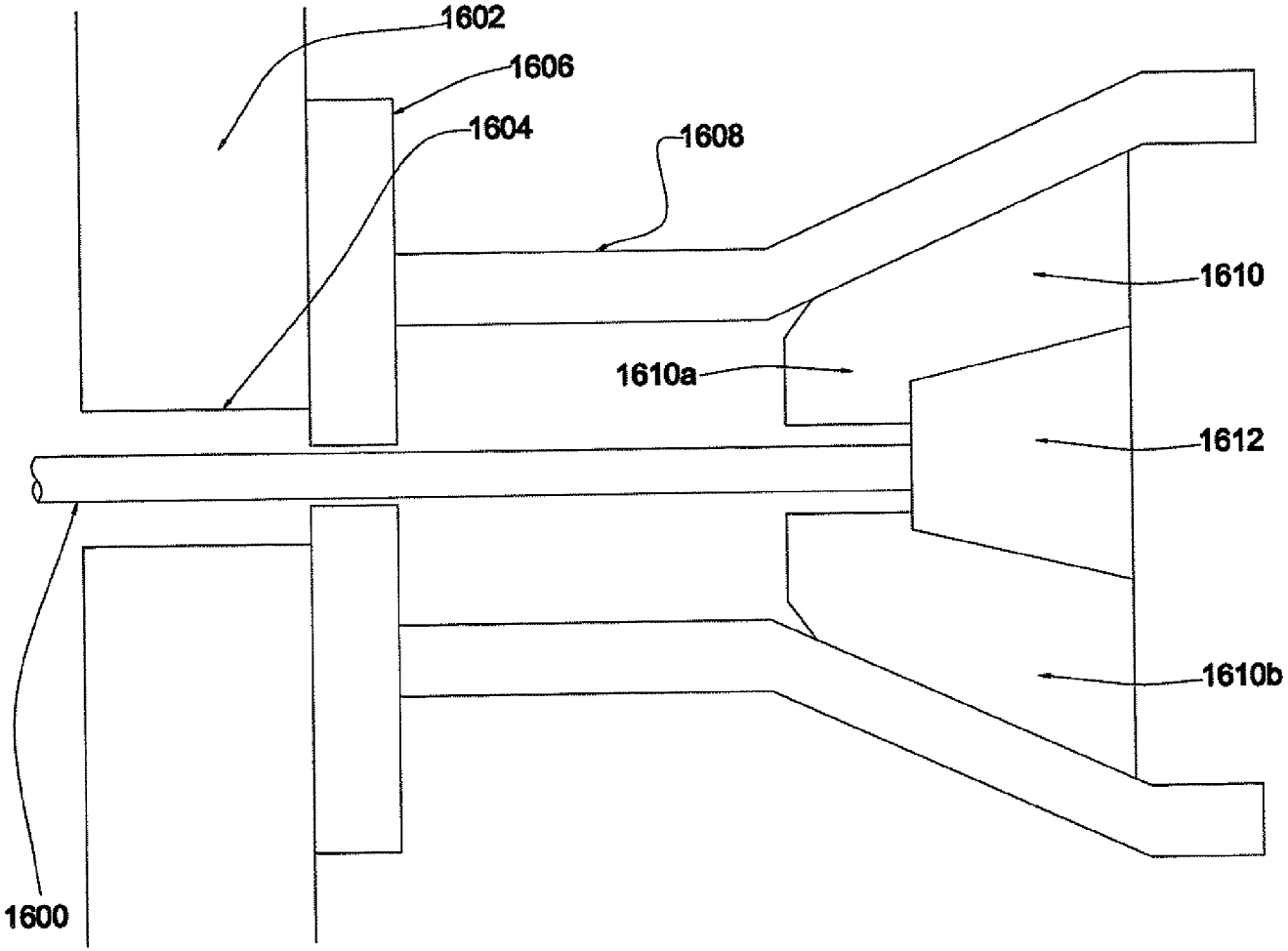
FIG. 101 is a sectional view of an energy absorbing means in accordance with certain principles of the invention.

As shown in FIG. 101, energy absorbing means comprises a portion of an end post 1602, a passage 1604 through the end post, a load distributing plate 1606, a ductile tube 1608, and a swaging end 1610. Cable 1600 passes through the panels of the barrier fence as shown in FIG. 99, through passage 1604, through a passage in swaging end 1610 and into a cable termination means 1612. Cable termination means 1612 may be any means suitable for terminating a cable. Swaging end 1610 is shown with a small end portion 1610*a* and a large end portion 1610*b*.

Figure 102:
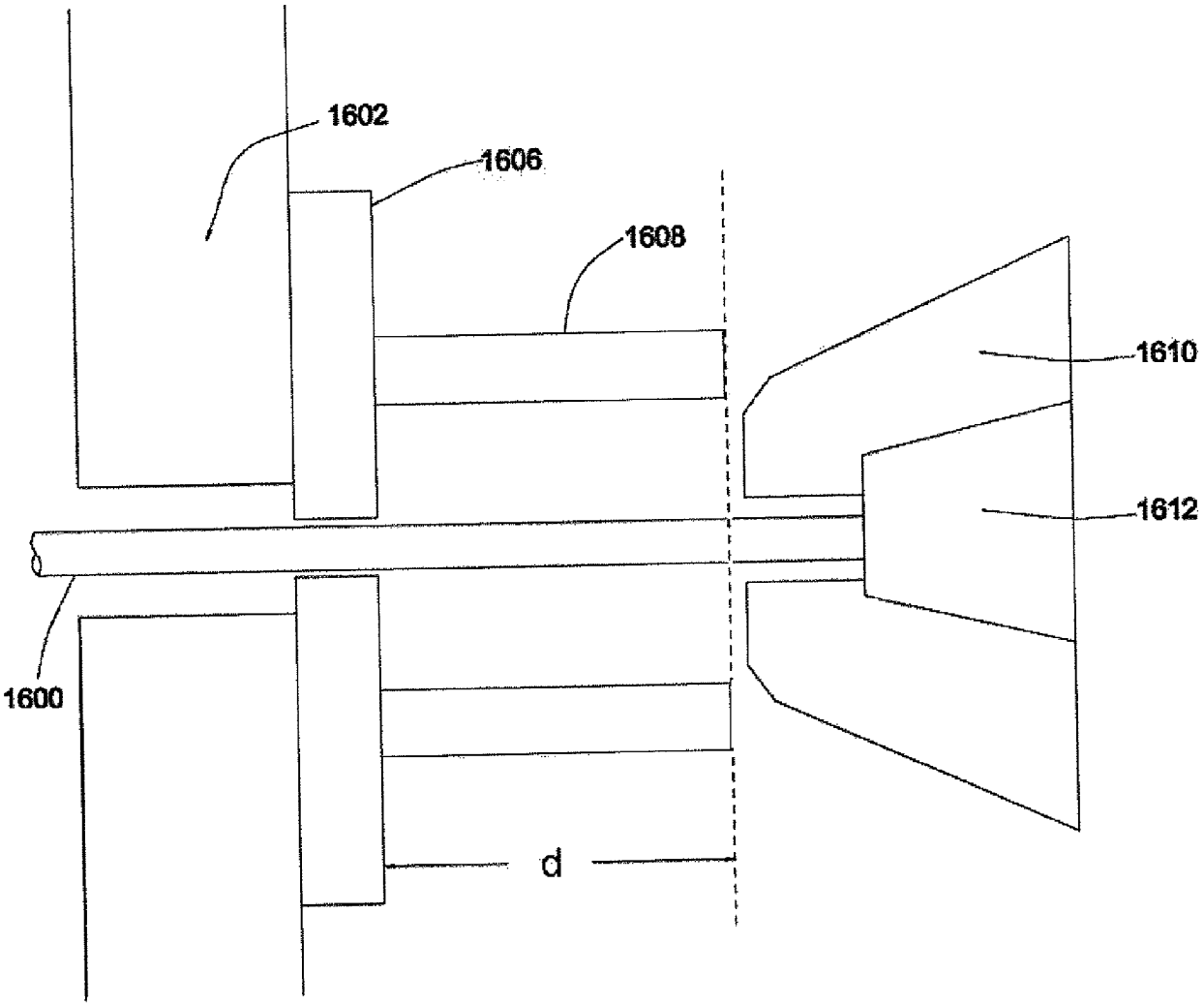
FIG. 102 is a sectional view of an energy absorbing means in a rest position in accordance with certain principles of the invention.

Referring to FIG. 102, before any force is applied to the energy absorbing means, the tube 1608 is a constant size shown at the small end portion 1610*a* of the swaging end 1610. When a force is applied to cable 1600, as shown in FIG. 101, swaging end 1610 is pulled in the direction of load distributing plate 1606. As swaging end 1610 is moved through tube 1608, tube 1608 is resized from a diameter corresponding with the smaller end portion 1610*a* of swaging end 1610 to a diameter corresponding with the larger end portion 1610*b*. This resizing of tube 1680 causes the ductile material of the tube to yield plastically from its yield strength to near its ultimate tensile strength. Preferably, a very large force "F" is required to cause the material to yield. Referring to FIG. 102, as the swaging end 1610 moves from its rest position at point 1615 of the tube to the point at which the small end portion 1610*a* comes to rest at plate 1606, the swaging end will have traveled a distance "d". The energy which is absorbed can be described as F×d.

The ductile material of tube 1608 may be comprised of stainless steel pipe or tube. For example, type 304 stainless steel pipe of approximately eight (8) inches in diameter with an approximately one-half (½) inch wall thickness may be used. The size and thickness of the pipe is chosen to provide a swaging force which is lower than the breaking strength of tension cable 1600. The 300 family of stainless steel has the ability to stretch 50% before breaking. In accordance with Table 1 (above) and Table 2 (below), type 304 stainless steel possesses a yield strength of 30,000 psi, an ultimate tensile strength of 80,000 psi, and a 50% elongation in 2 inches.

TABLE 2

Physical Properties of Certain Pipes.

| Nominal pipe size, O.D., in. | Schedule number† a | b | c | Wall thickness, in. | I.D., in. | Inside area, sq in. | Metal area, sq in. | Sq ft outside surface, per ft | Sq ft inside surface, per ft | Weight per ft, lb | Weight of water per ft, lb | Moment of inertia, in.$^4$ | Section modulus, in.$^3$ | Radius gyration, in. |
|---|---|---|---|---|---|---|---|---|---|---|---|---|---|---|
| 5 | — | — | 5S | 0.109 | 5.345 | 22.44 | 1.868 | 1.456 | 1.399 | 6.35 | 9.73 | 6.95 | 2.498 | 1.929 |
| 5.565 | — | — | 10S | 0.134 | 5.295 | 22.02 | 2.285 | 1.456 | 1.386 | 7.77 | 9.53 | 8.43 | 3.03 | 1.920 |
| | 40 | Std | 40S | 0.258 | 5.047 | 20.01 | 4.30 | 1.456 | 1.321 | 14.62 | 8.66 | 15.17 | 5.45 | 1.878 |
| | 80 | XS | 80S | 0.375 | 4.813 | 18.19 | 6.11 | 1.456 | 1.260 | 20.78 | 7.89 | 20.68 | 7.43 | 1.839 |
| | 120 | — | — | 0.500 | 4.563 | 16.35 | 7.95 | 1.456 | 1.195 | 27.04 | 7.09 | 25.74 | 9.25 | 1.799 |
| | 160 | — | — | 0.625 | 4.313 | 14.61 | 9.70 | 1.456 | 1.129 | 32.96 | 6.33 | 30.0 | 10.80 | 1.760 |
| | — | XXS | — | 0.750 | 4.063 | 12.97 | 11.34 | 1.456 | 1.064 | 38.55 | 5.62 | 33.6 | 12.10 | 1.722 |
| 6 | — | — | 5S | 0.109 | 6.407 | 32.2 | 2.231 | 1.734 | 1.677 | 5.37 | 13.98 | 11.85 | 3.58 | 2.304 |
| 6.625 | — | — | 10S | 0.134 | 6.357 | 31.7 | 2.733 | 1.734 | 1.664 | 9.29 | 13.74 | 14.40 | 4.35 | 2.295 |
| | 40 | Std | 40S | 0.280 | 6.065 | 28.89 | 5.58 | 1.734 | 1.588 | 18.97 | 12.51 | 28.14 | 8.50 | 2.245 |
| | 80 | XS | 80S | 0.432 | 5.761 | 26.07 | 8.40 | 1.734 | 1.508 | 28.57 | 11.29 | 40.5 | 12.23 | 2.195 |
| | 120 | — | — | 0.562 | 5.501 | 23.77 | 10.70 | 1.734 | 1.440 | 36.39 | 10.30 | 49.6 | 14.98 | 2.153 |
| | 160 | — | — | 0.718 | 5.189 | 21.15 | 13.33 | 1.734 | 1.358 | 45.30 | 9.16 | 59.0 | 17.81 | 2.104 |
| | — | XXS | — | 0.864 | 4.897 | 18.83 | 15.64 | 1.734 | 1.282 | 53.16 | 8.17 | 66.3 | 20.03 | 2.060 |
| 8 | — | — | 5S | 0.109 | 8.407 | 55.5 | 2.916 | 2.258 | 2.201 | 9.91 | 24.07 | 26.45 | 6.13 | 3.01 |
| 8.625 | — | — | 10S | 0.148 | 8.329 | 54.5 | 3.94 | 2.258 | 2.180 | 13.40 | 23.59 | 35.4 | 8.21 | 3.00 |
| | 20 | — | — | 0.250 | 8.125 | 51.8 | 6.58 | 2.258 | 2.127 | 22.36 | 22.48 | 57.7 | 13.39 | 2.962 |
| | 30 | — | — | 0.277 | 8.071 | 51.2 | 7.26 | 2.258 | 2.113 | 24.70 | 22.18 | 63.4 | 14.69 | 2.953 |
| | 40 | Std | 40S | 0.322 | 7.981 | 50.0 | 8.40 | 2.258 | 2.089 | 28.55 | 21.69 | 72.5 | 16.81 | 2.938 |
| | 60 | — | — | 0.406 | 7.813 | 47.9 | 10.48 | 2.258 | 2.045 | 35.64 | 20.79 | 88.8 | 20.58 | 2.909 |
| | 80 | XS | 80S | 0.500 | 7.625 | 45.7 | 12.76 | 2.258 | 1.996 | 43.39 | 19.80 | 105.7 | 24.52 | 2.878 |
| | 100 | — | — | 0.593 | 7.439 | 43.5 | 14.96 | 2.258 | 1.948 | 50.87 | 18.84 | 121.4 | 28.14 | 2.847 |
| | 120 | — | — | 0.718 | 7.189 | 40.6 | 17.84 | 2.258 | 1.882 | 60.63 | 17.60 | 140.6 | 32.6 | 2.807 |
| | 140 | — | — | 0.812 | 7.001 | 38.5 | 19.93 | 2.258 | 1.833 | 67.76 | 16.69 | 153.8 | 35.7 | 2.777 |
| | — | XXS | — | 0.875 | 6.875 | 37.1 | 21.30 | 2.258 | 1.800 | 72.42 | 16.09 | 162.0 | 37.6 | 2.757 |
| | 160 | — | — | 0.906 | 6.813 | 36.5 | 21.97 | 2.258 | 1.784 | 74.69 | 15.80 | 165.9 | 38.5 | 2.748 |
| 10 | — | — | 5S | 0.134 | 10.482 | 86.3 | 4.52 | 2.815 | 2.744 | 15.15 | 37.4 | 63.7 | 11.85 | 3.75 |
| 10.750 | — | — | 10S | 0.165 | 10.420 | 85.3 | 5.49 | 2.815 | 2.728 | 18.70 | 36.9 | 76.9 | 14.30 | 3.74 |
| | 20 | — | — | 0.250 | 10.250 | 82.5 | 8.26 | 2.815 | 2.683 | 28.04 | 35.8 | 113.7 | 21.16 | 3.71 |
| | — | — | — | 0.279 | 10.192 | 81.6 | 9.18 | 2.815 | 2.668 | 31.20 | 35.3 | 125.9 | 23.42 | 3.70 |
| | 30 | — | — | 0.307 | 10.136 | 80.7 | 10.07 | 2.815 | 2.654 | 34.24 | 35.0 | 137.5 | 25.57 | 3.69 |
| | 40 | Std | 40S | 0.365 | 10.020 | 78.9 | 11.91 | 2.815 | 2.623 | 40.48 | 34.1 | 160.8 | 29.90 | 3.67 |
| | 60 | XS | 80S | 0.500 | 9.750 | 74.7 | 16.10 | 2.815 | 2.553 | 54.74 | 32.3 | 212.0 | 39.4 | 3.63 |
| | 80 | — | — | 0.593 | 9.564 | 71.8 | 18.92 | 2.815 | 2.504 | 64.33 | 31.1 | 244.9 | 45.6 | 3.60 |
| | 100 | — | — | 0.718 | 9.314 | 68.1 | 22.63 | 2.815 | 2.438 | 76.93 | 29.5 | 286.2 | 53.2 | 3.56 |

It is to be understood that the present invention is by no means limited only to the particular constructions herein disclosed and shown in the drawings. The appended claims should be construed broadly to cover any variations or modifications within the scope or range of equivalents of the claims.

We claim:

1. A barrier system comprising:

a first end post;

a plurality of intermediate posts, each comprising a beam, at least one passage, and a base;

a plurality of panels, each comprising at least one conduit partially defined by at least one flared opening;

a second end post; and at least one tension cable, wherein a first end portion of said at least one tension cable is attached to said first end post, and a continuous length of said at least one tension cable extends laterally from said first end post through said at least one passage of each of said plurality of intermediate posts, through said at least one conduit of each of said plurality of panels, and a second end portion of said at least one tension cable is attached to said second end post, wherein each intermediate post from said plurality of intermediate posts is formed integrally with a respective panel from said plurality of panels.

2. The barrier system of claim 1, wherein at least some panels from the plurality of panels are interlocked end-to-end, and wherein a majority of said interlocked panels comprises a tongue portion and a groove portion and a minority of said interlocked panels comprises a first tongue portion and a second tongue portion.

3. The barrier system of claim 2, wherein said interlocked panels comprises at least one first panel and at least one second panel and said tongue portion of said first panel cooperates with said groove portion of said second panel.

4. The barrier system of claim 2, wherein the intermediate posts are formed integrally with the panels from the majority of said interlocked panels.

5. The barrier system of claim 1, wherein each of said first and second end posts comprises an integrally formed end post foundation, and each of said plurality of intermediate posts comprises an integrally formed intermediate post foundation.

6. The barrier system of claim 1, wherein said base of each of said plurality of intermediate posts comprises a short foot extending laterally in a first direction from said beam and a long foot extending laterally in a second direction from said beam, and said at least one conduit of each of said plurality of panels comprises an integral preform that defines at least one slot.

7. The barrier system of claim 6, wherein each of said plurality of panels comprises a first side and a second side, and said slot comprises an L-slot defined by a long-leg opening extending substantially centripetally from and substantially perpendicularly to said first side and a short-leg opening extending substantially perpendicularly to said long-leg opening.

8. The barrier system of claim 7, wherein said preform is formed from at least one of polymer, aluminum, and steel.

9. The barrier system of claim 1, wherein at least some panels from said plurality of panels are interlocked end-to-end, said interlocked panels comprising at least one first panel having a tongue portion and at least one second panel having a groove portion, and wherein said tongue portion of said first panel cooperates with said groove portion of said second panel, said second panel having an integrally formed intermediate post at said groove portion.

* * * * *